US011749970B2

(12) United States Patent
Behary

(10) Patent No.: US 11,749,970 B2
(45) Date of Patent: Sep. 5, 2023

(54) BROAD SPECTRUM ULTRAVIOLET SOURCES

(71) Applicant: RGF ENVIRONMENTAL GROUP, INC., Riviera Beach, FL (US)

(72) Inventor: Jeffrey David Behary, West Palm Beach, FL (US)

(73) Assignee: RGF ENVIRONMENTAL GROUP, INC., Riviera Beach, FL (US)

( * ) Notice: Subject to any disclaimer, the term of this patent is extended or adjusted under 35 U.S.C. 154(b) by 0 days.

(21) Appl. No.: 17/461,432

(22) Filed: Aug. 30, 2021

(65) Prior Publication Data

US 2022/0069549 A1 Mar. 3, 2022

Related U.S. Application Data

(60) Provisional application No. 63/073,106, filed on Sep. 1, 2020.

(51) Int. Cl.
*H01T 1/22* (2006.01)
*H01T 19/00* (2006.01)

(52) U.S. Cl.
CPC ..... *H01T 1/22* (2013.01); *H01T 19/00* (2013.01)

(58) Field of Classification Search
None
See application file for complete search history.

(56) References Cited

U.S. PATENT DOCUMENTS 4,447,766 A * 5/1984 Bedu ..... H01S 3/092 315/173

* cited by examiner

*Primary Examiner* — Ashok Patel
(74) *Attorney, Agent, or Firm* — ROTHWELL, FIGG, ERNST & MANBECK, P.C.

(57) ABSTRACT

In one embodiment, a device for generating broad spectrum ultraviolet radiation is provided. The device includes an adjustable spark gap of metallic solids, the spark gap including: a first electrode coupled to a first heatsink, and a second electrode coupled to a second heatsink, the second electrode spaced apart and opposite from the first electrode. The device includes a variable capacitor configured to discharge a voltage through the spark gap to generate broad spectrum ultraviolet radiation. The device includes a voltage source. The device includes a controller configured to control the variable capacitor. The first electrode is formed from a first metallic solid and the second electrode is formed from a second metallic solid, and the ultraviolet radiation generated is in the 140 nm to 400 nm range.

15 Claims, 163 Drawing Sheets

6061 aluminum 304 stainless steel 6061 aluminum 6061 aluminum 6061 aluminum copper tin 6061 aluminum indium 6061 aluminum silver copper nickel 6061 aluminum silver copper 6061 aluminum silver indium 6061 aluminum tungsten bismuth cadmium bismuth cobalt bismuth halfnium bismuth indium bismuth magnesium bismuth molybdenum bismuth rhenium bismuth uranium bismuth zirconium brass brass copper silver 304 stainless steel copper silver copper silver nickel copper silver copper tin copper silver nickel 304 stainless steel copper silver nickel copper tin copper silver nickel silver indium copper tin 304 stainless steel copper tin silver indium halfnium cadmium halfnium cobalt halfnium copper halfnium halfnium halfnium indium halfnium iron halfnium magnesium halfnium molybdenum halfnium muonionalusta halfnium nickel halfnium niobium halfnium rhenium halfnium silicon halfnium tungsten halfnium uranium halfnium zirconium indium 304 stainless steel iron 304 stainless steel iron copper nickel iron copper tin iron indium iron iron iron silver copper nickel iron silver copper iron silver indium magnesium 304 stainless steel magnesium 6061 aluminum magnesium copper tin magnesium indium magnesium iron magnesium magnesium magnesium nickel magnesium silver copper nickel magnesium silver copper magnesium silver indium magnesium tungsten Muonionalusta Replica nickel 304 stainless steel nickel copper tin nickel indium nickel iron nickel nickel nickel silver copper nickel nickel silver copper nickel silver indium samarium tungsten silicon iron silicon nickel silicon tungsten silver copper silver indium silver indium 304 stainless steel strontium 6061 aluminum strontium iron strontium magnesium strontium nickel strontium strontium strontium tungsten tellurium iron tellurium nickel tellurium tungsten tungsten 304 stainless steel tungsten copper tin tungsten indium tungsten iron tungsten nickel tungsten silver copper nickel tungsten silver copper tungsten silver indium tungsten tungsten uranium iron uranium molybdenum uranium muonionalusta uranium nickel uranium niobium uranium tungsten yttrium bismuth yttrium cadmium yttrium cobalt yttrium halfnium yttrium indium yttrium magnesium yttrium molybdenum yttrium rhenium yttrium tungsten yttrium uranium yttrium zirconium zirconium 6061 aluminum zirconium iron zirconium nickel zirconium tungsten zirconium zirconium Titanium Aluminum Titanium Antimony Titanium Bismuth Titanium Cadmium Titanium Carbon Titanium Copper Titanium Dysprosium Titanium Erbium Titanium Hafnium Titanium Indium Titanium Iron Titanium Lead Titanium Magnesium Titanium Molybdenum Titanium Nickel Titanium Niobium Titanium Niodium Chromium Titanium Palladium 20
25
30
35
40
45
50
55
60
65
70
75
80
85
90
95
100
105
110
115
120
125
130
135
140
145
150
155
160
165
170
175
180
185
190
195
200
205
210
215
220

Titanium Rhenium

Titanium Silicon

Titanium Tantalum

Titanium Titanium

Titanium Tungsten

Titanium Yttrium

Titanium Zinc

Titanium Zirconium

Titanium 25 Silver 75 Copper

Titanium 50 Copper 50 Silver

Titanium 60 Copper 40 Zinc

Titanium 6061

Tungsten under normal air and argon at atmospheric pressure

Muonionalusta Meteorite

Low Pressure Mercury Lamp

Sunlight in South Florida

BROAD SPECTRUM ULTRAVIOLET SOURCES

PRIORITY CLAIM AND CROSS-REFERENCE TO RELATED APPLICATIONS

The present application claims priority to U.S. Provisional Patent Application Ser. No. 63/073,106, filed Sep. 1, 2020, which is hereby incorporated by reference in its entirety.

TECHNICAL FIELD

This disclosure relates to generating ultraviolet (UV) radiation providing a broad spectrum of wavelengths. Aspects of the disclosure produce radiation through a spark gap of similar or different metals, either in open air or enclosed, with or without the use of inert gases under vacuum or at various pressures, utilizing a capacitor discharge fluorescence of minerals, phosphors, or diverse materials. The UV radiation generated can be used, for example, to inactivate viruses; disrupt the DNA of cells or bacteria; cause fluorescence; produce chemical reactions; excite catalysts; treat skin conditions through phototherapy or actinotherapy, or other kindred applications that utilize sources of UV radiation for diverse applications.

BACKGROUND

Ultraviolet radiation has been studied and employed since the late 1800s using carbon arcs, electric sparks, or gas discharges at low vacuums or medium to high pressures. Examples include modern fluorescent lamps, which use low pressure gas including mercury vapor to cause the fluorescence of phosphors used to convert ultraviolet radiation to visible light inside of an evacuated glass tube.

In modern applications, low pressure mercury lamps are commonly used as sources of ultraviolet radiation. The spectrum of these lamps is limited to mostly the UVC range, with peak spectral lines at 253.7 nm and 184.9 nm. Special coatings on the lamps can reduce the transmission of 184.9 nm, thereby limiting the amount of ozone produced by the lamps. However, the highest qualities of quartz glass and fused silica can only transmit ultraviolet radiation down to 180 nm. Medium pressure lamps have a broader spectral output but are severely limited in application due to power levels needed and excessive cost. The spectral output of medium pressure lamps is improved over low pressure lamps but is still limited to a fixed spectrum of lines common to mercury vapor at the pressures commonly used.

Carbon arc lamps and welding arcs have the broadest range of spectral outputs of most light sources, but require a large amount of energy to operate and produce a lot of heat and infrared radiation in addition to ultraviolet radiation.

Metallic electrodes of iron and tungsten were developed but required cumbersome apparatus and water-cooling in order to be efficient UV sources, and frequently required electrode replacement or adjustments as the metals are gradually volatized by the heavy currents needed to make the apparatus function.

The use of iron electrodes was common in the early 1900s as UV sources by utilizing capacitor discharges using high voltage transformers and capacitors or induction coils and Leyden jars. Görl developed a portable lamp using small iron balls that sparks passed between, however once the gaps began to overheat the ultraviolet portions of the spectrum became weaker and finally ceased as the gaps began to "arc" as opposed to having a "disruptive" or oscillatory discharge.

U.S. Pat. No. 817,976 describes that providing heatsinks to iron electrodes made the spectrums more continuous and efficient.

SUMMARY

Aspects of this disclosure improve upon the generation of ultraviolet radiation by using an adjustable spark gap of metallic solids and a variable capacitor. According to some aspects, a novel source of ultraviolet radiation for which, for example, can be used for laboratory experimentation, is provided using materials hitherto not employed in the generation of ultraviolet radiation. Aspects of this disclosure allow for experimentation with softer materials and alloys not previously able to be utilized for spark gaps and spectral analysis.

Aspects of the present disclosure demonstrate how a combination of ultraviolet sources can be made possible using a single apparatus, with a broad range of spectrums not previously made available and not yet experimented with in the current fields of investigation.

According to one aspect, a device for generating broad spectrum ultraviolet radiation is provided. The device includes an adjustable spark gap of metallic solids, the spark gap including a first electrode coupled to a first heatsink and a second electrode coupled to a second heatsink, the second electrode spaced apart and opposite from the first electrode. The device further includes a variable capacitor configured to discharge a voltage through the spark gap to generate broad spectrum radiation. The device further includes a voltage source. The device further includes a controller configured to control the variable capacitor. According to some embodiments, the first electrode is formed from a first metallic solid. According to some embodiments, the second electrode is formed from a second metallic solid. According to some embodiments, the first and second metallic solids each comprise one or more of aluminum, stainless steel, brass, tungsten, copper, nickel, tin, magnesium, indium, soft iron, tantalum, and carbon. According to some embodiments, the ultraviolet radiation generated is in the 140 nm to 400 nm range.

According to some aspects, a lamp is provided including the device for generating broad spectrum ultraviolent radiation. According to some embodiments, the lamp can be used as a UV light source in the systems, devices, and methods described in the issued US patents and published patent applications identified in the attached Appendix A. Each of the listed US patents and published patent applications are hereby incorporated by reference in their entirety.

According to some embodiments, the lamp can be used as a UV light source in the air purification systems and HVAC maintenance products, wastewater treatment and wash water recycling systems, and food safety and sanitation systems available from RGF Environmental Group Inc. and described in the product literature included in the attached Appendix B.

According to some aspects, products including the lamp are provided, including products to inactivate viruses; disrupt the DNA of cells or bacteria; cause fluorescence of minerals, phosphors, or diverse materials; produce chemical reactions; excite catalysts; and treat skin conditions through phototherapy or actinotherapy.

According to some aspects, an adjustable capacitance device for providing a plurality of selectable capacitance values is provided. The device includes a common connector. The device further includes a capacitive element coupled to the common connector, the capacitive element comprising a plurality of tapped sections, each tapped section comprising one or more sets of two parallel conductive plates, and wherein each tapped section comprises a binary number equivalents of sets of two parallel conductive plates corresponding to each tapped section. The device further includes a terminal. The device further includes a plurality of adjustable switches coupled to the terminal, wherein each switch of the plurality of switches is operable to move between a first position that combines a respective tapped section to the terminal and a second position that separates the respective tapped section from the terminal. The capacitive element is connected to the terminal to provide a selected capacitance value in an electric circuit by moving, using a controller, one or more of the plurality of adjustable switches into the first position.

BRIEF DESCRIPTION OF THE DRAWINGS

The accompanying drawings, which are incorporated herein and form part of the specification, illustrate various embodiments.

DETAILED DESCRIPTION

Figure 1:
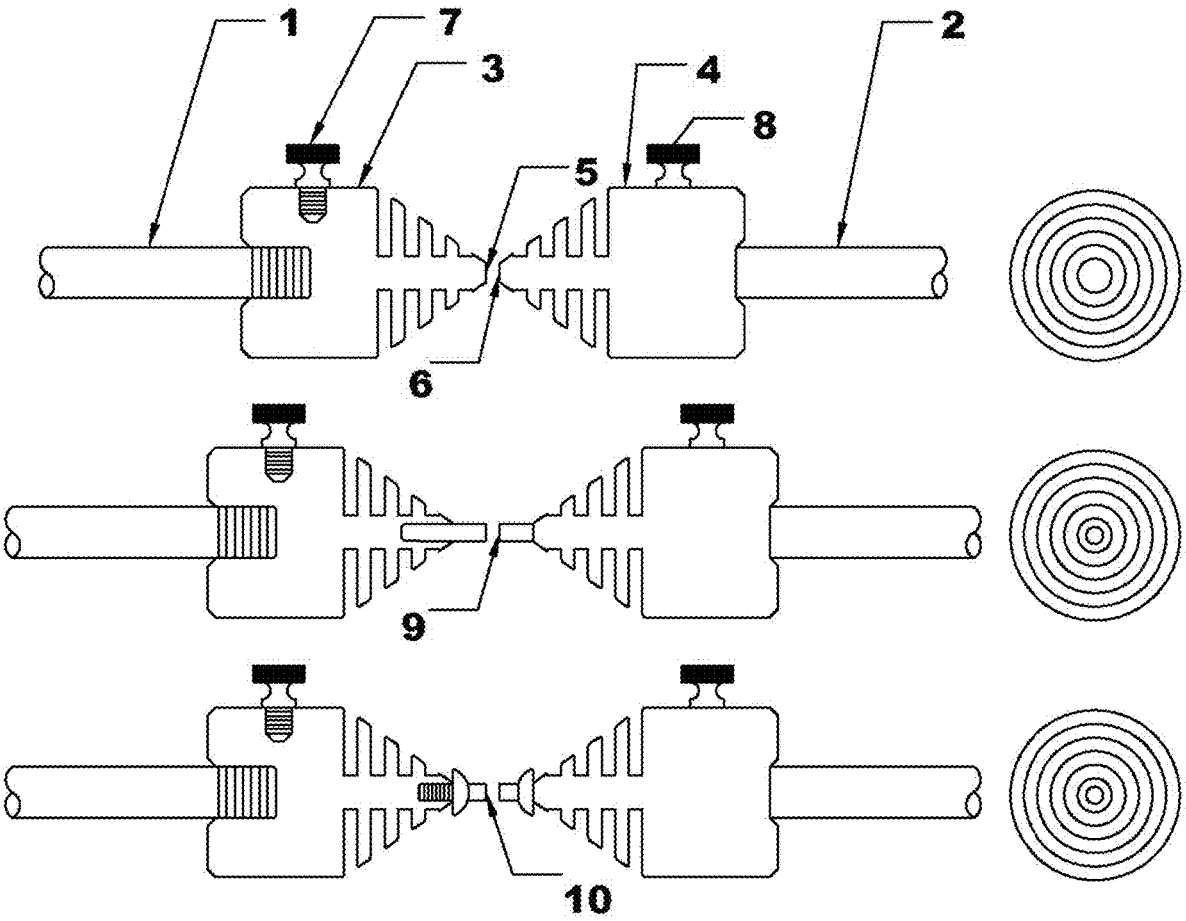
FIG. 1 shows an open-air self-cooling spark gap, according to some embodiments.

FIG. 1 shows an open-air self-cooling spark gap, according to one embodiment. FIG. 1 shows an open-air spark gap made into the form of heatsinks to allow the heat of the discharges to be naturally radiated and not to overheat. The spark faces are either the material of the heatsinks or press-fit elements or brazed contacts containing the metals or alloys described herein. The spark faces 5 and 6 where the gap occurs may be made out of the same material as the heatsinks 3 as seen in the upper drawing; they can be press-fit elements or metal rods as seen in the middle drawing; or they can be brazed contacts 10 as in the bottom drawing. In all examples thumbscrews 7 and 8 are shown to accommodate the fastening of high voltage conducting wires in place although other methods can be used without deterring from the scope of the invention. It is understood that the gap should be mounted to rods 2 which are adjustable to accommodate different spacing of the gaps, either by sliding with machine threads. Finned grooves are turned into the heatsinks in a conical pattern to allow dispersion of ultraviolet radiation to a larger area and yet still give adequate cooling to keep the spark faces from overheating.

Figure 2:
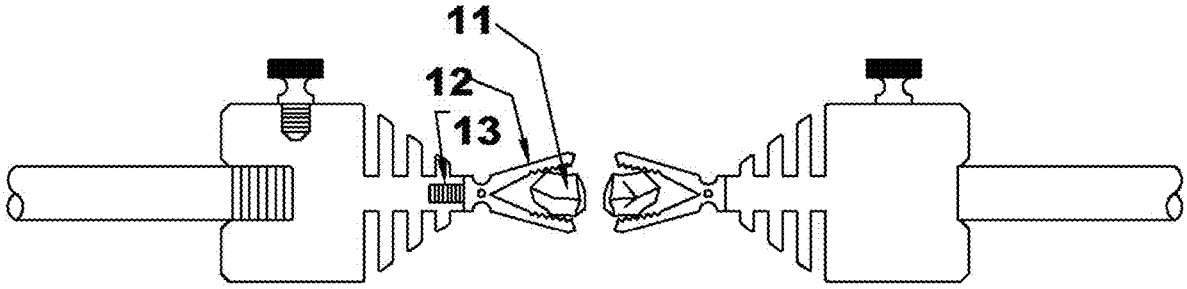
FIG. 2 shows an open-air self-cooling spark gap, according to some embodiments.

FIG. 2 shows an open-air self-cooling spark gap, according to some embodiments. The spark gap of FIG. 2 allows for utilization of irregular element samples or alloys without special or unique preparations. The spark gap of FIG. 2 is a modification of the open-air spark gap shown in FIG. 1 to accommodate irregular sized pieces of metallic elements or metal samples. It may be particularly suited for pieces fused in the laboratory which may acquire an irregular shape upon cooling. The pieces 11 may be held by alligator clips 12 soldered onto threaded studs 13, which are fastened to the heatsinks by a tapped hole in the center of their facing surfaces.

Figure 3:
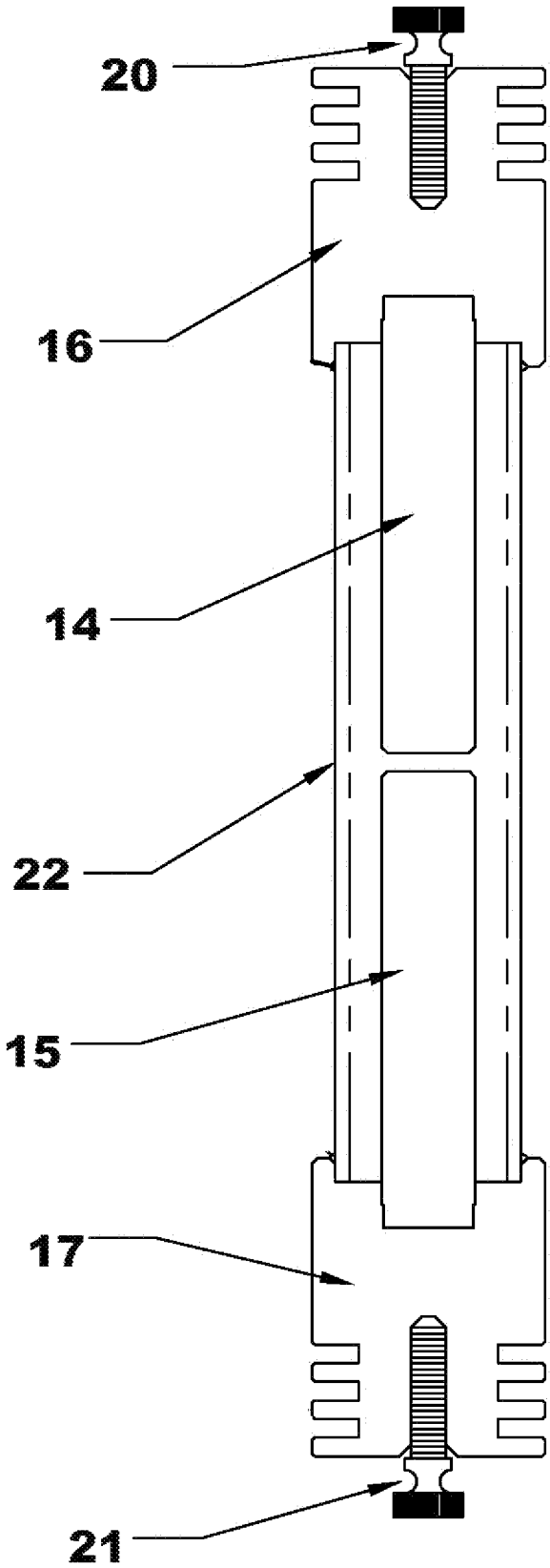
FIG. 3 shows an enclosed form of a lamp in cross-section, according to some embodiments.

FIG. 3 shows an enclosed form of a lamp in cross-section, according to some embodiments. FIG. 3 is partially diagrammatic for illustrative purposes. The lamp may be enclosed in glass, quartz, or materials that readily transmit ultraviolet radiation or specific wavelengths of the ultraviolet or visible spectrum.

Figure 4:
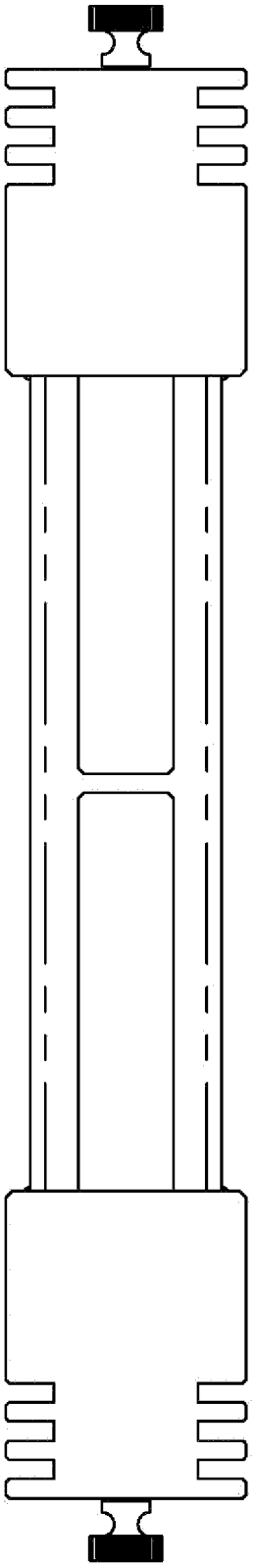
FIG. 4 shows a complete form of a lamp without cross-sectional components visible, according to some embodiments.

FIG. 4 shows a complete form of the lamp of FIG. 3 without cross-sectional components visible, according to some embodiments. Electrodes 14 and 15 may be made of similar or dissimilar metals or elements, press-fit into heatsinks 16 and 17 by methods known in the art. Examples of materials these electrodes can be made from include but are not limited to iron, tungsten, nickel, aluminum, tantalum, carbon, or diverse alloys of materials containing metals and/or rare earths elements in combination. A glass, quartz, Teflon-based, or fused silica vessel 22 is shown in the example as a way of enclosing the arc but still allowing various wavelengths of light and radiation to pass. Heatsinks 16 and 17 are machined and glued to the vessel 22 using a vacuum-tight cement. They may be made out of aluminum or copper or any material convenient to dissipate heat. Binding screws 20 and 21 are contained on the ends of the heatsinks to allow for electrical connections to the lamp. In this example the vessel is used to transmit portions of the ultraviolet spectrum while lessening the noise and evolution of corrosive gases such as ozone and nitric compounds typically associated with electrical spark in the open air.

Figure 5:
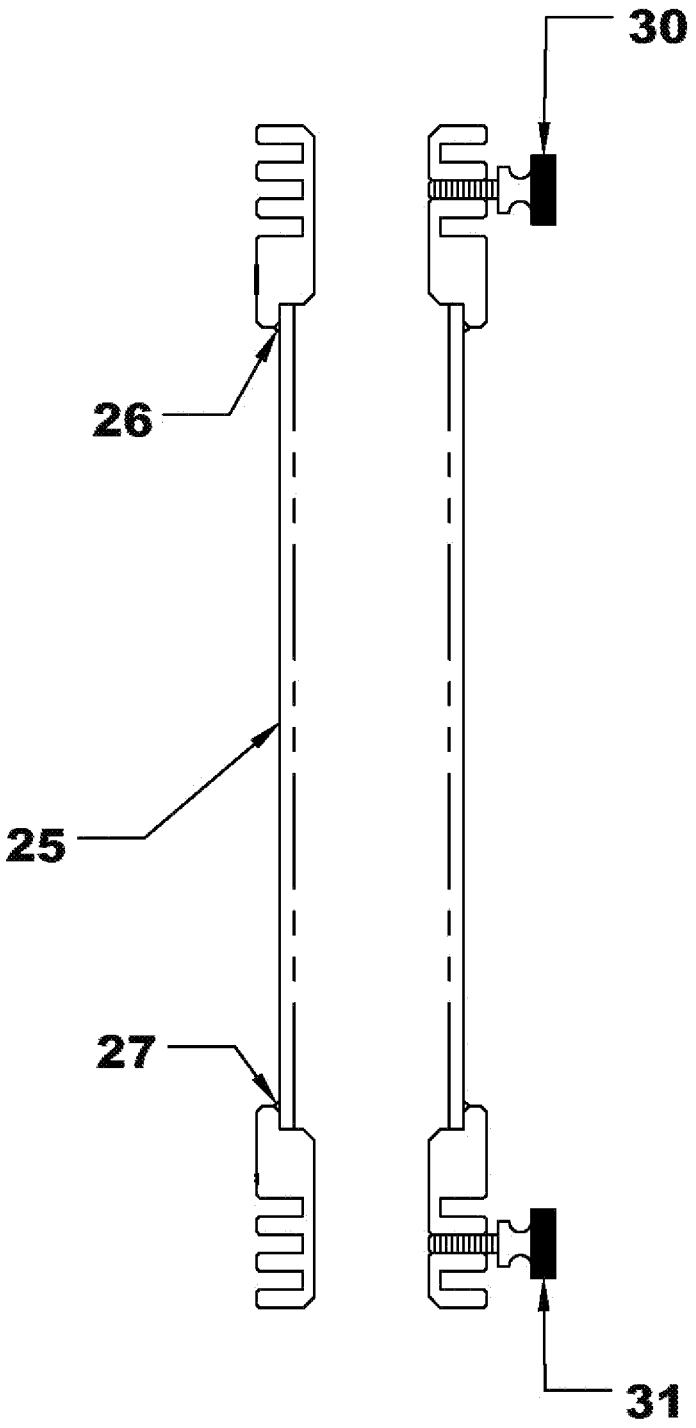
FIG. 5 shows an exterior housing of a lamp, according to some embodiments.

FIG. 5 shows an exterior housing of a lamp, according to some embodiments. According to some embodiments, FIG. 5 shows a detailed view of an enclosure that is to contain electrodes outlined in FIG. 6 to create a lamp with replaceable electrodes detailed in FIGS. 7 and 8. The enclosure may be comprised of a quartz or glass vessel that readily transmits ultraviolet radiation or specific wavelengths of the ultraviolet or visible spectrum in combination with fixed heatsinks to accept a plurality of electrodes, for example, for experimentation.

Heatsinks, preferably made of aluminum, copper, or other heat-dissipating metals, are finned and bored out to accommodate a quartz, glass, fused silica, Teflon-based, or other material transparent to light or ultraviolet radiation vessel 25, which is cemented in place at 26 and 27 using a vacuum-tight cement. Binding posts 30 and 31 and provided for mechanically securing the electrodes in FIG. 6 within the housing at the proper distance apart. The electrodes can be removed from this assembly to exchange with other electrodes for studying different spectra, to be cleaned or periodically resurfaced, or for transportation. The vessel 25 may also be periodically cleaned if metallic vapors are deposited on the inner surface of the walls thereby blocking portions of the light or ultraviolet radiation to be transmitted.

Figure 6:
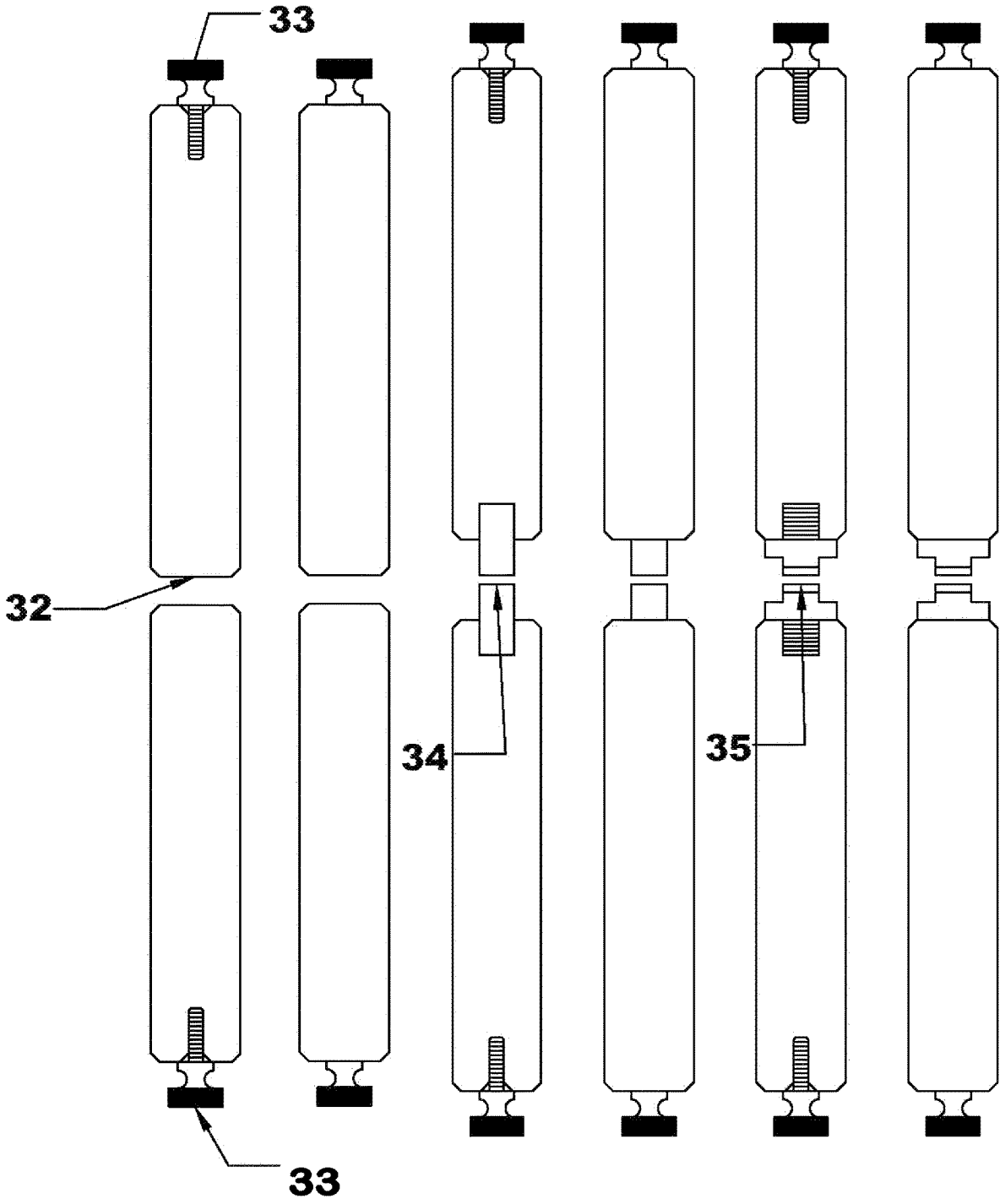
FIG. 6 shows a plurality of electrodes, according to some embodiments.

FIG. 6 shows a plurality of electrodes, according to some embodiments. According to some embodiments, FIG. 6 details a variety of electrode possibilities that can be inserted into the exterior housing in FIG. 5. The electrodes may be made of bare metal or metallic/conductive elements, heatsink material with press-fit elements or metallic/conductive alloys, or heatsink materials with brazed replaceable contacts containing the metals, alloys, or elements desired herein. The drawings shown in FIG. 6 are partially in cross-section and part diagrammatic for illustration purposes. Binding posts 33 are provided for electrical connections to the electrodes. The spark surfaces 32 may be formed from the metal itself of the electrode, from press-fit element samples or metallic rods 34 inserted into the ends of the electrodes, or by brazed contacts 35 containing the desired metals or alloys on the spark faces. The electrodes may be made of uniform diameters so that no matter what surfaces present themselves on the spark faces the spectrums can be analyzed simply by exchanging one with another.

Figure 7:
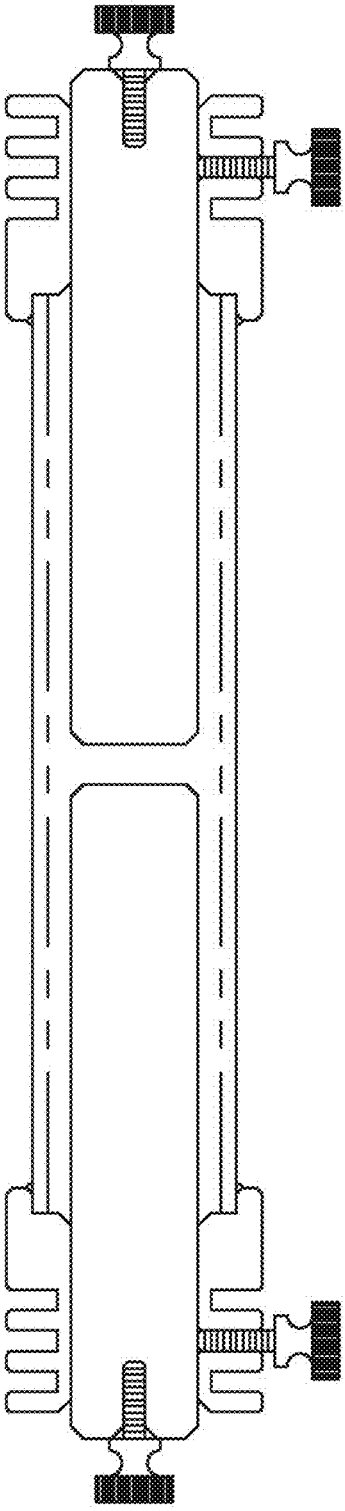
FIG. 7 shows a lamp, according to some embodiments.

FIG. 7 shows a lamp, according to some embodiments. According to some embodiments, FIG. 7 includes the exterior housing of FIG. 5, partially in cross-section and diagrammatic for illustrative purposes, combined with one or more electrodes provided from FIG. 6.

Figure 8:
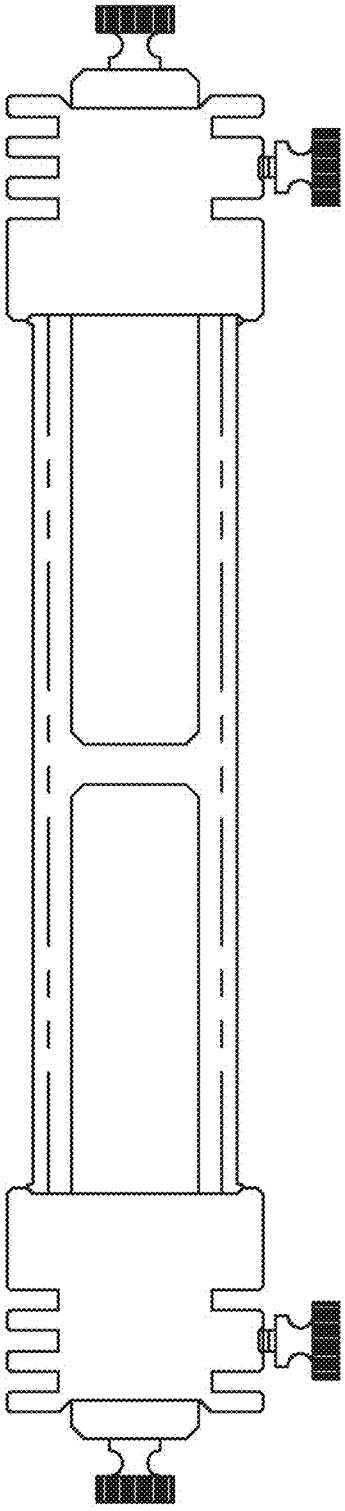
FIG. 8 shows a lamp without cross-sectional components visible, according to some embodiments.

FIG. 8 shows a lamp without cross-sectional components visible, according to some embodiments. According to some embodiments, FIG. 8 shows a complete form of the lamp in FIG. 7 without cross-sectional components visible.

Figure 9:
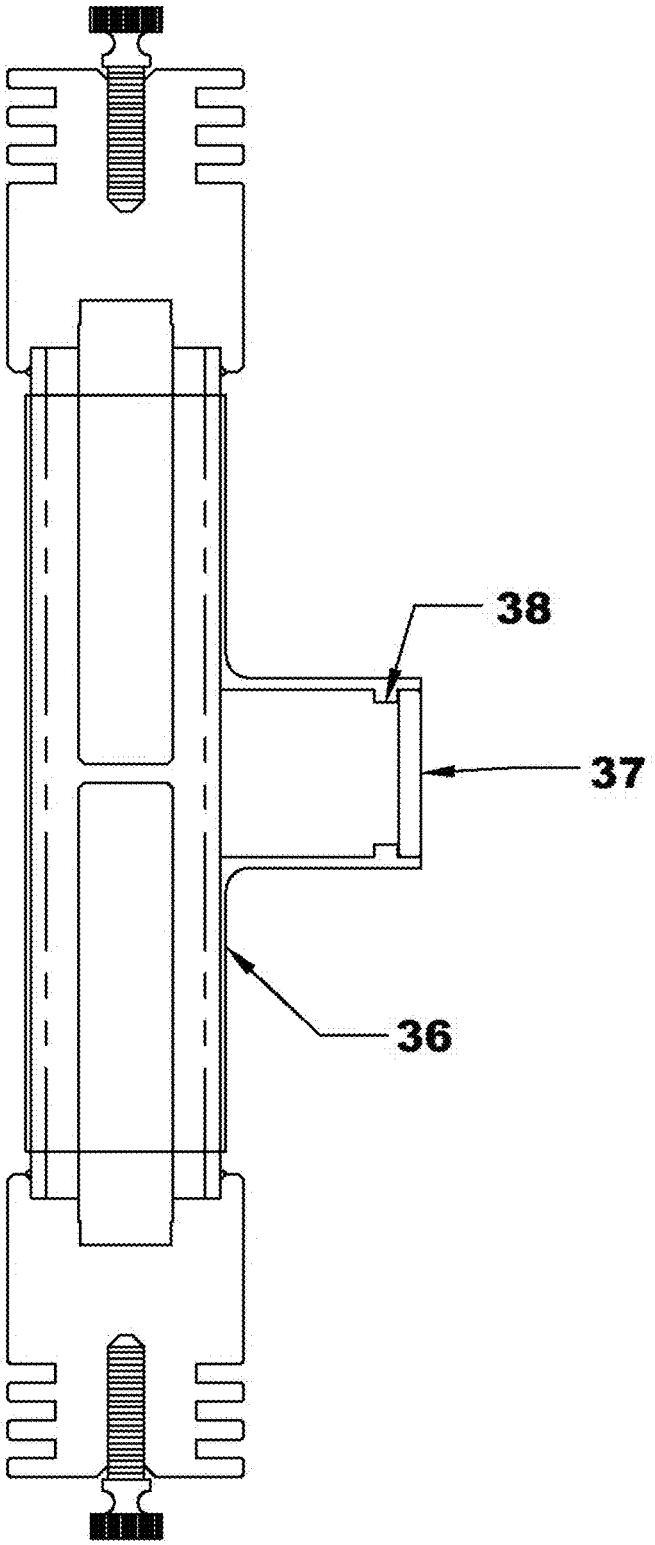
FIG. 9 shows an opaque covering for a lamp, according to some embodiments.

FIG. 9 shows an opaque covering for a lamp, according to some embodiments. According to some embodiments, FIG. 9 shows an opaque covering, partially cross-sectional and diagrammatic for illustrative purposes that can be combined with either of the lamps in FIG. 4 or FIG. 8 with filtration lenses to cut out or transmit specific wavelengths of the ultraviolet or visible spectrum. Opaque covering 36 may be used with the lamps in FIG. 4 or FIG. 8 to transmit only a portion of the ultraviolet or visible light spectrum through a special window 37 cemented into a recessed section 38 with vacuum-tight cement. The window 37 can be composed of materials such as Crookes glass, or ultraviolet wavelength filters known in the art such as ZWB1, ZWB2, ZWB3, etc. In this way specific wavelengths or wavelength ranges of ultraviolet radiation can be made to pass through the window without interference from the unwanted or superfluous portions of the spectrums which are generated in the gap. It is understood that other filters, lenses, or materials can be used in place of the ones outlined, plastics, crystal lenses, glass, composites, Teflon-based materials, or kindred lenses known in the field can be utilized.

Figure 10:
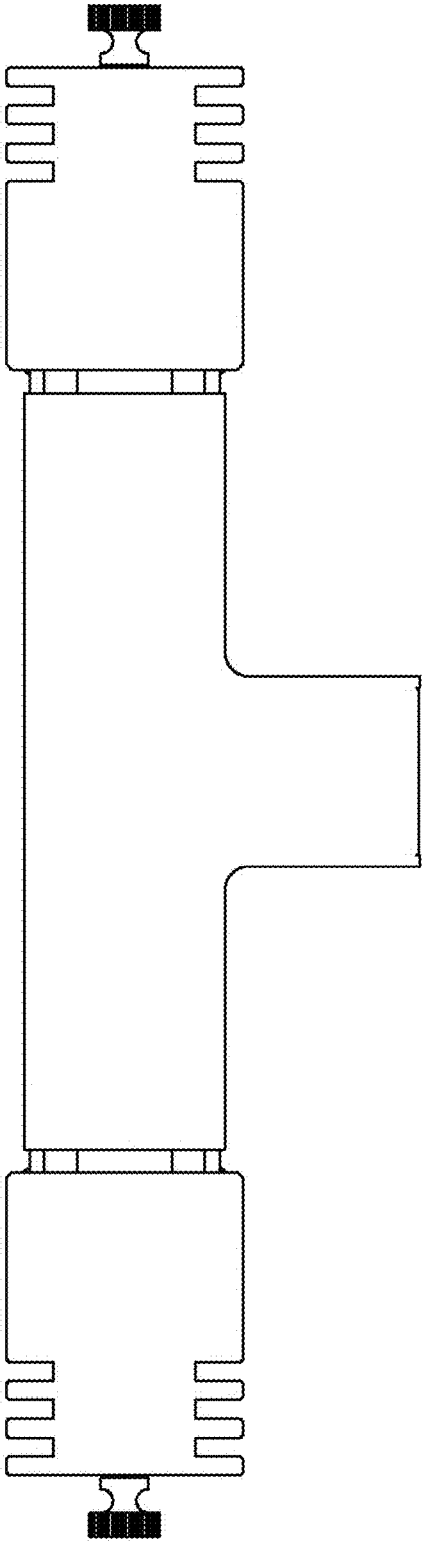
FIG. 10 shows a lamp, according to some embodiments.

FIG. 10 shows a lamp, according to some embodiments. According to some embodiments, FIG. 10 shows a complete embodiment of the lamp in FIG. 9 with hidden aspects removed. The opaque covering 36 is shown not covering the entire lamp merely for illustrative purposes, but in actual use it can be made to cover all or simply a portion of the lamp.

Figure 11:
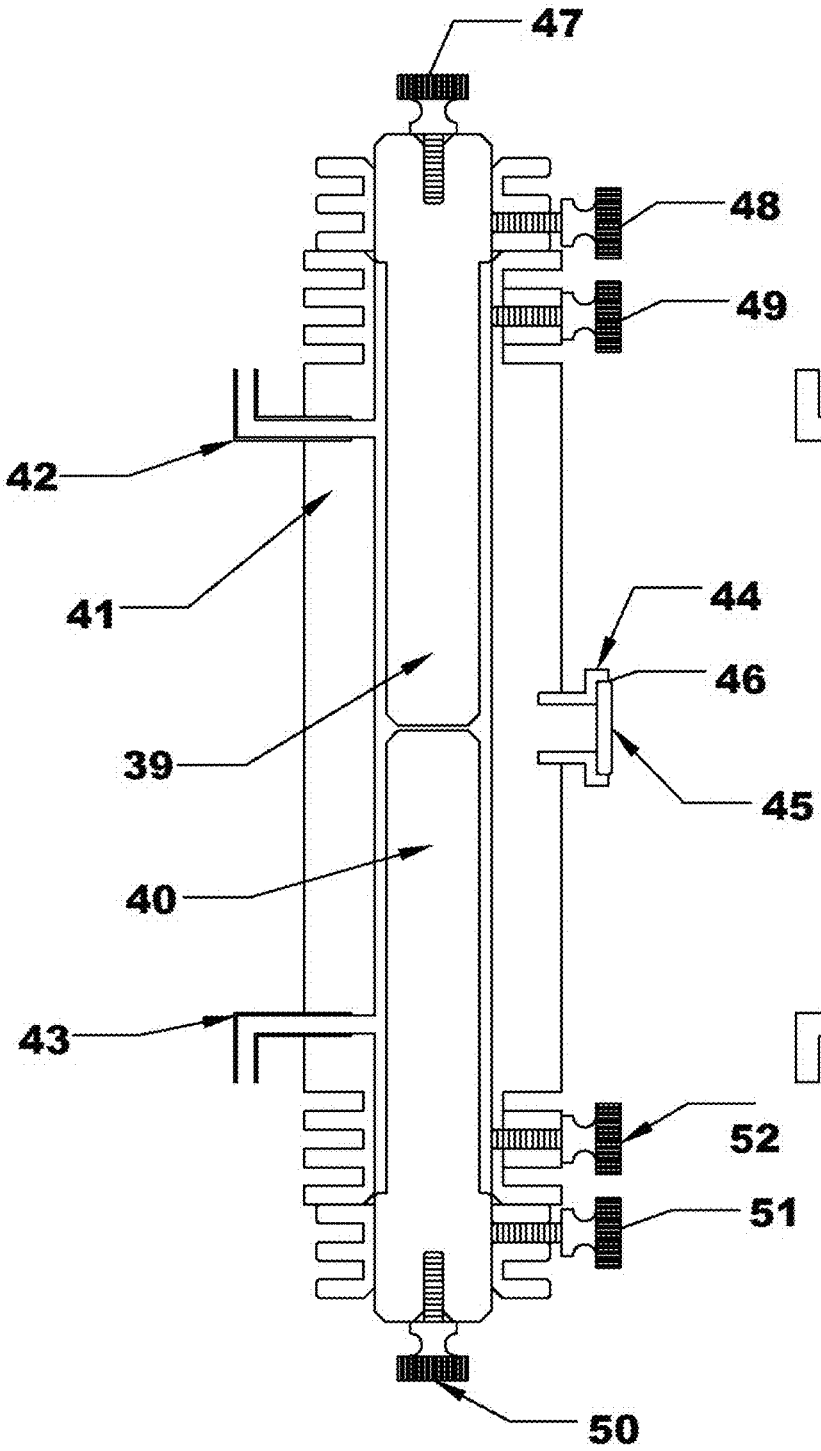
FIG. 11 shows a lamp, according to some embodiments.

FIG. 11 shows a lamp, according to some embodiments. The lamp shown may be in an opaque housing, partially in cross-section and diagrammatic for illustrative purposes, with a special window to transmit shorter wavelengths of ultraviolet radiation than glass or quartz can permit. Inlets and outlets may be provided for the introduction of gas mixes that facilitate the production of these shorter vacuum- and near vacuum ultraviolet radiation wavelengths. The lamp may be made of insulating compounds 41 with a special quartz, fused silica, fluorite, calcite, Icelandic spar, or rock salt window 45 used to transmit the shortest wavelengths of ultraviolet radiation. The window 45 may be placed along the surface of on outward extension 44, held by vacuum-tight cement 46, where it can be isolated for spectral analysis, compressed to the skin for treating skin conditions, or placed in a chamber containing a vacuum, inert gases, or hydrogen/hydrocarbon mixtures to study the vacuum range of ultraviolet radiation (VUV) or shorter wavelengths more typically absorbed in common air.

The lamp contains electrodes 39 and 40, similar to the ones in FIG. 6, which are held in heatsinks kept in place by binding posts 49 and 52, with electrodes being held in place by binding posts 48 and 51. Binding posts 47 and 50 are used for electrical connections to the electrodes. The insulated housing 41 contains inlets and outlets 42 and 43 for the admission of inert gases, hydrocarbons, compressed air, vacuums, distilled water, liquids or other components that can materially change the spectrum produced by the metallic electrodes 39 and 40.

Figure 12:
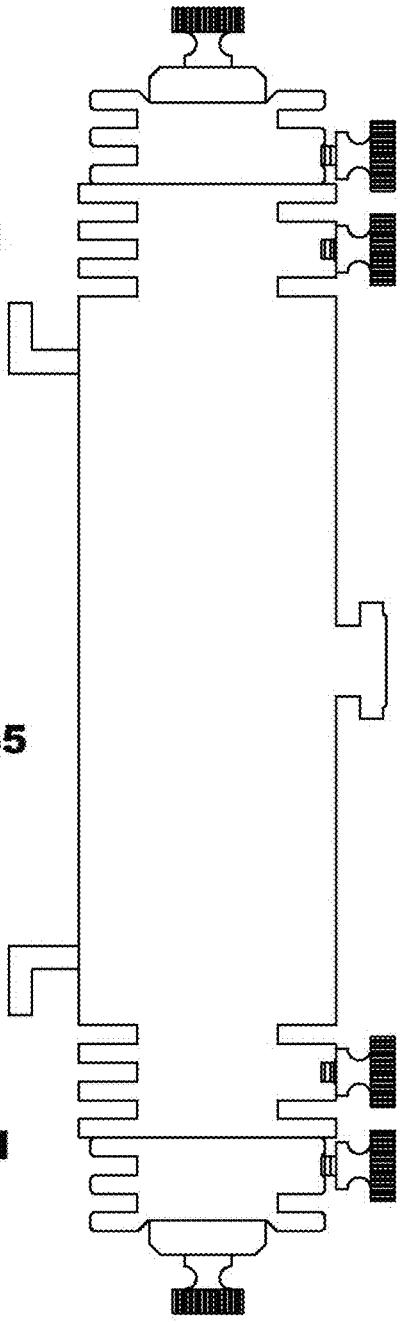
FIG. 12 shows a lamp without cross-sectional components visible, according to some embodiments.

FIG. 12 shows a lamp without cross-sectional components visible, according to some embodiments. According to some embodiments, FIG. 12 shows a complete form of the lamp in FIG. 11 without cross-sectional components visible.

Figure 13:
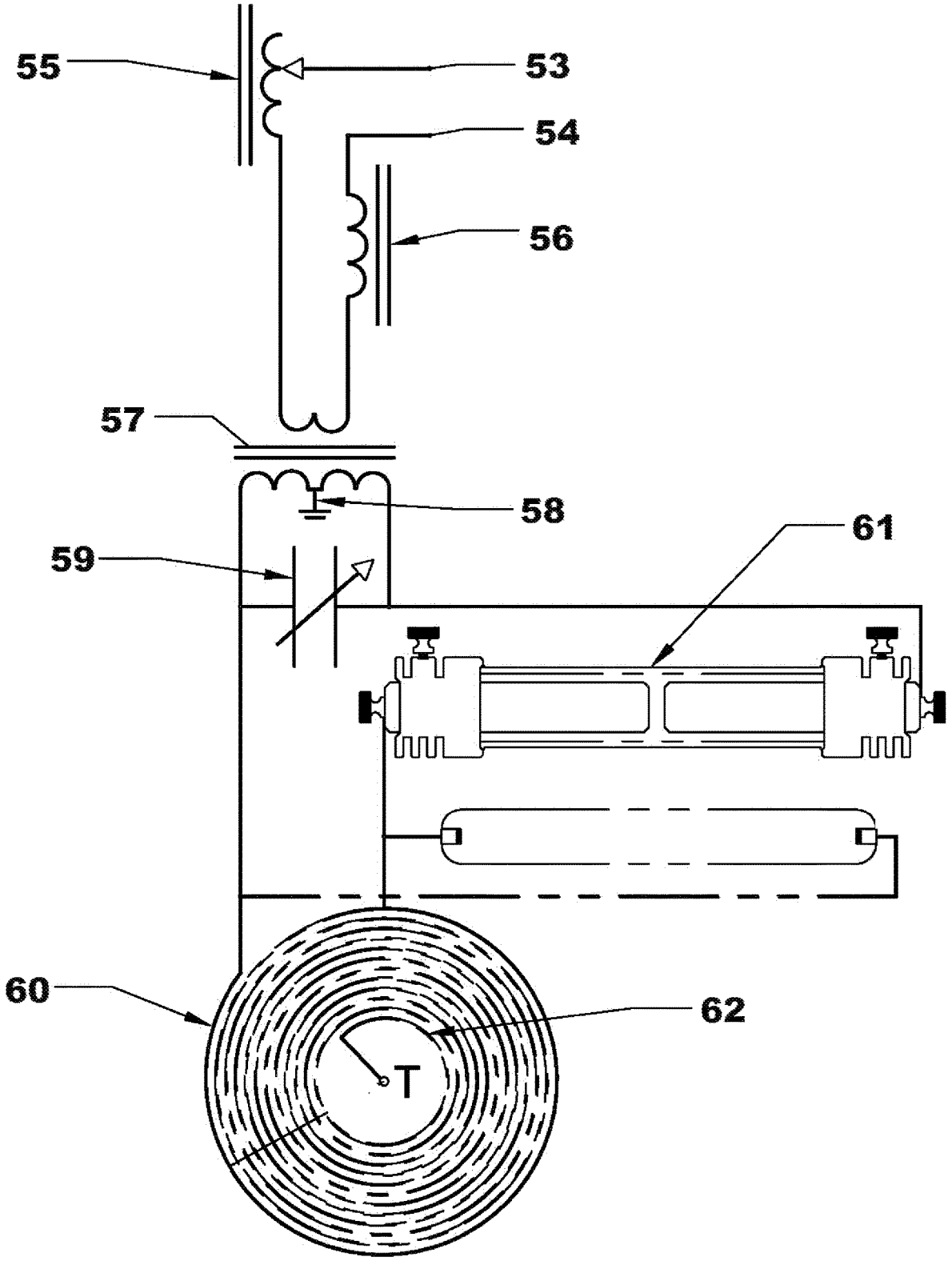
FIG. 13 shows an operation of a lamp, according to some embodiments.

FIG. 13 shows an operation of a lamp, according to some embodiments. FIG. 13 shows a suitable wiring diagram of any of the spark gaps outlined in this disclosure. While many of these components may be omitted or simplified, fine adjustments to the apparatus may be necessary to achieve full spectrums of ultraviolet radiation. As shown in FIG. 13, the mains enters the power supply at 53 and 54, and may be any alternating current source. The voltage of the mains may be controlled by a variable transformer 55. The high voltage transformer 57 may be of the magnetic leakage type with internal shunts, or an open core type requiring ballasting by an additional reactance coil 56. The high voltage winding may contain a single winding, or multiple windings with the center-point grounded 58. The high voltage from transformer 57 charges a high voltage capacitor, the preferred type being an adjustable binary-tapped capacitor outlined in FIG. 14. It may however have a fixed value. The high voltage capacitor discharges through the spark gap 61. An air-core choke coil 60 is provided to reduce the EMP-like emissions from the spark gap by creating an oscillatory RF circuit. It may be formed of a few coarse turns of copper ribbon, tubing, or wire of sufficient surface area. A secondary coil 62 may be placed within this coil to act as a high frequency transformer for the production of corona discharges. These discharges have unique emissions in the ultraviolet spectrum and may be combined with the emissions from spark gap 61. A suitable terminal T can be used to direct the discharges from the innermost terminal of coil 62, while the outermost terminal is grounded to one leg of the primary winding 60. A suitable coil can be made from 200 turns of 28 AWG wire wound in a flat spiral with 2" wide interleaves of 0.010" paper in-between turns, the whole coil being potted in a mixture of beeswax and rosin melted in proportion of 50:50 by volume. The center terminal may be mounted to an insulated post with a polished 2" sphere as the discharge terminal, though it may be understood that many departures from this type of winding can be made without altering the scope of the invention. An optional gas-discharge tube can be shunted across the choke coil 60 for the addition of ultraviolet spectrums produced by gas discharges, such as mercury vapor, xenon, or other gas mixtures well-known in the industry. By careful adjustment of the capacity, spark gap length and pulse duration, corona discharges closely resembling upper atmospheric phenomena can be reproduced at terminal T and enable, for example, the study of the ultraviolet spectrum of lightning forms mimicking sprites, lightning leaders, runaway breakdowns, northern lights, and similar upper-atmospheric events. The creation of such types of ultraviolet radiation wavelengths were not possible with prior apparatuses.

Figure 14:
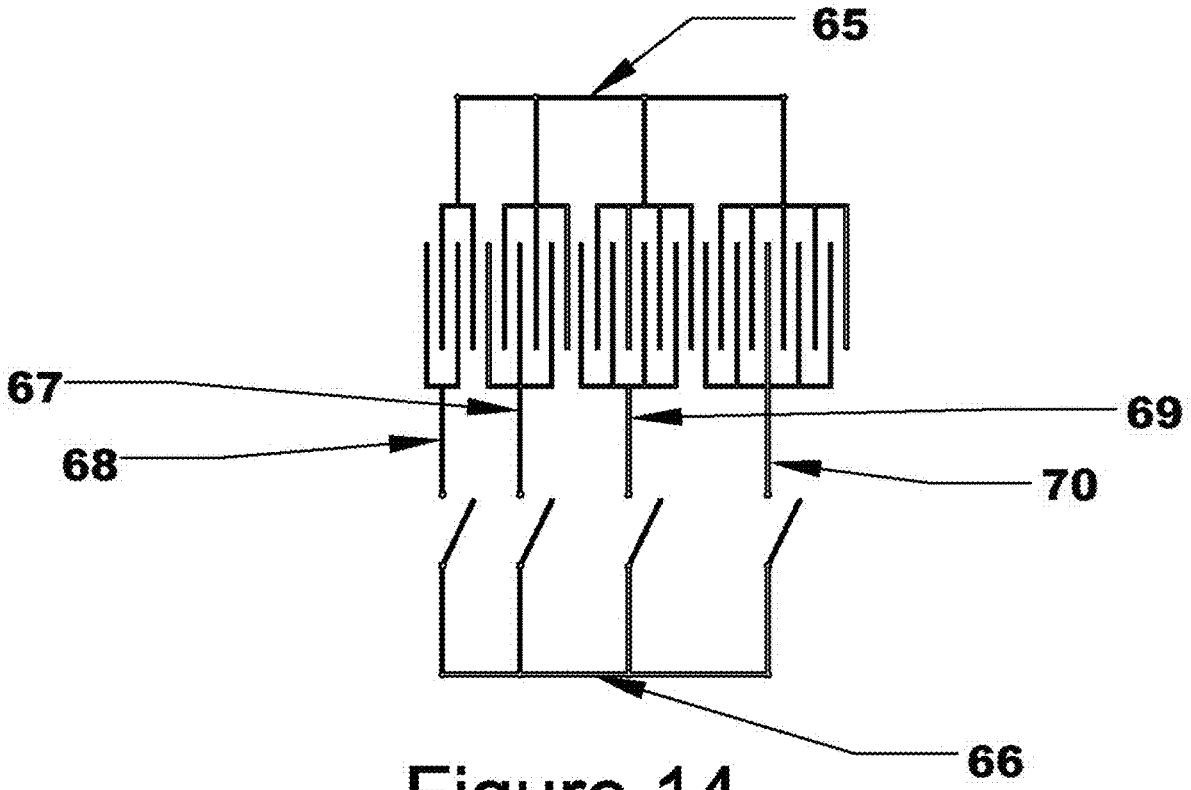
FIG. 14 shows a capacitor, according to some embodiments.

FIG. 14 shows a capacitor, according to some embodiments. According to some embodiments, FIG. 14 shows a specific form of capacitor mathematically designed to produce the best results with this form of circuit over a wide range of operating conditions and materials used. The capacitor may make minute adjustments of the spark discharges present in the spark gaps outlined. According to some embodiments, the capacitor is a multiple-plate adjustable capacitor with tapped sections corresponding to binary number equivalents of the total number of plates used in its construction. All sections of the capacitor have a common connection 65 which is connected to all sets of plates. The individual sections of the capacitor (four are shown for illustrative purposes, but can contain more sections) are tapped to include 1 set of plates, 2 sets of plates, 4 sets of plates, and 8 sets of plates though it can be understood that the binary series can continue with 16 sets of plates, 32, 64, 128, 256, etc. In this method of construction the maximum adjustability of the capacitor is available with no moving parts other than switches 67, 68, 69, 70 etc. to combine the sections onto a common terminal 66. As an example, if a single set of plates of 8"×10" acetate film 0.010" thick a certain size of foil approximately 7"×9"×0.001" thick pasted to either side will yield a value of 0.001 microfarads. When used in a binary series the capacitor may be adjusted from 0.001 to 0.015 microfarads in 0.001 microfarad increments using the basic mathematics of binary numbers. With larger capacities and sections, a capacitor with sections of 0.001, 0.002, 0.004, 0.008, 0.016, 0.032, 0.064, 0.128, 0.256, and 0.512 microfarads can be made to have any value from 0.001 microfarad to 1.024 microfarads in 0.001 microfarad increments. In using this capacitor with a high voltage source in connection with a spark gap 61 and inductance 60 shown in FIG. 13, the spark gap can be made to oscillate from 50 kilohertz to over one million cycles. Because of the unique combinations of materials used as electrodes in the spark gaps, certain frequencies will discharge disruptively with better success across the gap without overheating or arcing and produce the richest spectrums of ultraviolet radiations with the least possibilities of overheating thereby diminishing portions of the spectrum enhanced by the use of this tuned circuit. This feature also allows softer materials not previously able to be employed in spark gaps for oscillatory purposes successfully to be used for spectral analysis by alternating the character of the spark produced in the gap over a wide range of flexibility.

Figure 15:
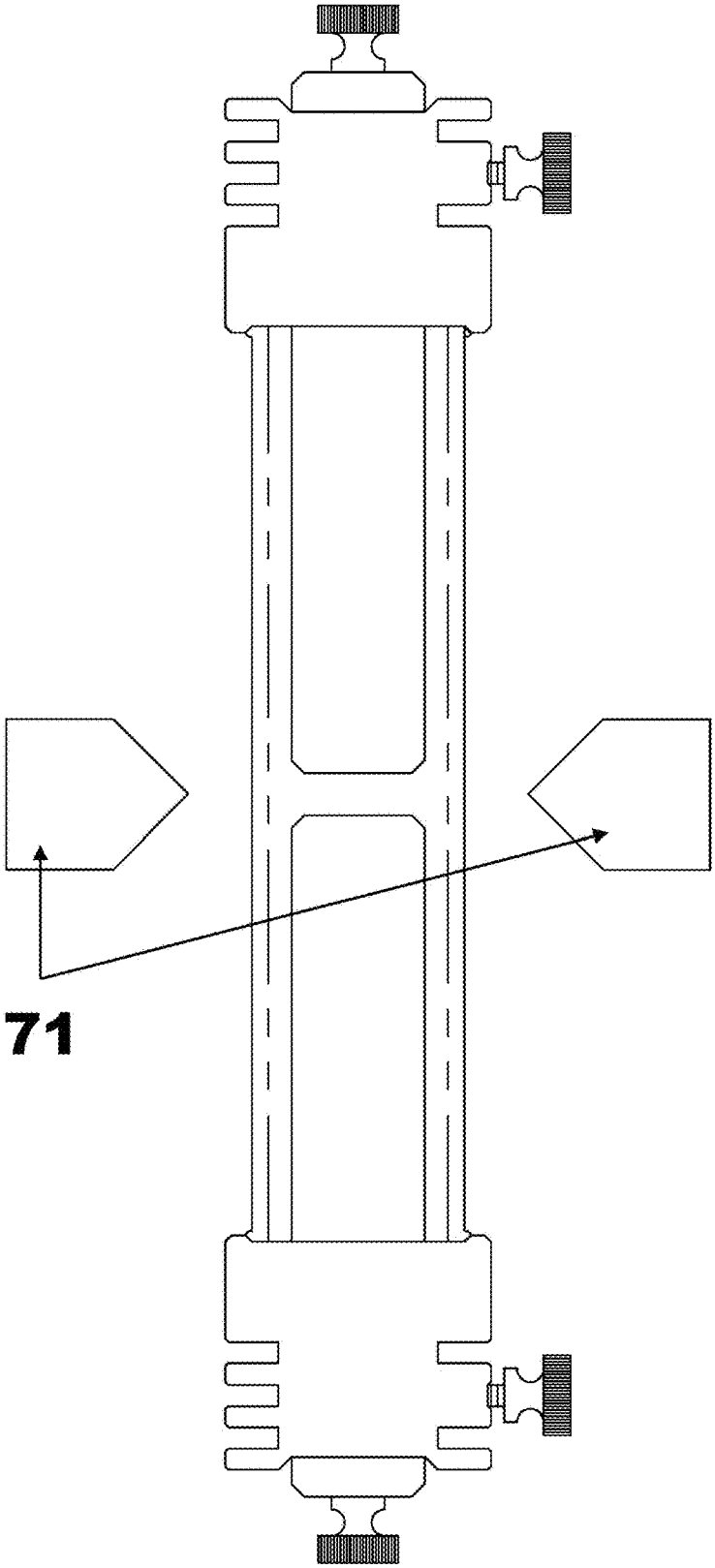
FIG. 15 shows a lamp with a strong magnetic field placed perpendicularly to the spark gap, according to some embodiments.

FIG. 15 shows a lamp with a strong magnetic field placed perpendicularly to the spark gap, according to some embodiments. FIG. 15 illustrates a strong magnetic field 71 placed perpendicular to the gap to enhance parts of the spectrum as noticed with certain elements. This feature, according to some embodiments, makes the period of oscillation in the gap quicker and prevents an arc discharge from forming. The magnetic field 71 may be produced, for example, by pole pieces placed externally to the gap of the lamp or be incorporated into the electrode material or holders to either render the electrodes magnetic or to place the gap under a strong magnetic field by proximity.

For simplicity, the term spark gap refers to a single gap; however, multiple gaps can be employed of the same or different designs outlined herein without departing from the breadth and scope of this disclosure and the exemplary embodiments described herein—the result is simply multiple sources of ultraviolet radiation being generated simultaneously. When combined with gas discharge tubes or corona discharge effects from coil 62 the spectrum of ultraviolet radiation present is simply multiplied and enhanced.

In operating the spark gap or gaps, electrodes are first chosen. Traditional materials include silver, platinum, tungsten, zinc, or tungsten carbide for oscillatory circuits; however according to some aspects, unique spectrums are provided through a selection of unique materials not previously employed to be able to sustain an oscillatory spark discharges. As one example, a unique alloy contained in meteorite slices of Muonionalusta, a 4.5653 billion year old meteorite found in Finland, was selected. The spectrum was found to be rich in germicidal UV specifically along the UVC wavelength region where the DNA of cells and bacteria is most disrupted. While the source was fairly continuous from 190 nm-350 nm, the peak spectral lines were from 235-275 nm. The meteorite has a construction of primary iron with 8.4% nickel and trace amounts of rare elements—0.33 ppm gallium, 0.133 ppm germanium and 1.6 ppm iridium. Artificial alloys created with these elements showed similar UV spectrums.

Figure 16:
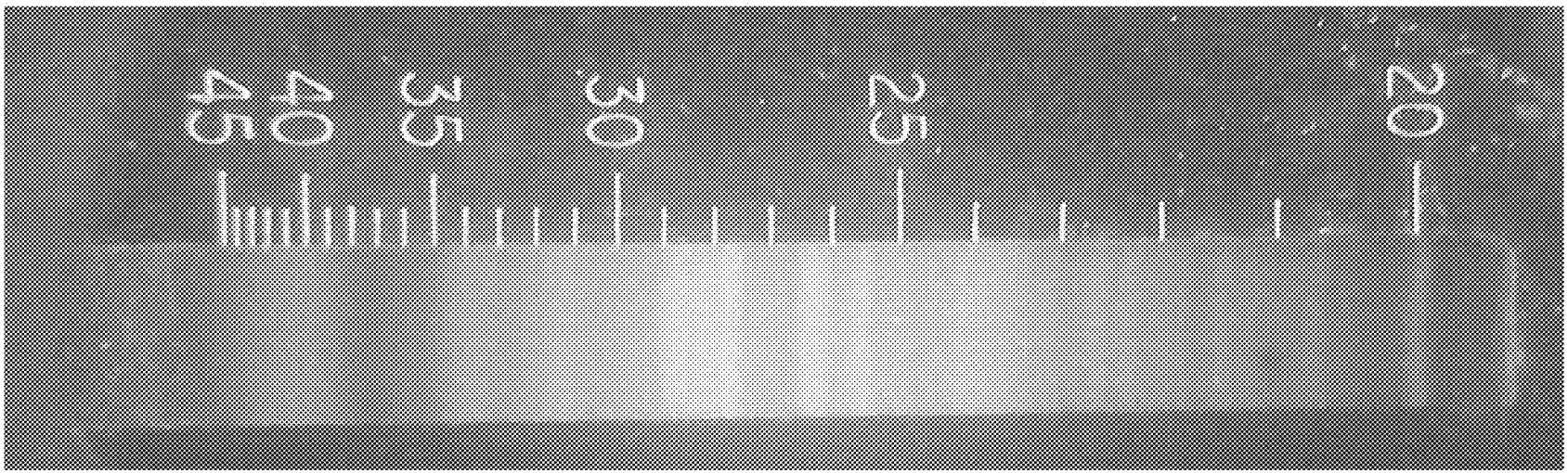
FIGS. 16-163 show specific wavelengths of ultraviolet radiation produced by the spark gaps in FIG. 1 and FIG. 2 using a plurality of materials in open air/atmosphere.
Figure 163:
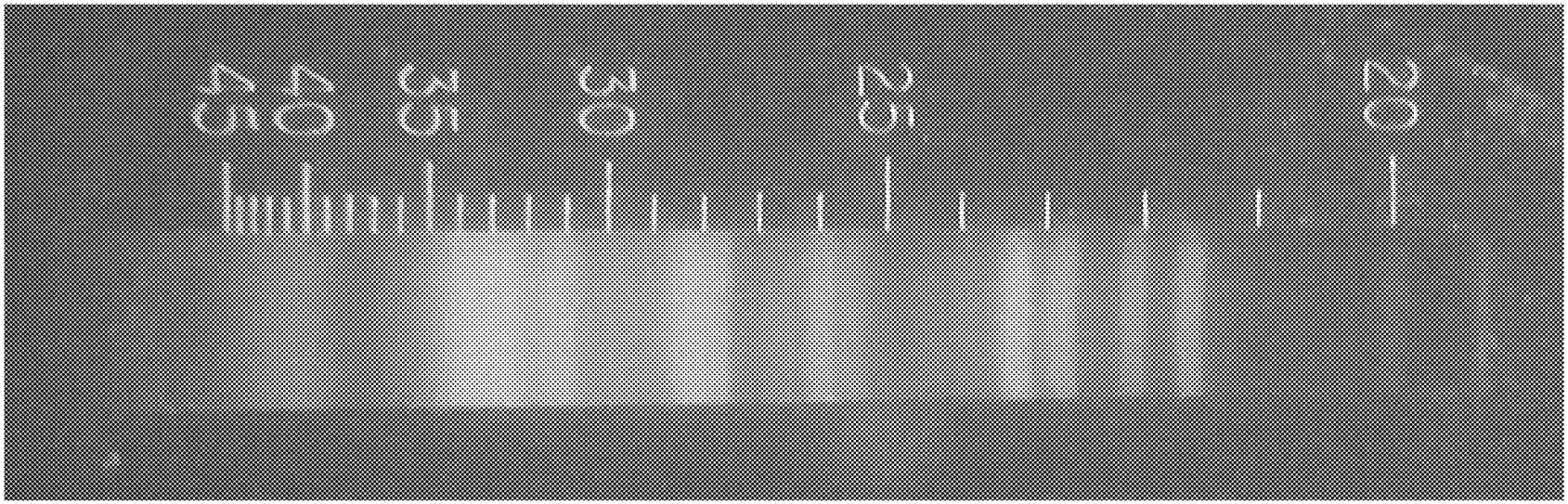

FIGS. 16-163 show ultraviolet spectrum analysis of open-air gaps for specific wavelengths of ultraviolet radiation produced by the spark gaps in FIG. 1 and FIG. 2 using a plurality of materials in open air/atmosphere. Common metals in the laboratory were first experimented with and custom alloys were fused using oxygen and acetylene gases, or by melting with a small carbon arc furnace. The darker lines in these spectrographs represent higher energy levels at those wavelengths, the lighter grey lines represent weaker portions of the spectrum. The numbers on the left of the scales represent Angstrom, and in conversion to nanometers a trailing zero is all that is required. The spectrum lines will be referred to in nanometers. For reference, a standard UVC germicidal lamp of modern construction (FIG. 166) and sunlight (FIG. 167) were measured for comparison.

FIG. 16 shows the spectral lines produced from 6061 aluminum to 304 stainless steel.

Figure 17:
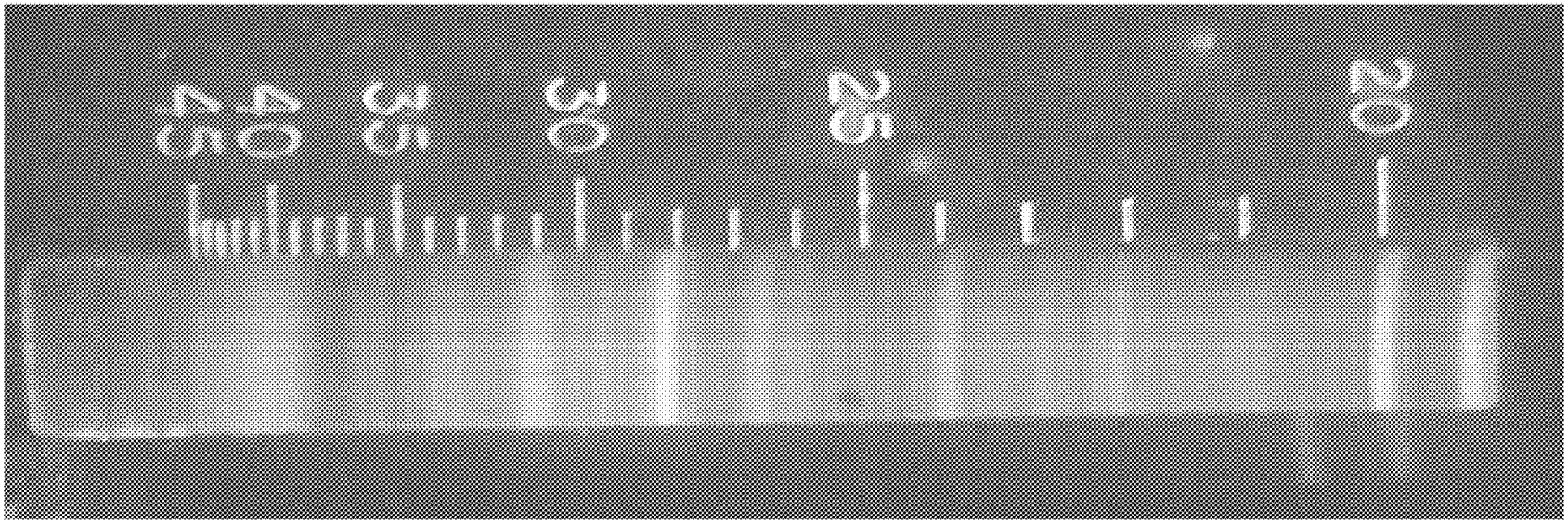

FIG. 17 shows the spectral lines produced from 6061 aluminum to 6061 aluminum.

Figure 18:
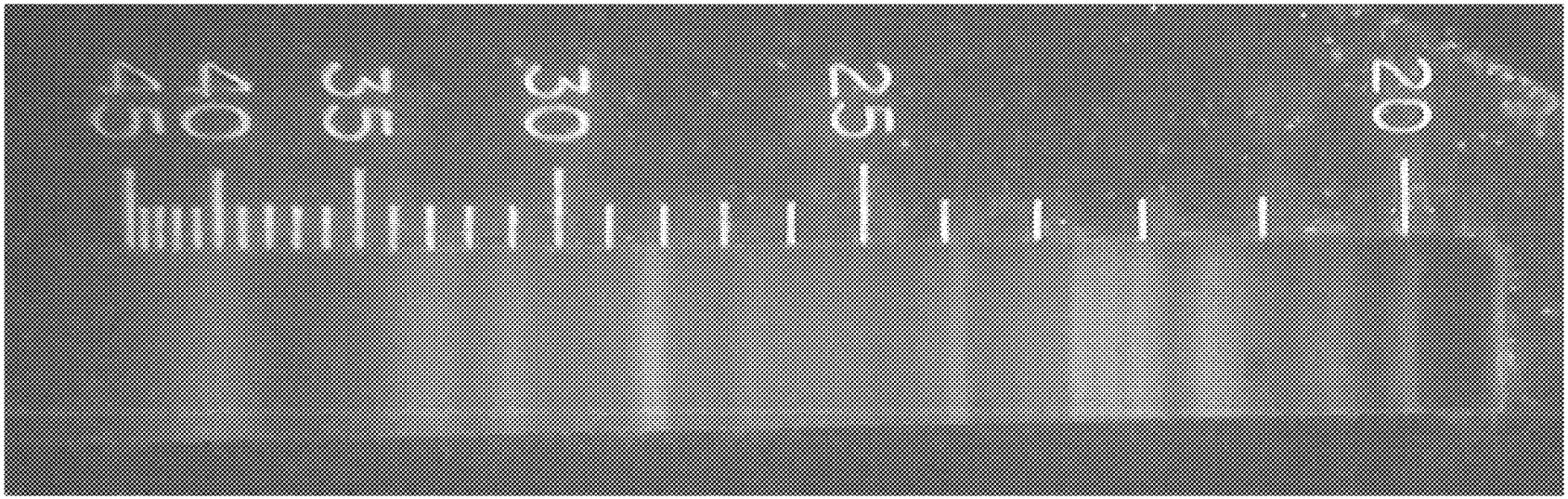

FIG. 18 shows the spectral lines produced from 6061 aluminum to copper tin.

Figure 19:
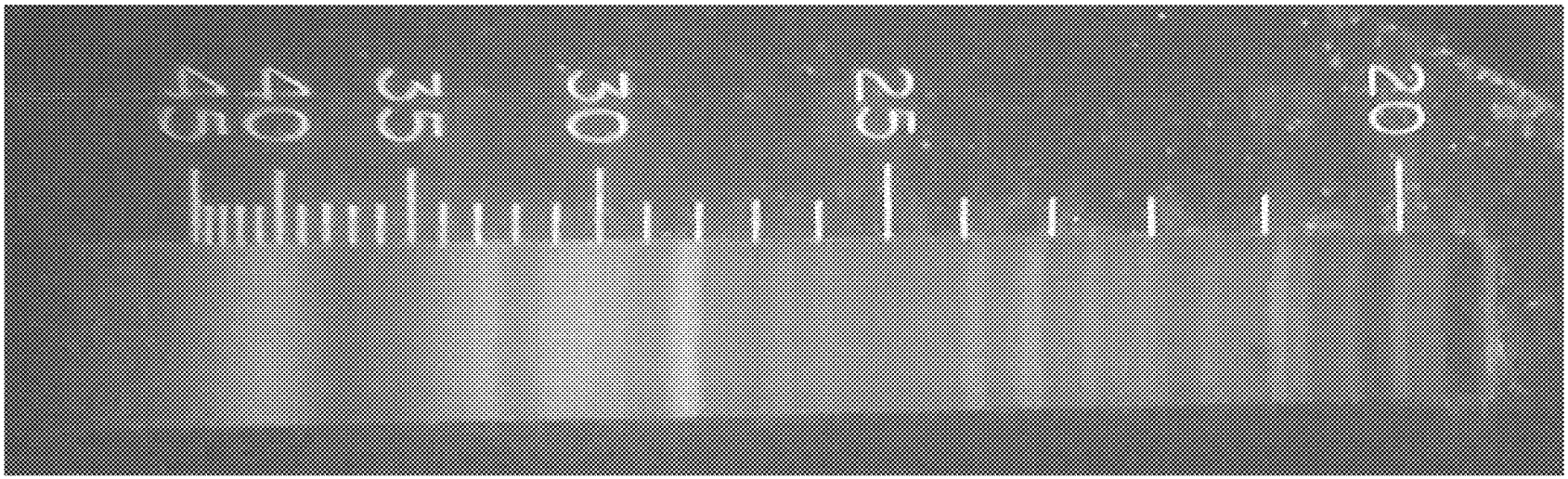

FIG. 19 shows the spectral lines produced from 6061 aluminum to indium.

Figure 20:
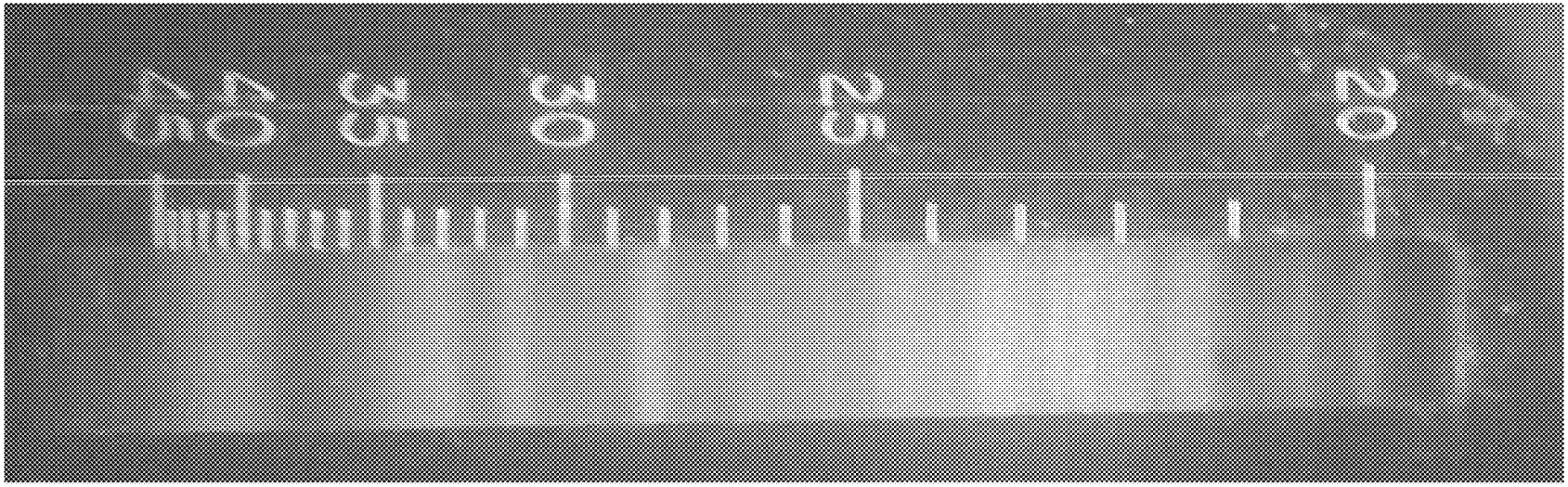

FIG. 20 shows the spectral lines produced from 6061 aluminum to silver copper nickel.

Figure 21:
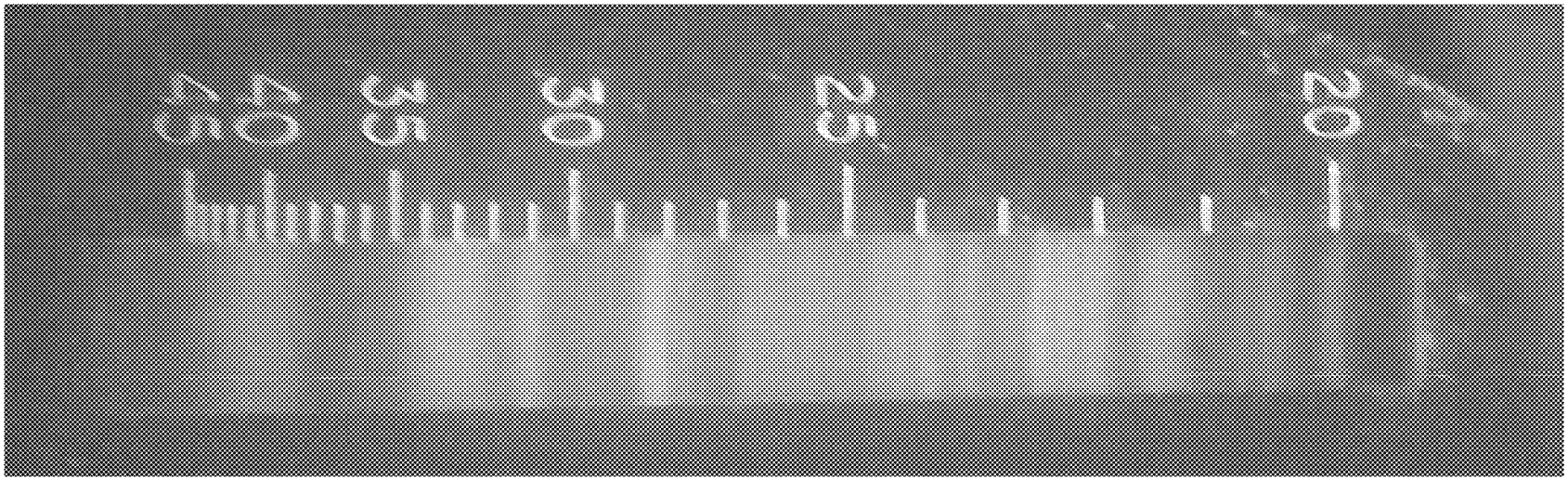

FIG. 21 shows the spectral lines produced from 6061 aluminum to silver copper.

Figure 22:
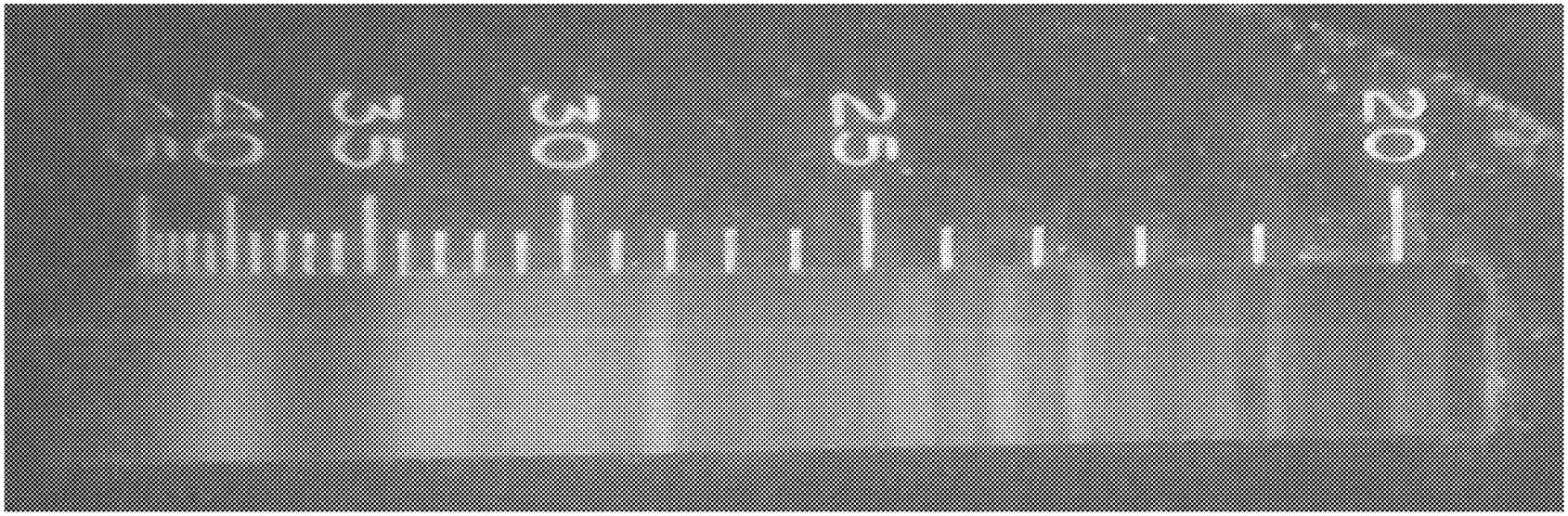

FIG. 22 shows the spectral lines produced from 6061 aluminum to silver indium.

Figure 23:
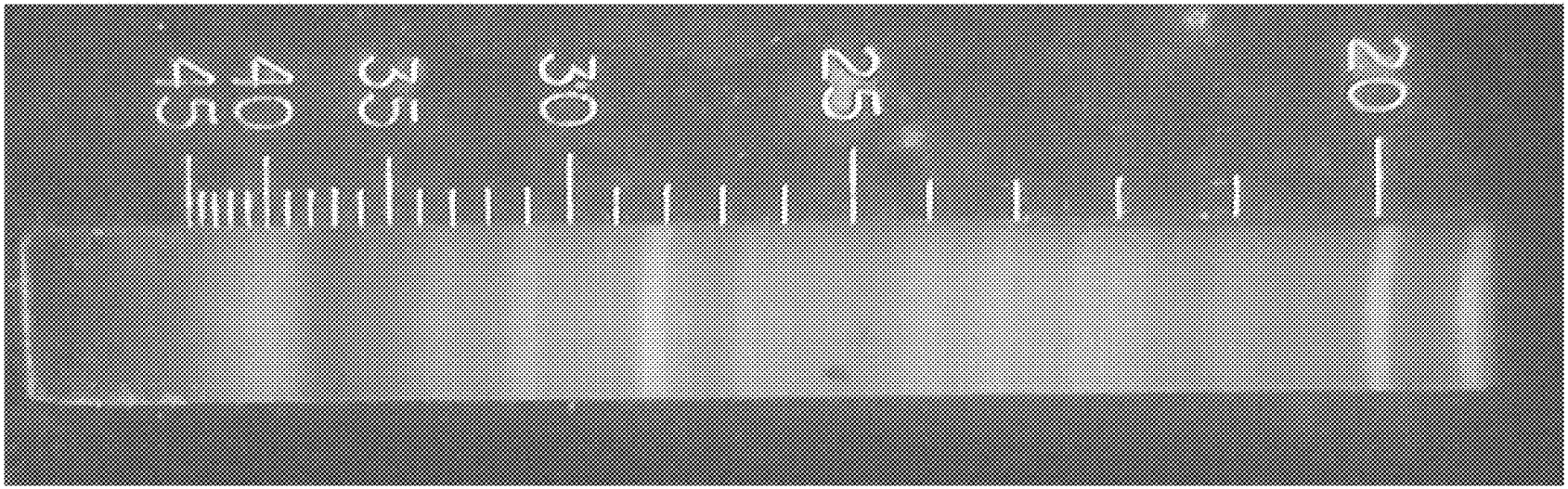

FIG. 23 shows the spectral lines produced from 6061 aluminum to tungsten.

Figure 24:
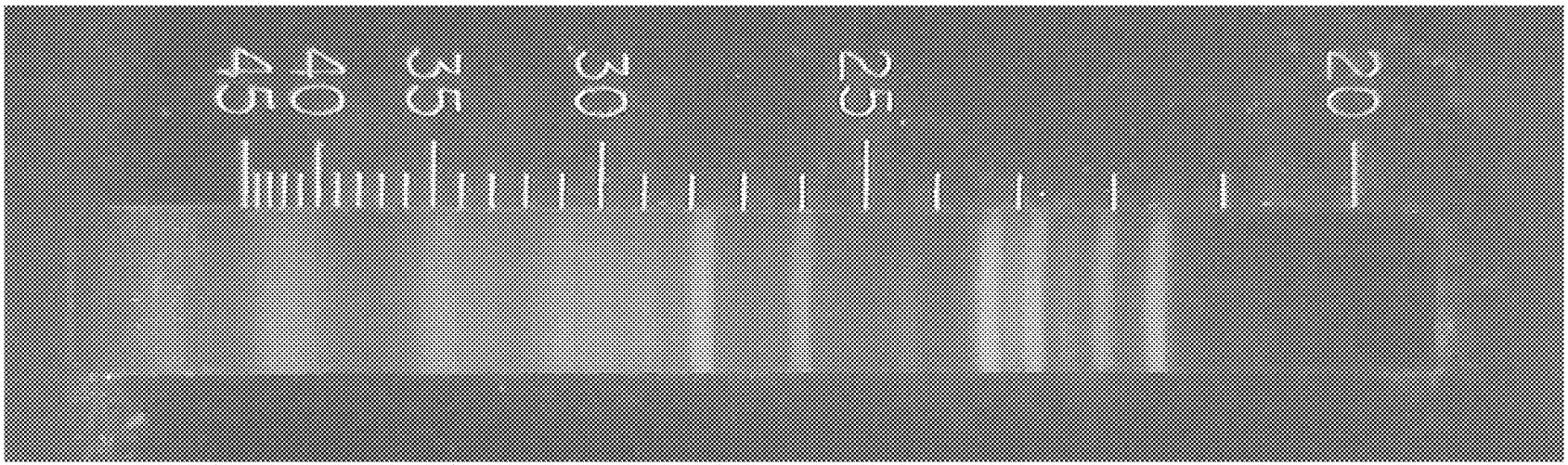

FIG. 24 shows the spectral lines produced from bismuth to cadmium.

Figure 25:
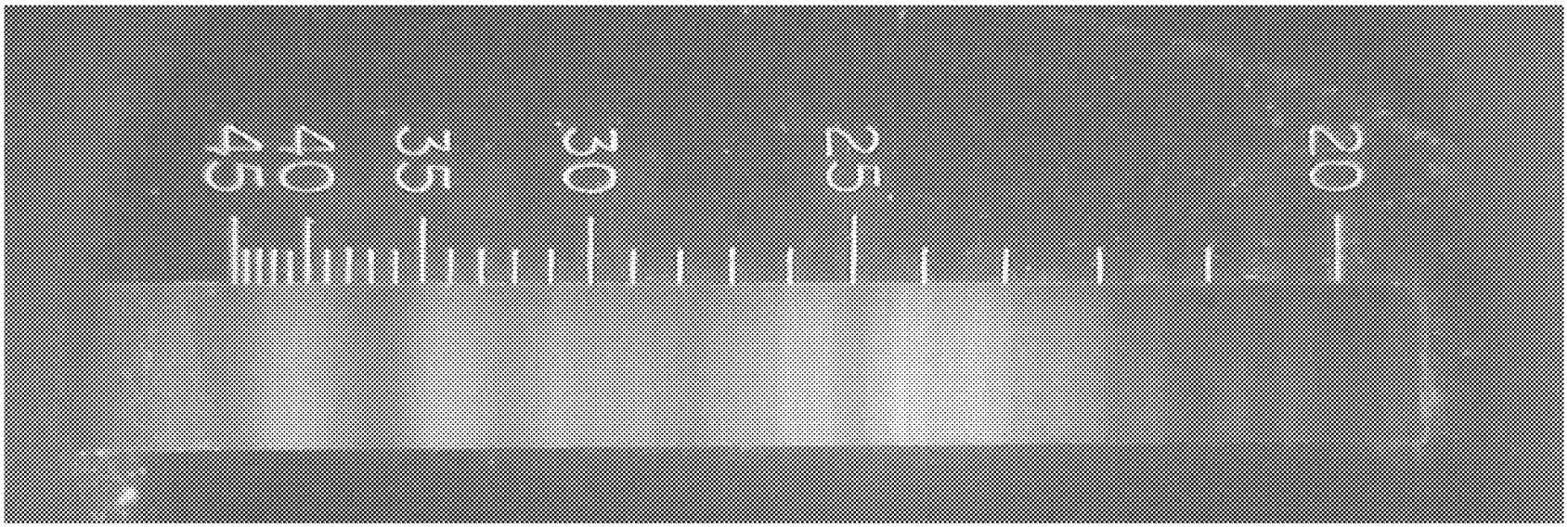

FIG. 25 shows the spectral lines produced from bismuth to cobalt.

Figure 26:
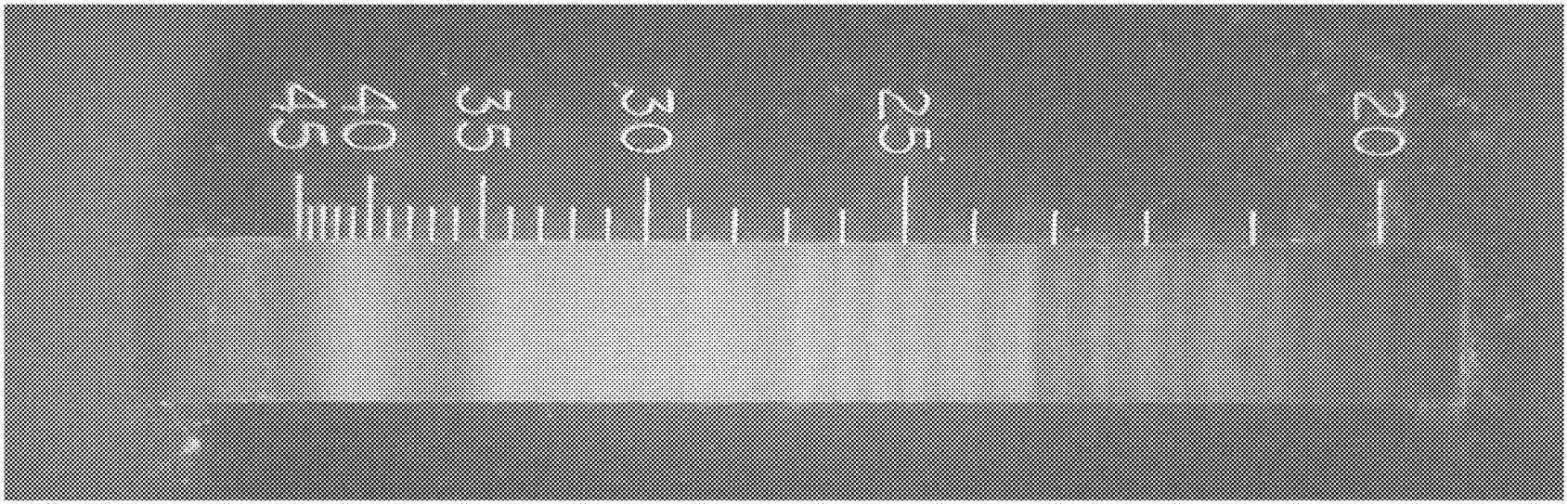

FIG. 26 shows the spectral lines produced from bismuth to hafnium.

Figure 27:
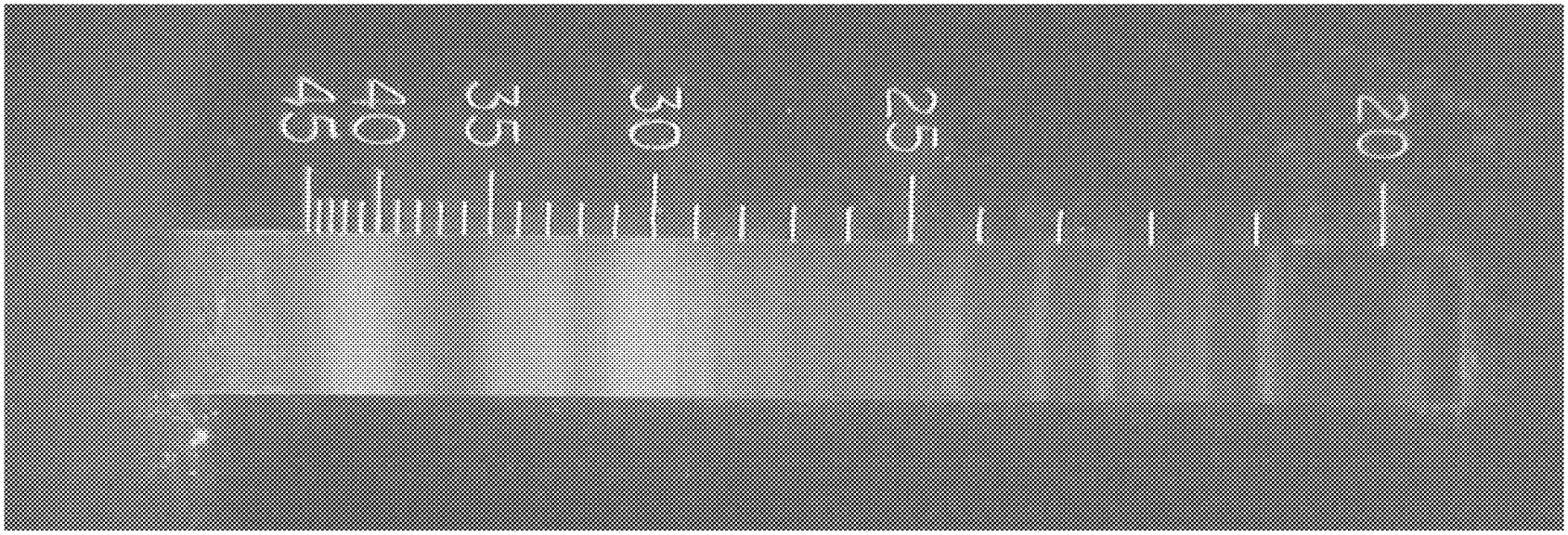

FIG. 27 shows the spectral lines produced from bismuth to indium.

Figure 28:
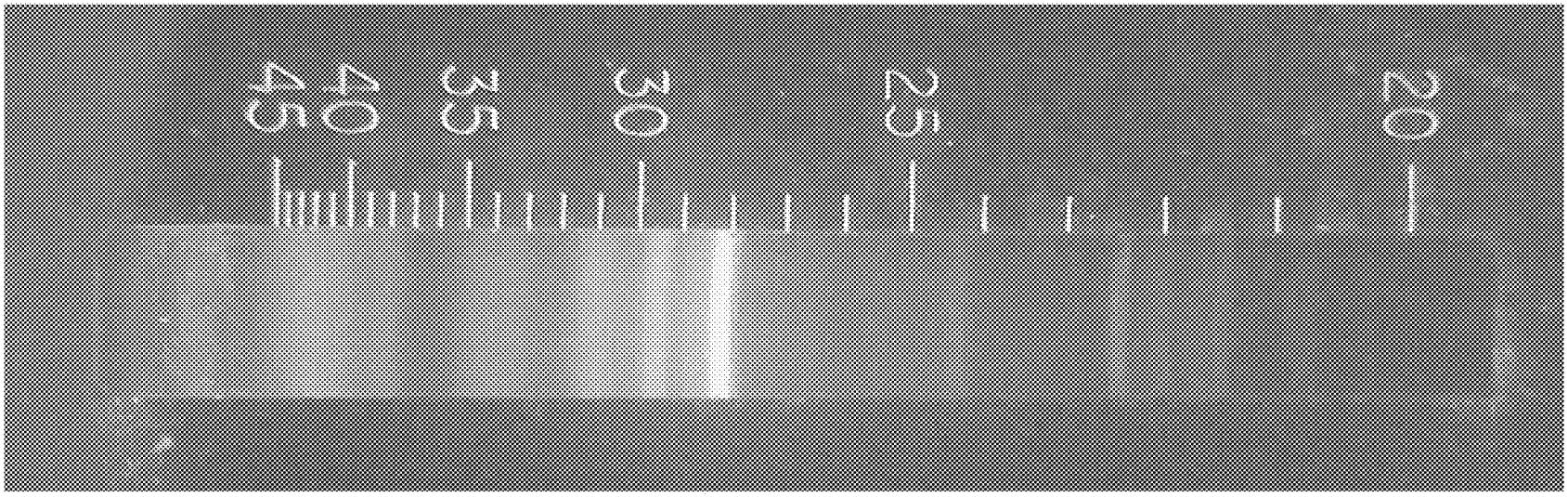

FIG. 28 shows the spectral lines produced from bismuth to magnesium.

Figure 29:
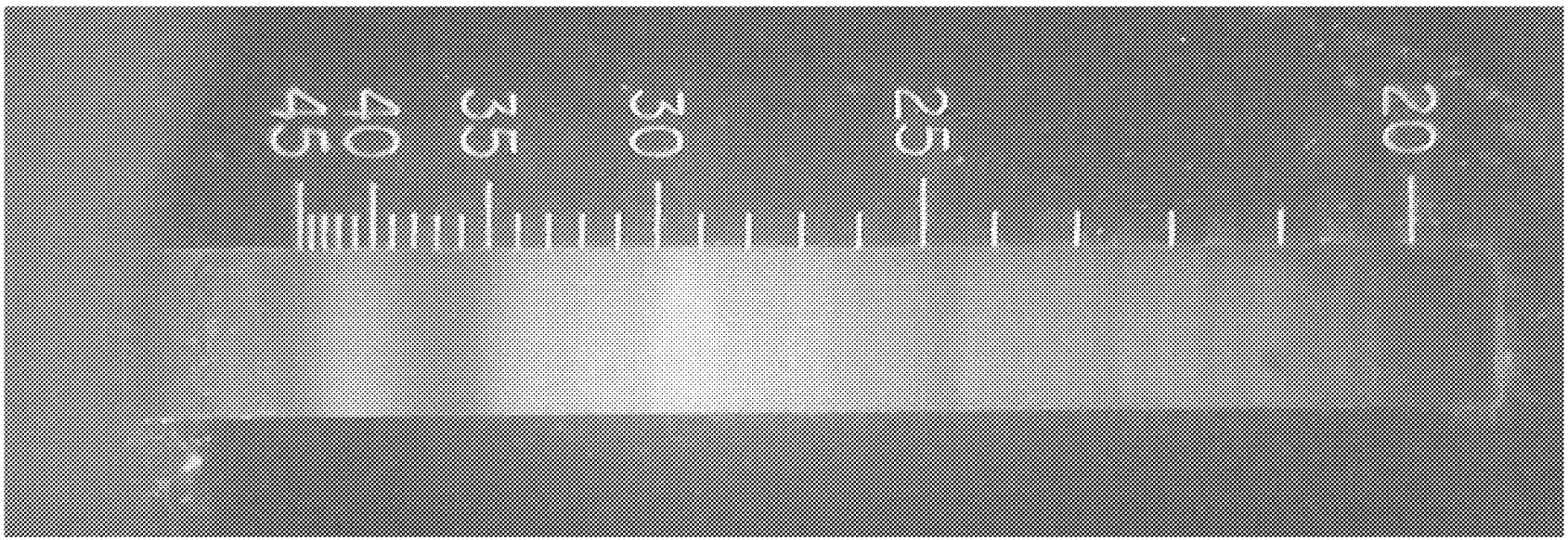

FIG. 29 shows the spectral lines produced from bismuth to molybdenum.

Figure 30:
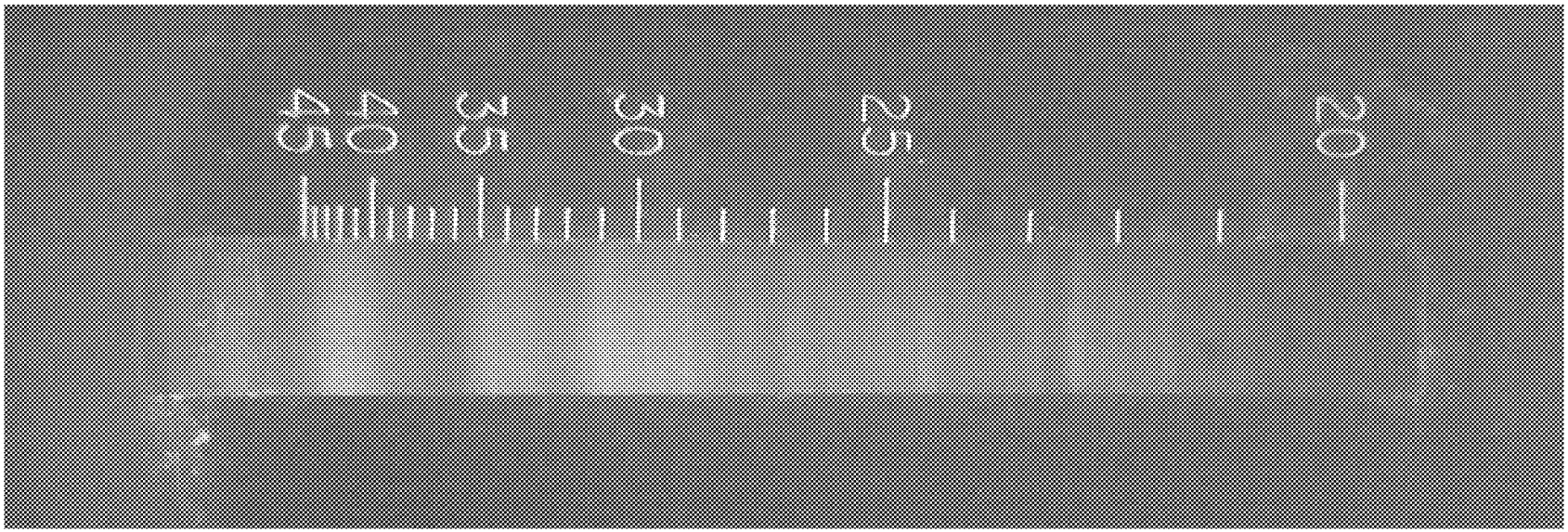

FIG. 30 shows the spectral lines produced from bismuth to rhenium.

Figure 31:
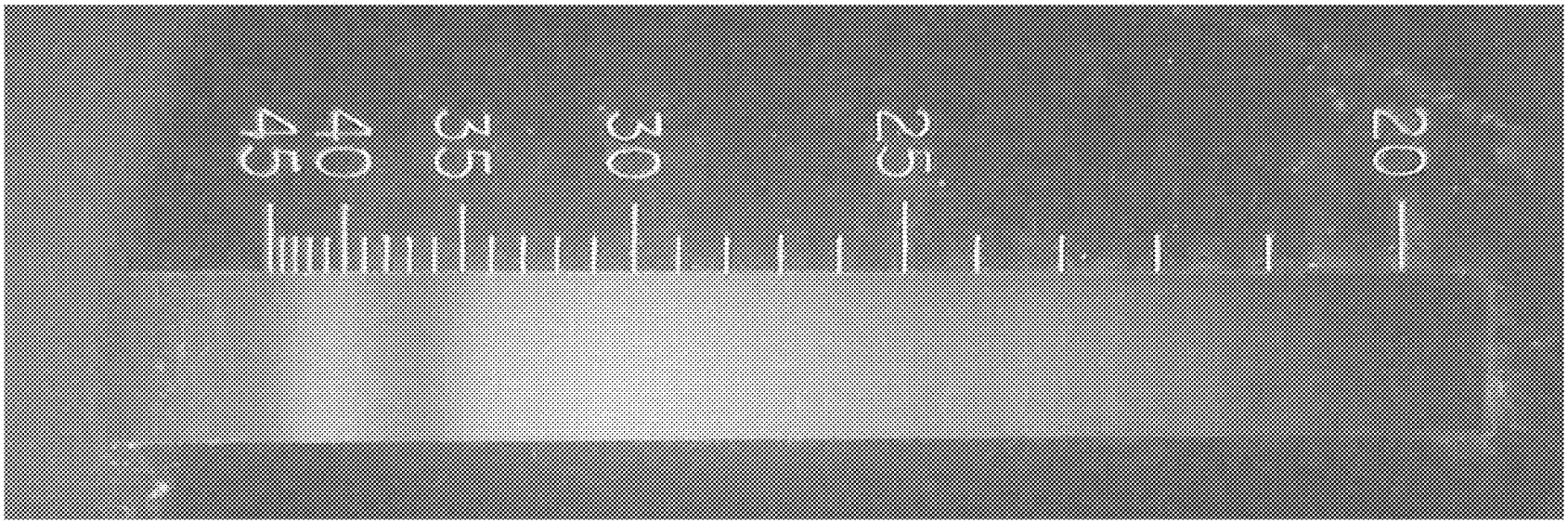

FIG. 31 shows the spectral lines produced from bismuth to uranium.

Figure 32:
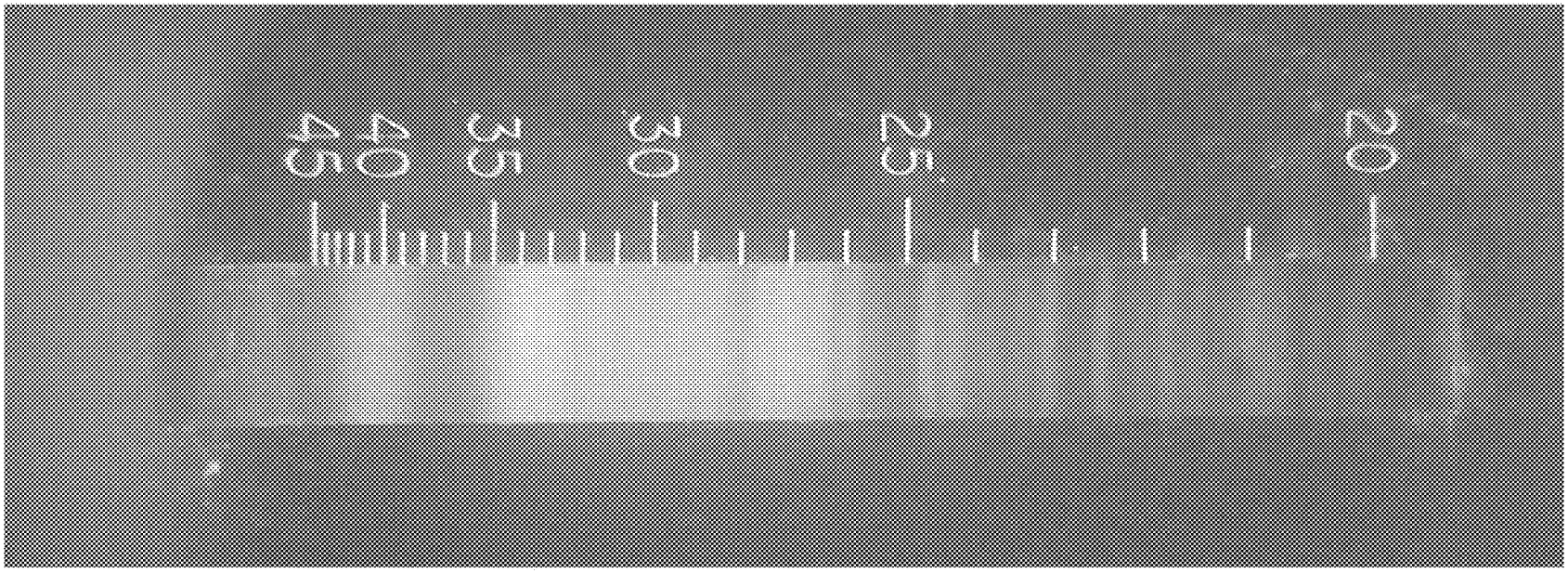

FIG. 32 shows the spectral lines produced from bismuth to zirconium.

Figure 33:
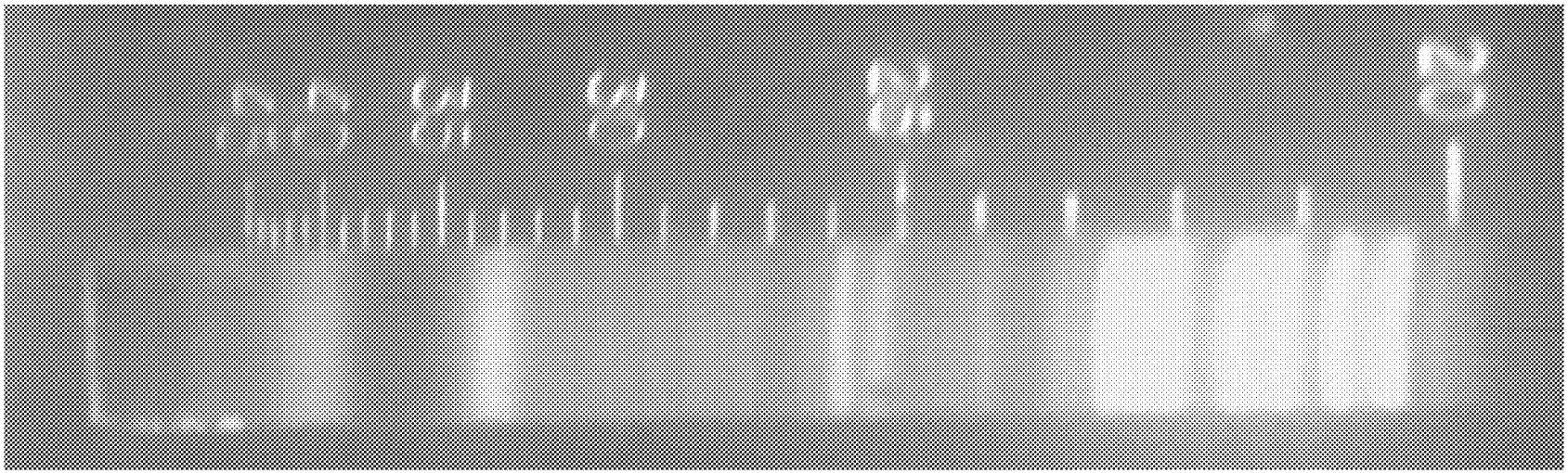

FIG. 33 shows the spectral lines produced from brass to brass.

Figure 34:
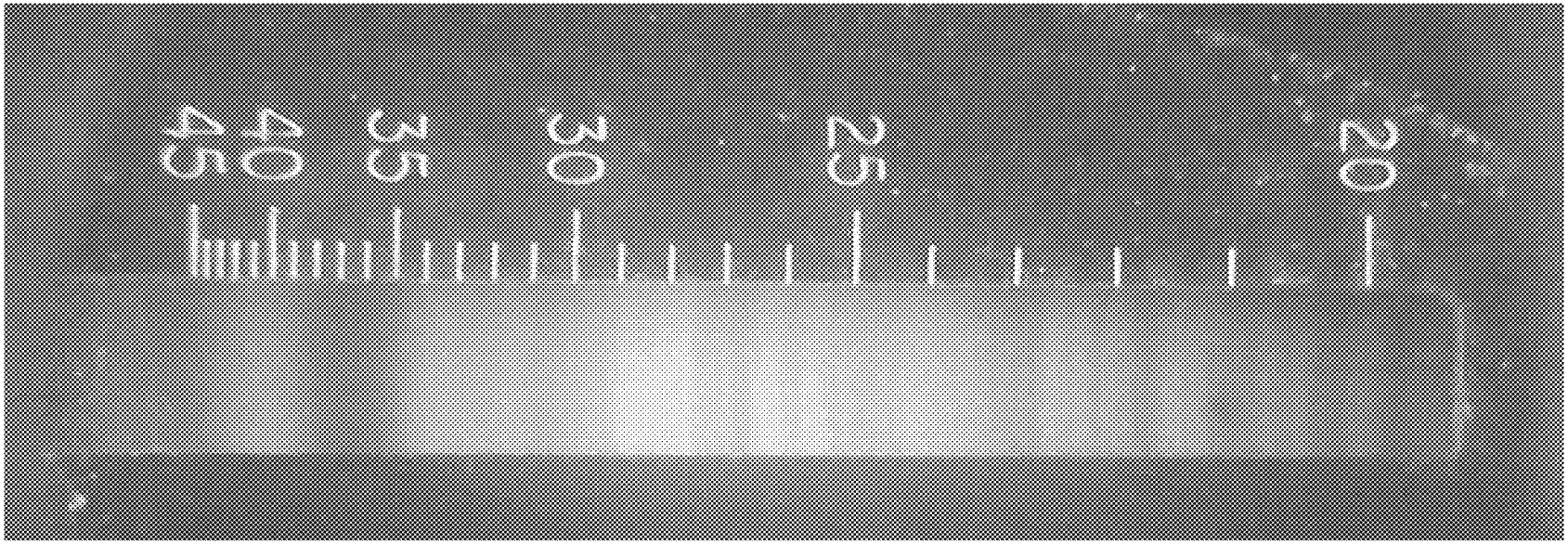

FIG. 34 shows the spectral lines produced from copper silver to 304 stainless steel.

Figure 35:
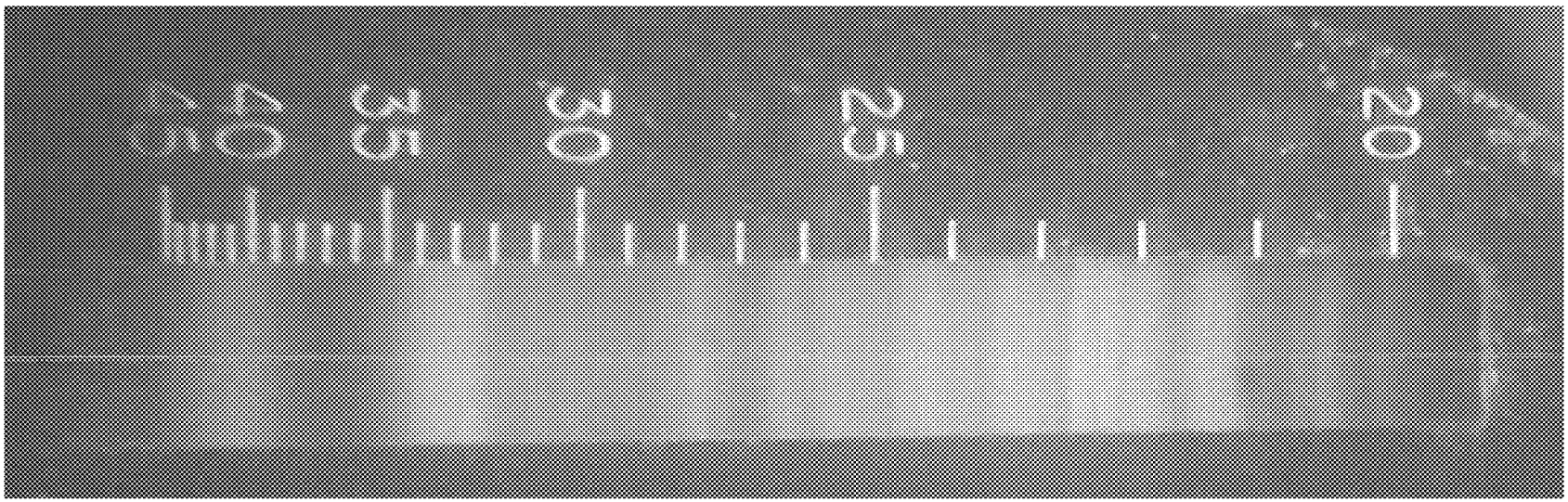

FIG. 35 shows the spectral lines produced from copper silver to copper silver nickel.

Figure 36:
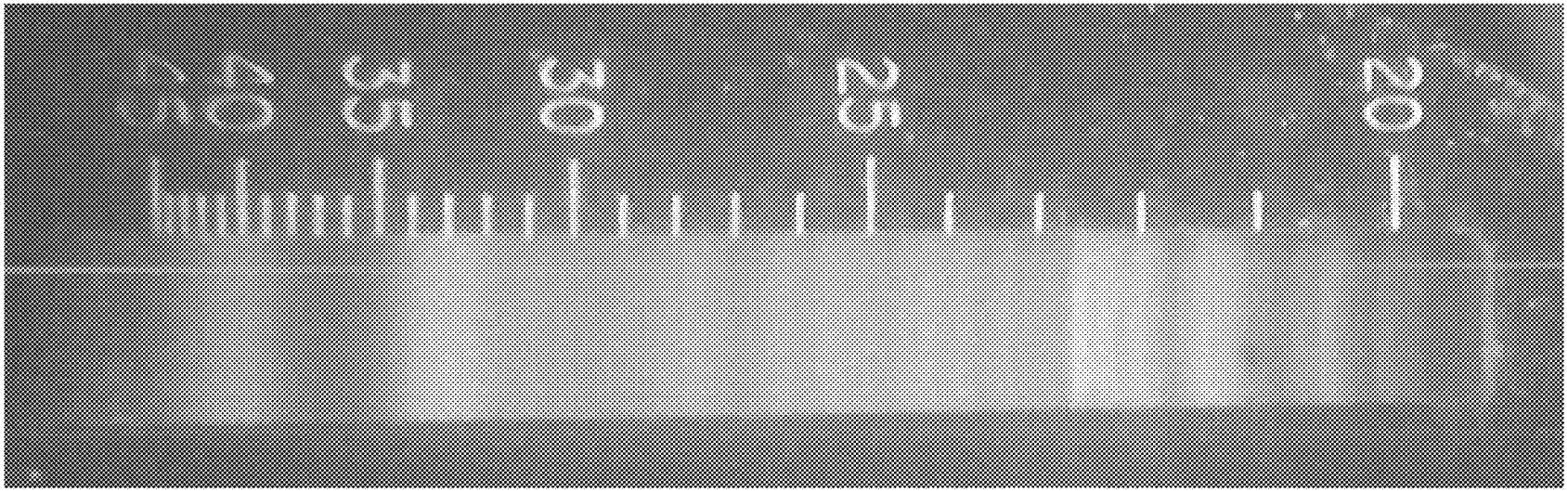

FIG. 36 shows the spectral lines produced from copper silver copper tin.

Figure 37:
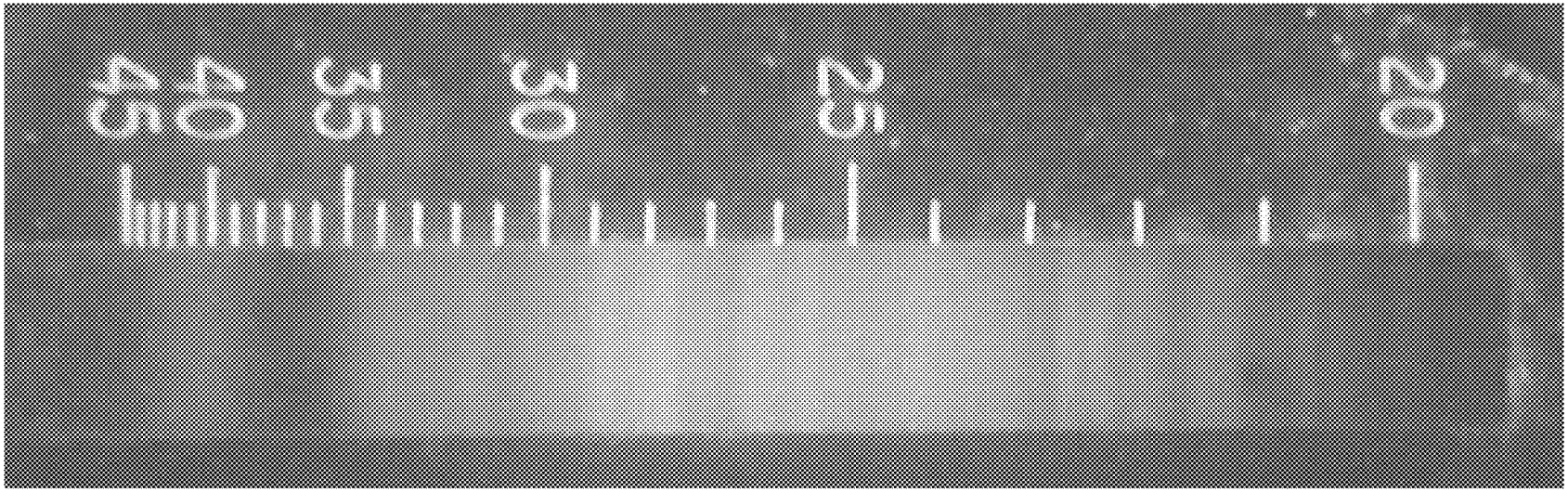

FIG. 37 shows the spectral lines produced from copper silver nickel to 304 stainless steel.

Figure 38:
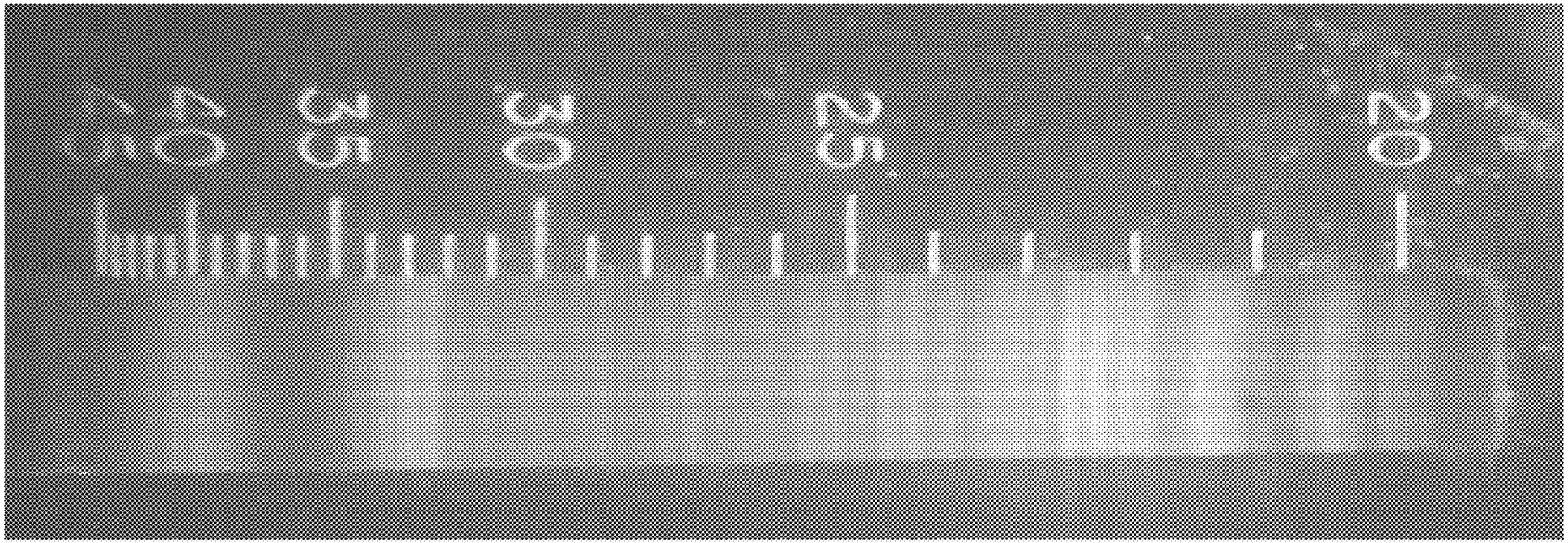

FIG. 38 shows the spectral lines produced from copper silver nickel to copper tin.

Figure 39:
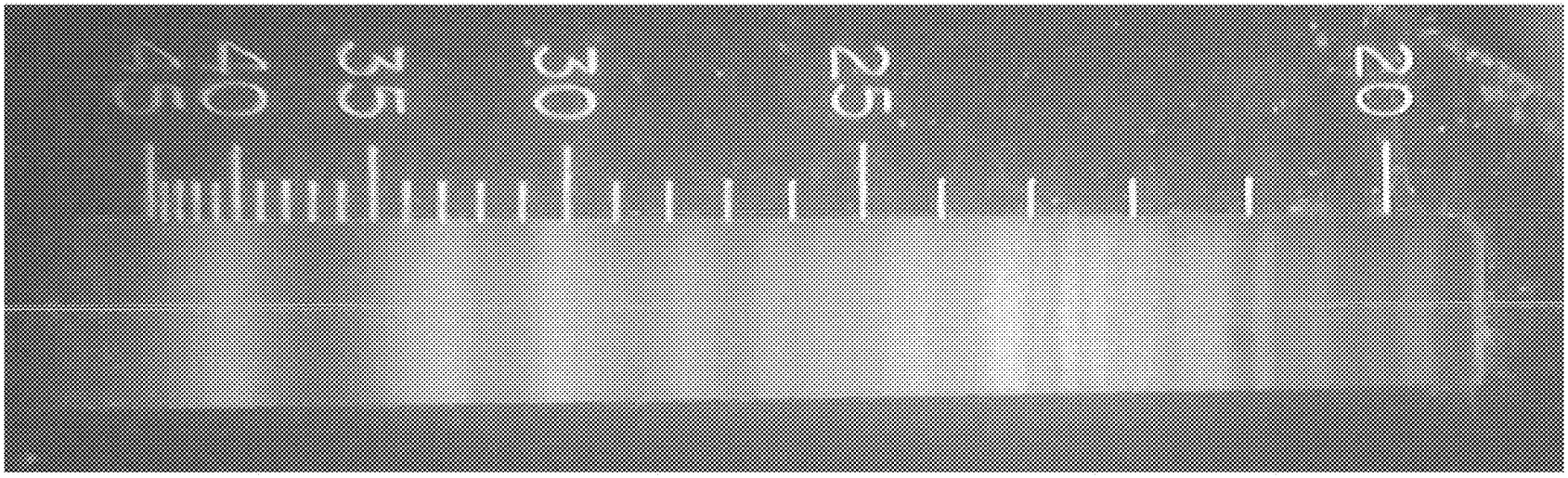

FIG. 39 shows the spectral lines produced from copper silver nickel to silver indium.

Figure 40:
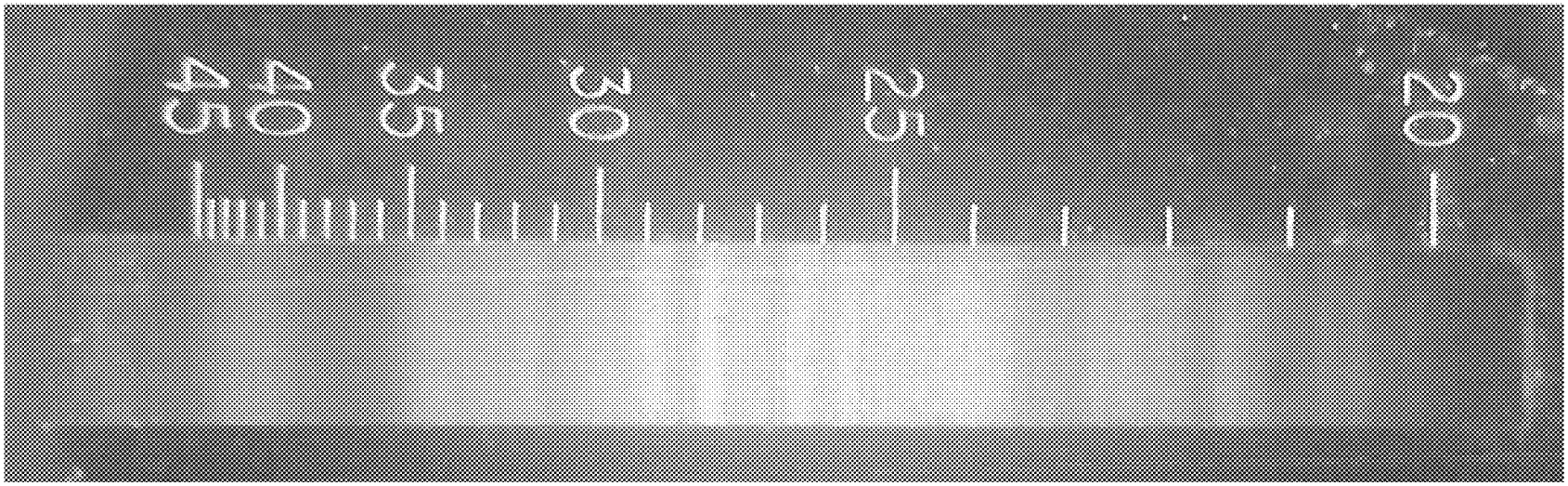

FIG. 40 shows the spectral lines produced from copper tin to 304 stainless steel.

Figure 41:
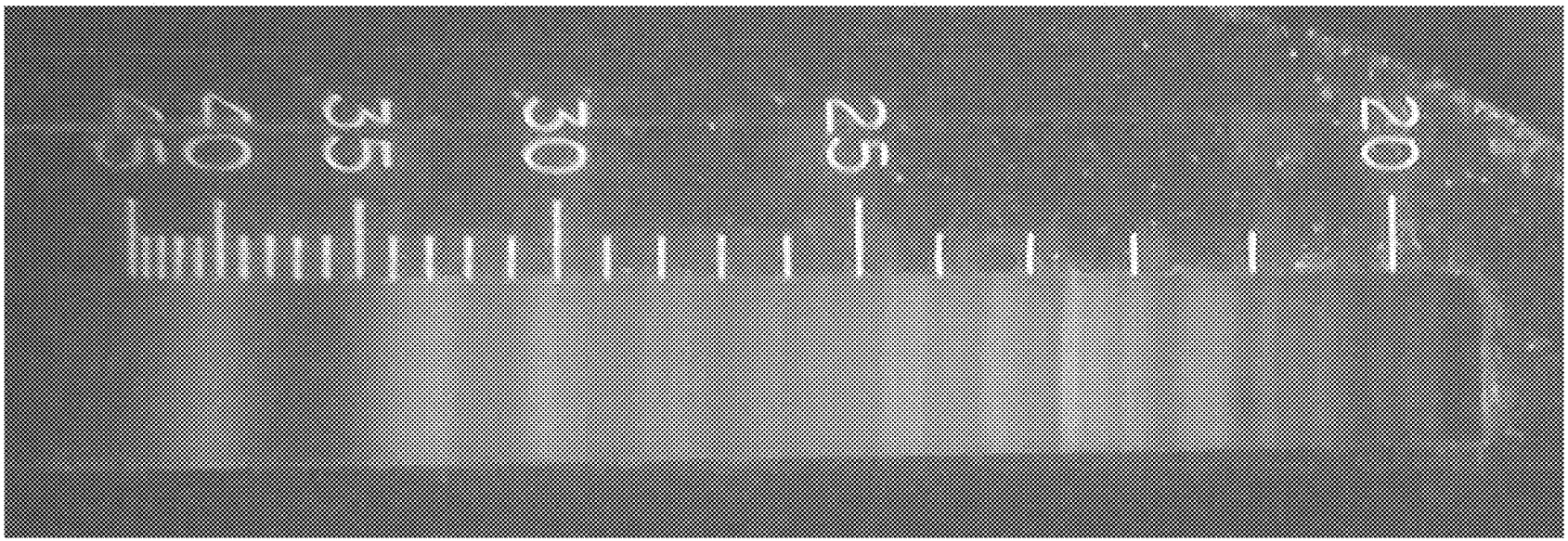

FIG. 41 shows the spectral lines produced from copper tin to silver indium.

Figure 42:
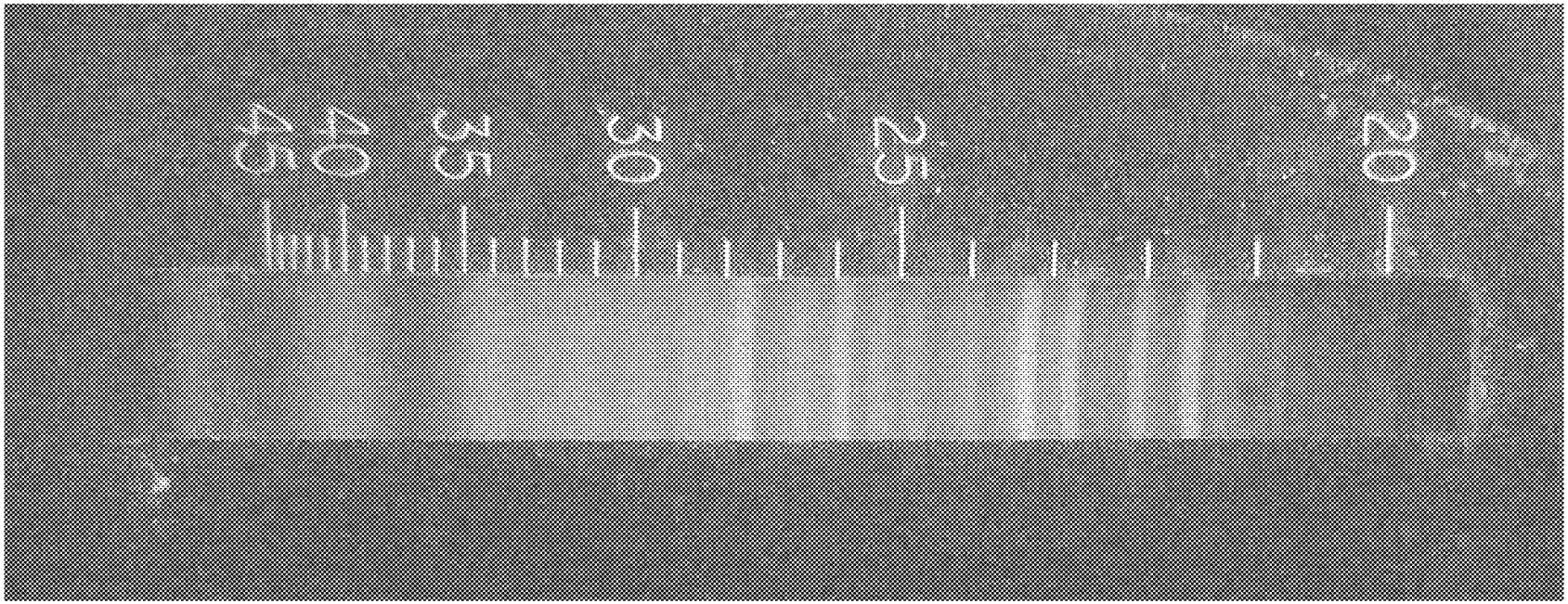

FIG. 42 shows the spectral lines produced from hafnium to cadmium.

Figure 43:
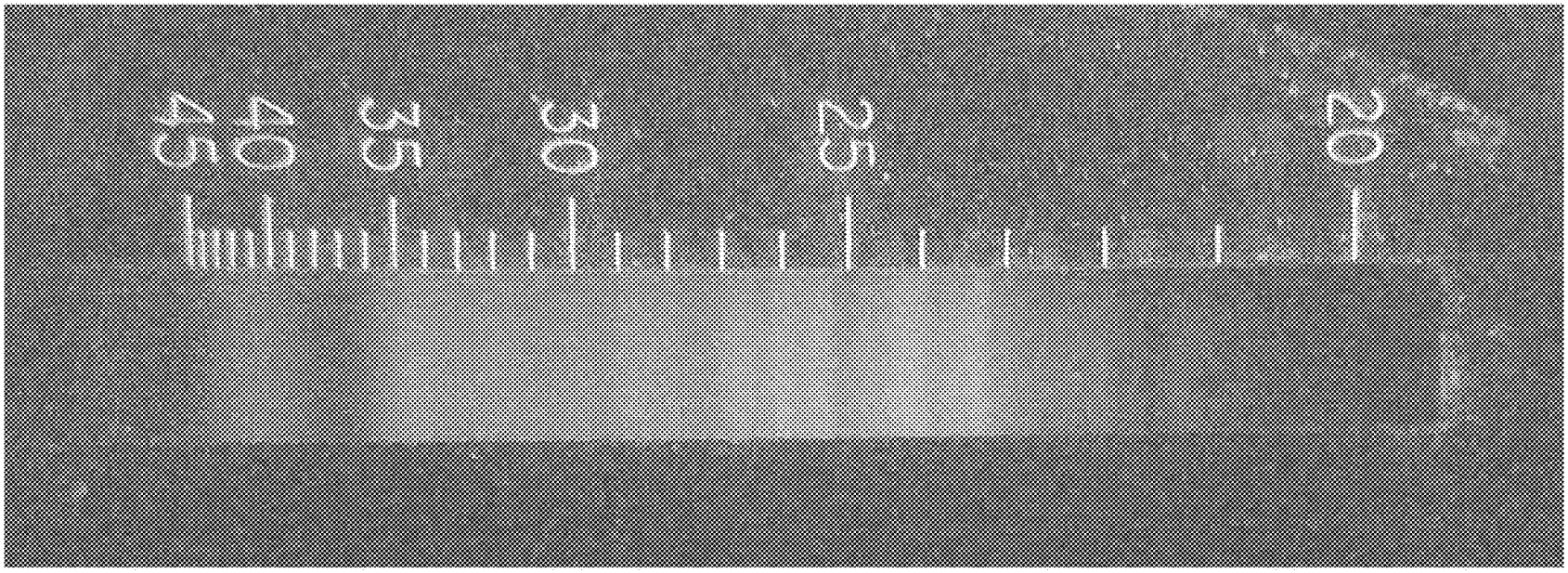

FIG. 43 shows the spectral lines produced from hafnium to cobalt.

Figure 44:
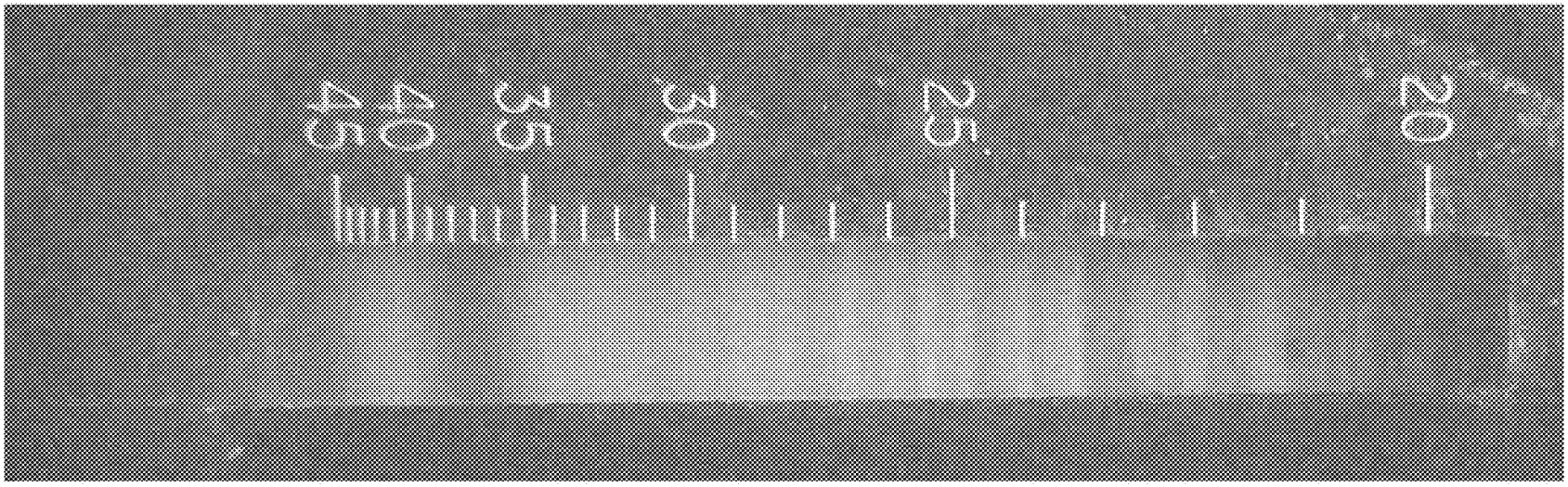

FIG. 44 shows the spectral lines produced from hafnium to copper.

Figure 45:
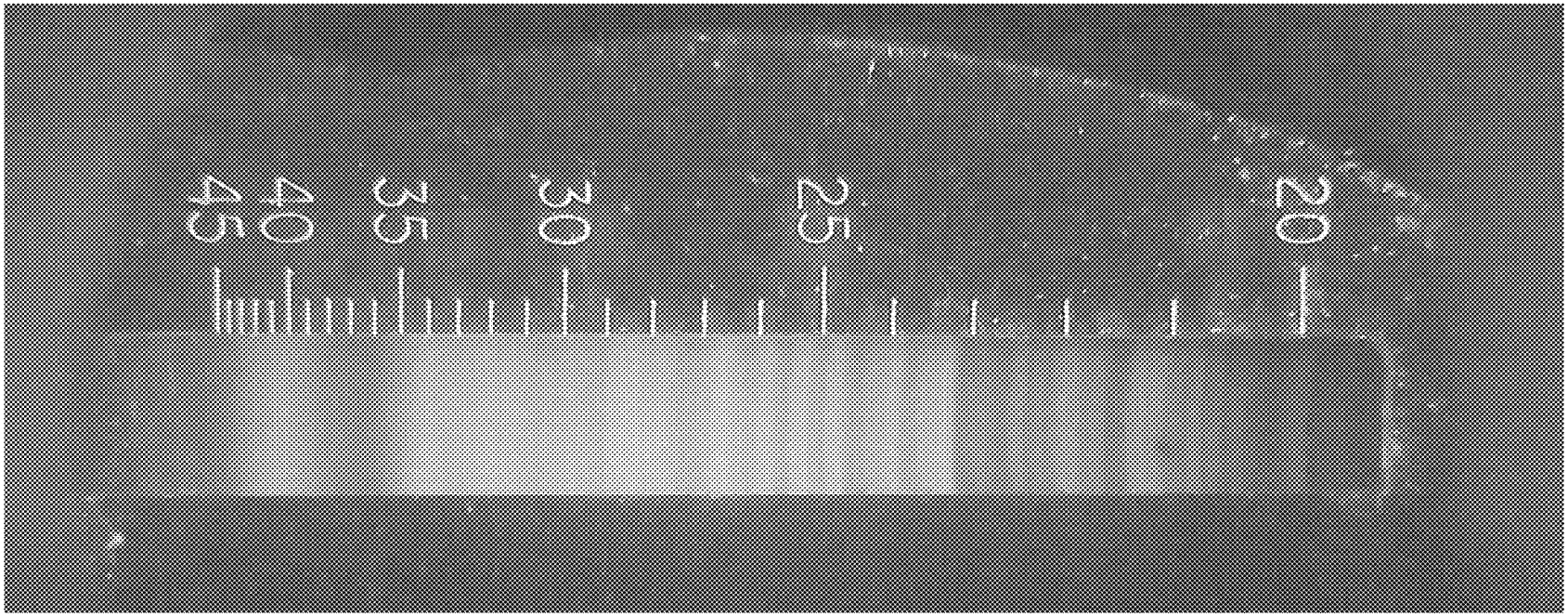

FIG. 45 shows the spectral lines produced from hafnium to hafnium.

Figure 46:
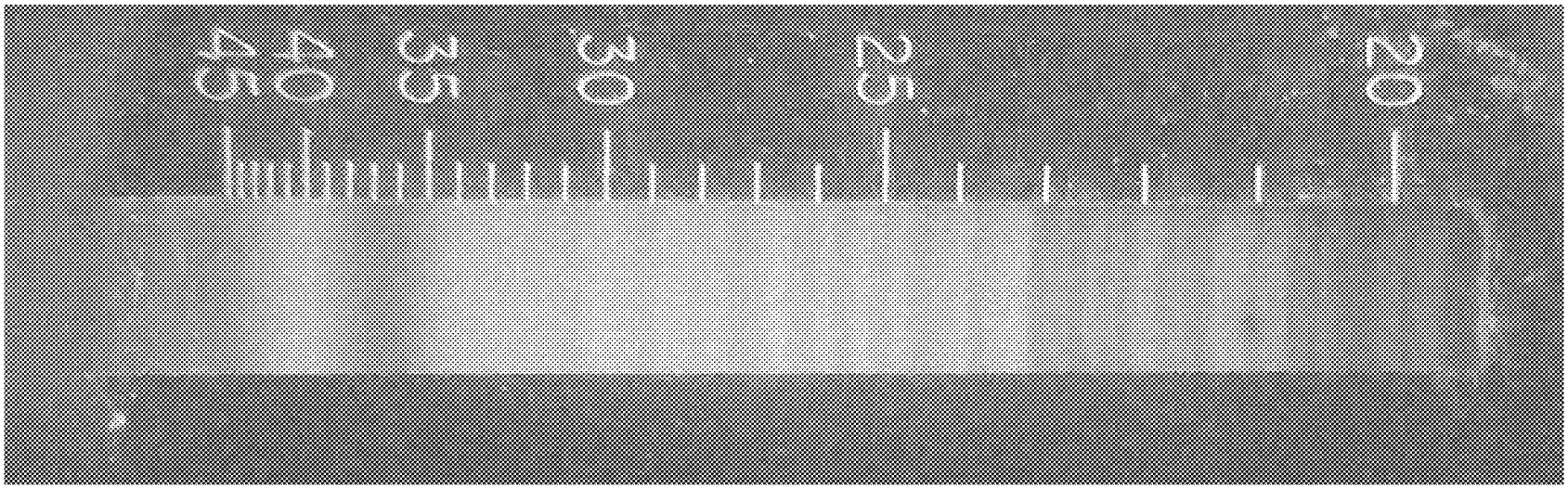

FIG. 46 shows the spectral lines produced from hafnium to indium.

Figure 47:
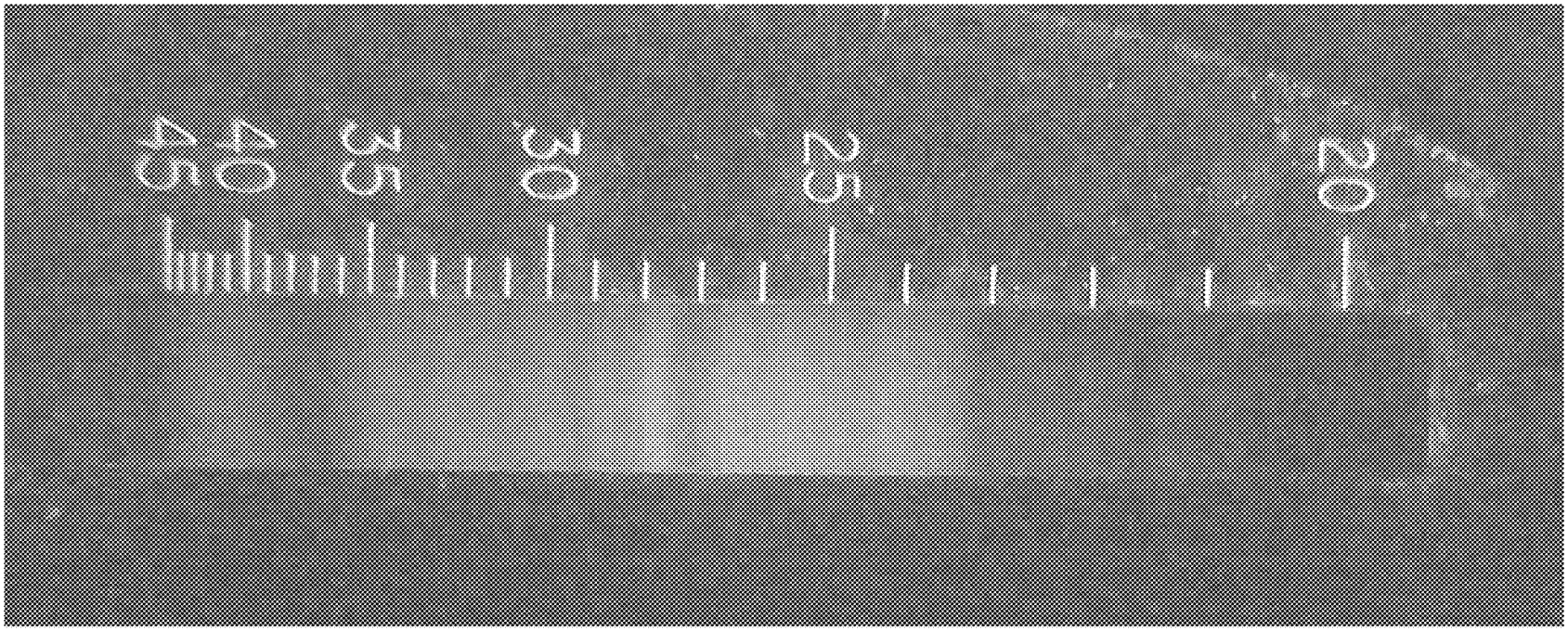

FIG. 47 shows the spectral lines produced from hafnium to iron.

Figure 48:
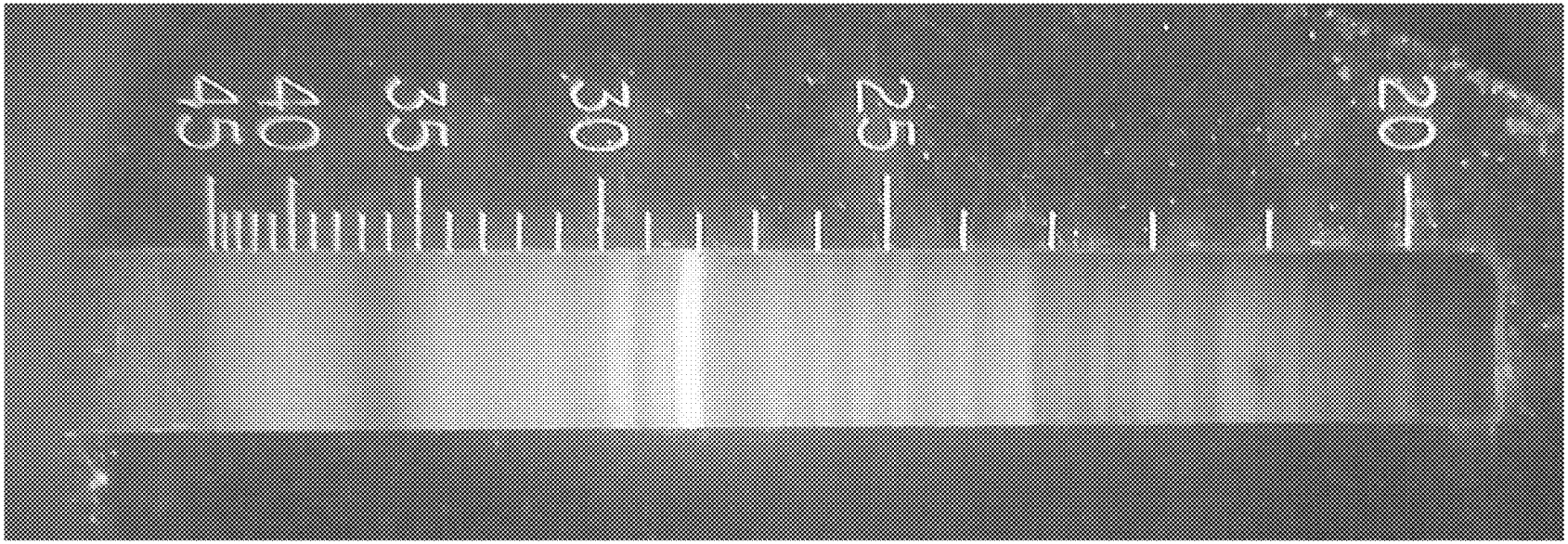

FIG. 48 shows the spectral lines produced from hafnium to magnesium.

Figure 49:
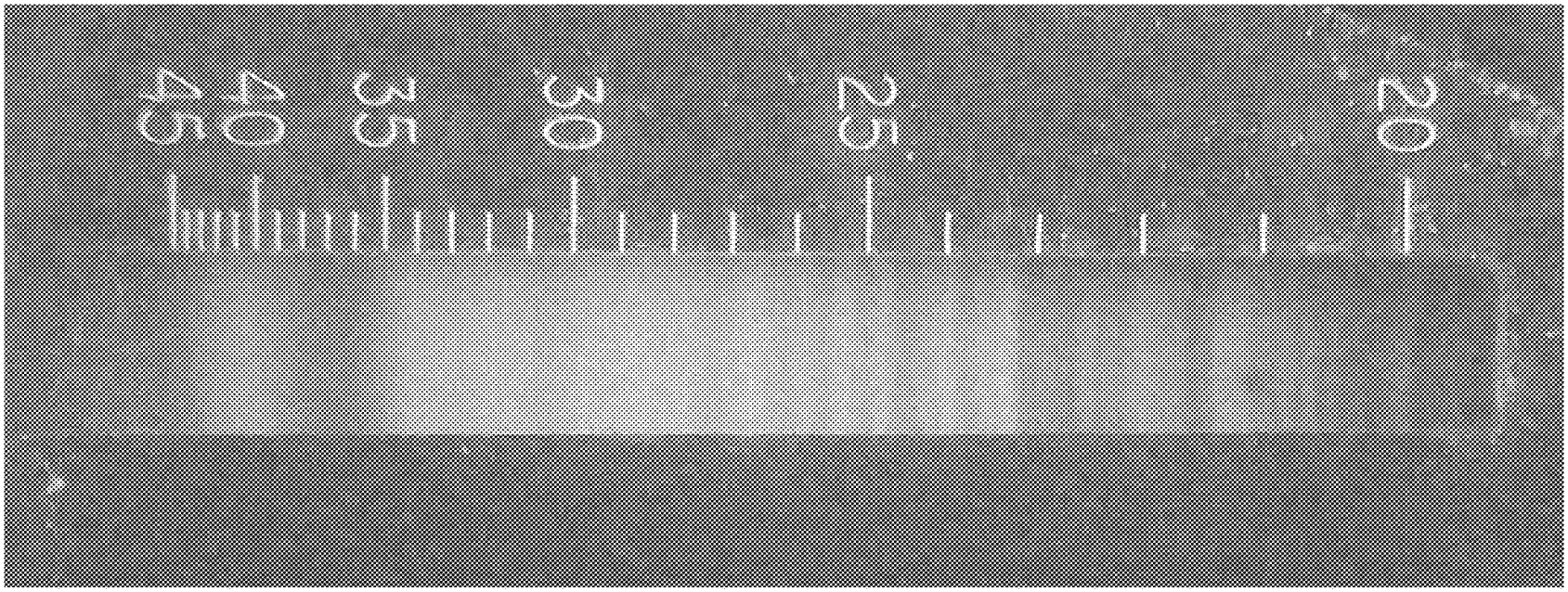

FIG. 49 shows the spectral lines produced from hafnium to molybdenum.

Figure 50:
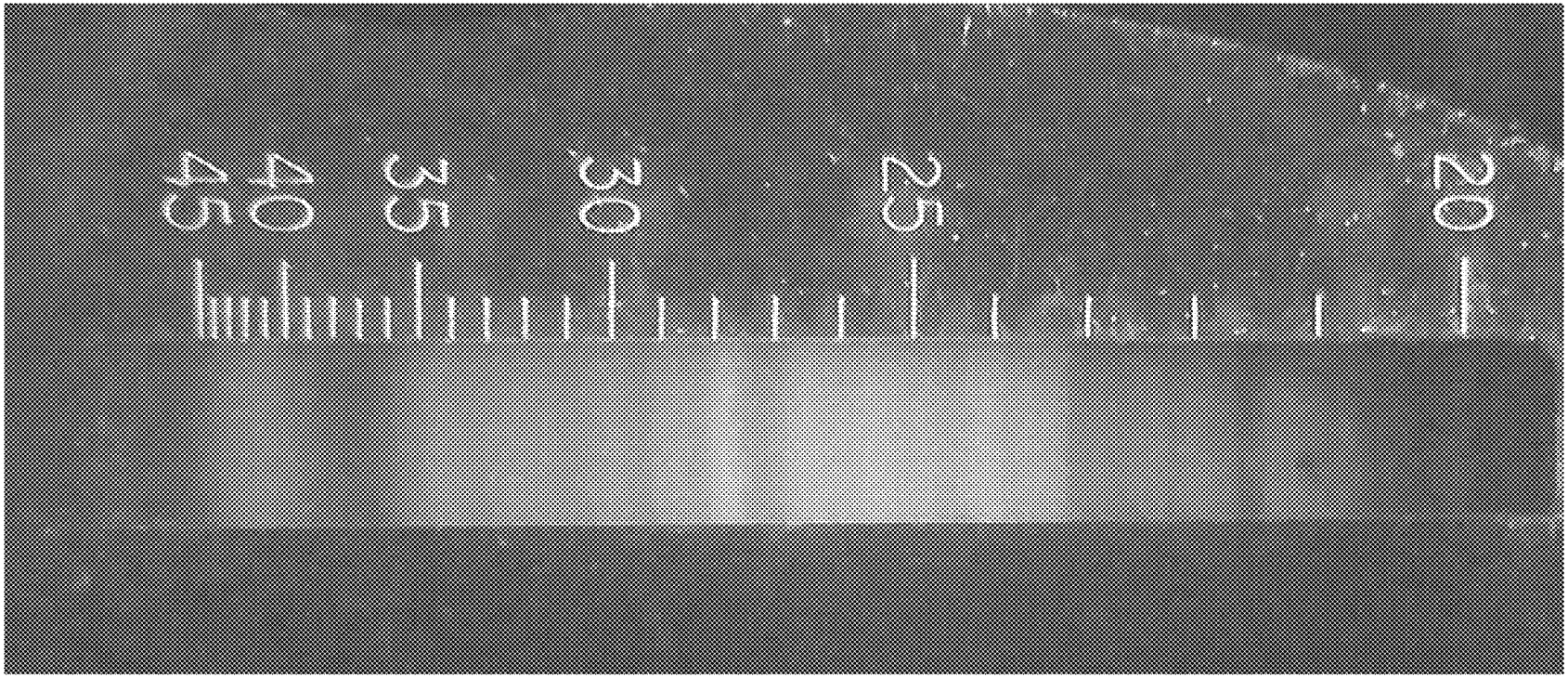

FIG. 50 shows the spectral lines produced from hafnium to Muonionalusta.

Figure 51:
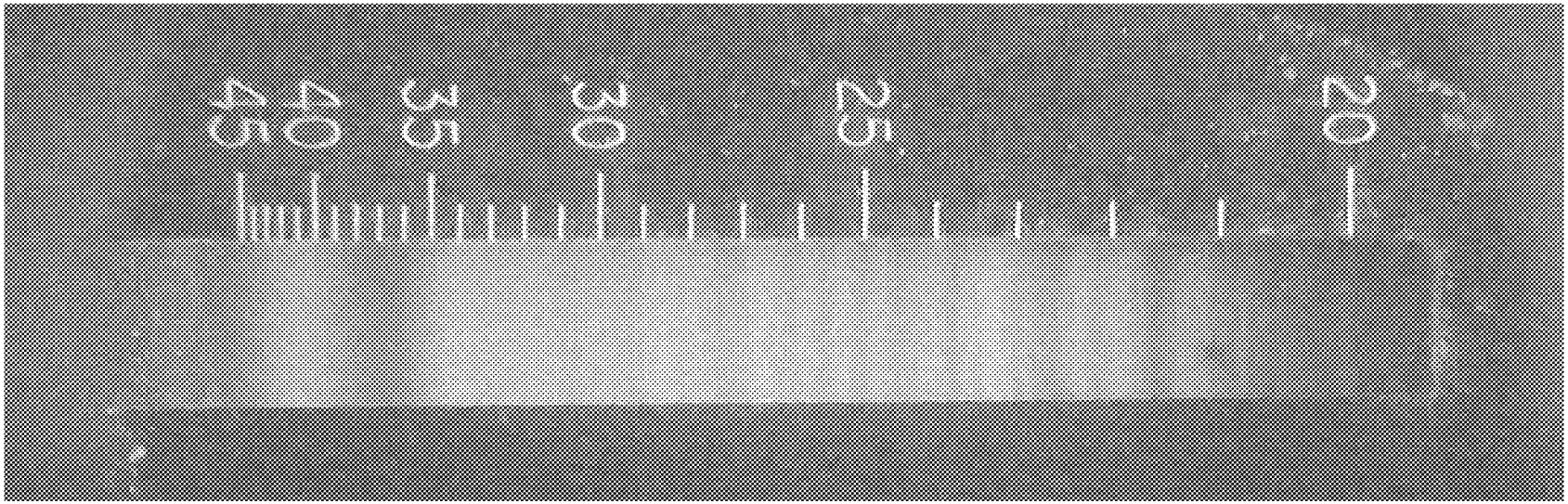

FIG. 51 shows the spectral lines produced from hafnium to nickel.

Figure 52:
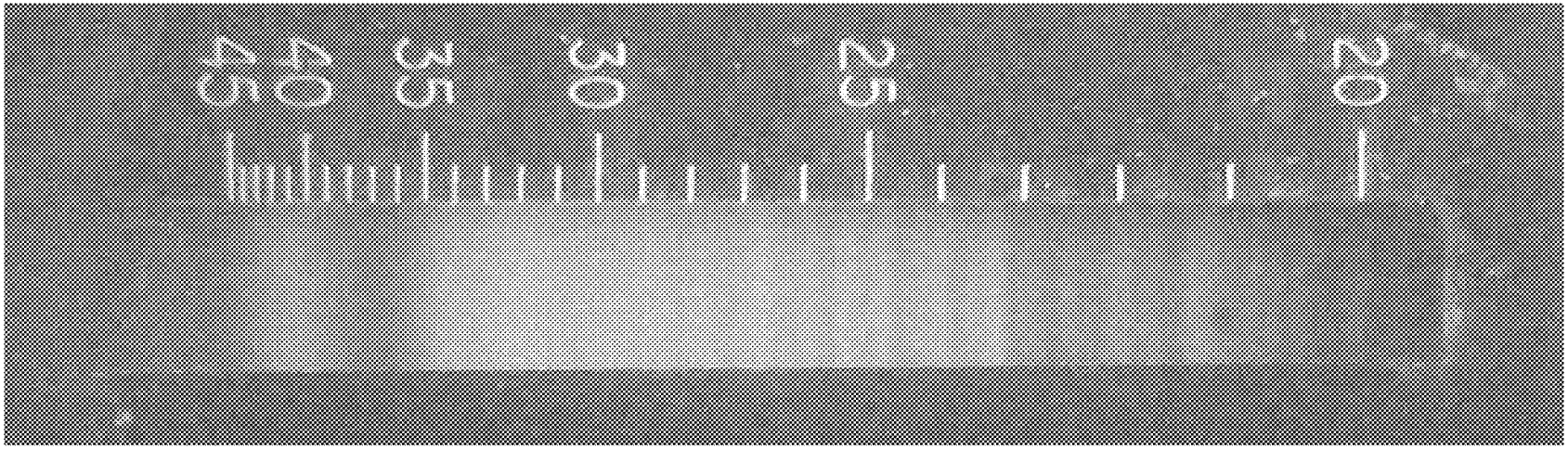

FIG. 52 shows the spectral lines produced from hafnium to niobium.

Figure 53:
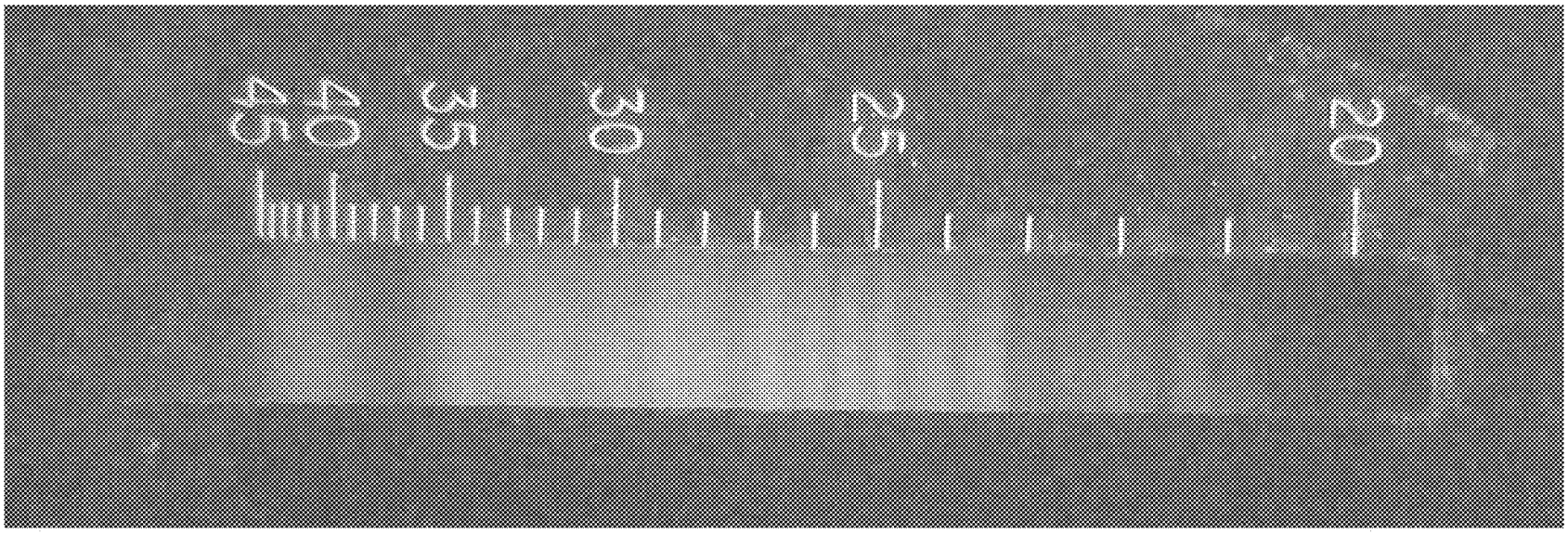

FIG. 53 shows the spectral lines produced from hafnium to rhenium.

Figure 54:
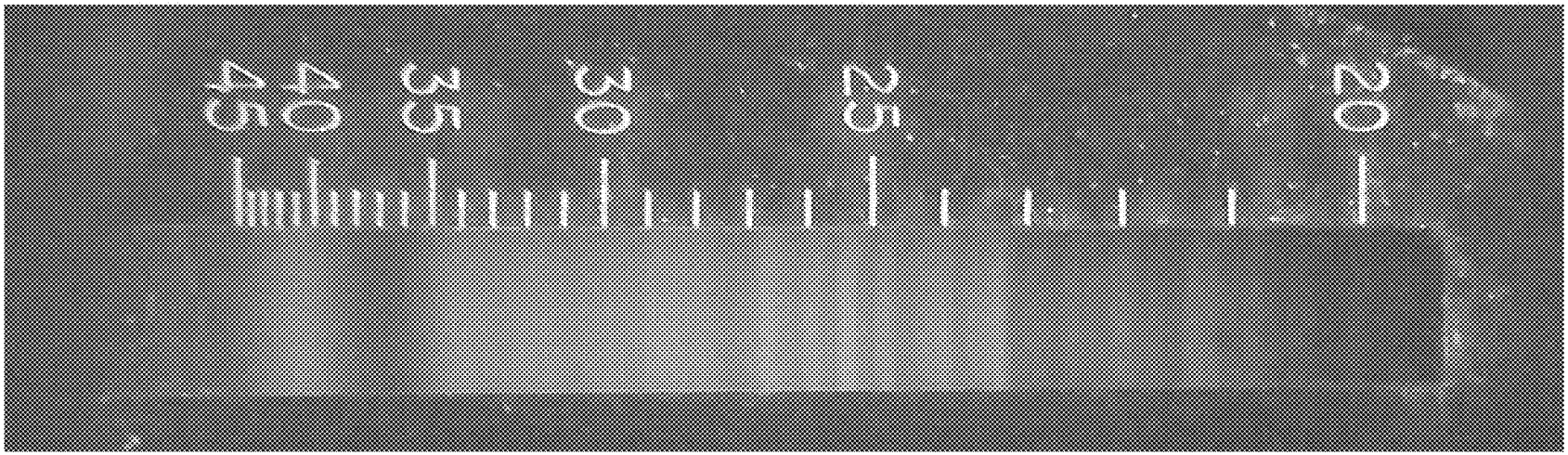

FIG. 54 shows the spectral lines produced from hafnium to silicon.

Figure 55:
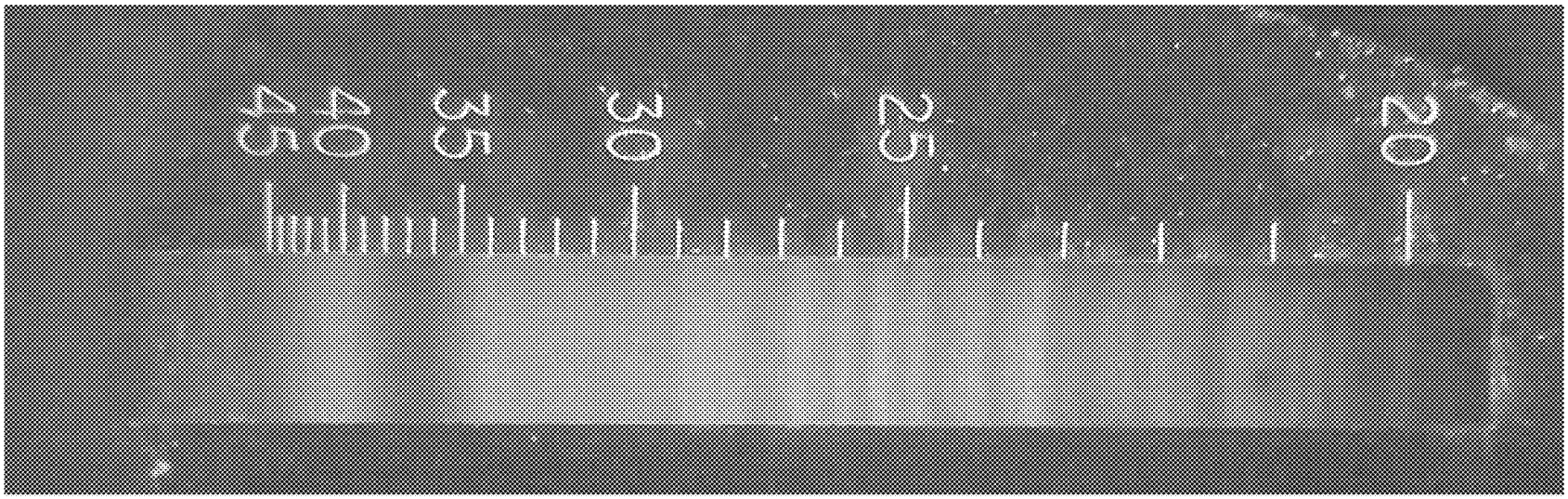

FIG. 55 shows the spectral lines produced from hafnium to tungsten.

Figure 56:
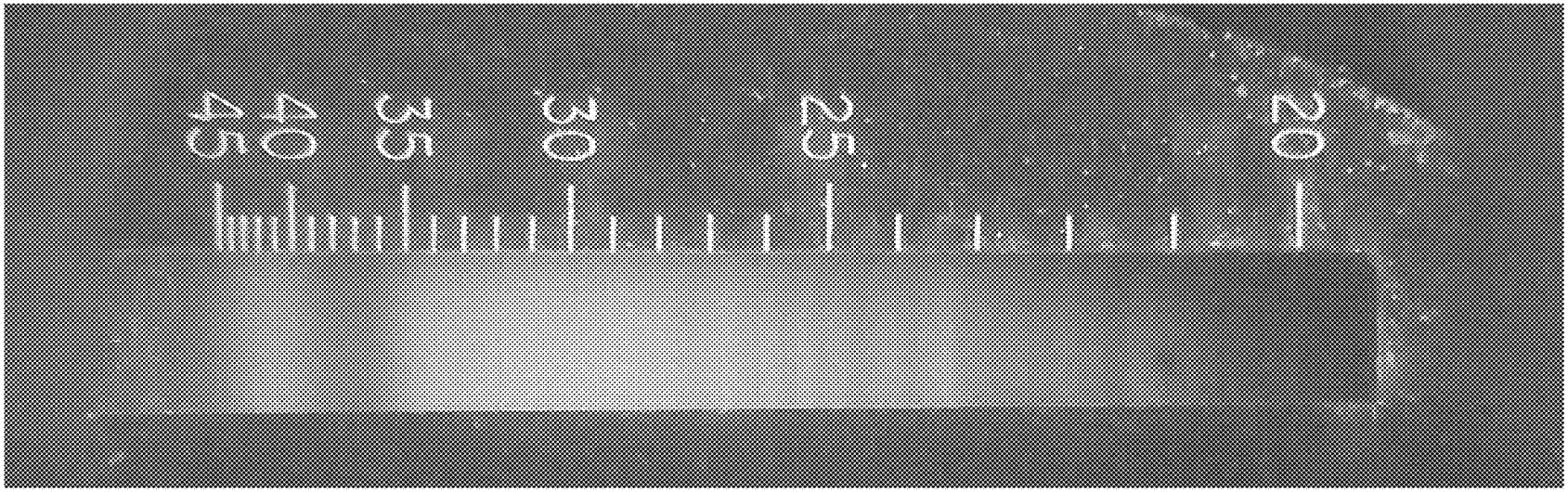

FIG. 56 shows the spectral lines produced from hafnium to uranium.

Figure 57:
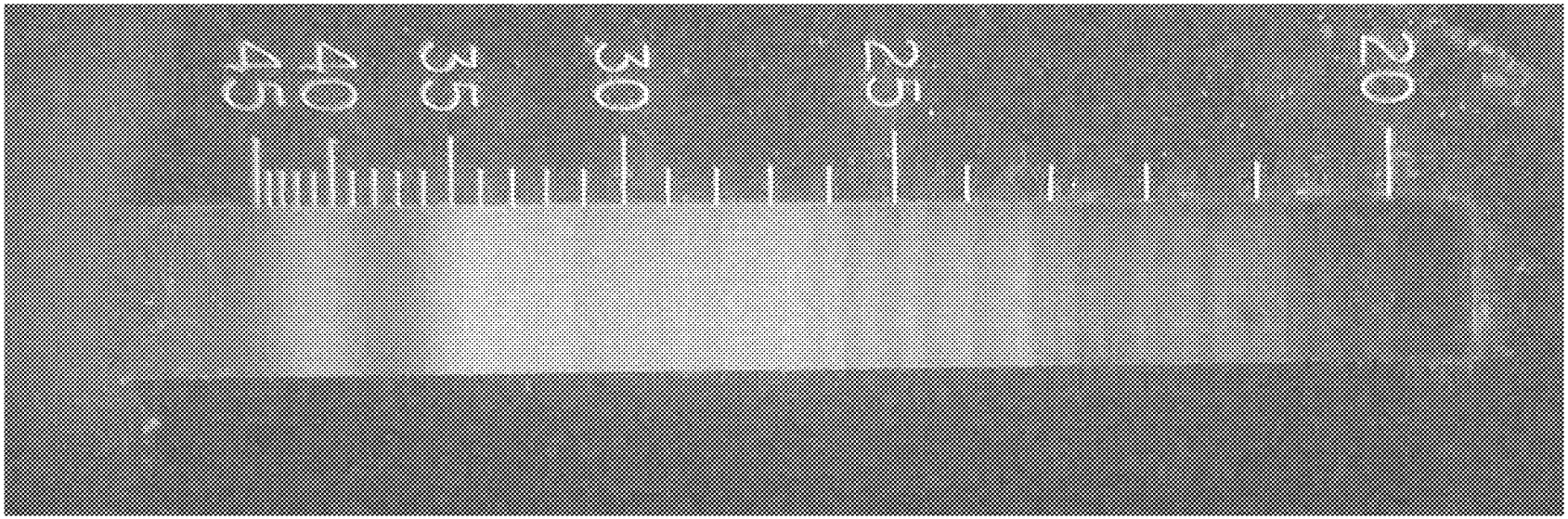

FIG. 57 shows the spectral lines produced from hafnium to zirconium.

Figure 58:
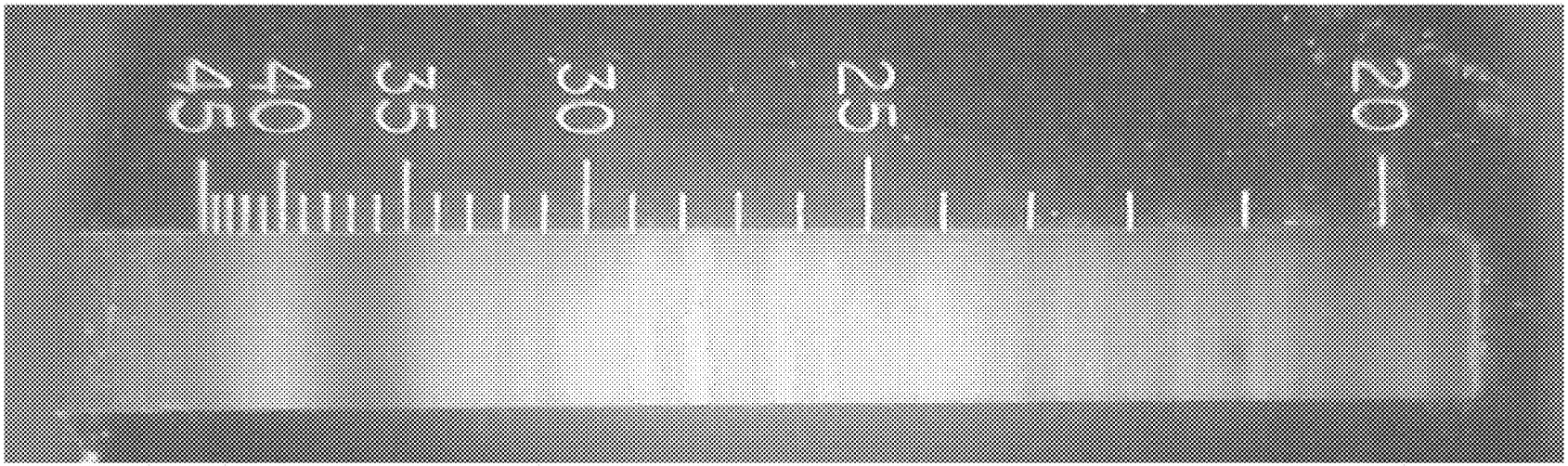

FIG. 58 shows the spectral lines produced from indium to 304 stainless steel.

Figure 59:
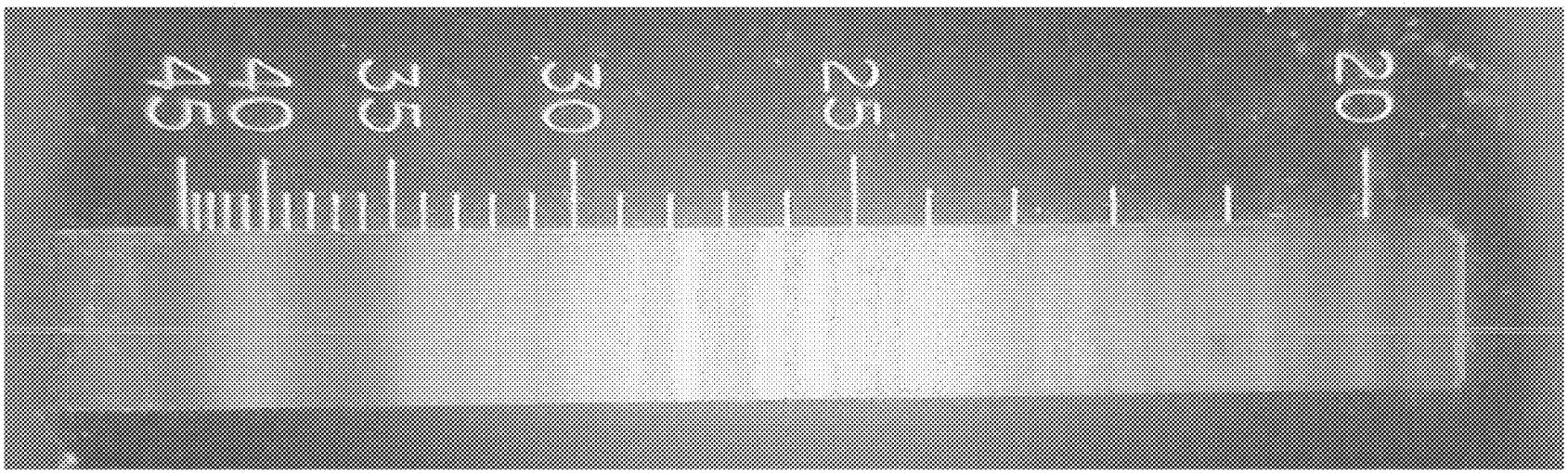

FIG. 59 shows the spectral lines produced from iron to 304 stainless steel.

Figure 60:
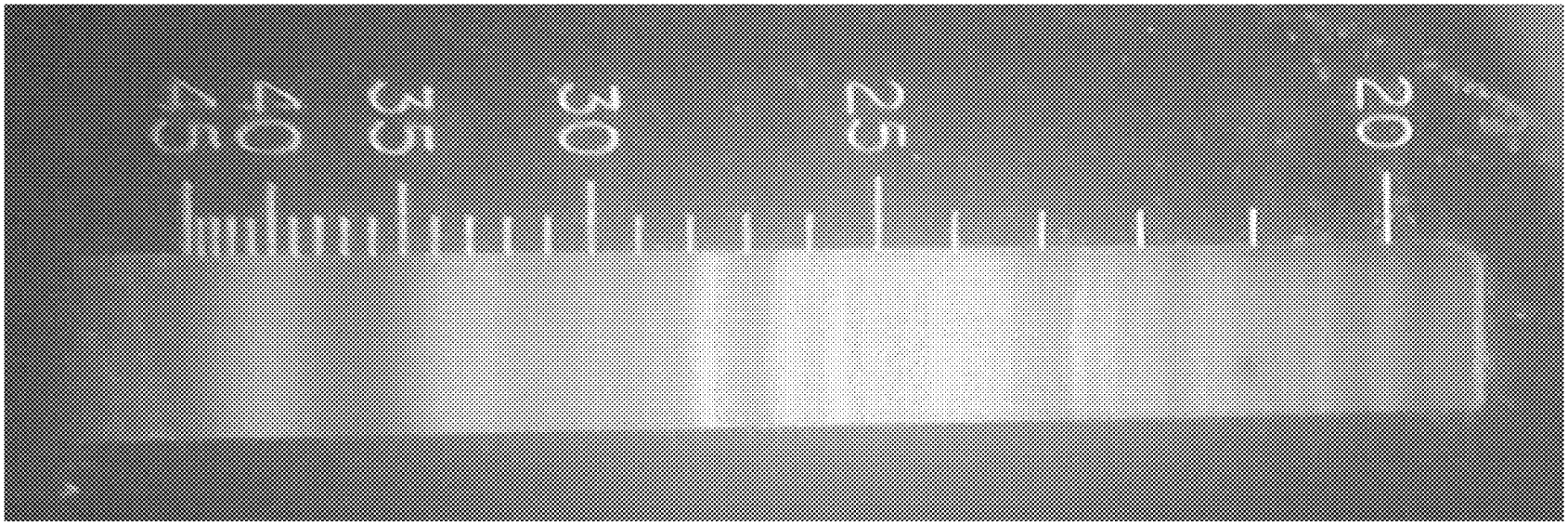

FIG. 60 shows the spectral lines produced from iron to copper nickel.

Figure 61:
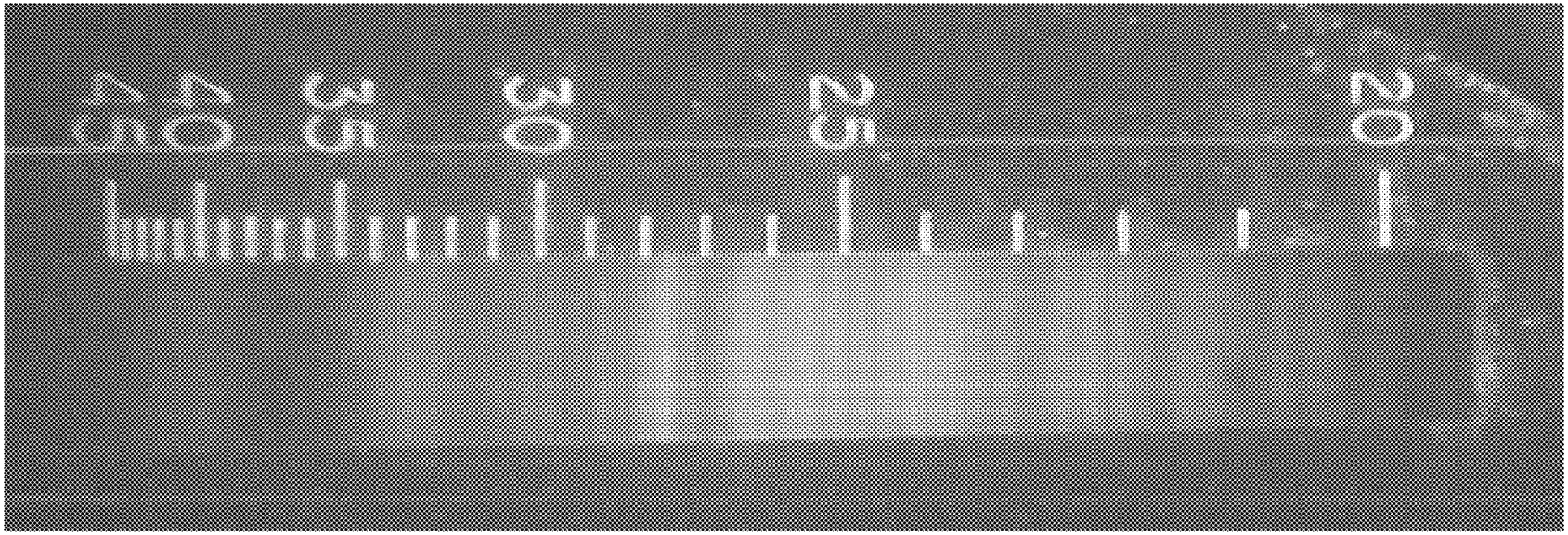

FIG. 61 shows the spectral lines produced from iron to copper tin.

Figure 62:
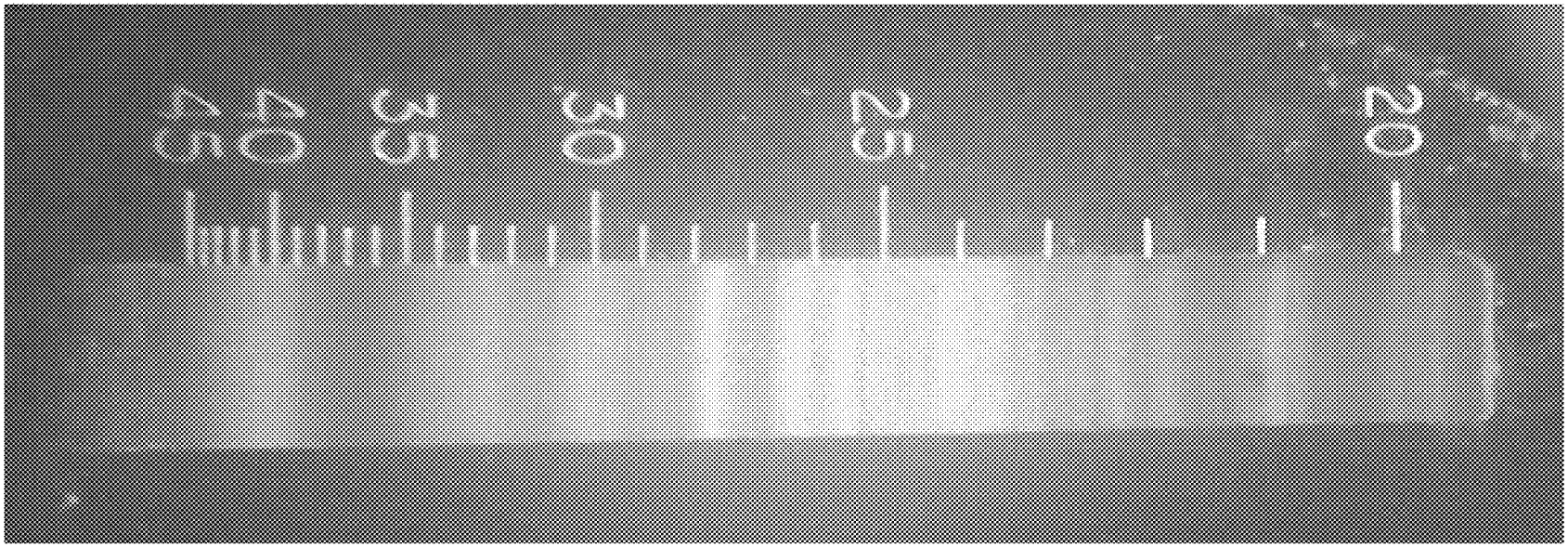

FIG. 62 shows the spectral lines produced from iron to indium.

Figure 63:
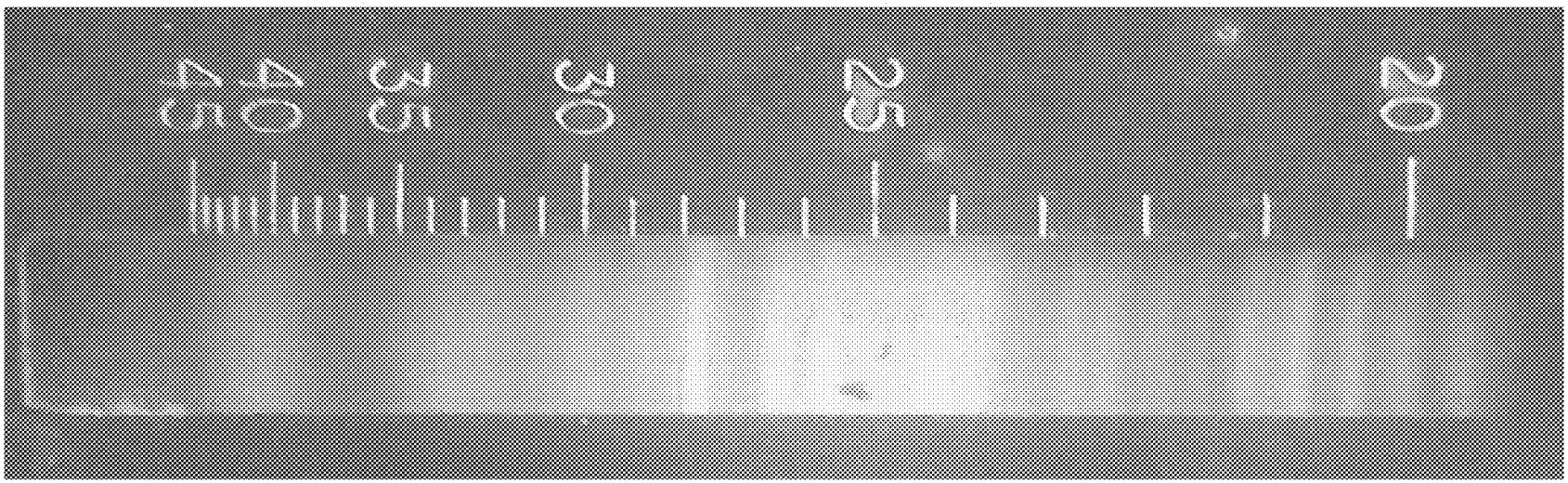

FIG. 63 shows the spectral lines produced from iron to iron.

Figure 64:
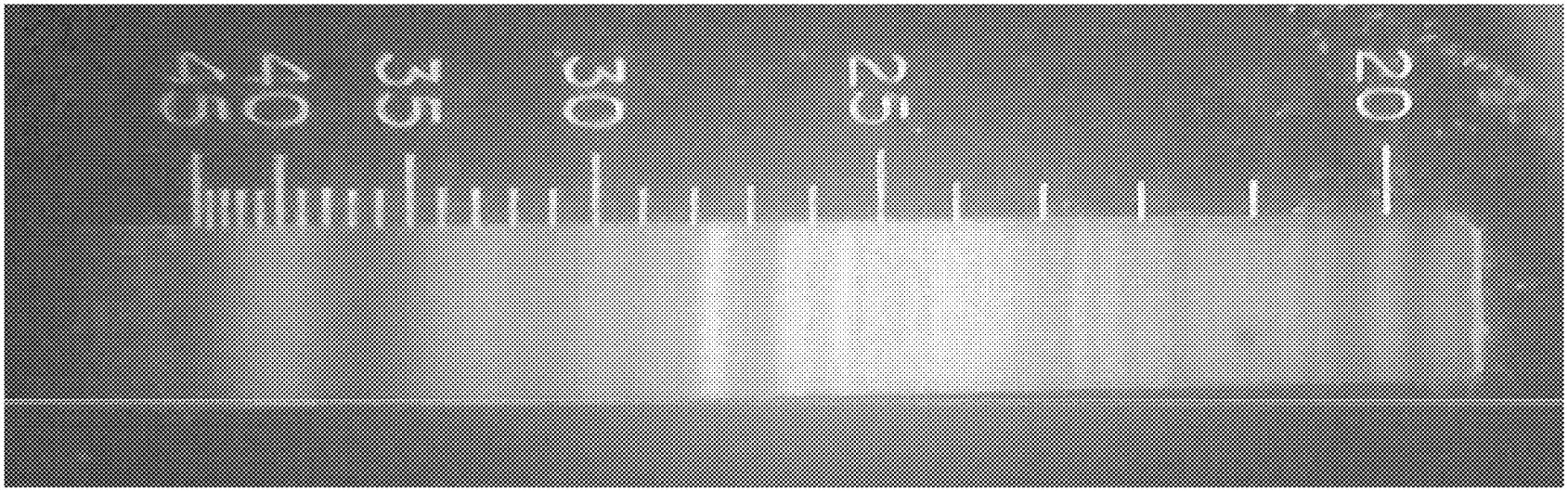

FIG. 64 shows the spectral lines produced from iron silver to copper nickel.

Figure 65:
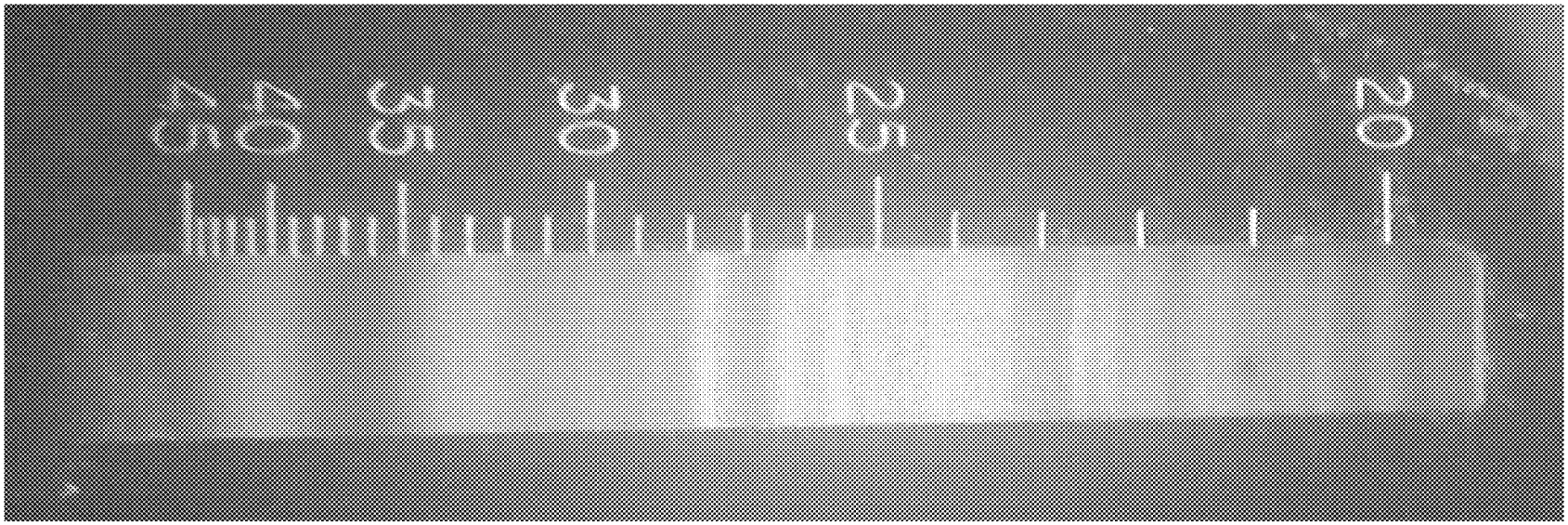

FIG. 65 shows the spectral lines produced from iron to silver copper.

Figure 66:
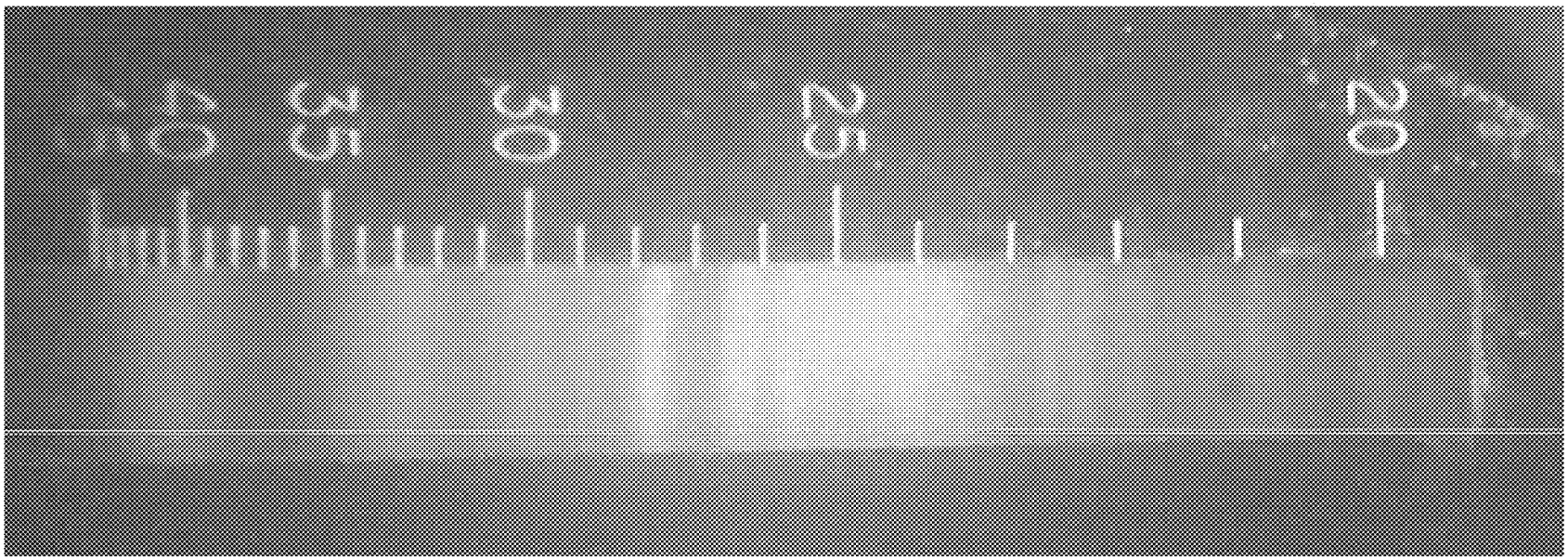

FIG. 66 shows the spectral lines produced from iron to silver indium.

Figure 67:
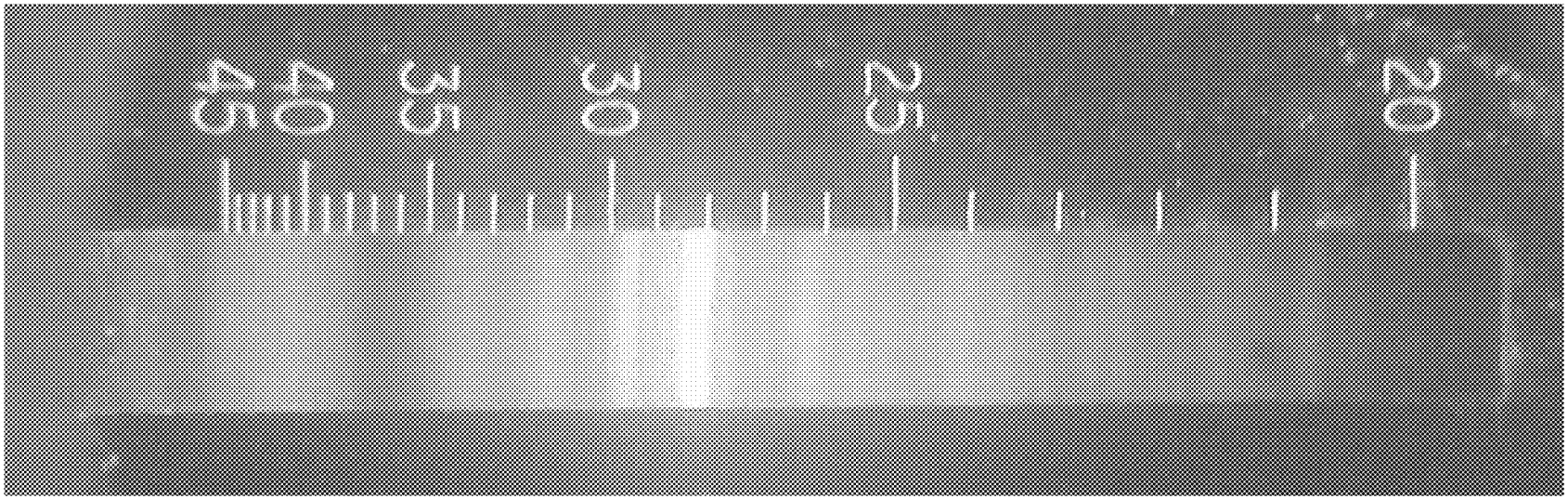

FIG. 67 shows the spectral lines produced from magnesium to 304 stainless steel.

Figure 68:
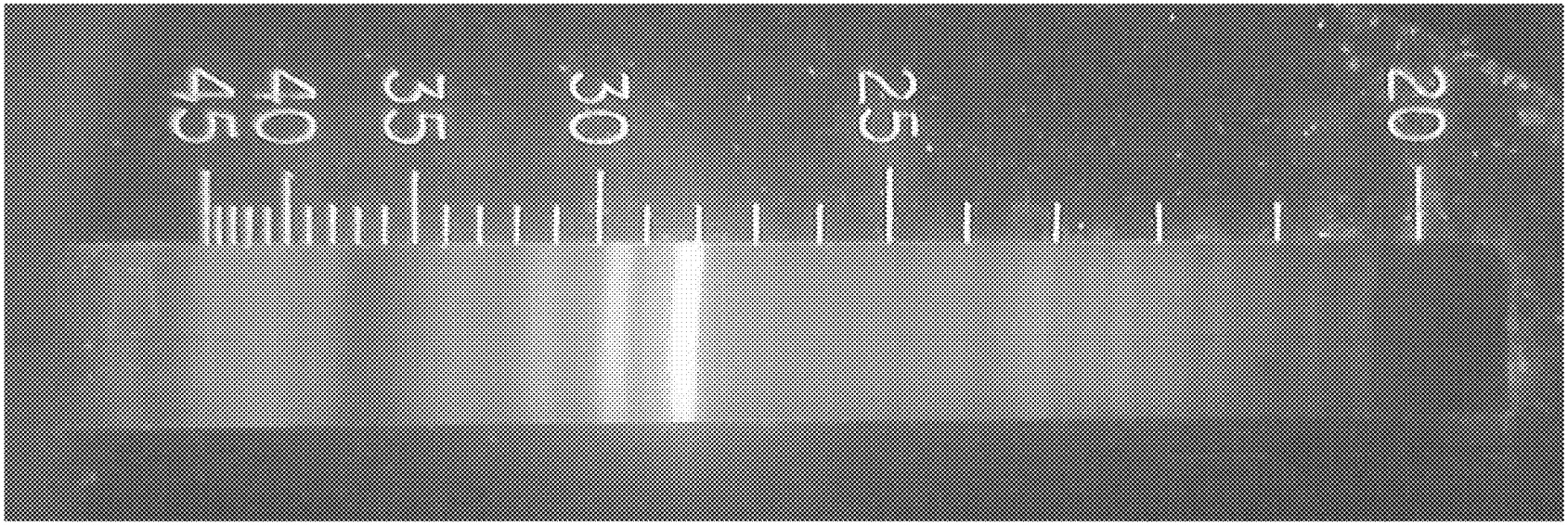

FIG. 68 shows the spectral lines produced from magnesium to 6061 aluminum.

Figure 69:
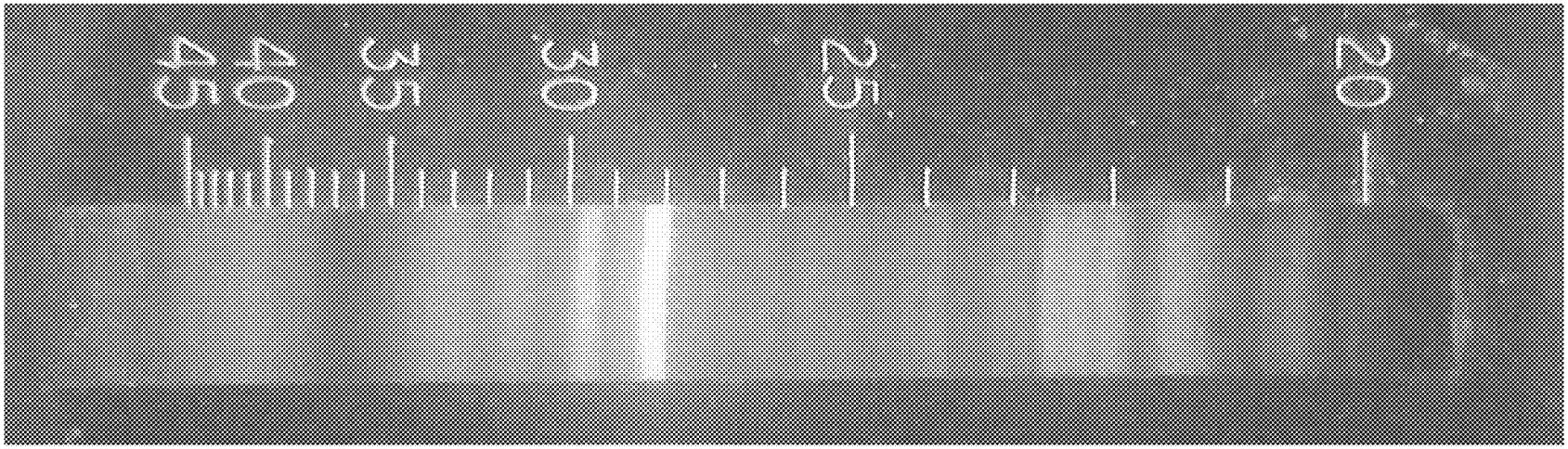

FIG. 69 shows the spectral lines produced from magnesium to copper tin.

Figure 70:
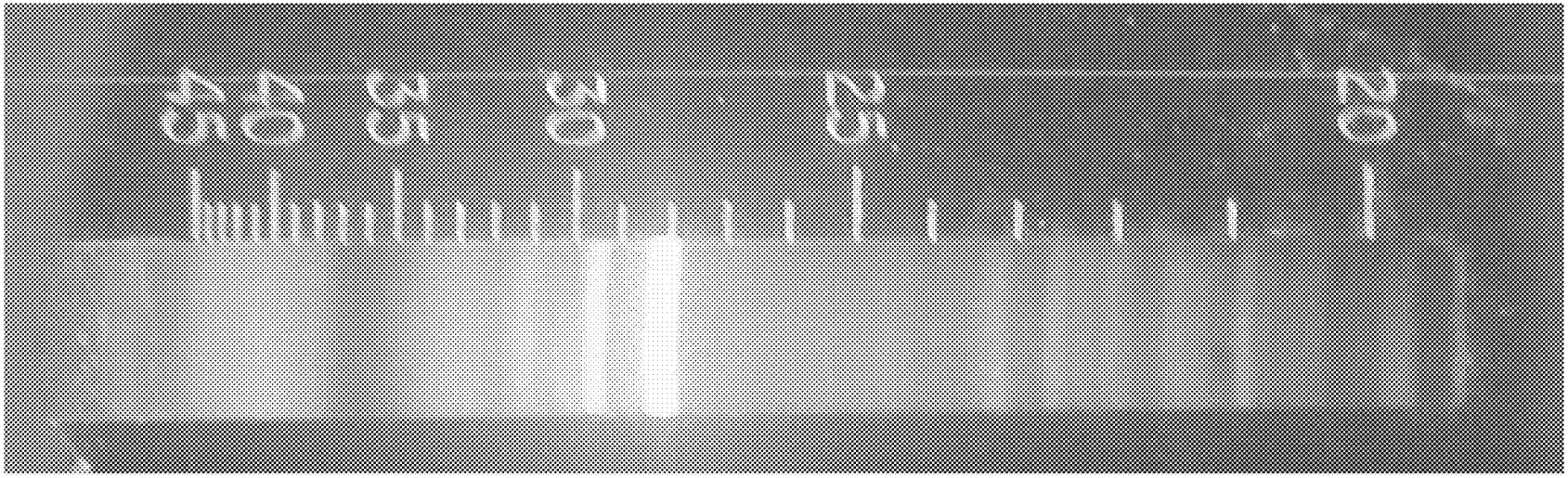

FIG. 70 shows the spectral lines produced from magnesium indium.

Figure 71:
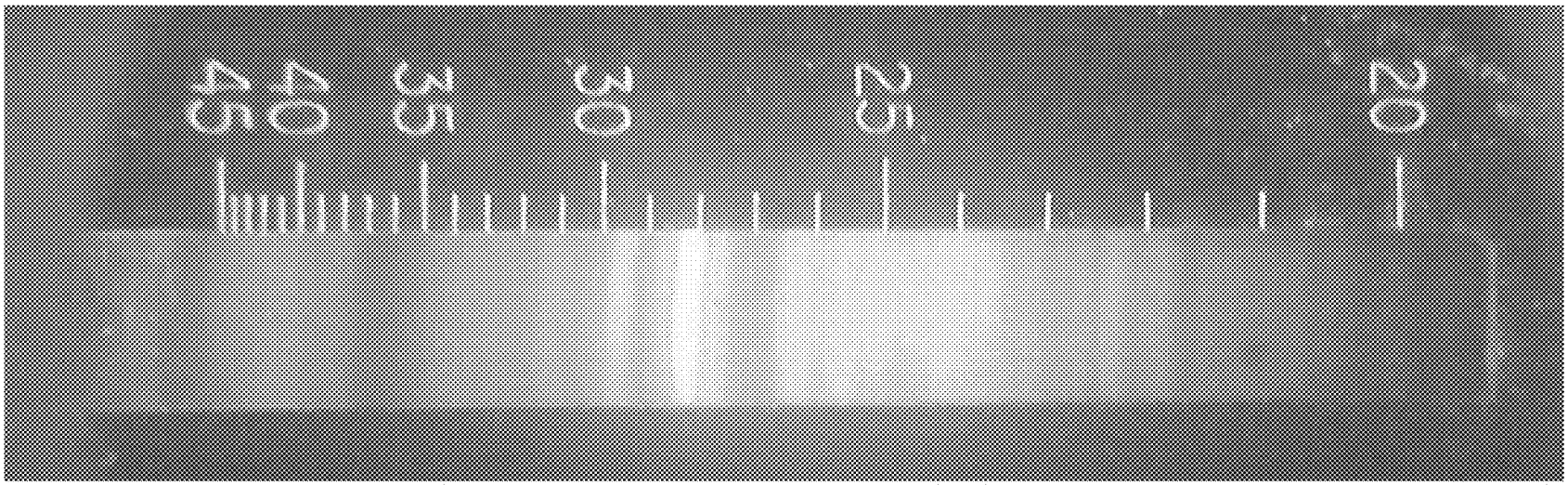

FIG. 71 shows the spectral lines produced from magnesium to iron.

Figure 72:
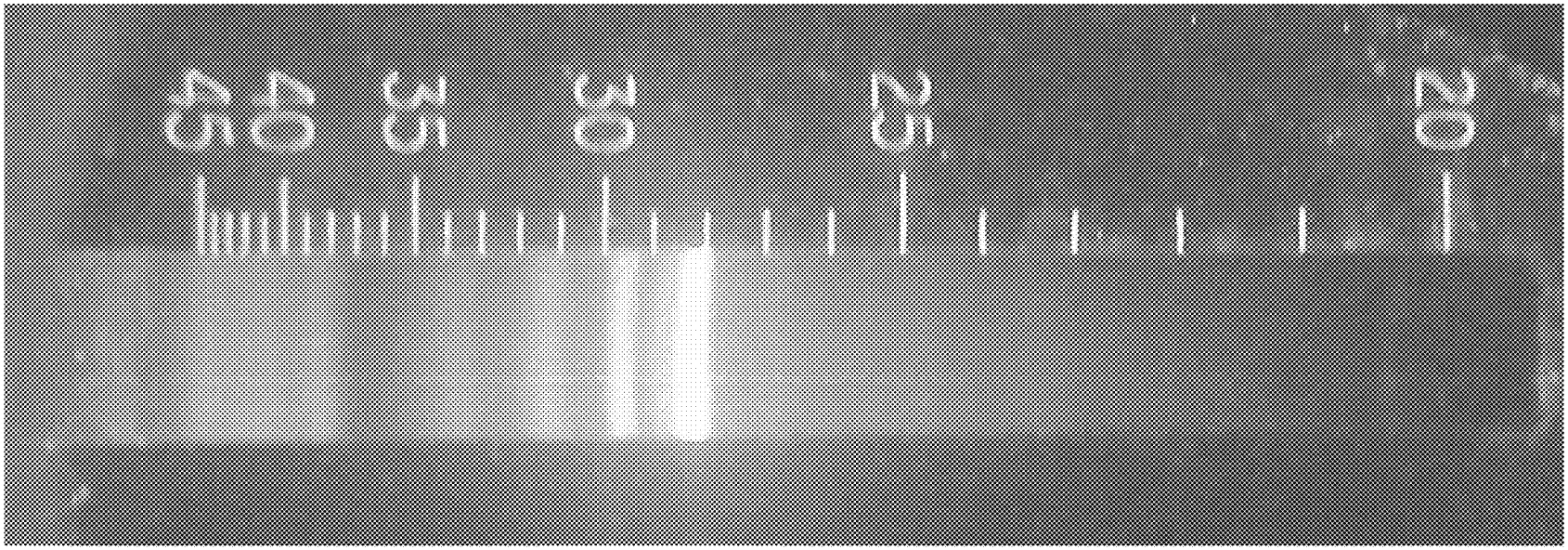

FIG. 72 shows the spectral lines produced from magnesium to magnesium.

Figure 73:
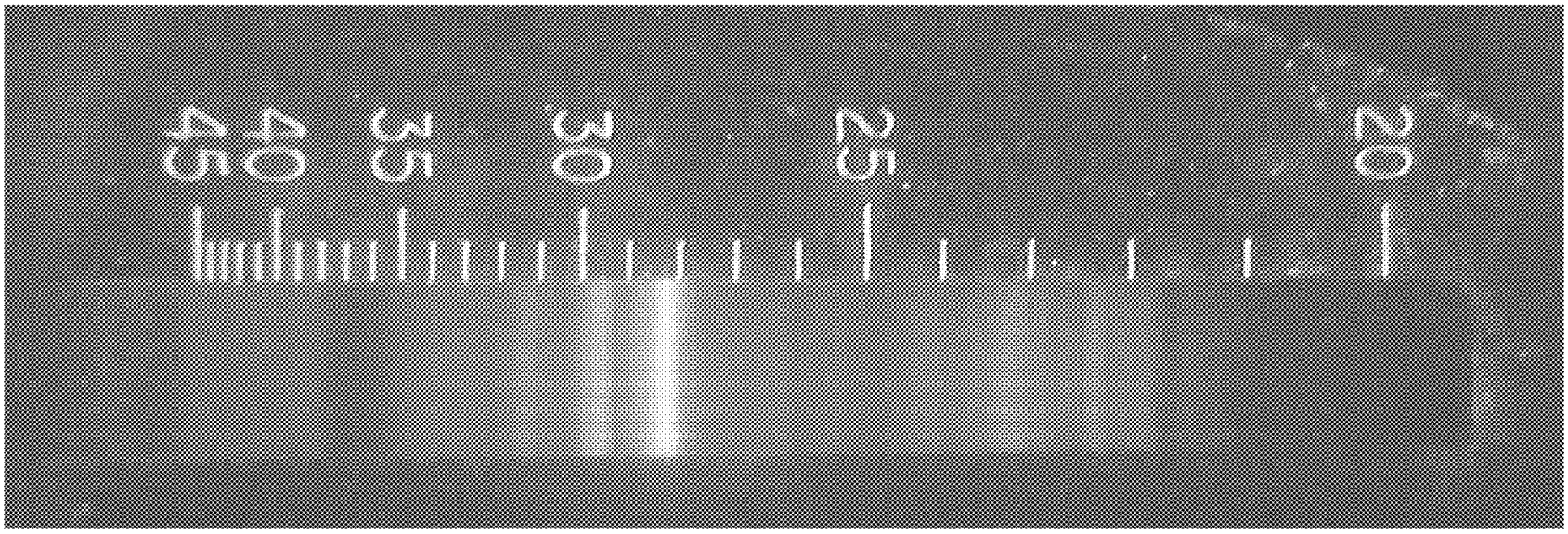

FIG. 73 shows the spectral lines produced from magnesium to nickel.

Figure 74:
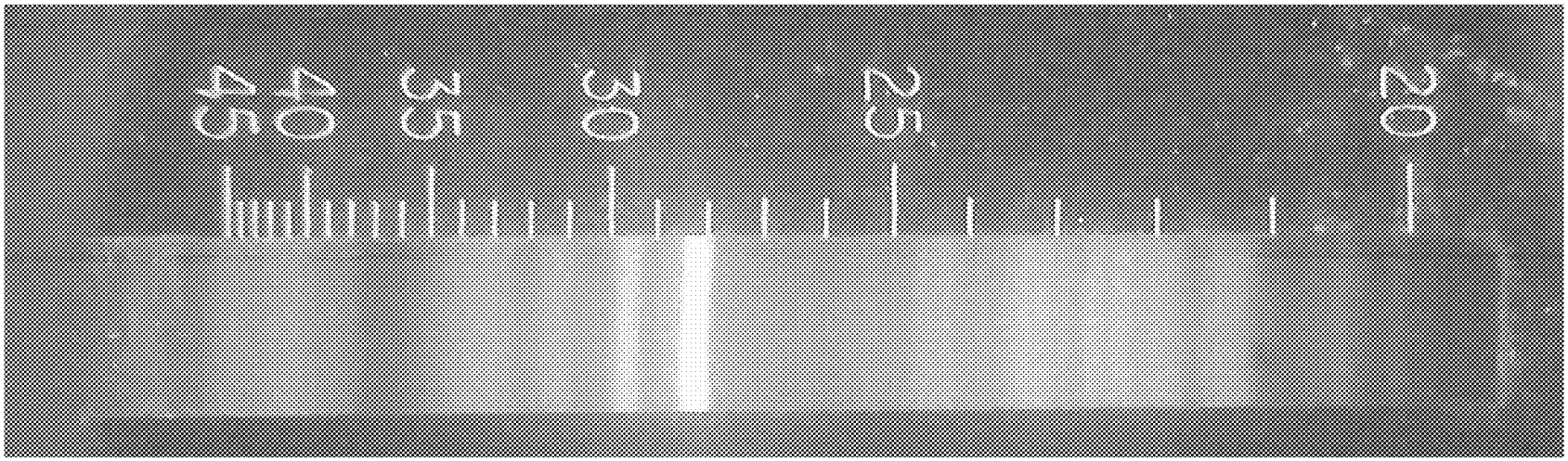

FIG. 74 shows the spectral lines produced from magnesium to silver copper nickel.

Figure 75:
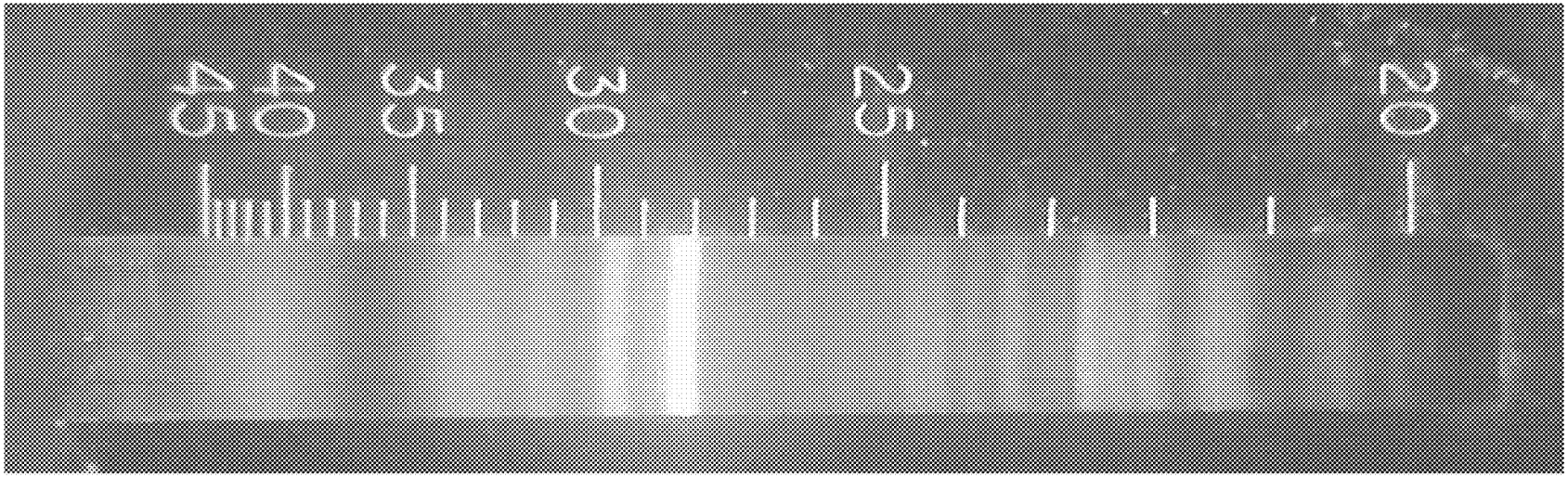

FIG. 75 shows the spectral lines produced from magnesium to silver copper.

Figure 76:
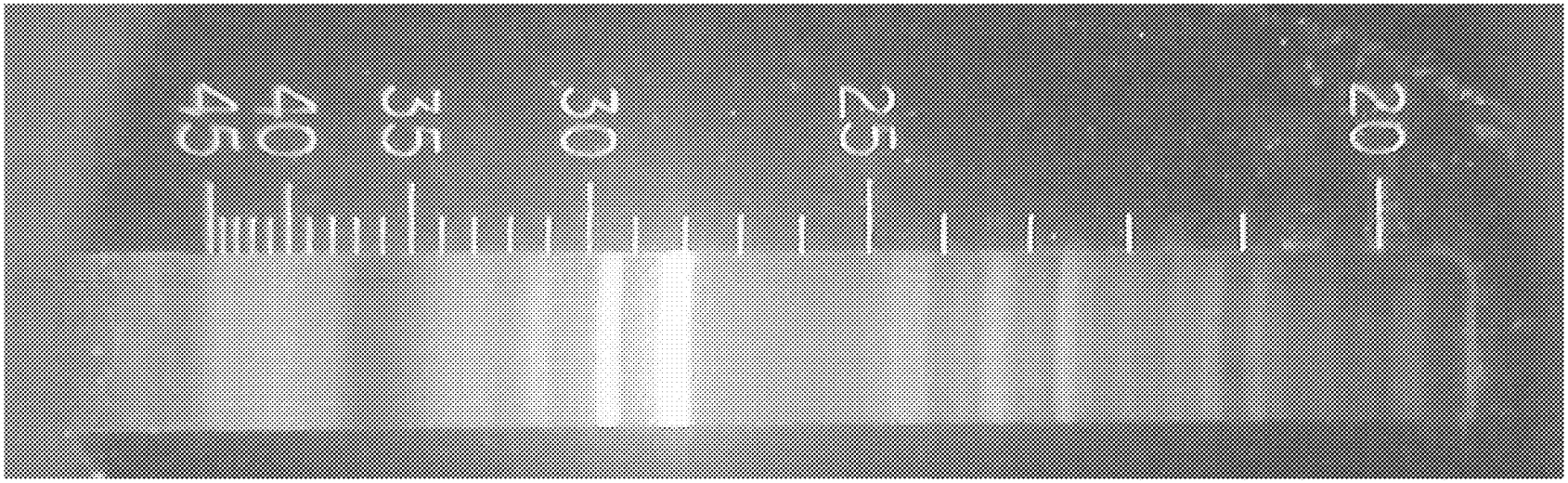

FIG. 76 shows the spectral lines produced from magnesium to silver indium.

Figure 77:
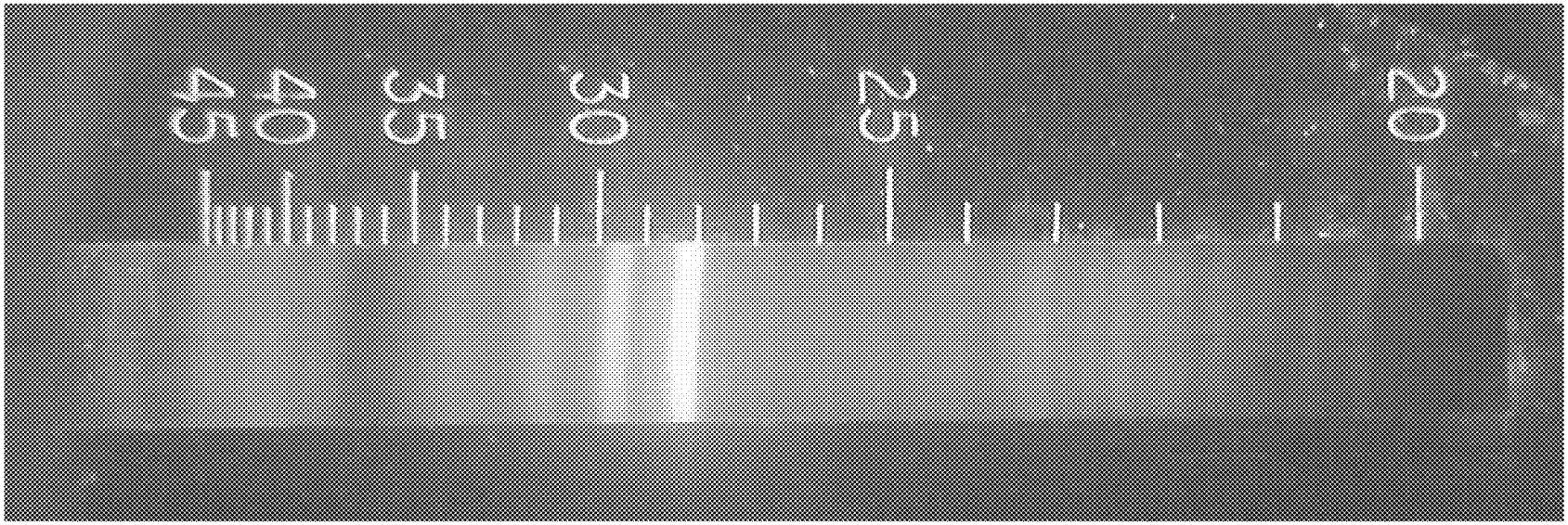

FIG. 77 shows the spectral lines produced from magnesium to tungsten.

Figure 78:
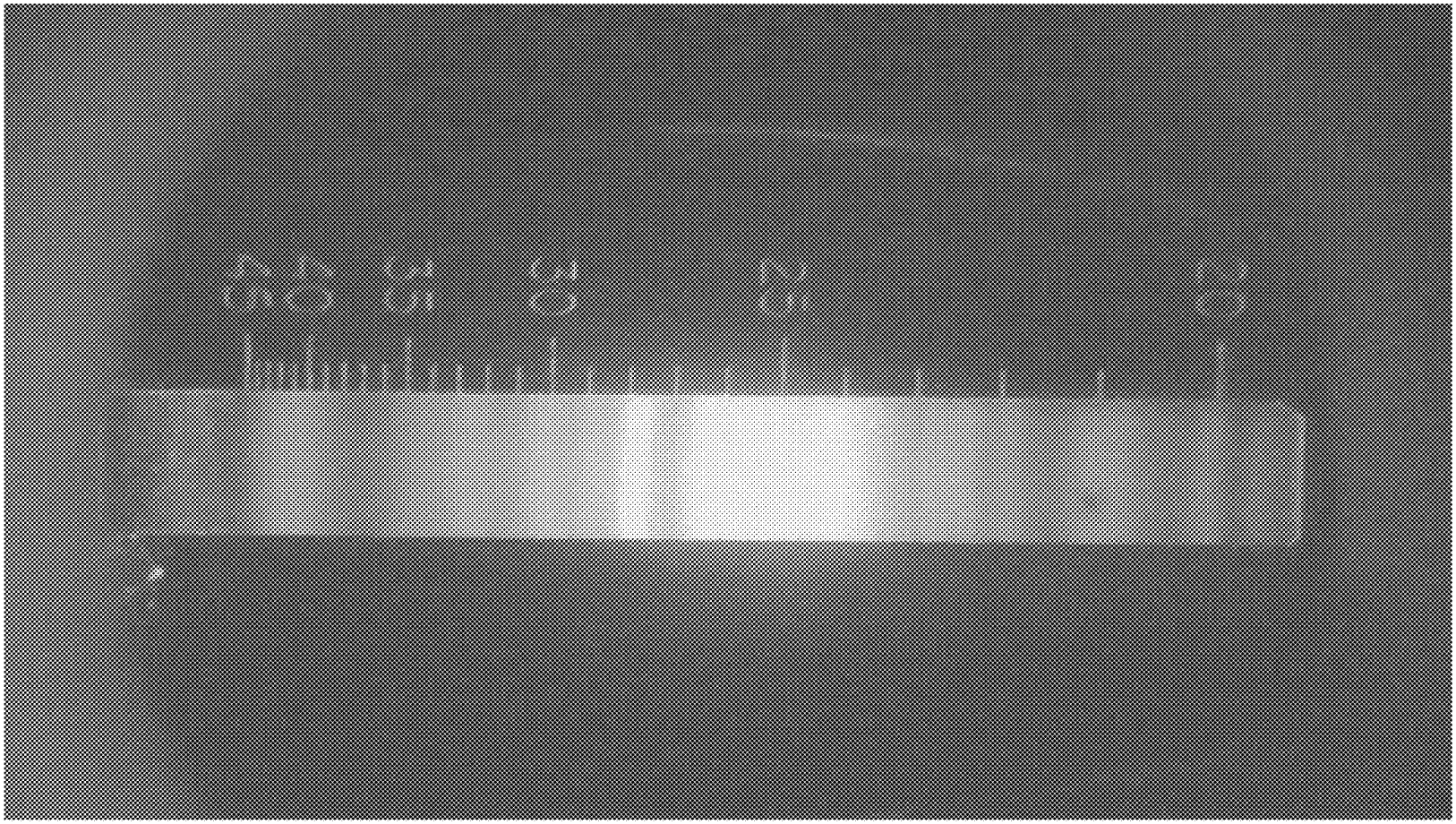

FIG. 78 shows the spectral lines produced from replica Muonionalusta alloy.

Figure 79:
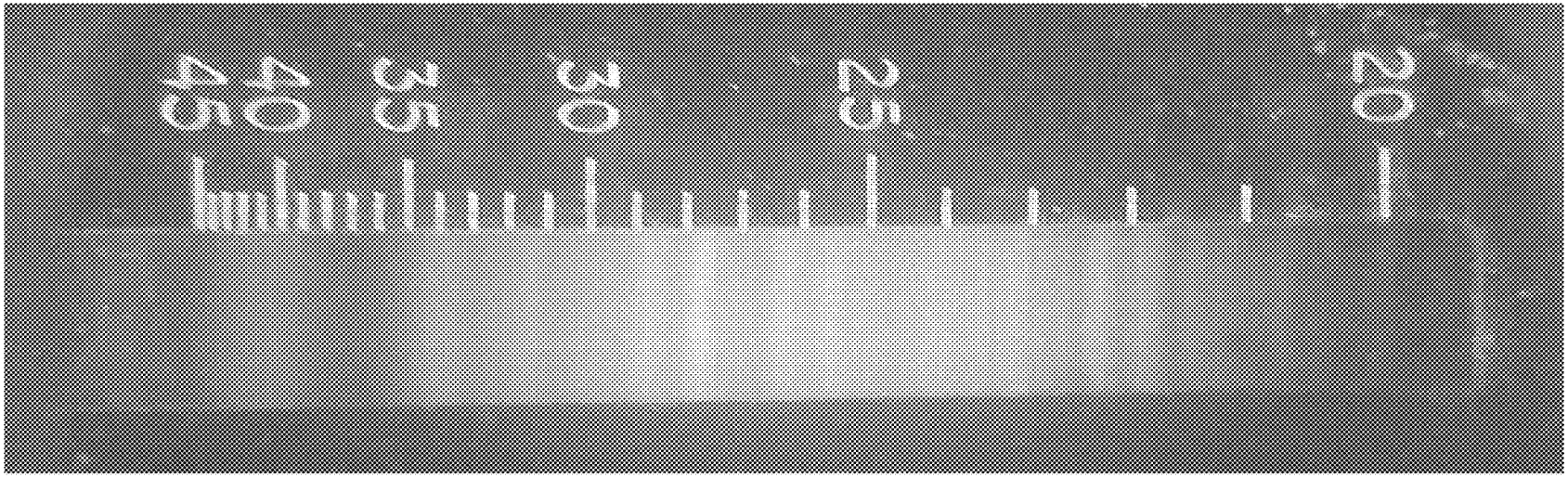

FIG. 79 shows the spectral lines produced from nickel to 304 stainless steel.

Figure 80:
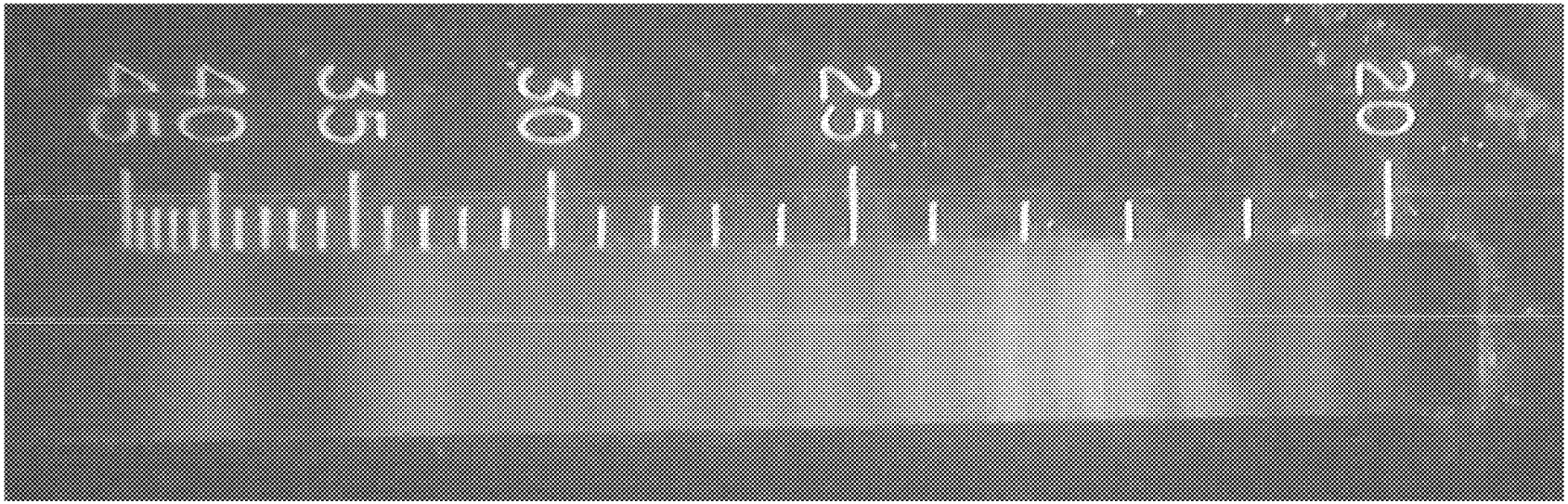

FIG. 80 shows the spectral lines produced from nickel to copper tin.

Figure 81:
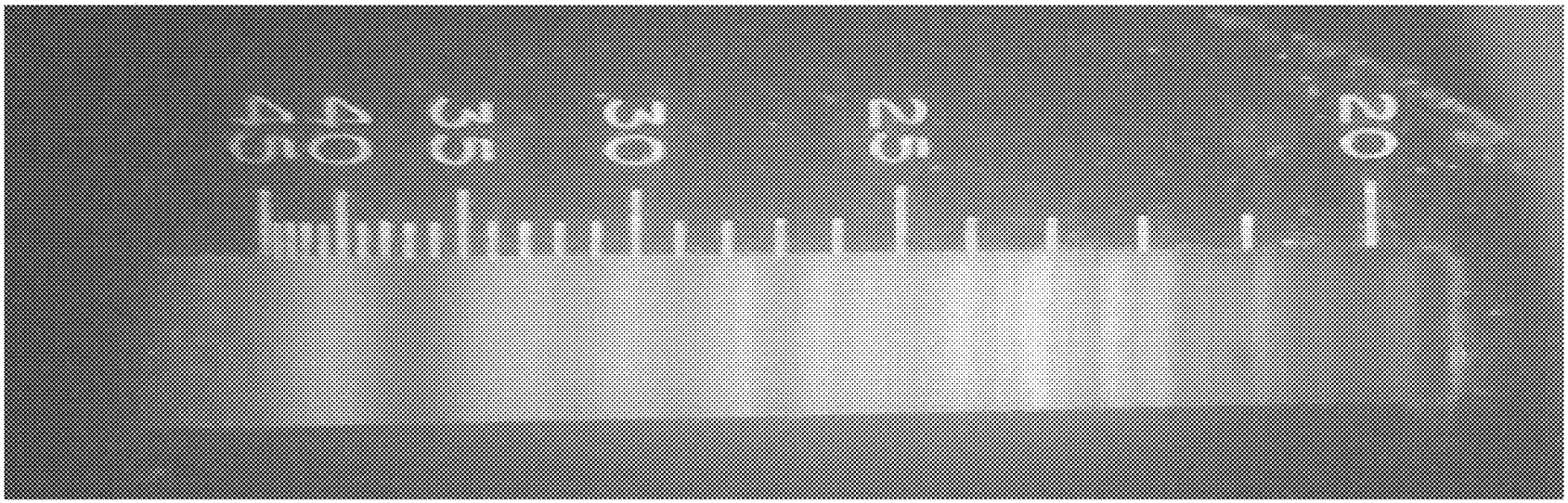

FIG. 81 shows the spectral lines produced from nickel to indium.

Figure 82:
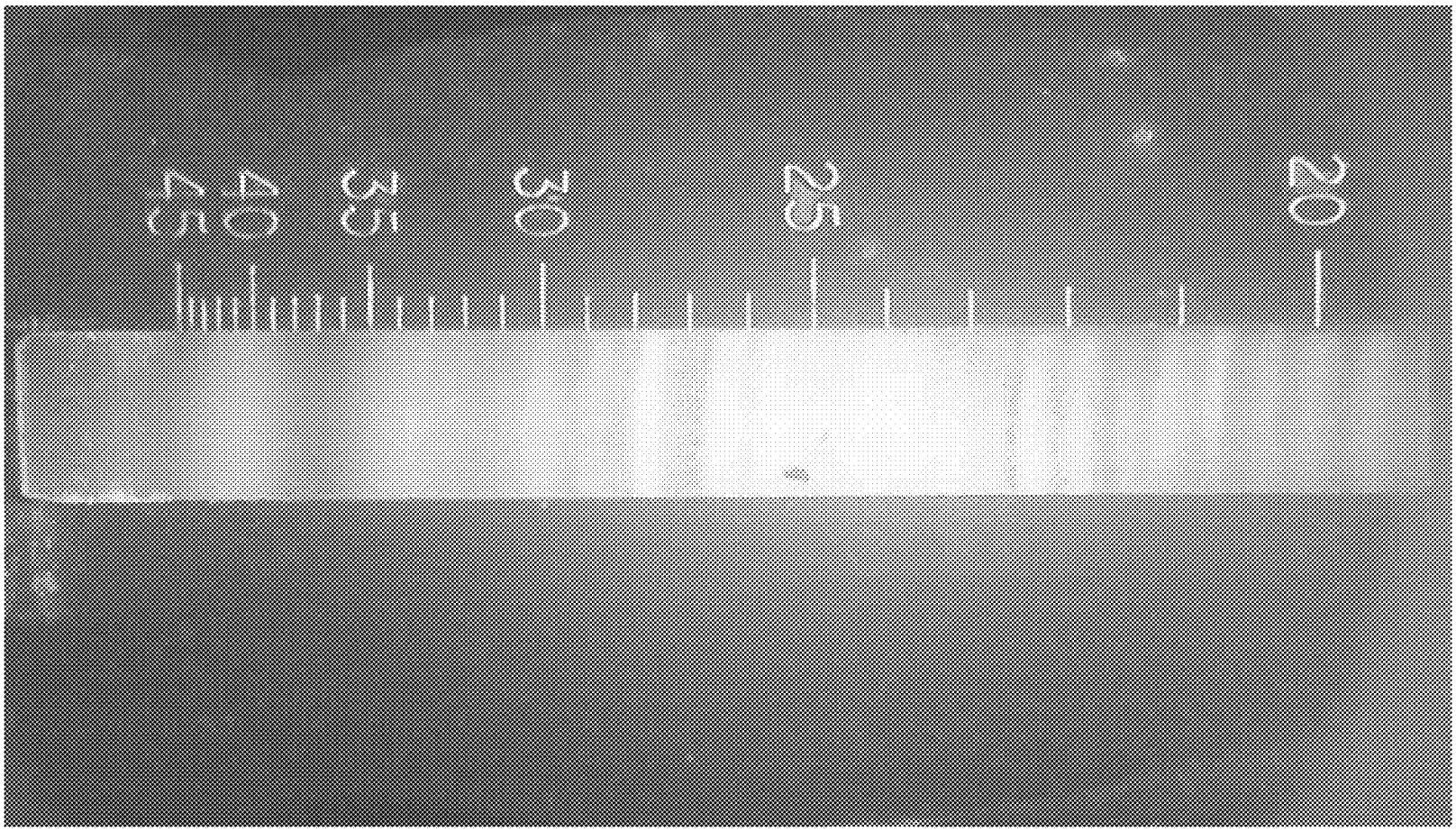

FIG. 82 shows the spectral lines produced from nickel to iron.

Figure 83:
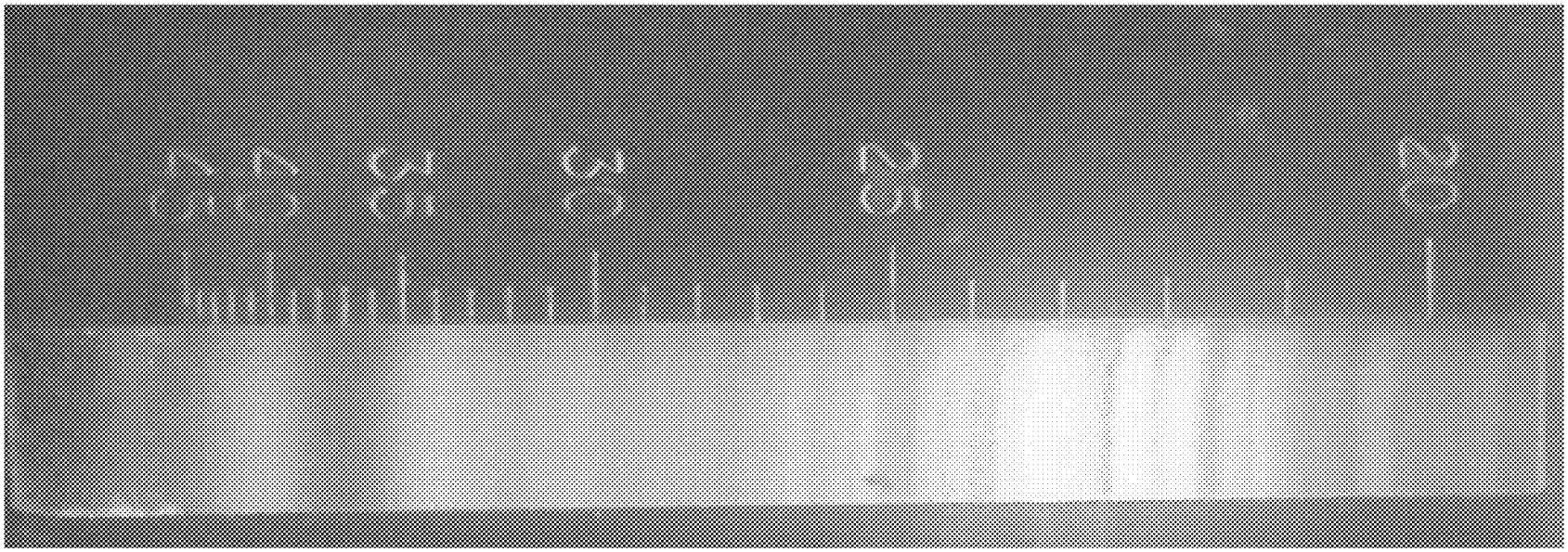

FIG. 83 shows the spectral lines produced from nickel to nickel.

Figure 84:
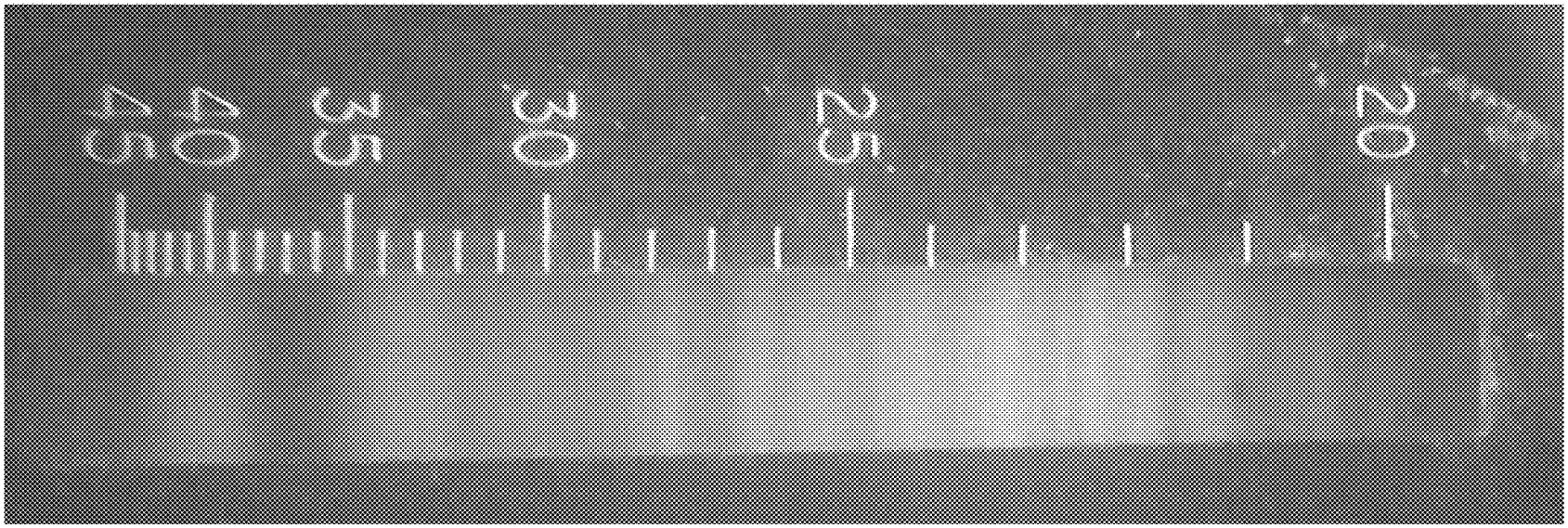

FIG. 84 shows the spectral lines produced from nickel silver to copper nickel.

Figure 85:
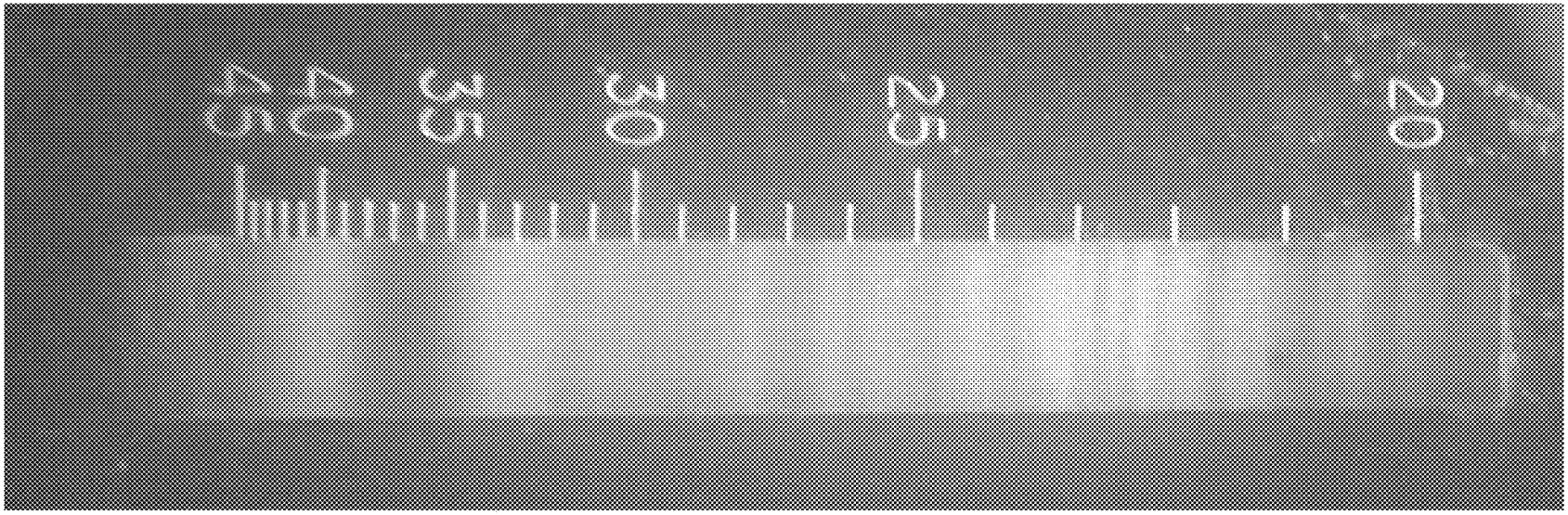

FIG. 85 shows the spectral lines produced from nickel to silver copper.

Figure 86:
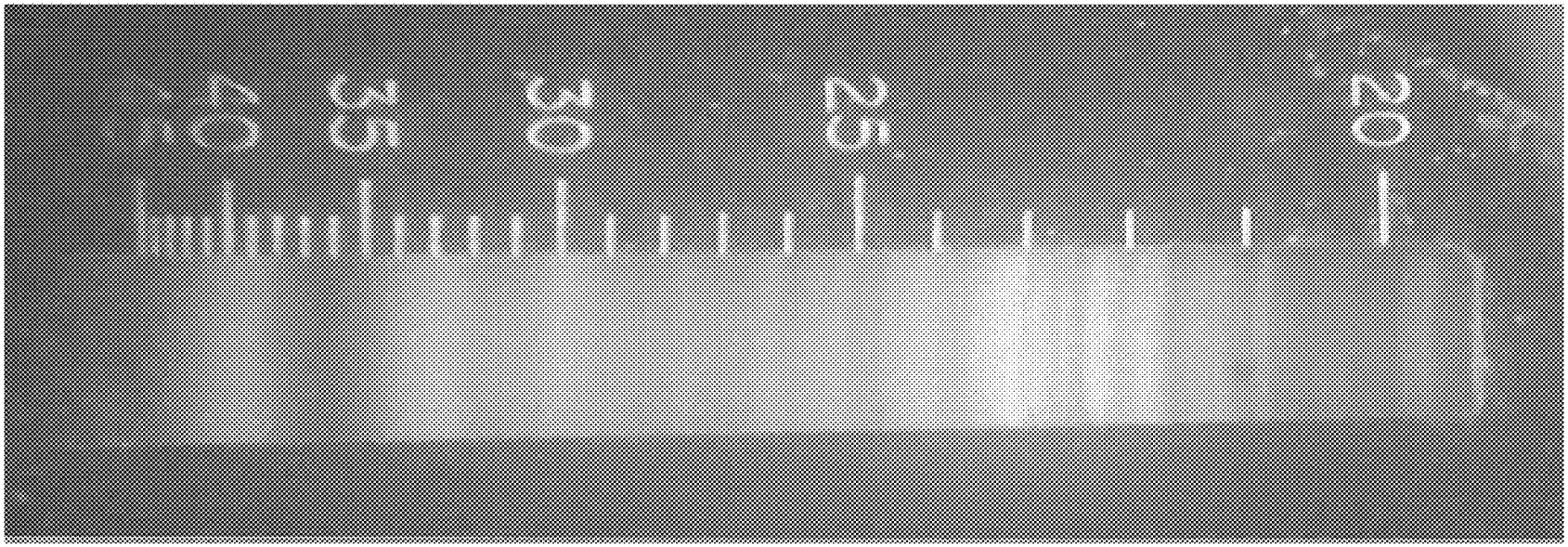

FIG. 86 shows the spectral lines produced from nickel to silver indium.

Figure 87:
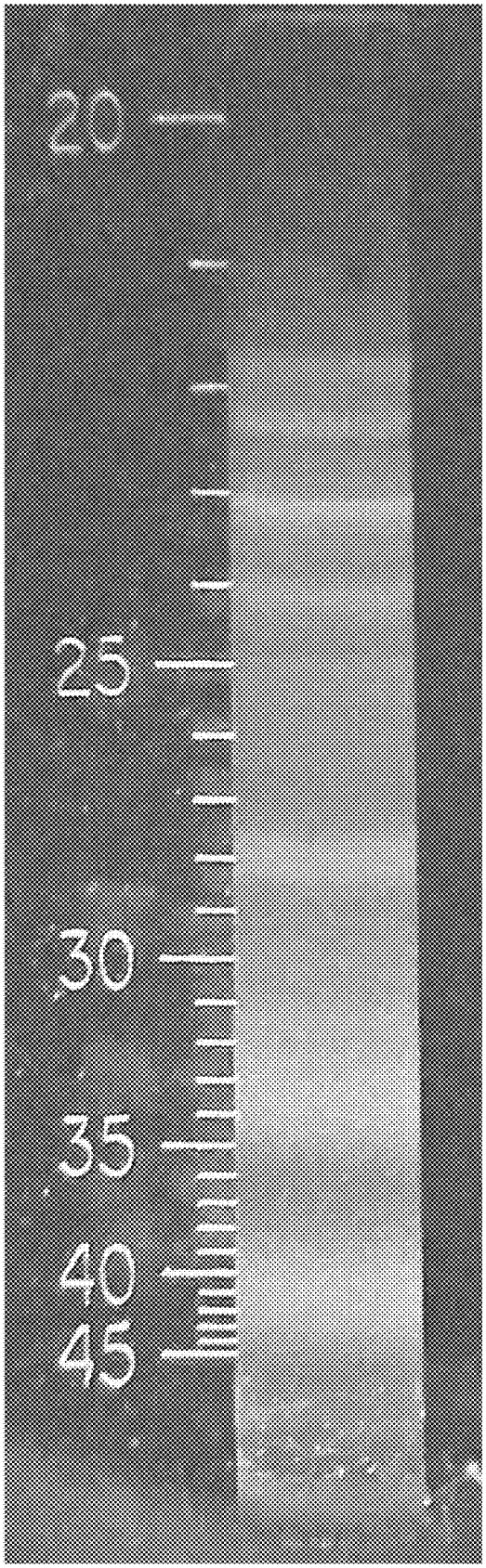

FIG. 87 shows the spectral lines produced from samarium to tungsten.

Figure 88:
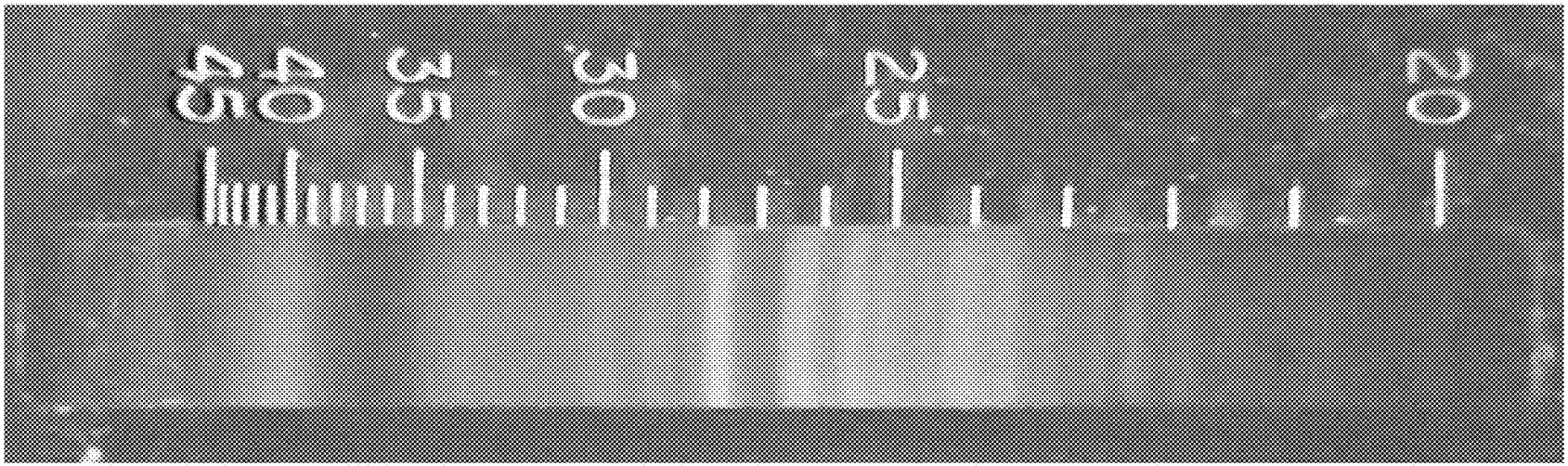

FIG. 88 shows the spectral lines produced from silicon to iron.

Figure 89:
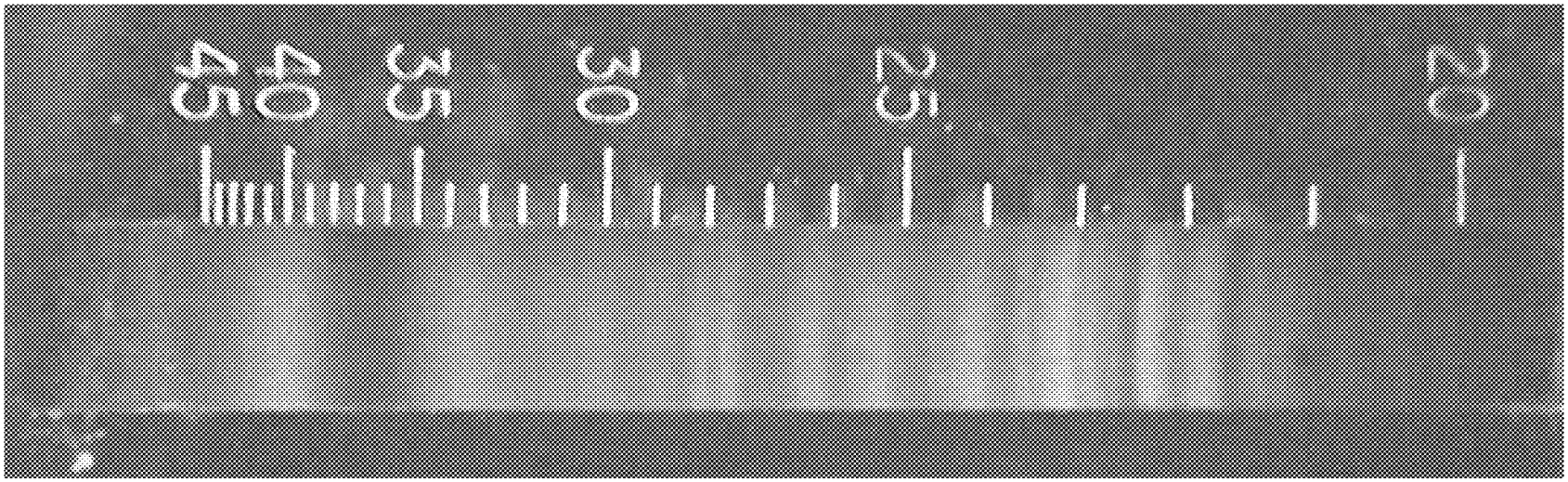

FIG. 89 shows the spectral lines produced from silicon to nickel.

Figure 90:
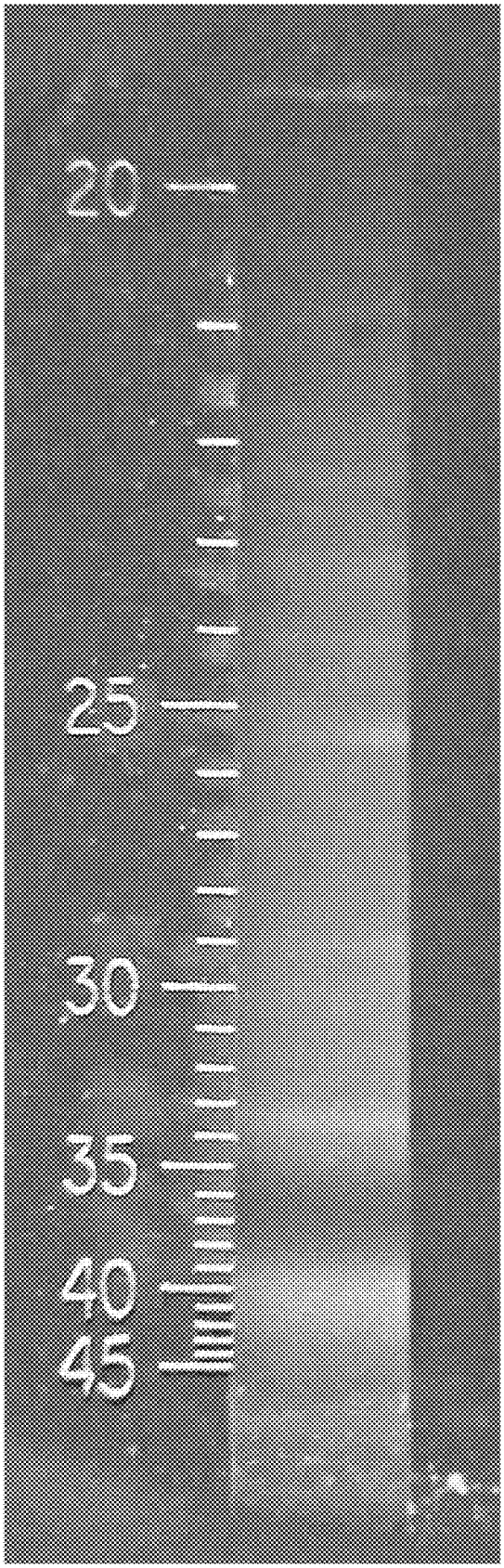

FIG. 90 shows the spectral lines produced from silicon to tungsten.

Figure 91:
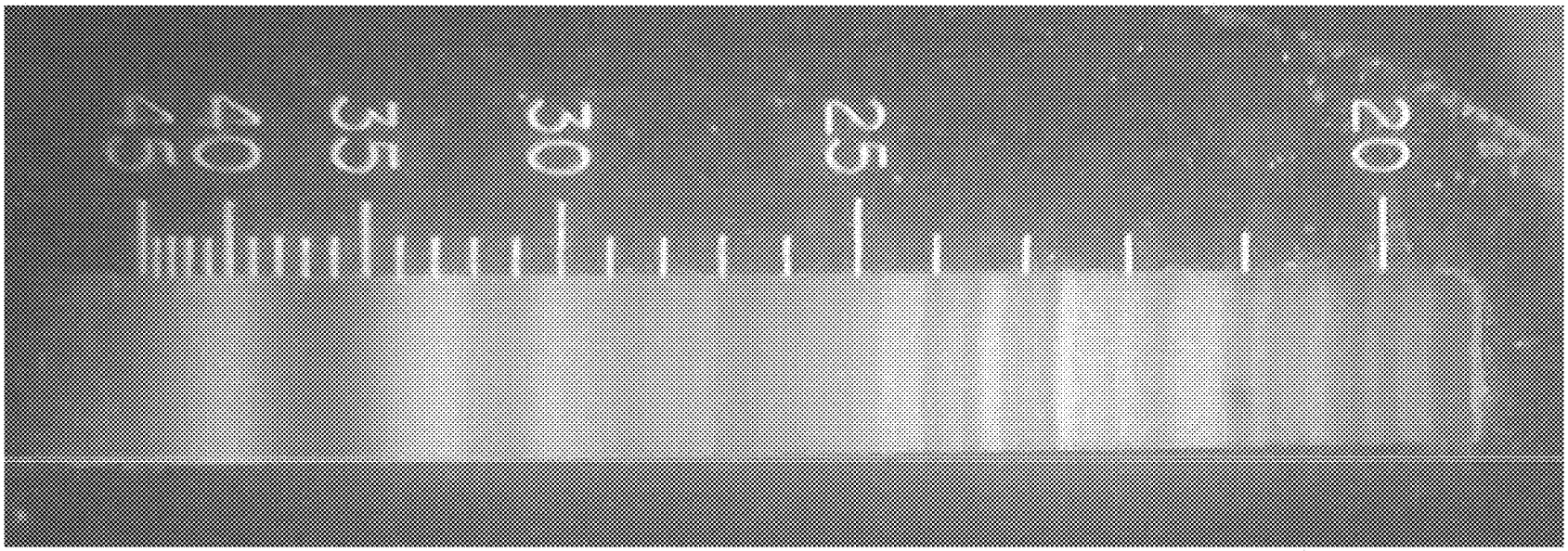

FIG. 91 shows the spectral lines produced from silver copper to silver indium.

Figure 92:
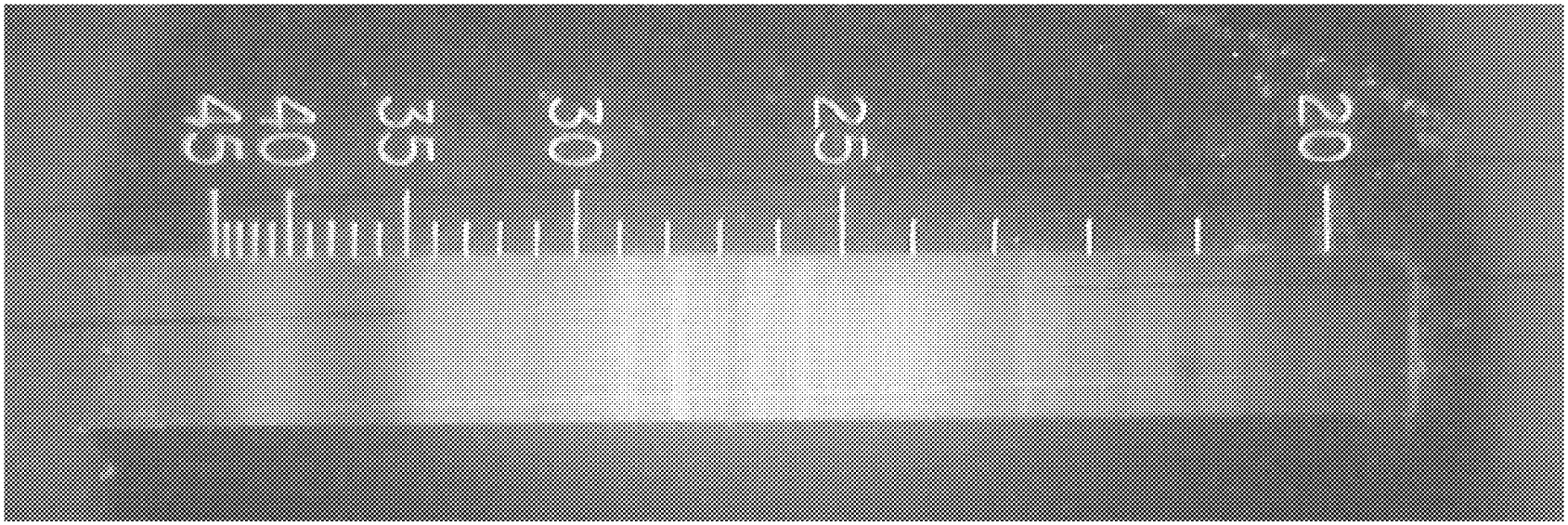

FIG. 92 shows the spectral lines produced from silver indium to 304 stainless steel.

Figure 93:
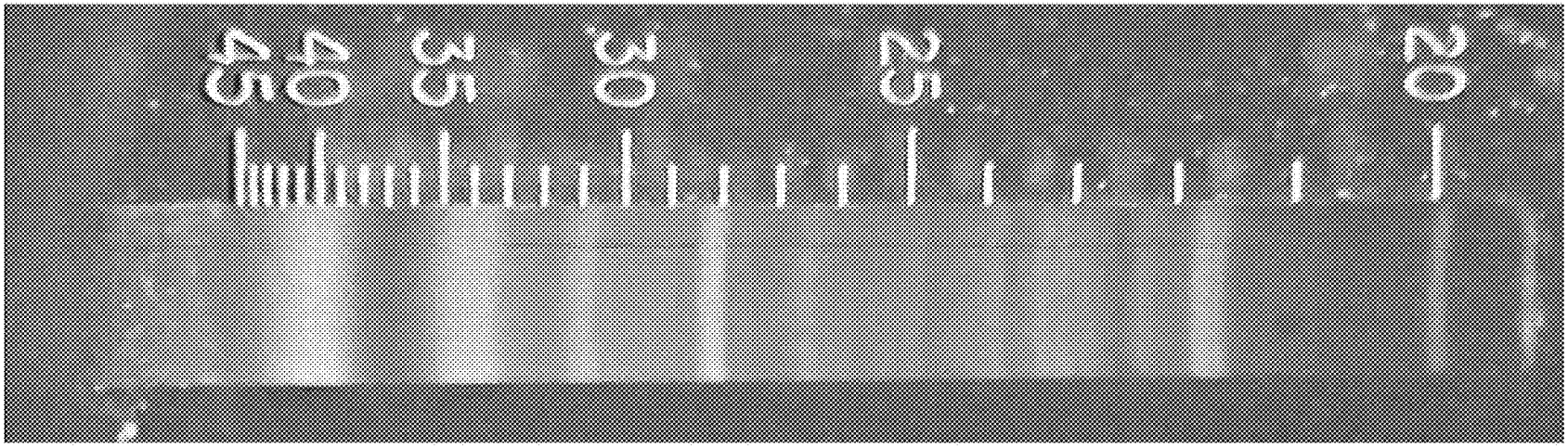

FIG. 93 shows the spectral lines produced from strontium 6061 aluminum.

Figure 94:
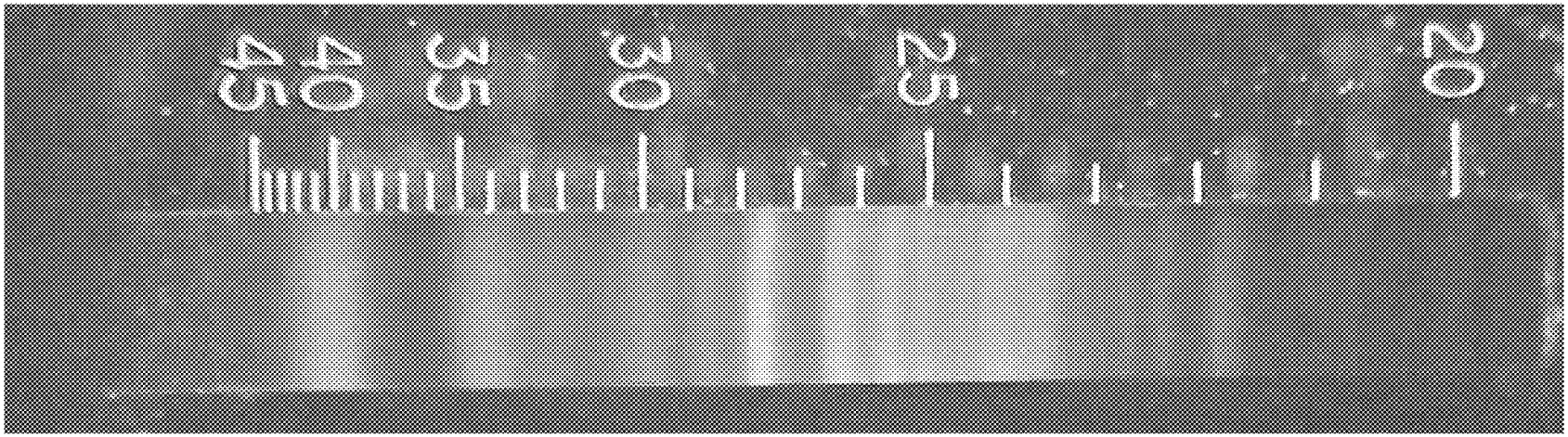

FIG. 94 shows the spectral lines produced from strontium to iron.

Figure 95:
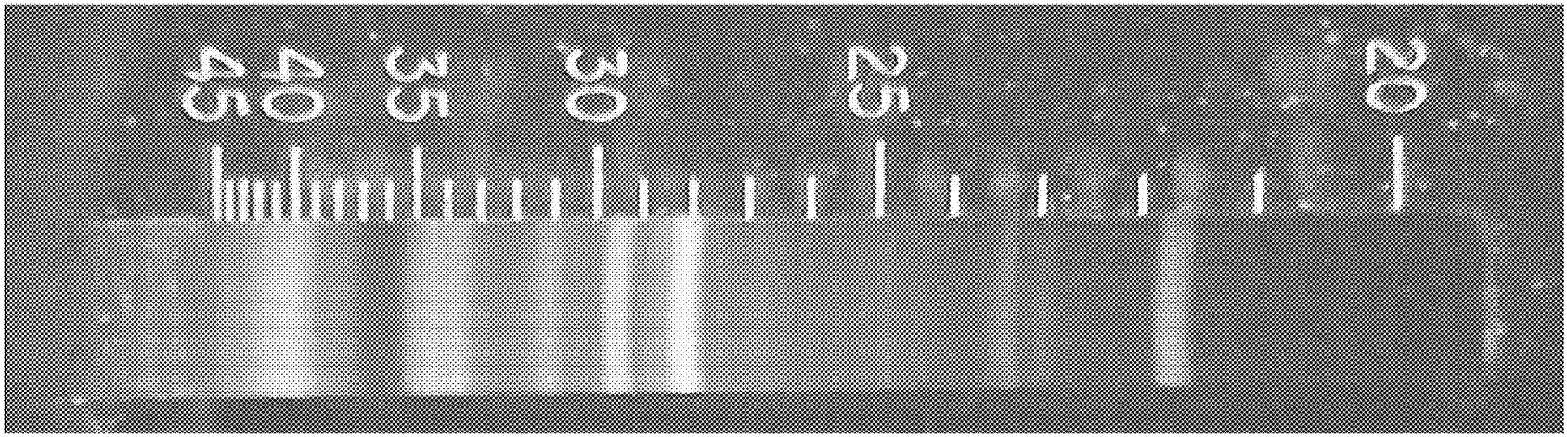

FIG. 95 shows the spectral lines produced from strontium to magnesium.

Figure 96:
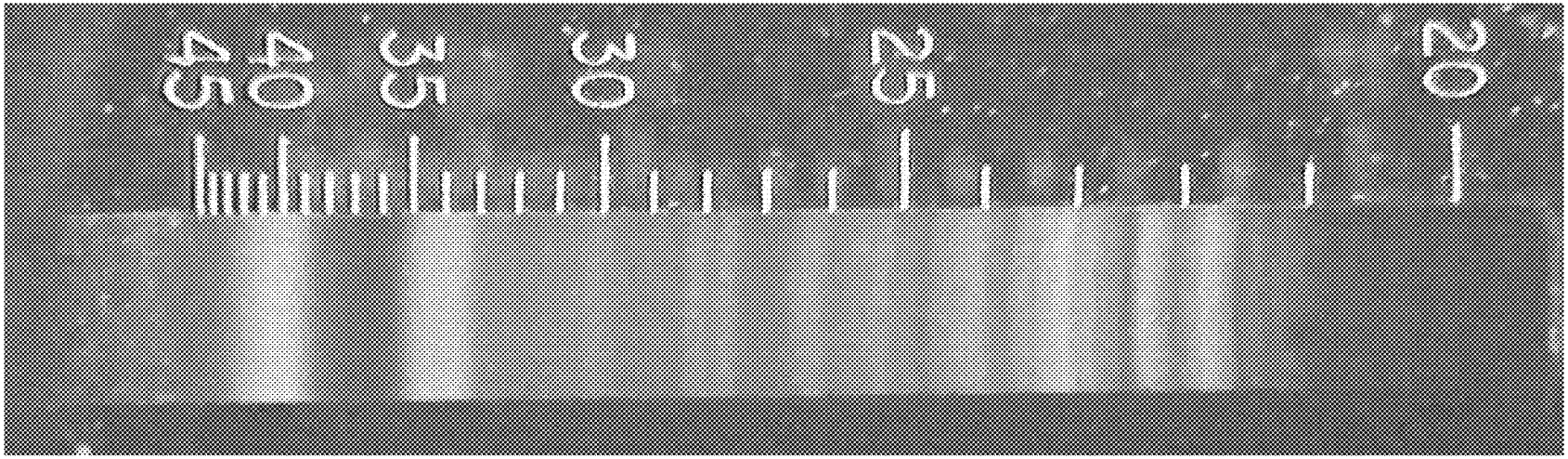

FIG. 96 shows the spectral lines produced from strontium to nickel.

Figure 97:
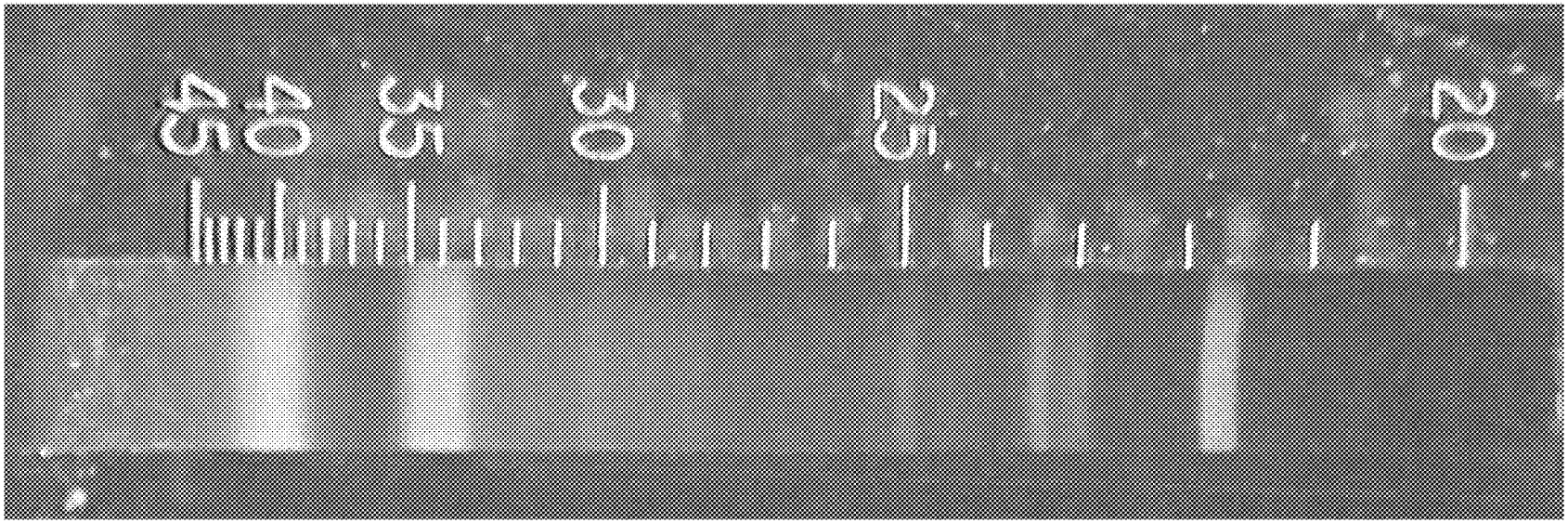

FIG. 97 shows the spectral lines produced from strontium to strontium.

Figure 98:
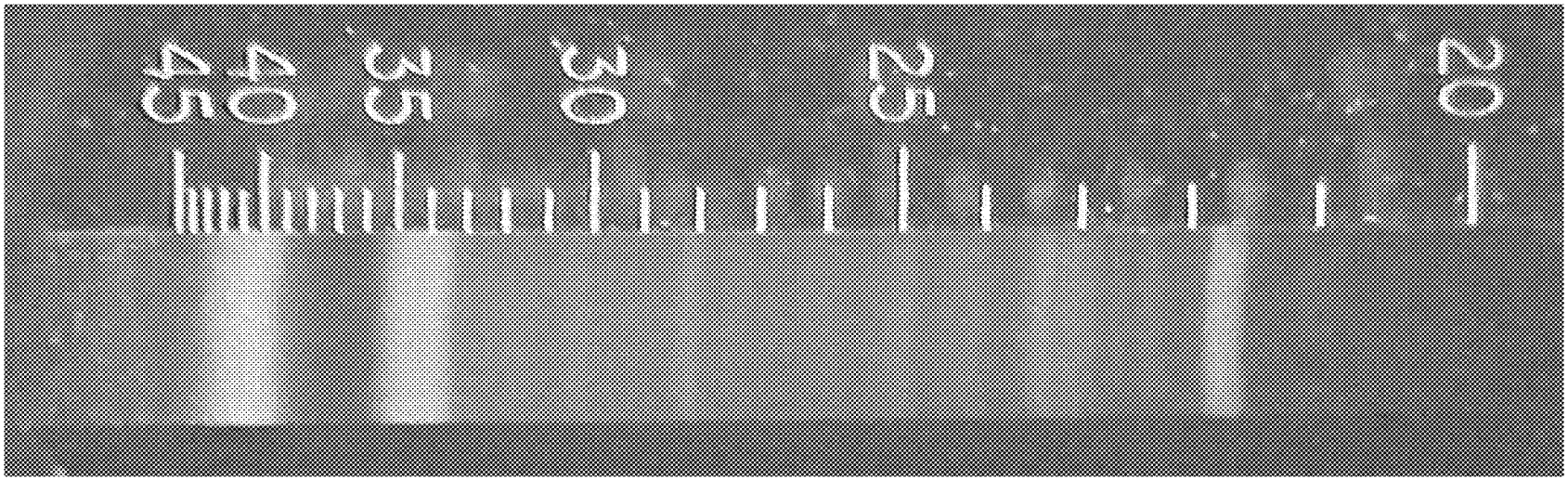

FIG. 98 shows the spectral lines produced from strontium to tungsten.

Figure 99:
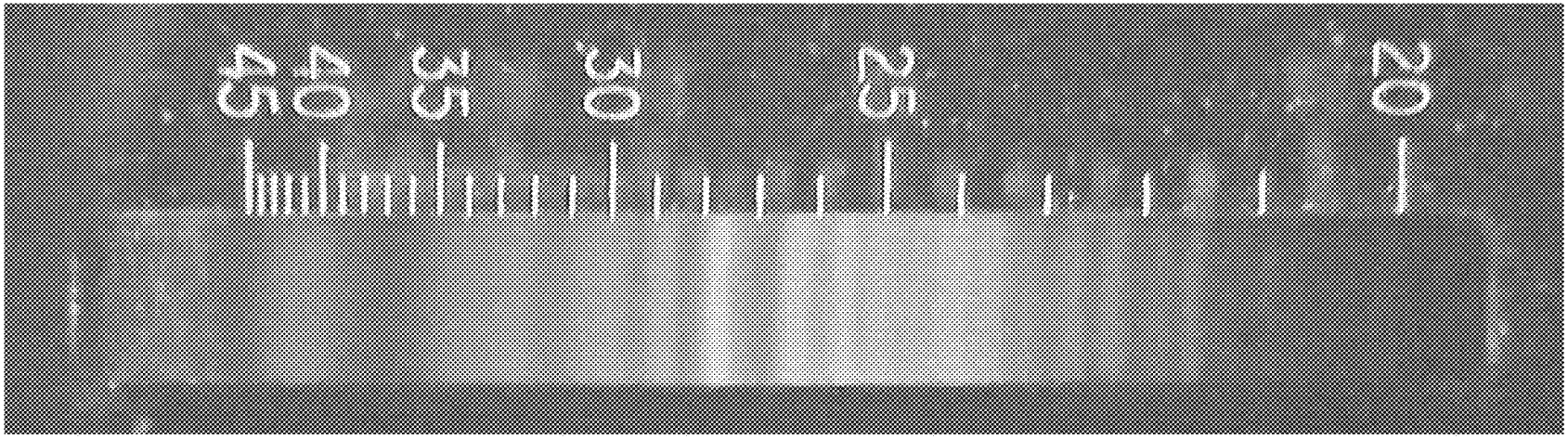

FIG. 99 shows the spectral lines produced from tellurium to iron.

Figure 100:
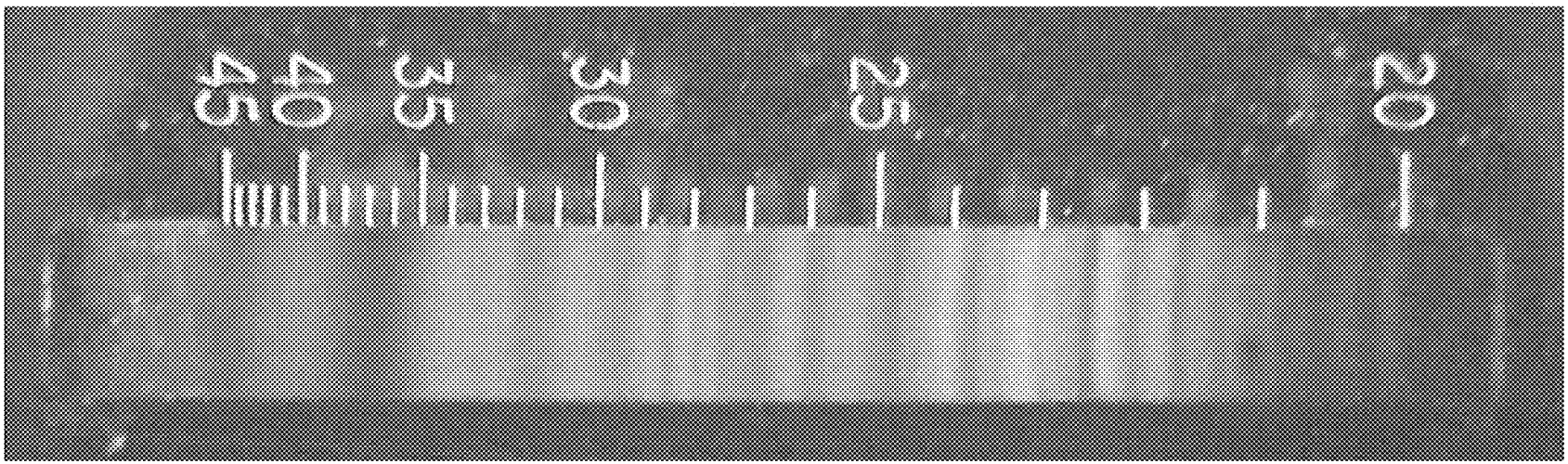

FIG. 100 shows the spectral lines produced from tellurium to nickel.

Figure 101:
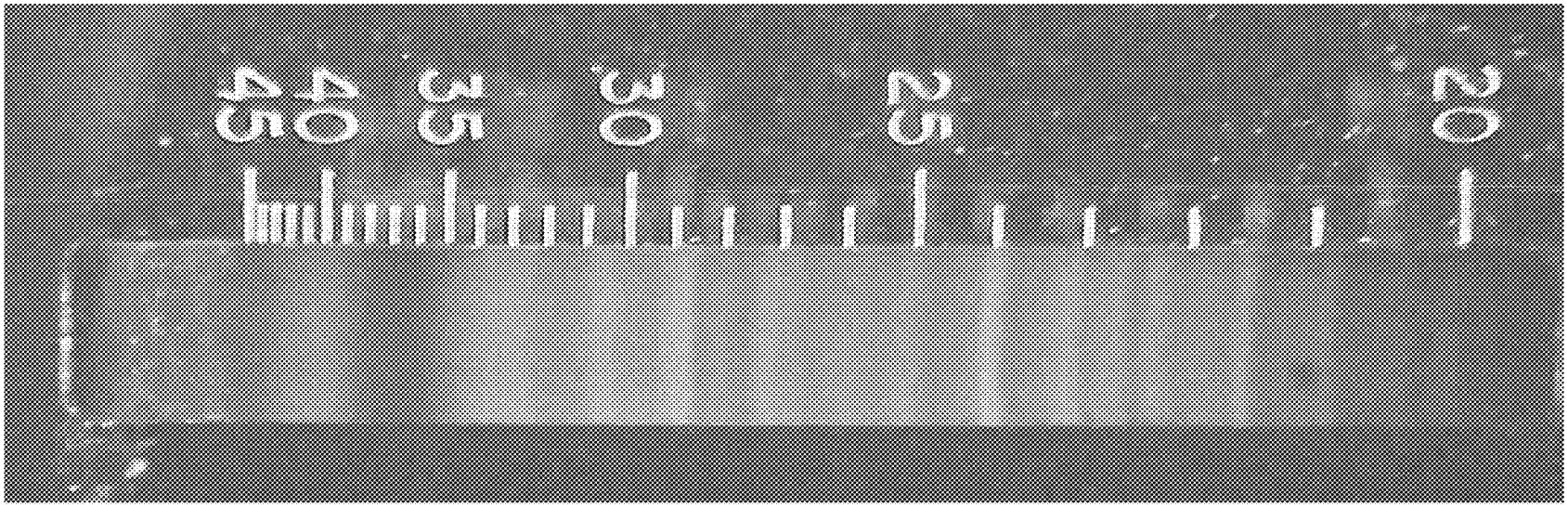

FIG. 101 shows the spectral lines produced from tellurium to tungsten.

Figure 102:
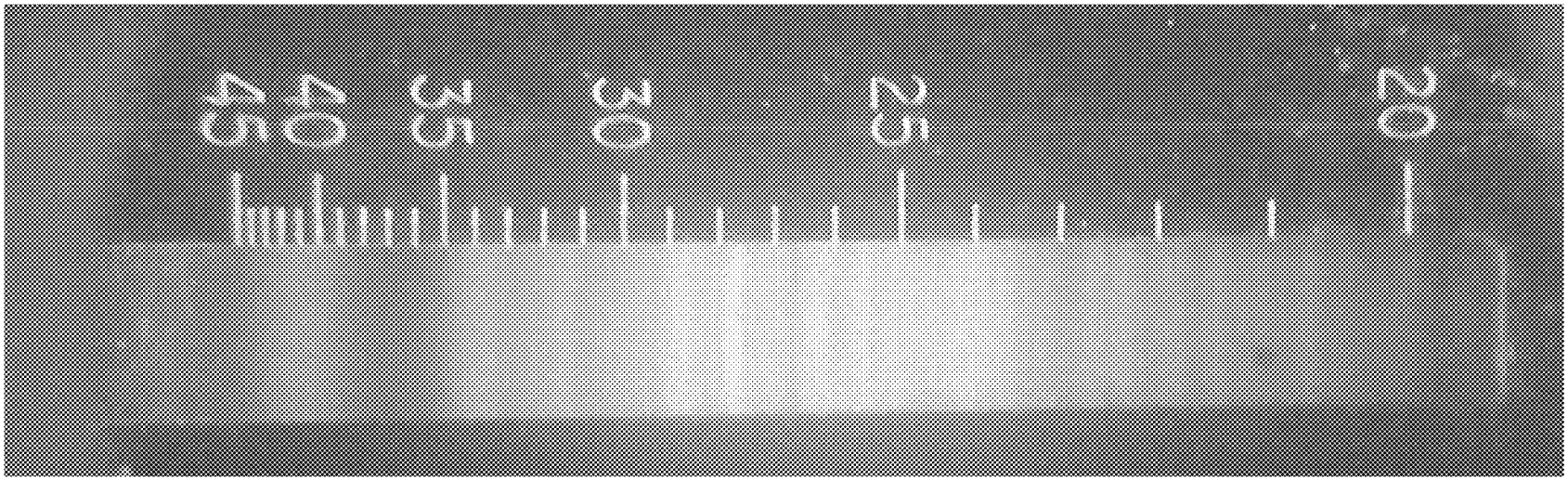

FIG. 102 shows the spectral lines produced from tungsten to 304 stainless steel.

Figure 103:
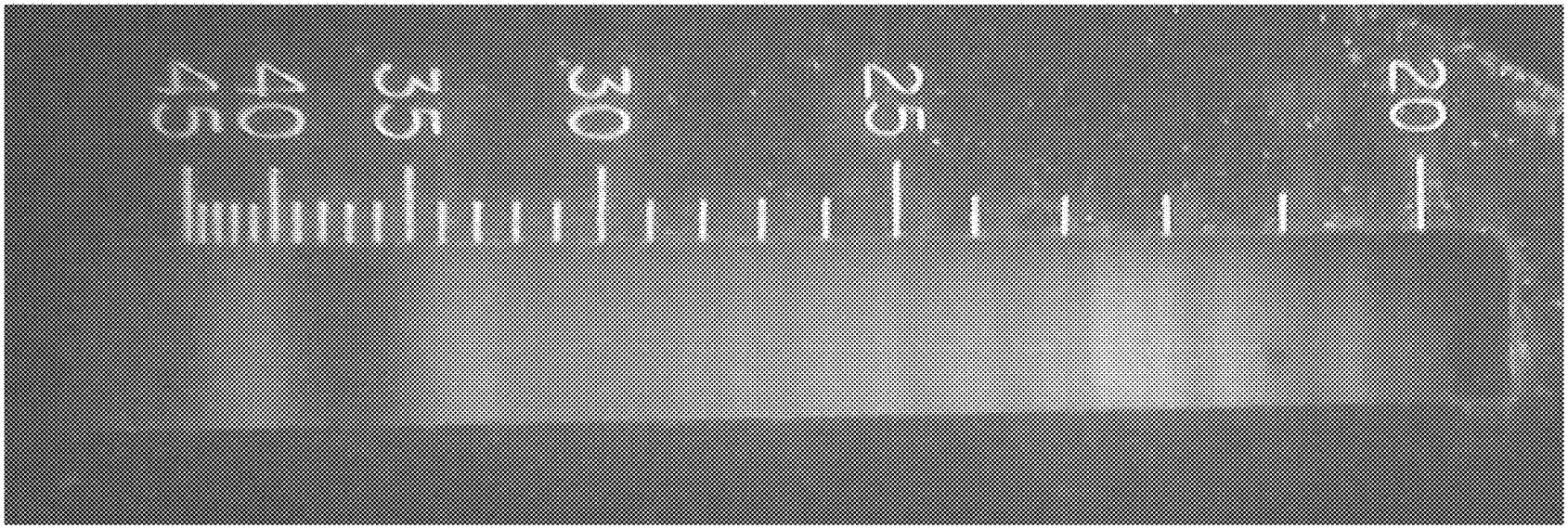

FIG. 103 shows the spectral lines produced from tungsten to copper tin.

Figure 104:
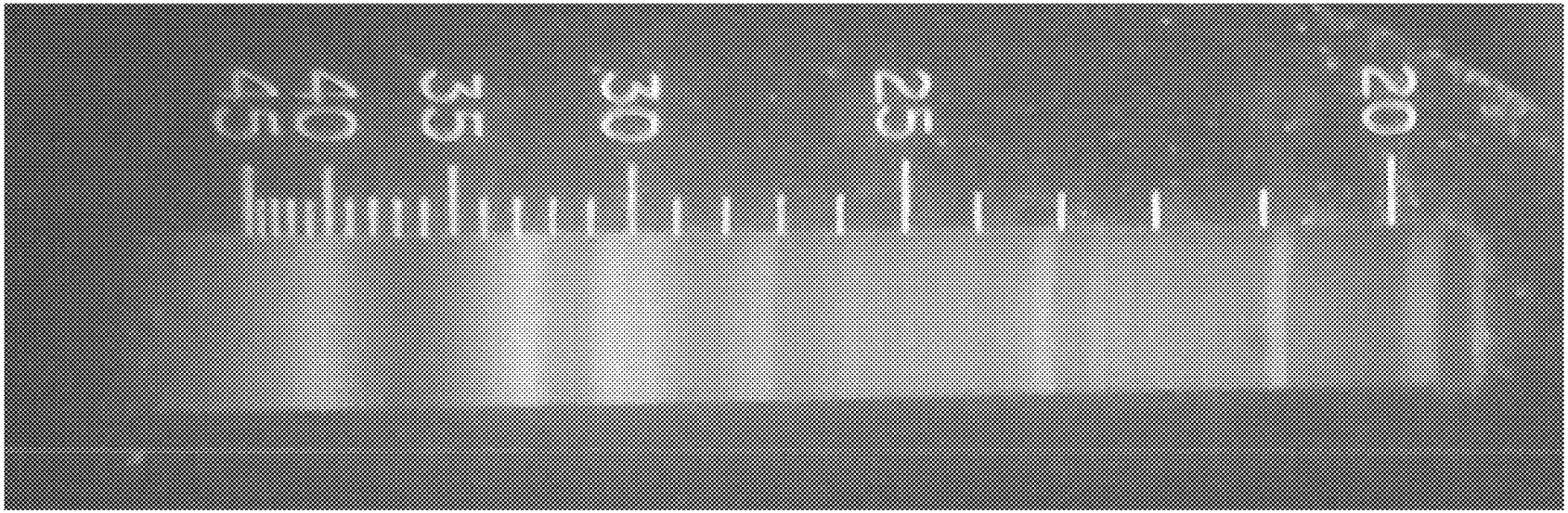

FIG. 104 shows the spectral lines produced from tungsten to indium.

Figure 105:
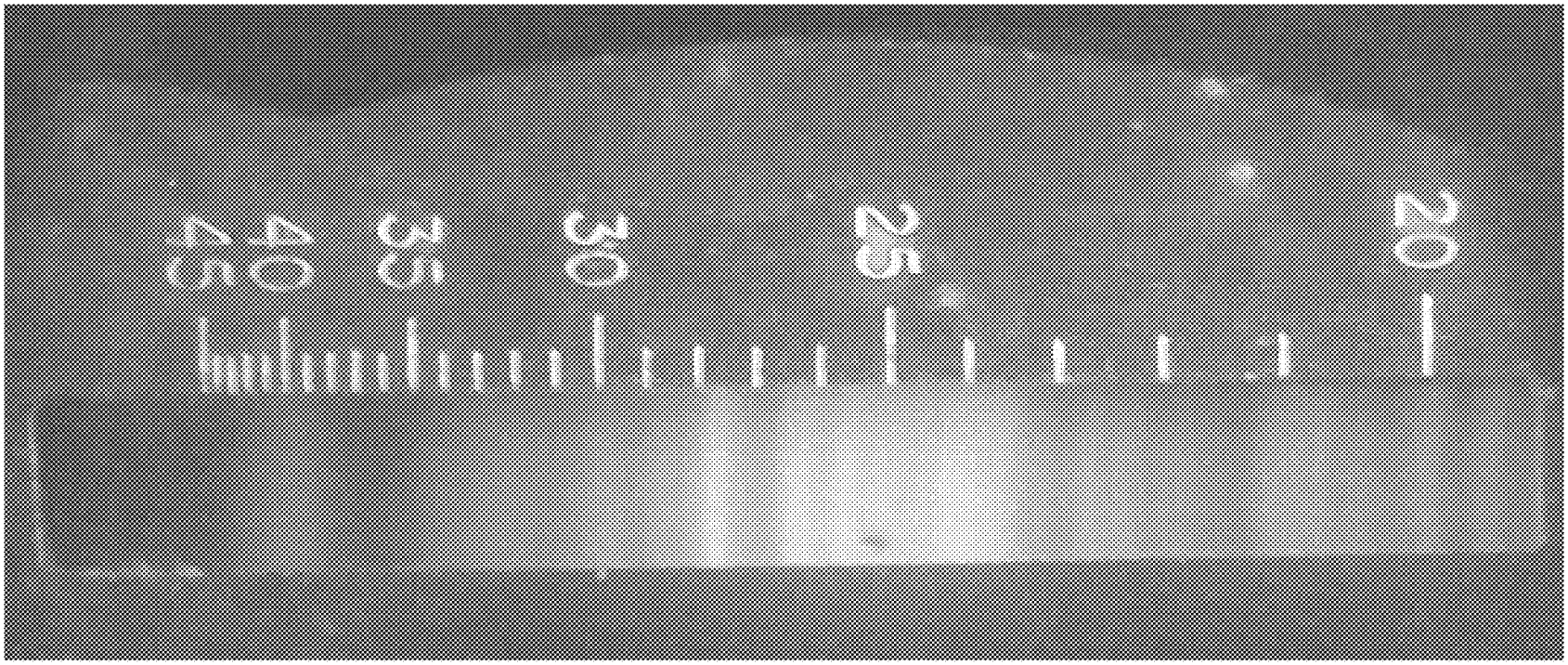

FIG. 105 shows the spectral lines produced from tungsten to iron.

Figure 106:
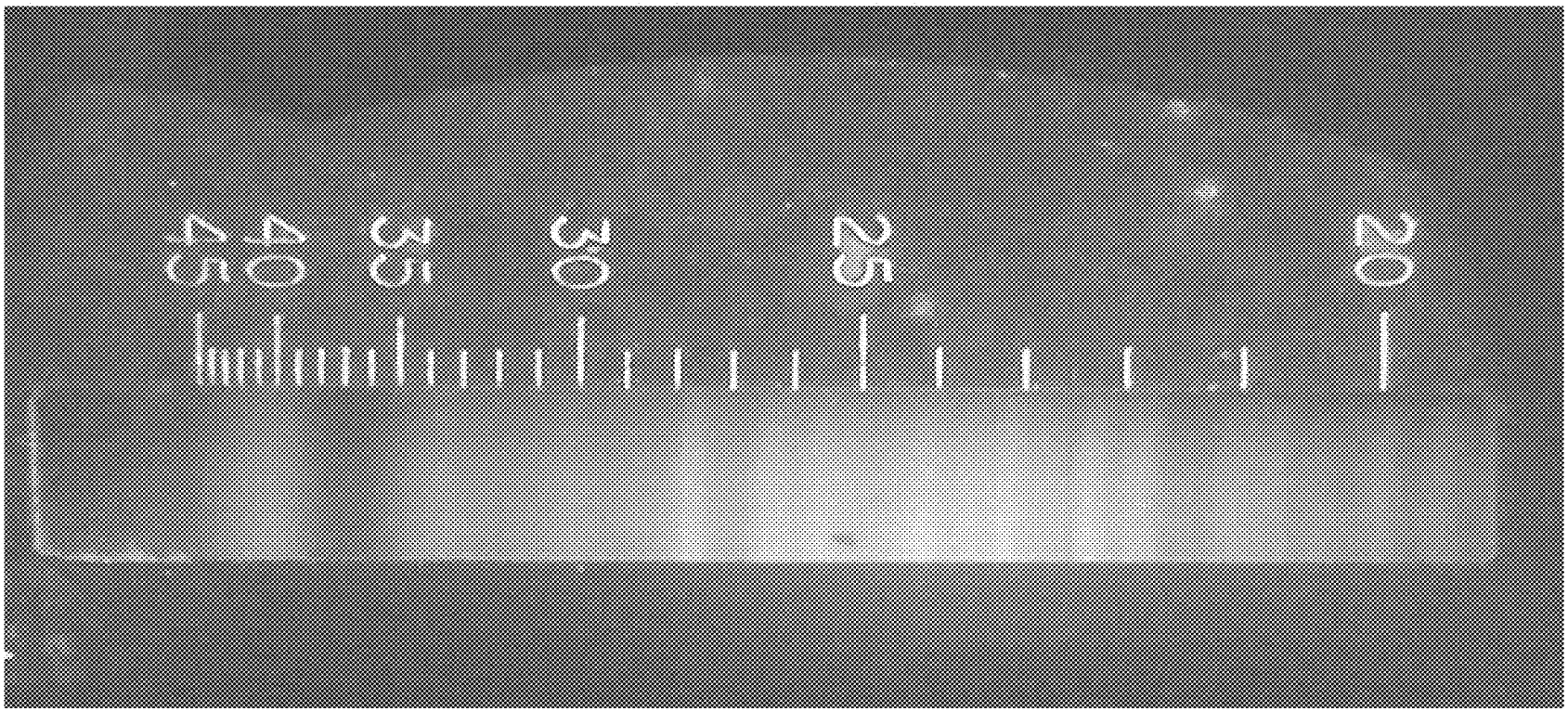

FIG. 106 shows the spectral lines produced from tungsten to nickel.

Figure 107:
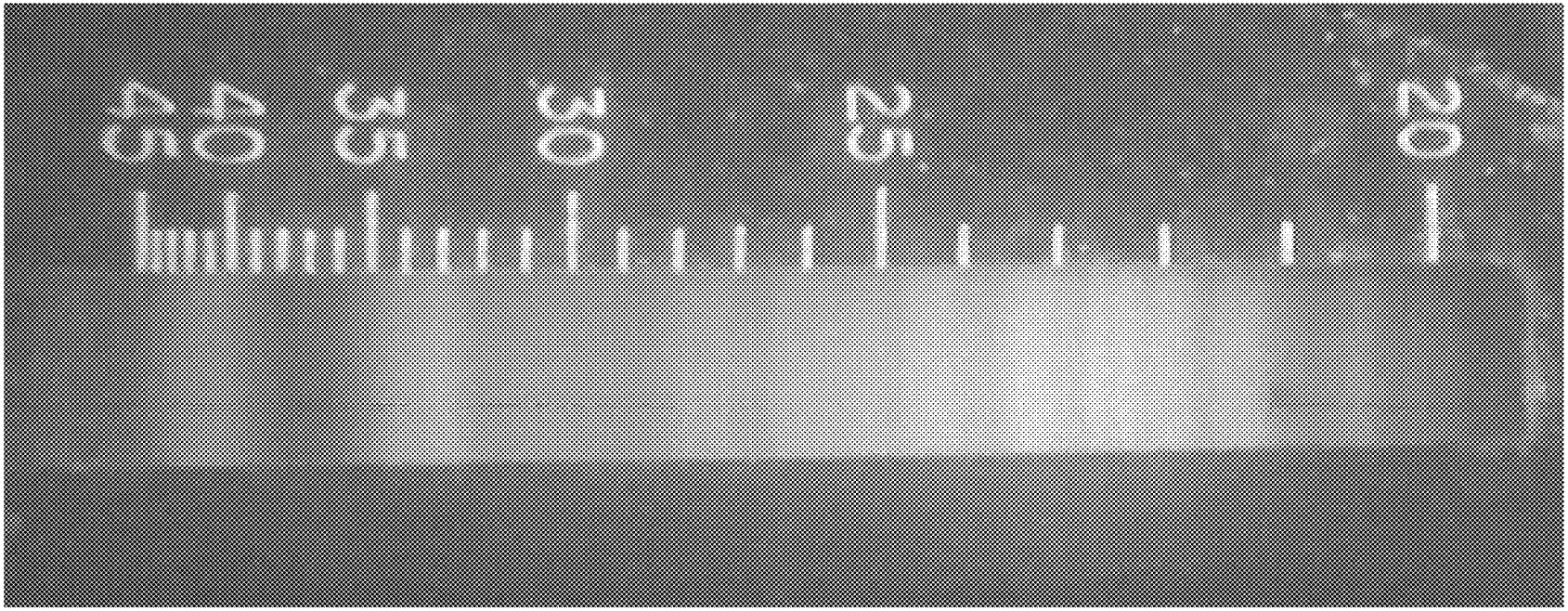

FIG. 107 shows the spectral lines produced from tungsten to silver copper nickel.

Figure 108:
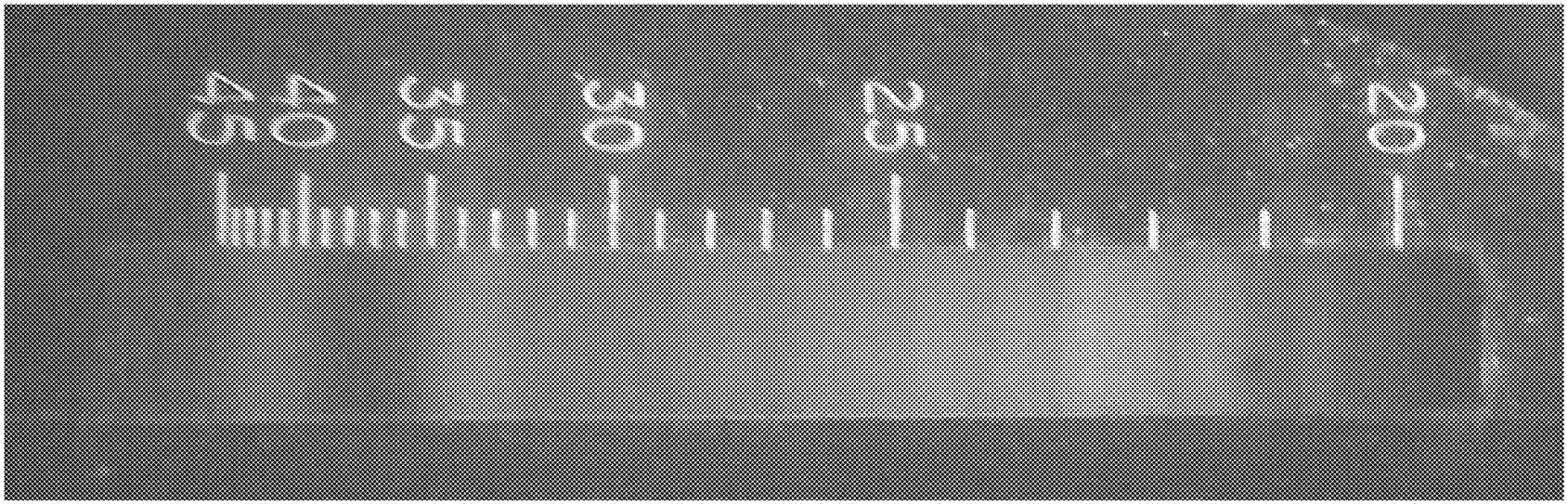

FIG. 108 shows the spectral lines produced from tungsten to silver copper.

Figure 109:
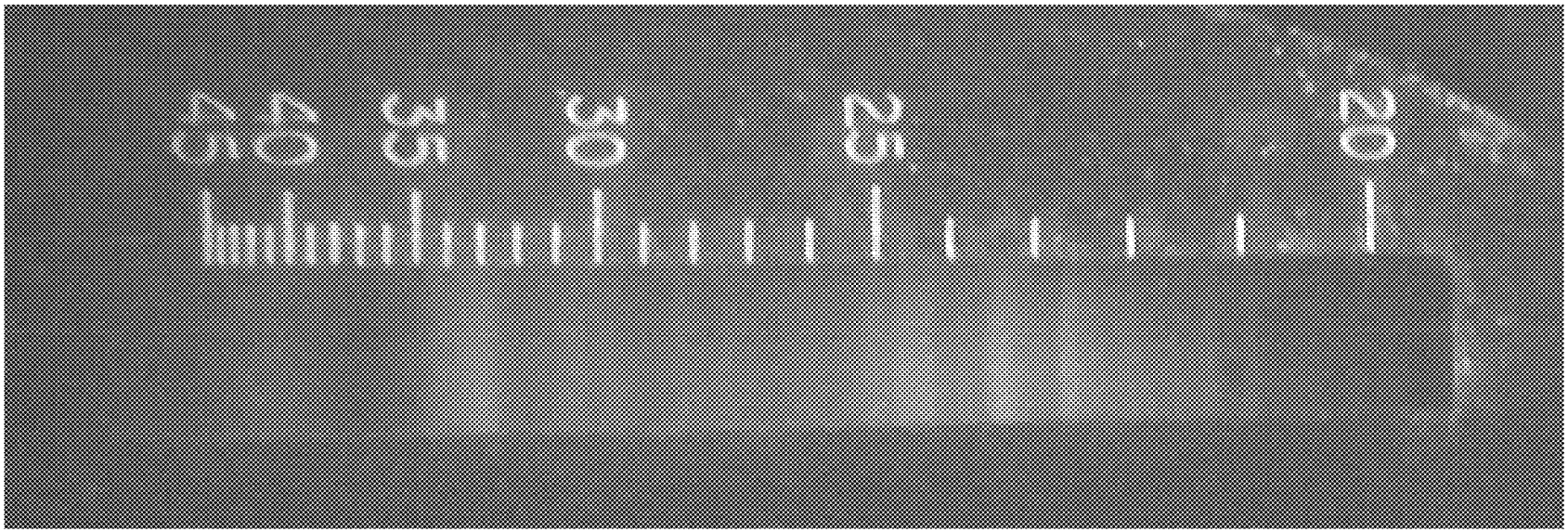

FIG. 109 shows the spectral lines produced from tungsten to silver indium.

Figure 110:
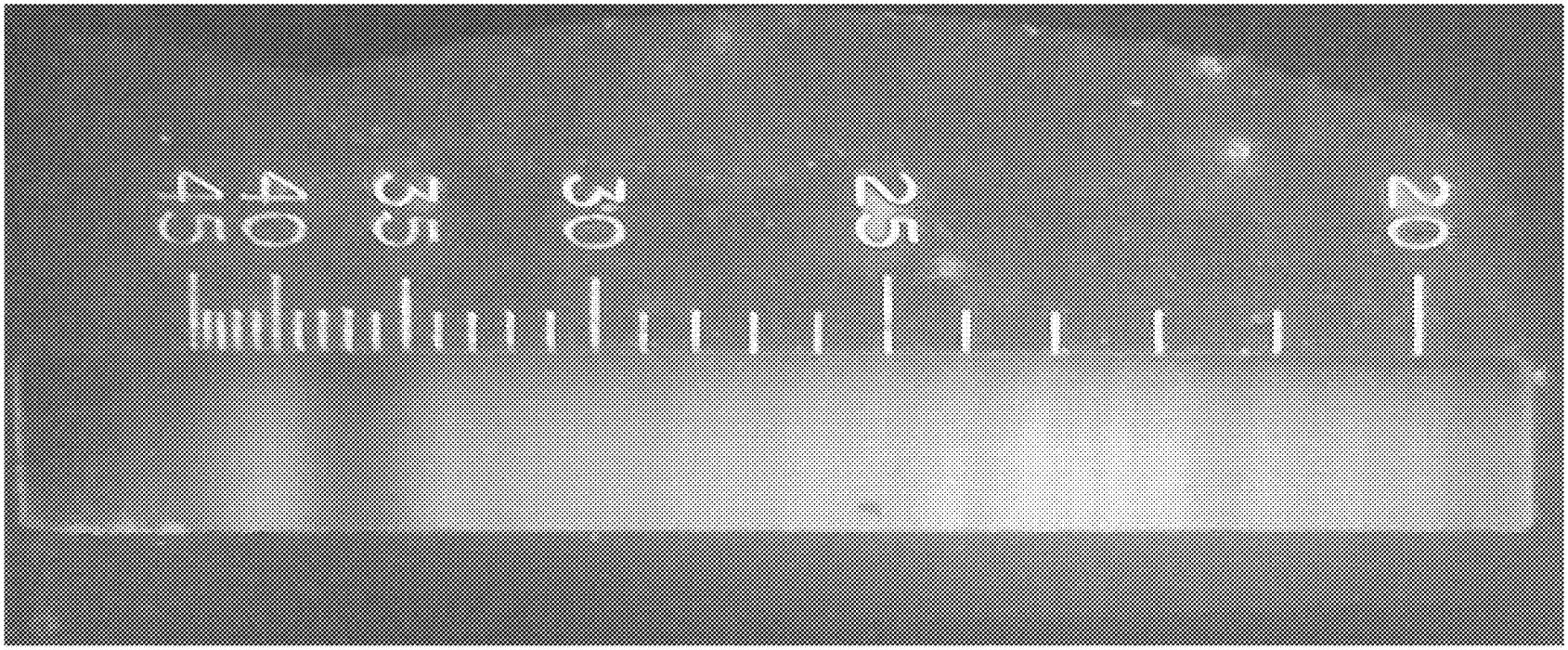

FIG. 110 shows the spectral lines produced from tungsten to tungsten.

Figure 111:
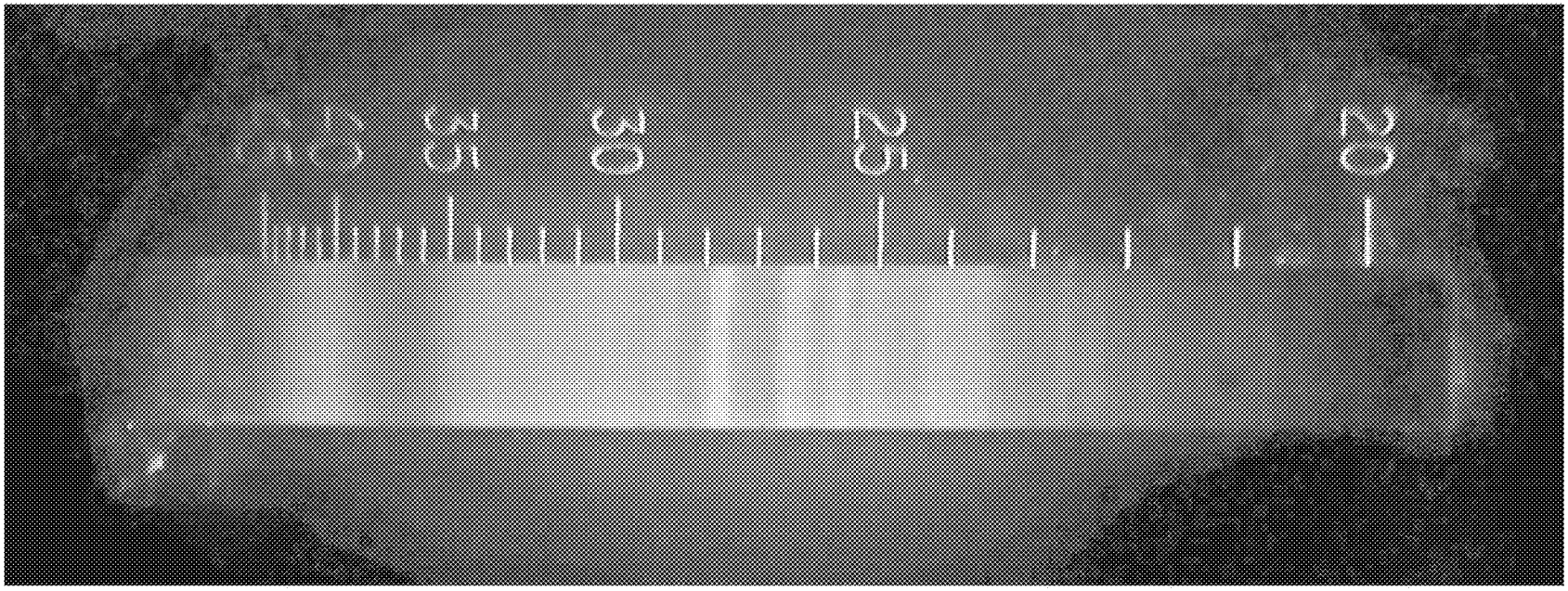

FIG. 111 shows the spectral lines produced from uranium to iron.

Figure 112:
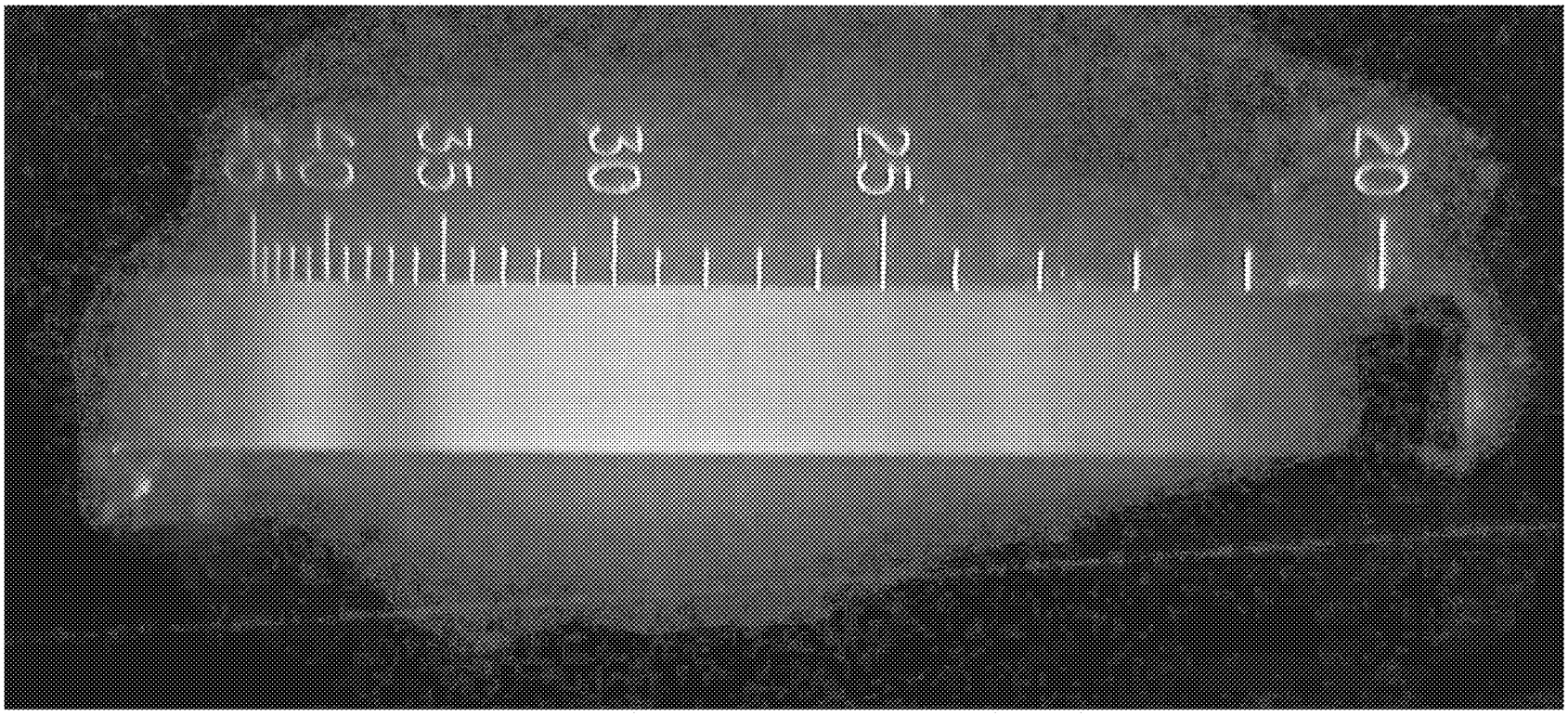

FIG. 112 shows the spectral lines produced from uranium to molybdenum.

Figure 113:
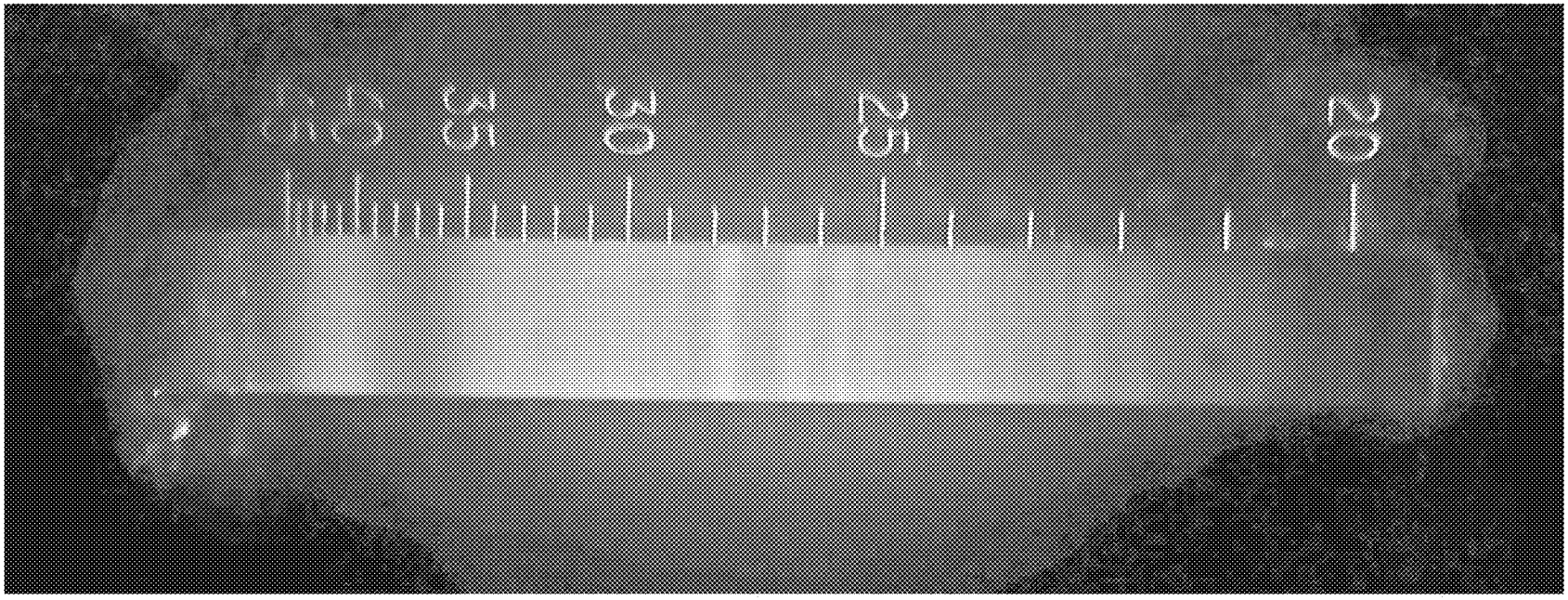

FIG. 113 shows the spectral lines produced from uranium to Muonionalusta.

Figure 114:
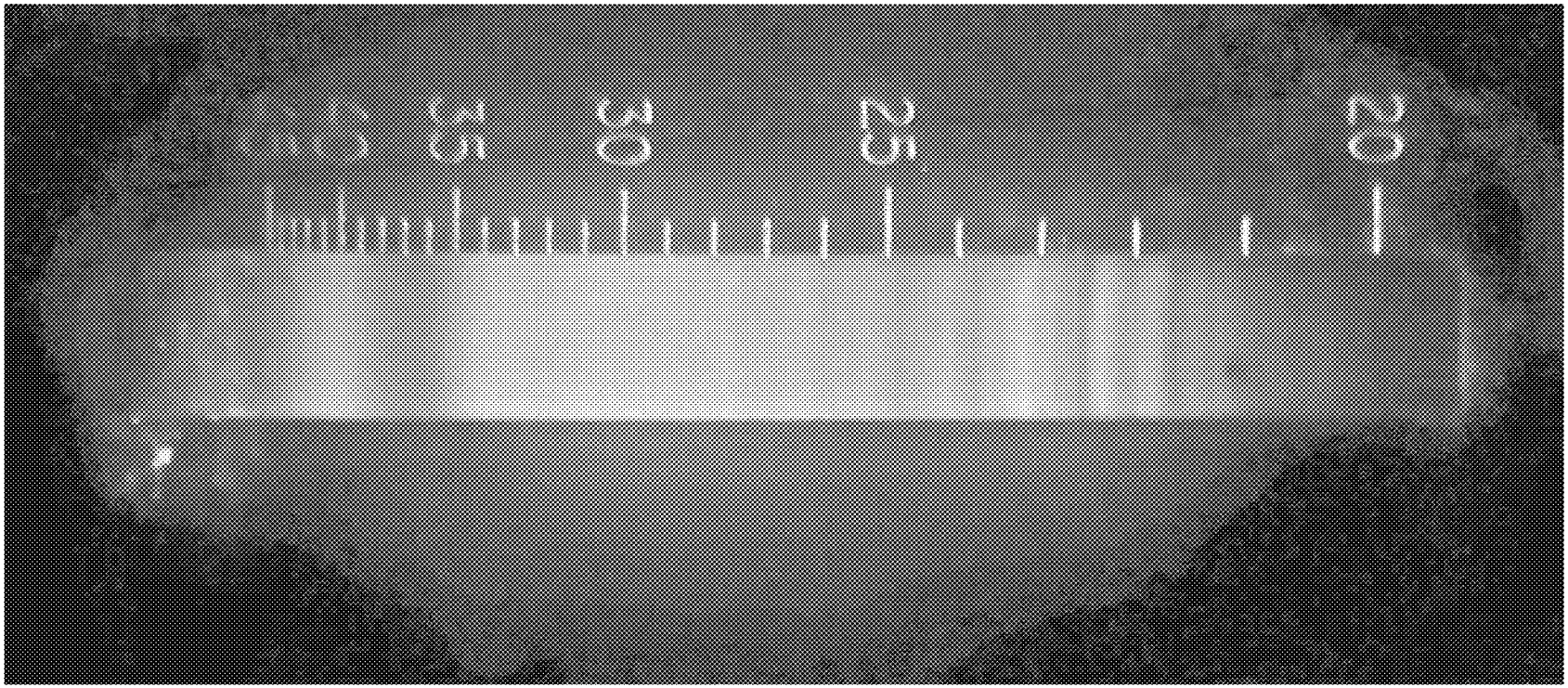

FIG. 114 shows the spectral lines produced from uranium to nickel.

Figure 115:
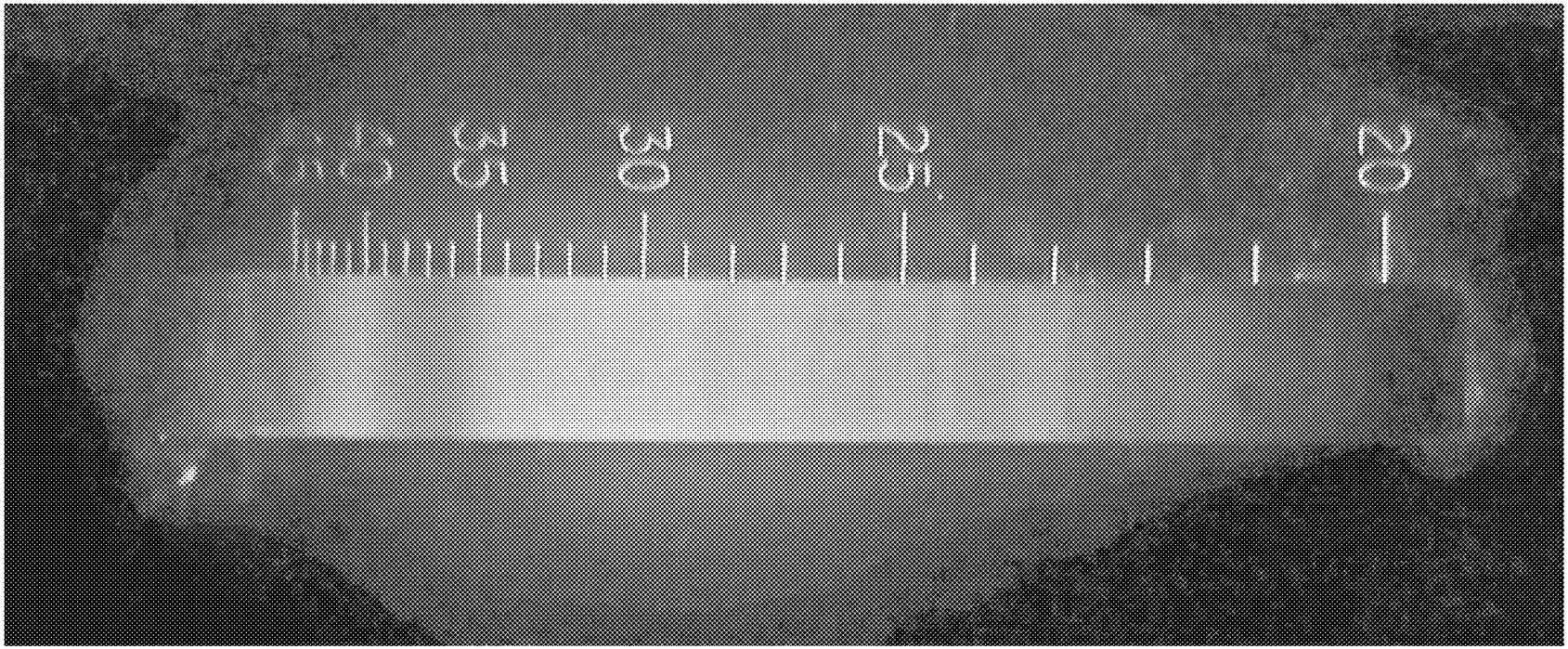

FIG. 115 shows the spectral lines produced from uranium niobium.

Figure 116:
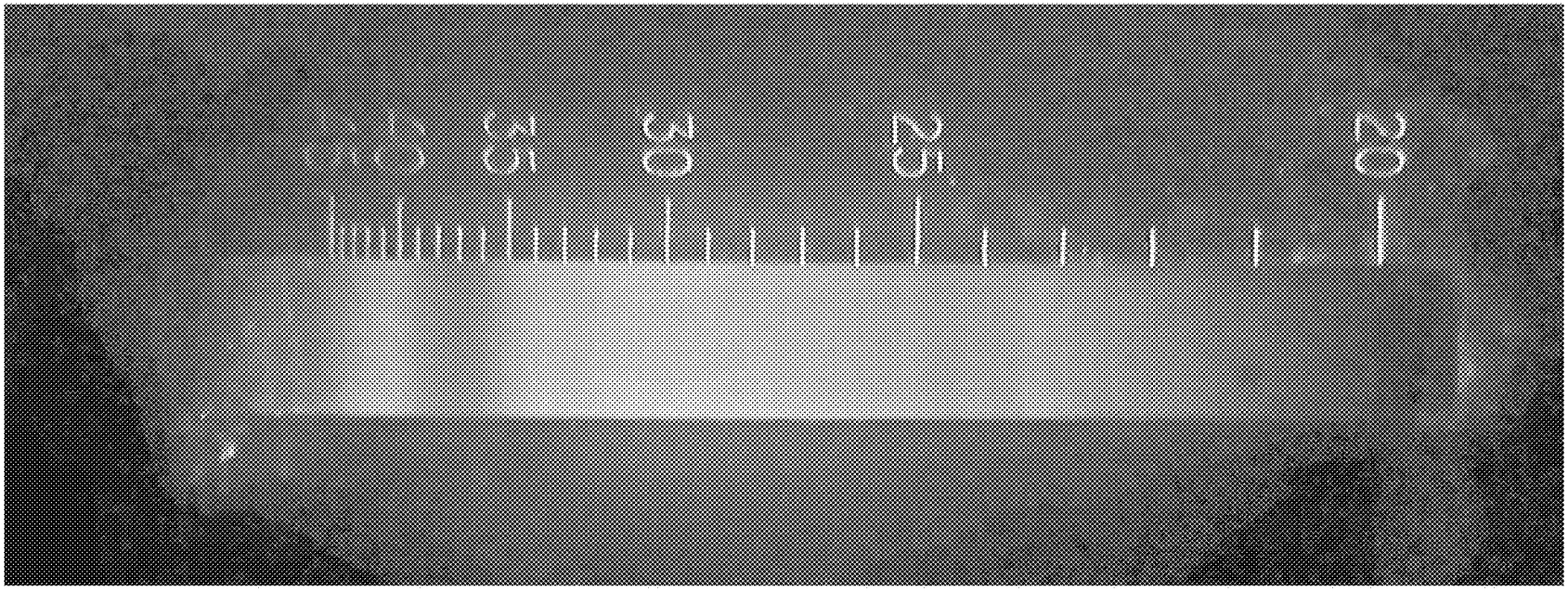

FIG. 116 shows the spectral lines produced from uranium to tungsten.

Figure 117:
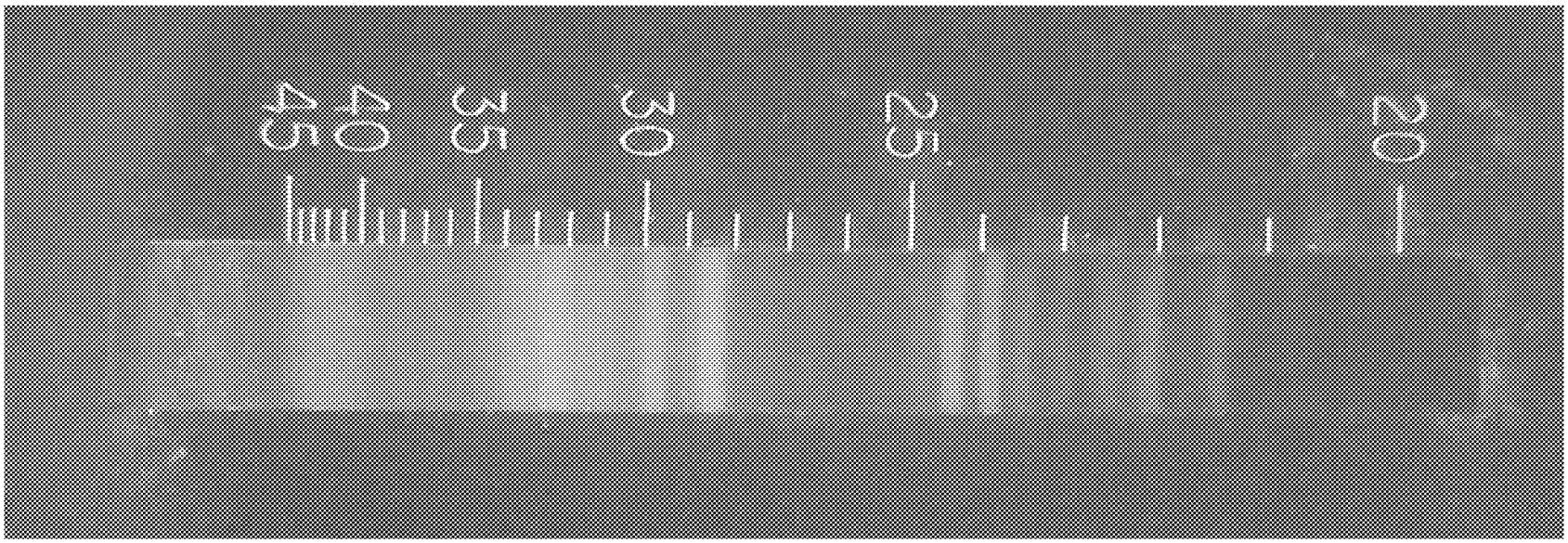

FIG. 117 shows the spectral lines produced from yttrium to bismuth.

Figure 118:
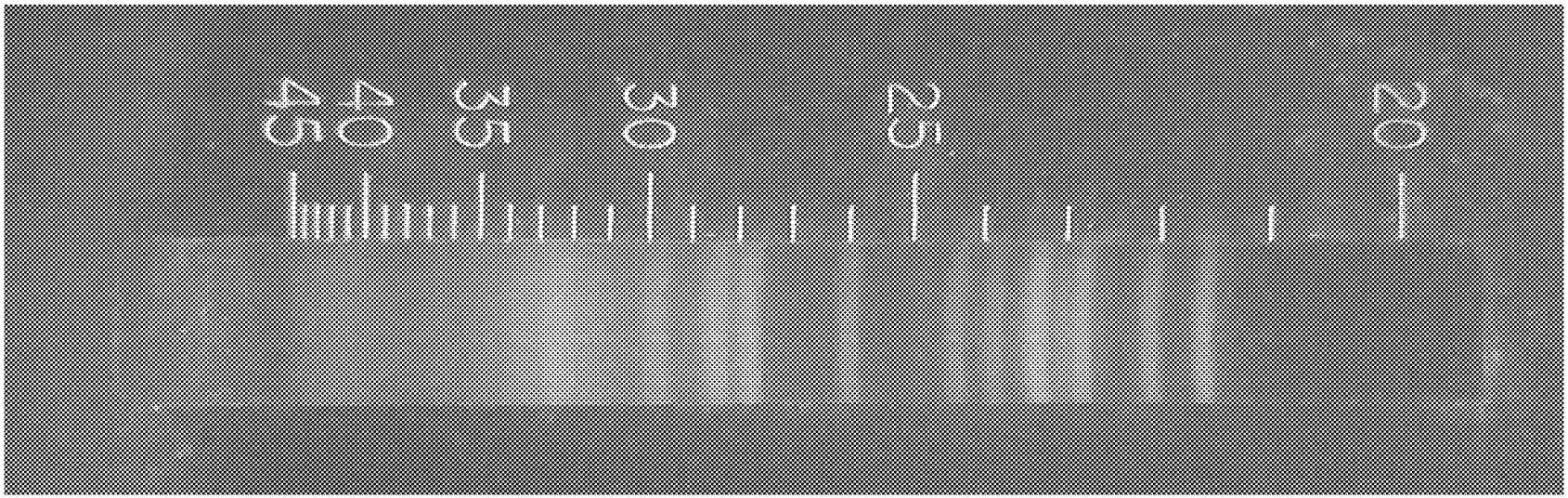

FIG. 118 shows the spectral lines produced from yttrium to cadmium.

Figure 119:
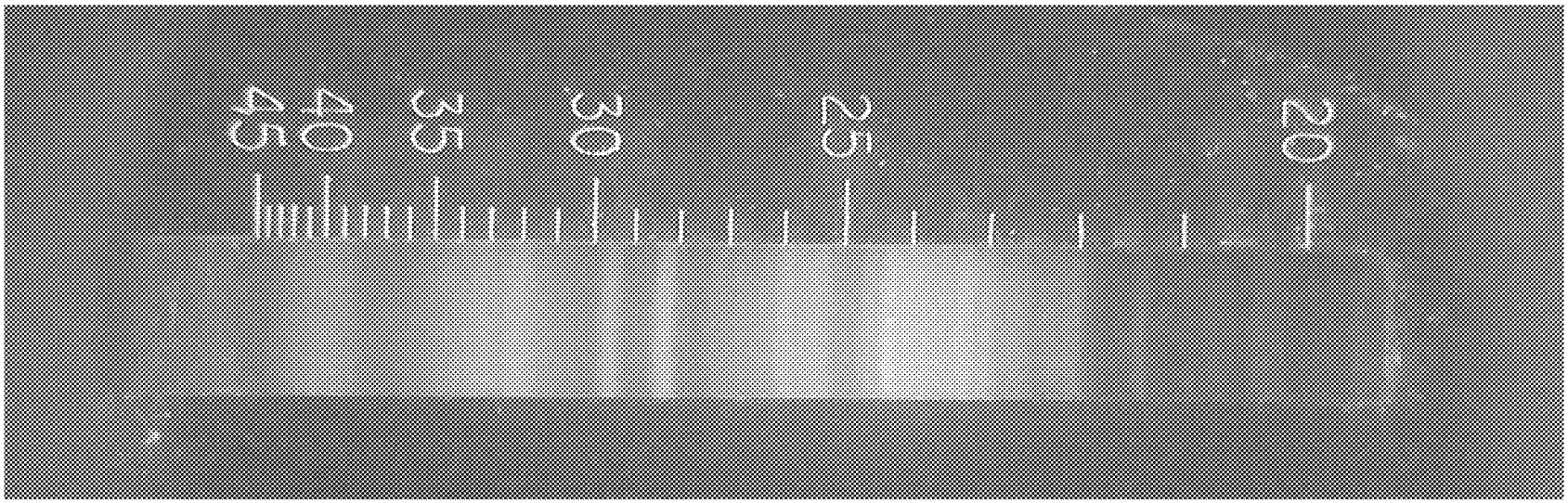

FIG. 119 shows the spectral lines produced from yttrium to cobalt.

Figure 120:
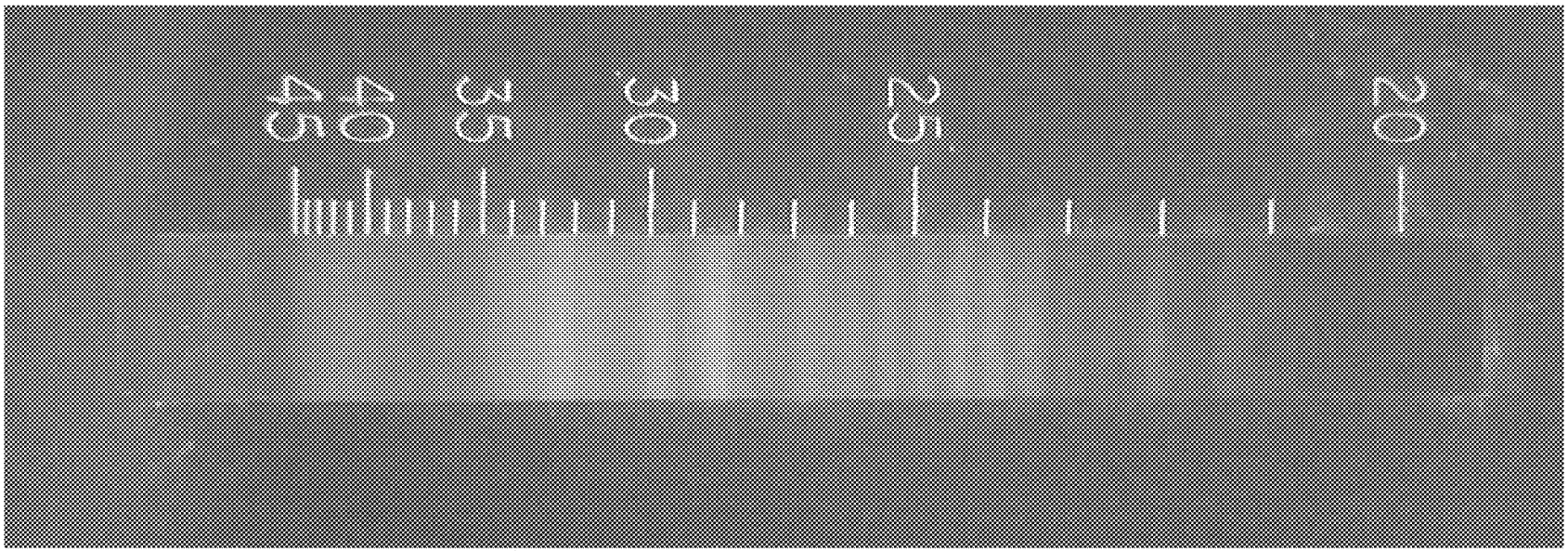

FIG. 120 shows the spectral lines produced from yttrium to hafnium.

Figure 121:
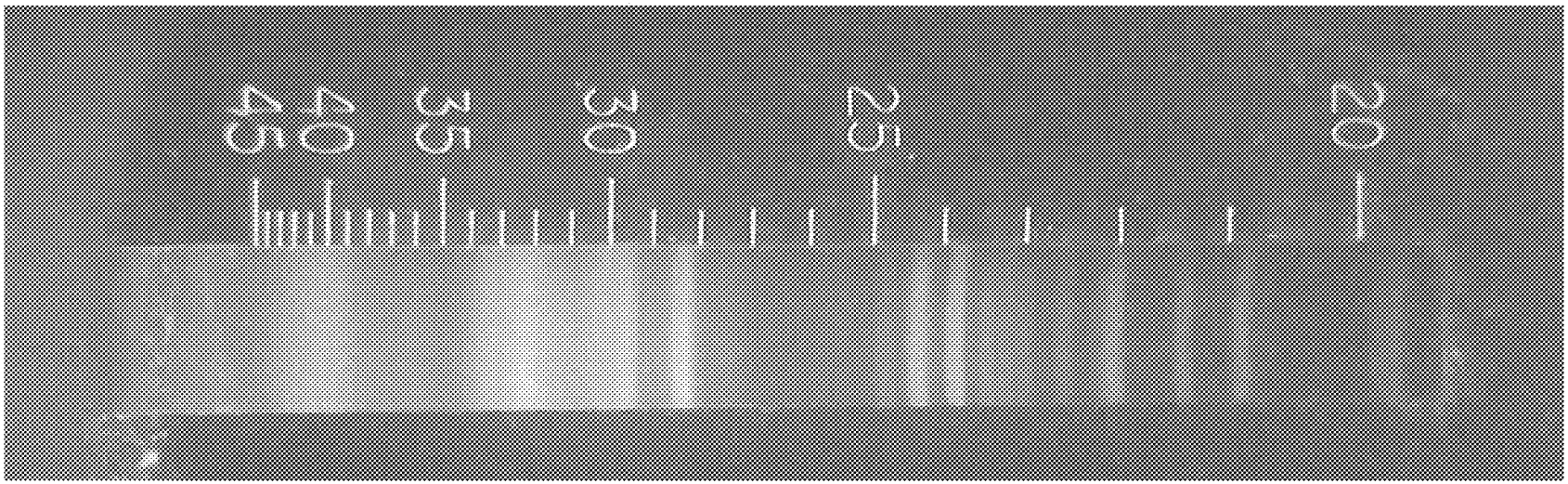

FIG. 121 shows the spectral lines produced from yttrium to indium.

Figure 122:
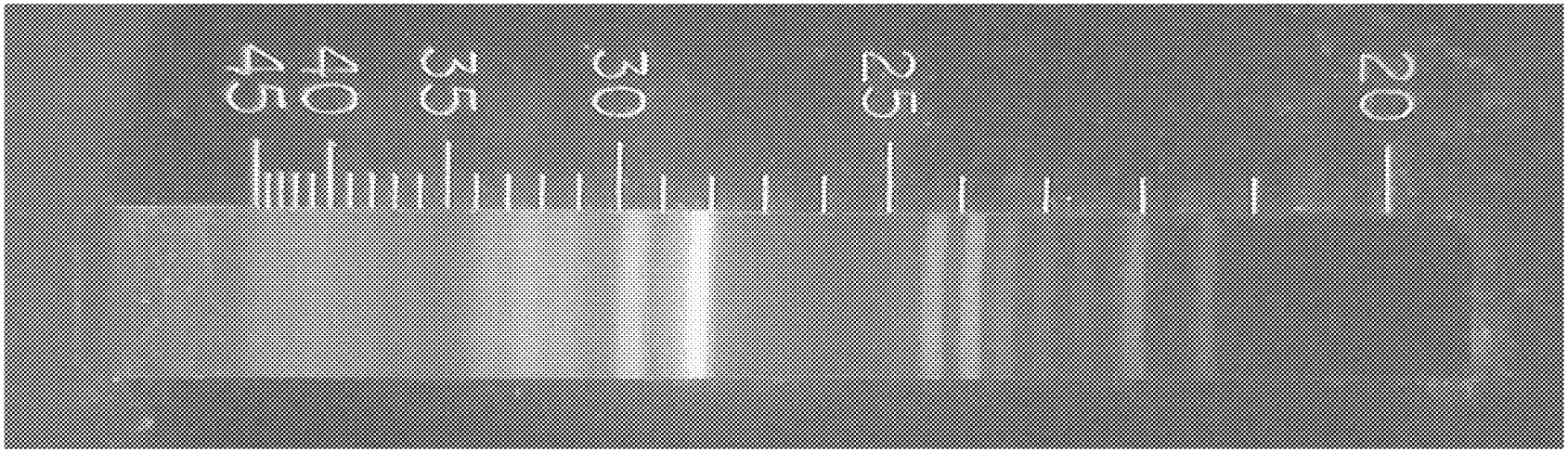

FIG. 122 shows the spectral lines produced from yttrium to magnesium.

Figure 123:
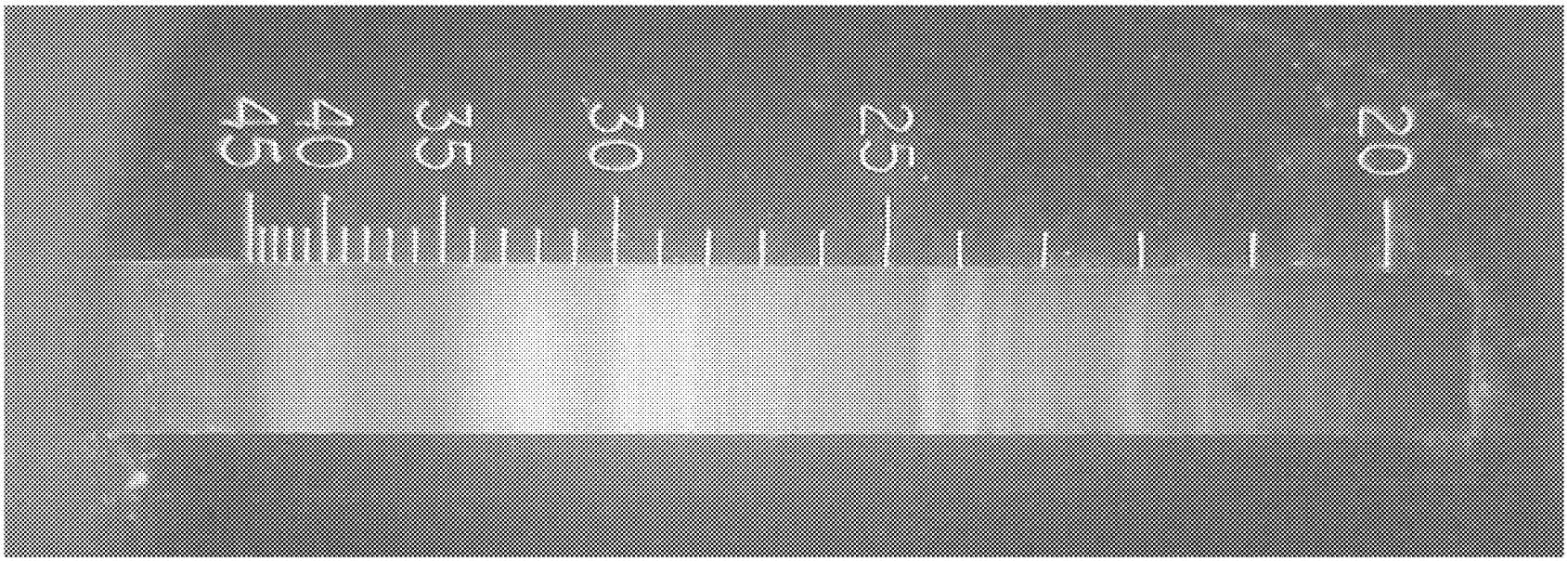

FIG. 123 shows the spectral lines produced from yttrium to molybdenum.

Figure 124:
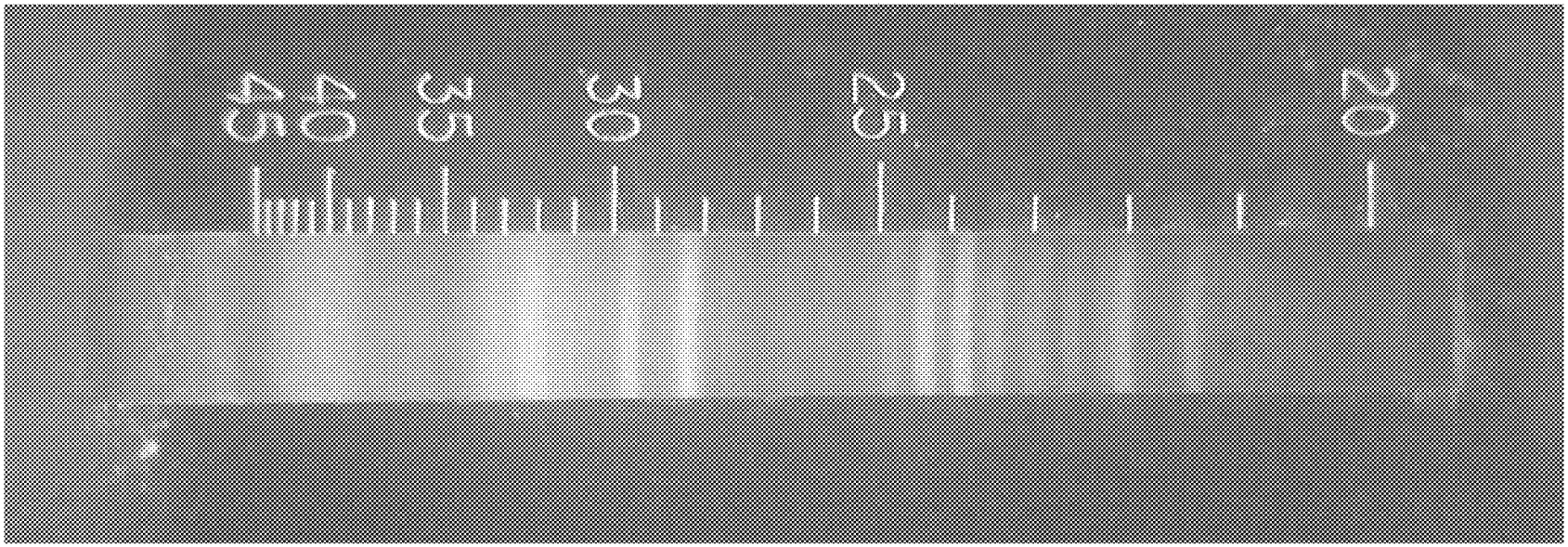

FIG. 124 shows the spectral lines produced from yttrium to rhenium.

Figure 125:
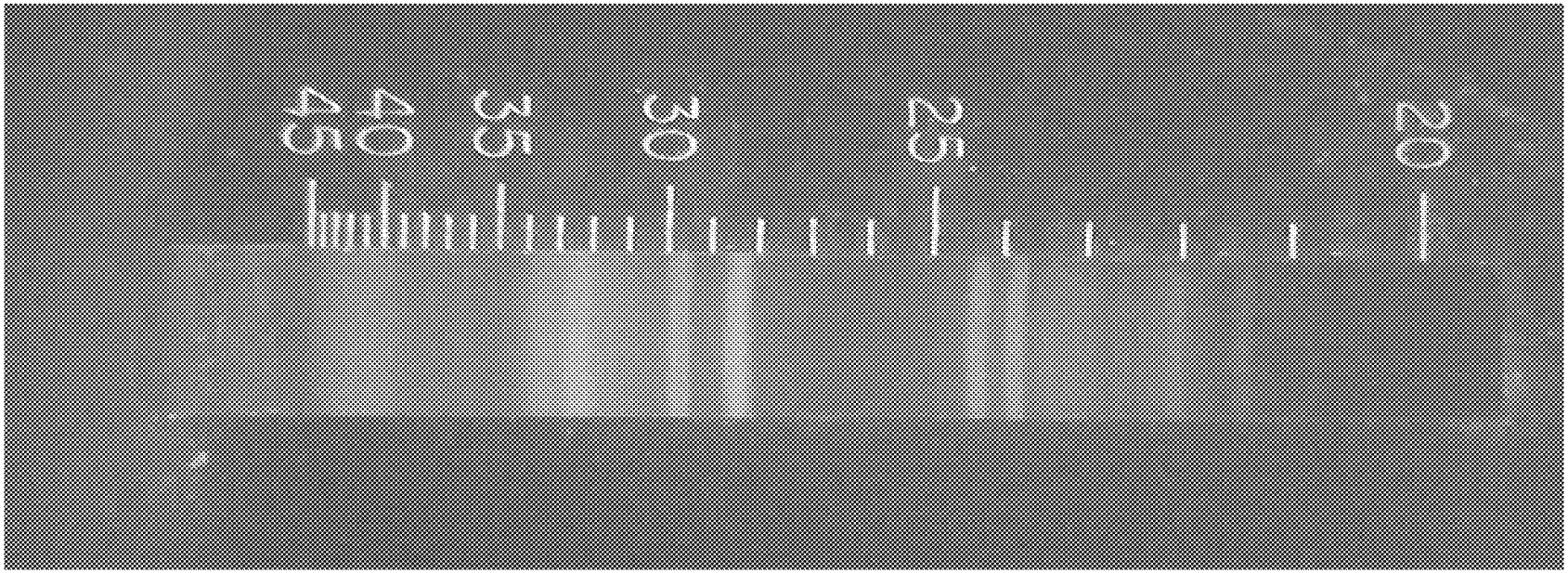

FIG. 125 shows the spectral lines produced from yttrium to tungsten.

Figure 126:
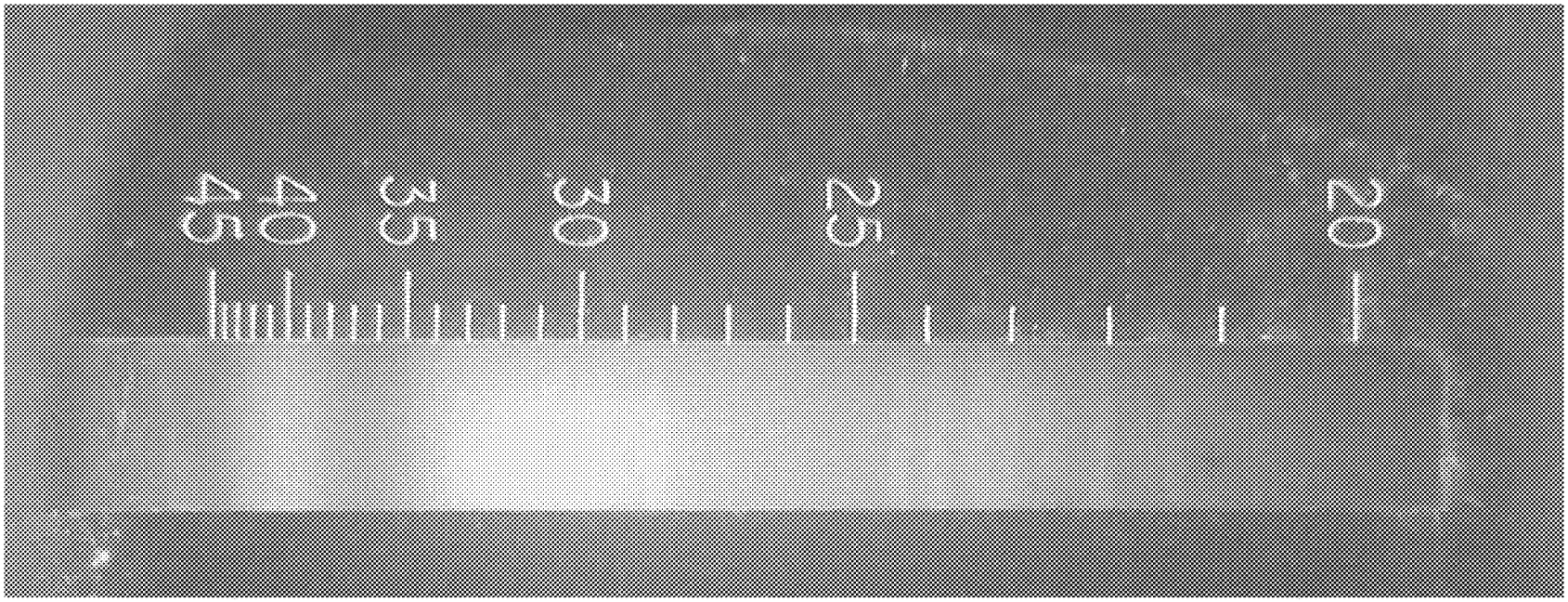

FIG. 126 shows the spectral lines produced from yttrium to uranium.

Figure 127:
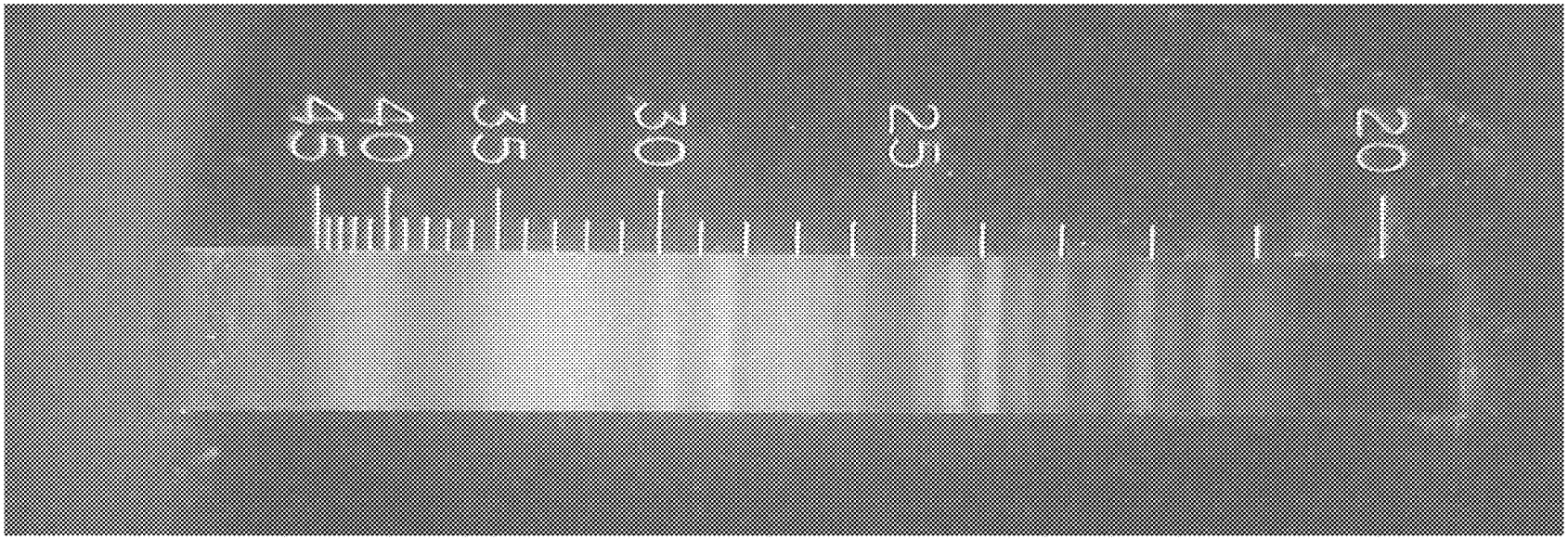

FIG. 127 shows the spectral lines produced from yttrium to zirconium.

Figure 128:
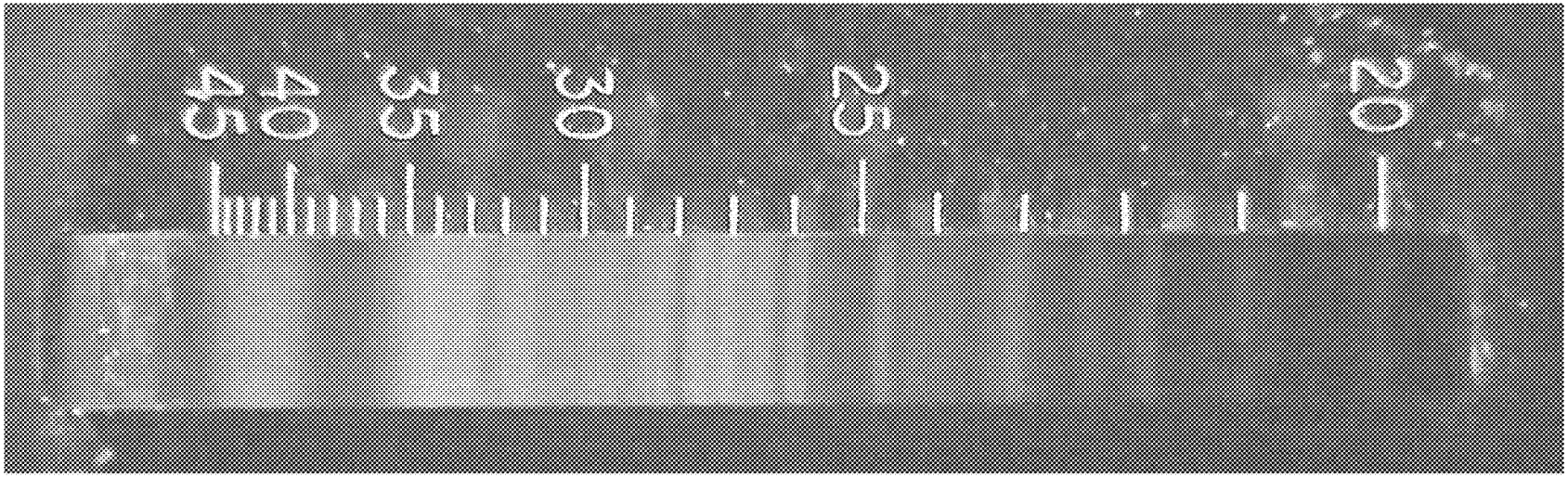

FIG. 128 shows the spectral lines produced from zirconium to 6061 aluminum.

Figure 129:
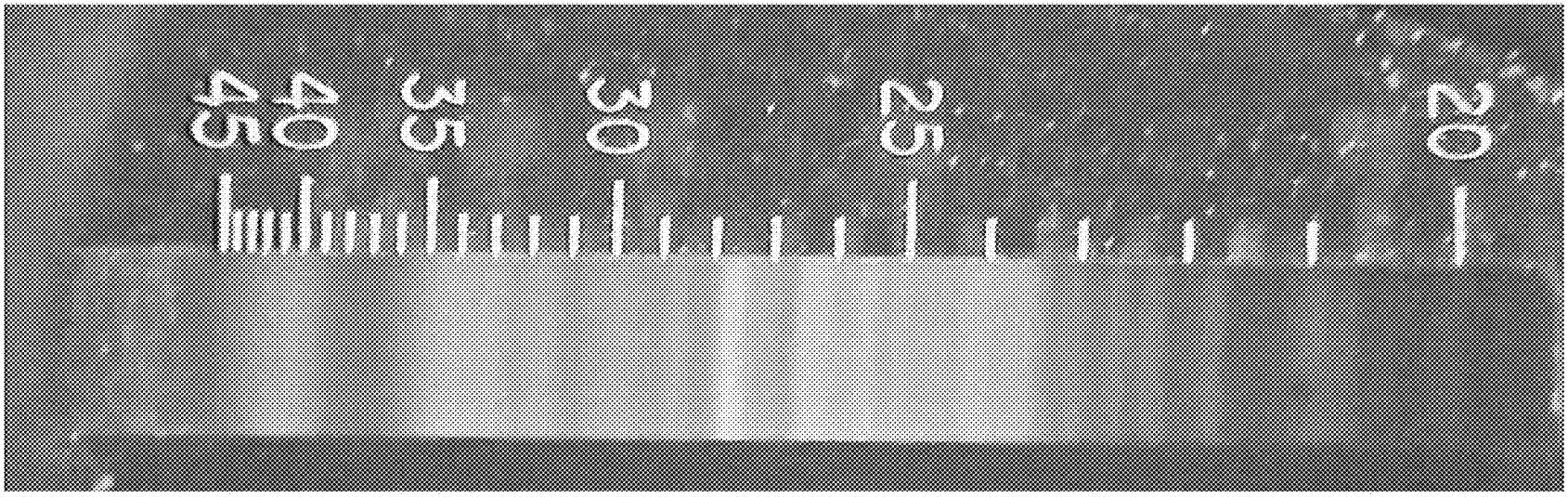

FIG. 129 shows the spectral lines produced from zirconium to iron.

Figure 130:
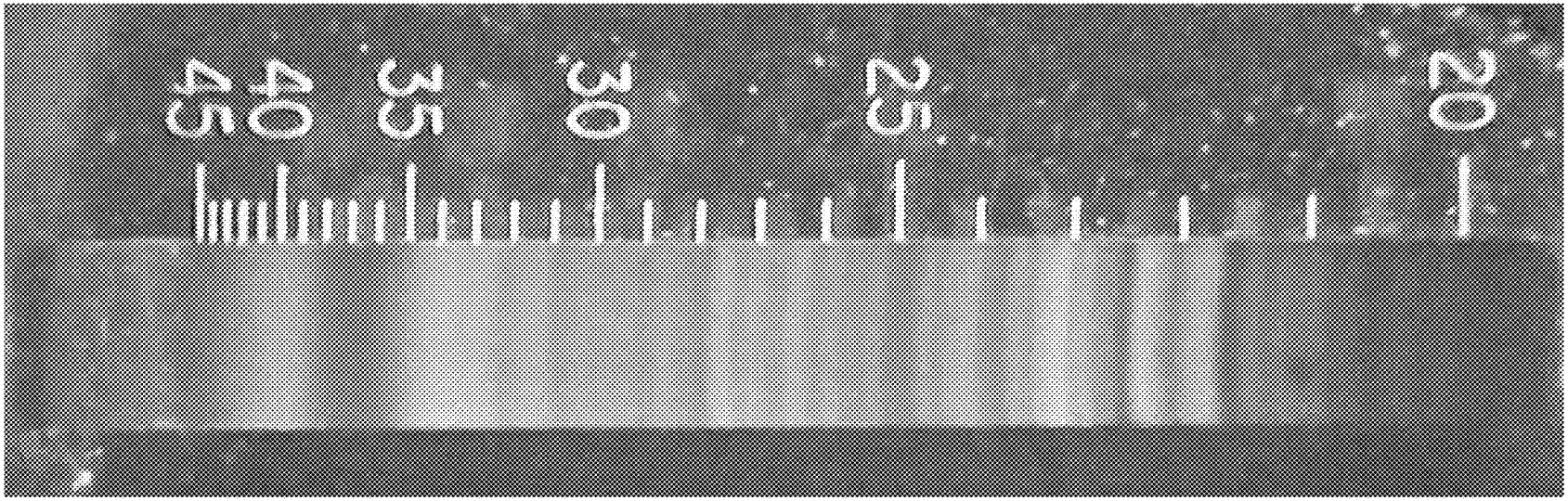

FIG. 130 shows the spectral lines produced from zirconium to nickel.

Figure 131:
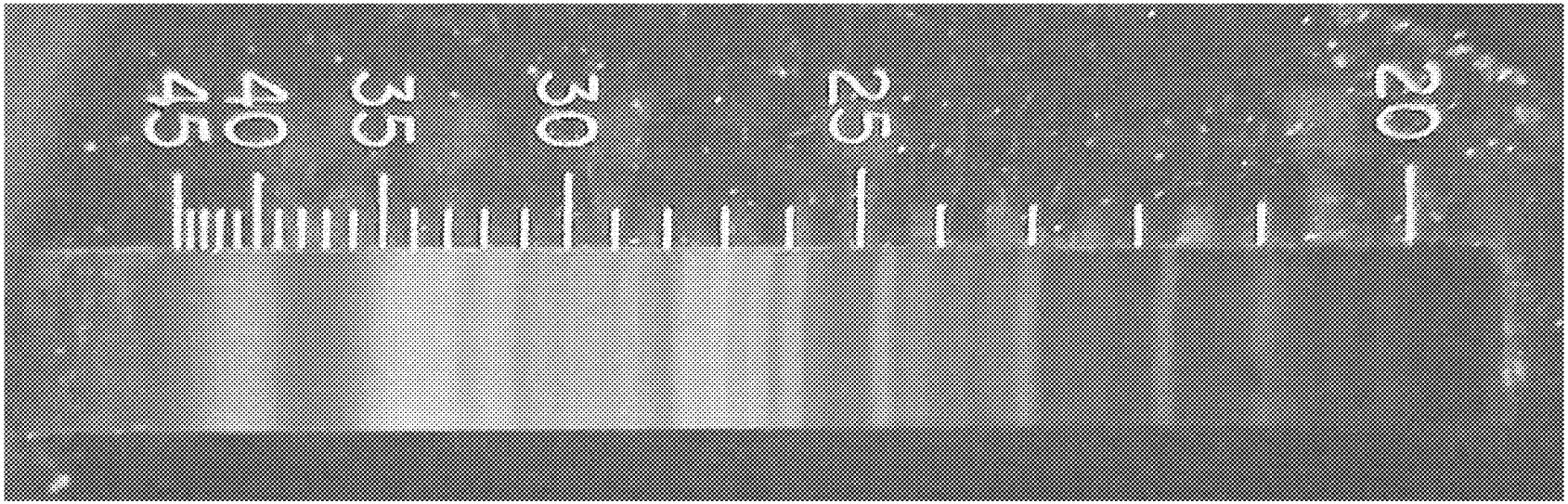

FIG. 131 shows the spectral lines produced from zirconium to tungsten.

Figure 132:
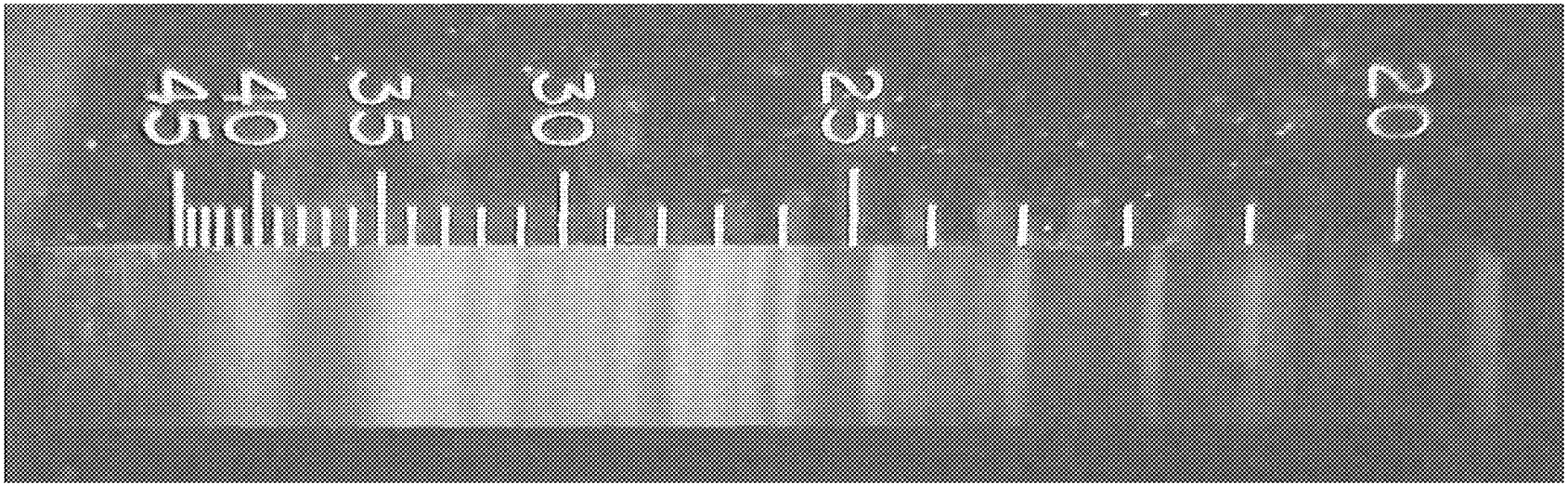

FIG. 132 shows the spectral lines produced from zirconium to zirconium.

Figure 133:
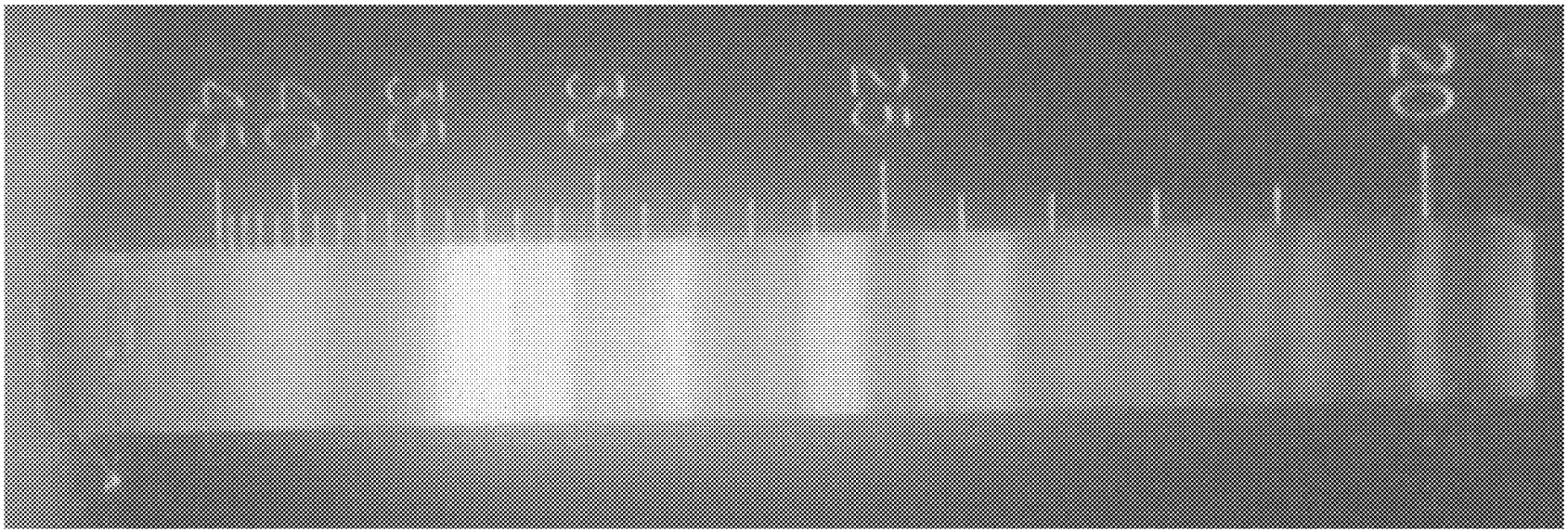

FIG. 133 shows the spectral lines produced from titanium to aluminum.

Figure 134:
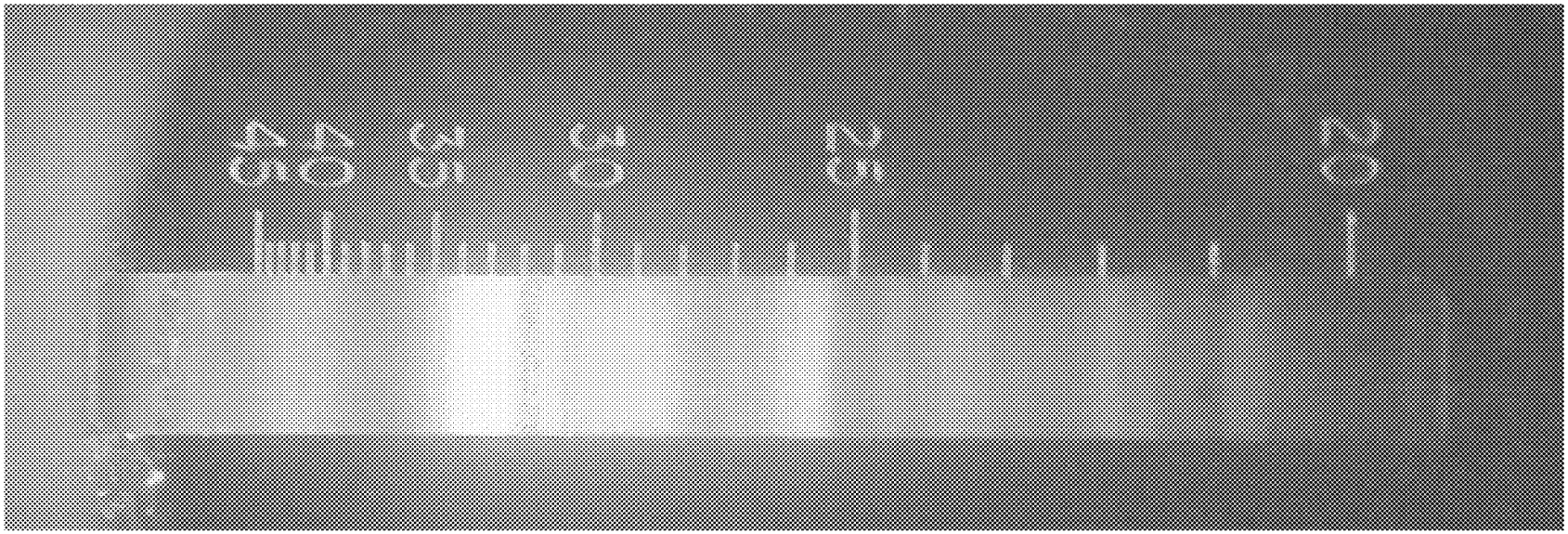

FIG. 134 shows the spectral lines produced from titanium to antimony.

Figure 135:
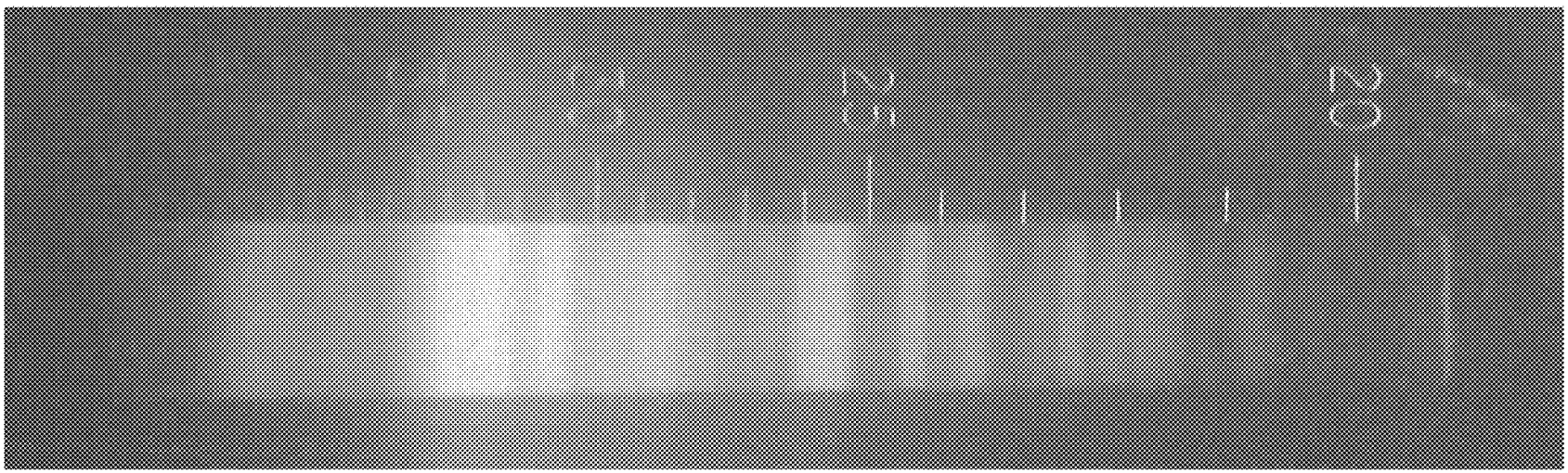

FIG. 135 shows the spectral lines produced from titanium to bismuth.

Figure 136:
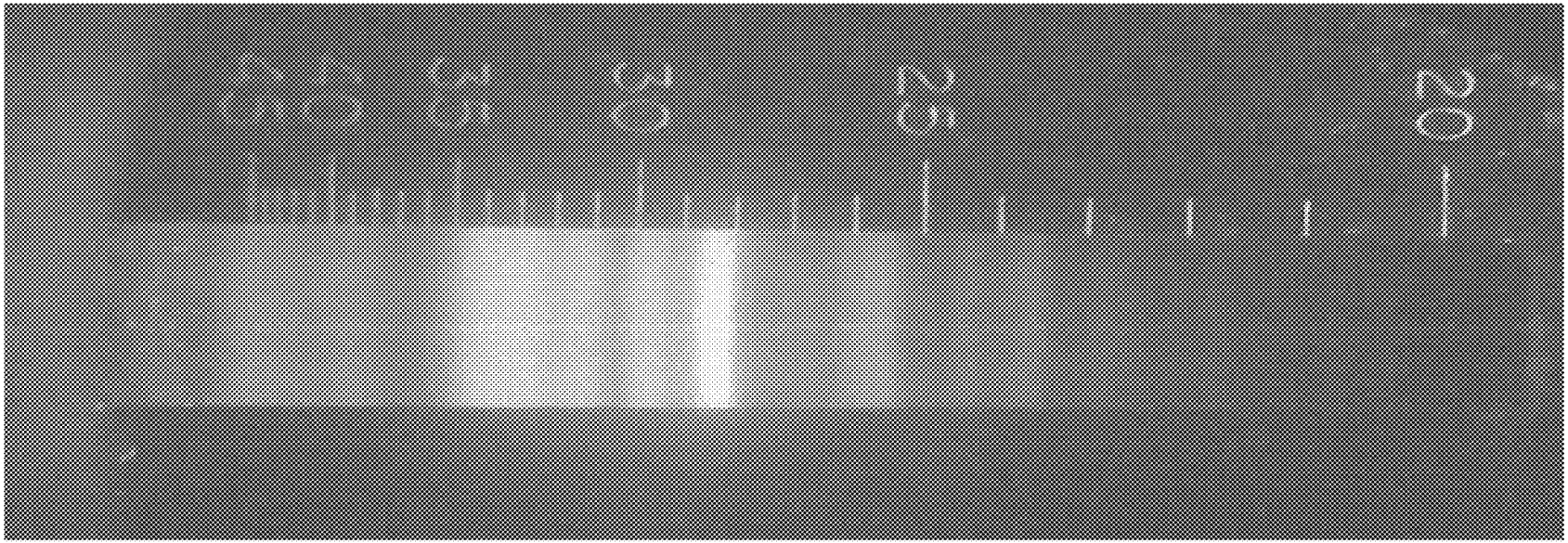

FIG. 136 shows the spectral lines produced from titanium to cadmium.

Figure 137:
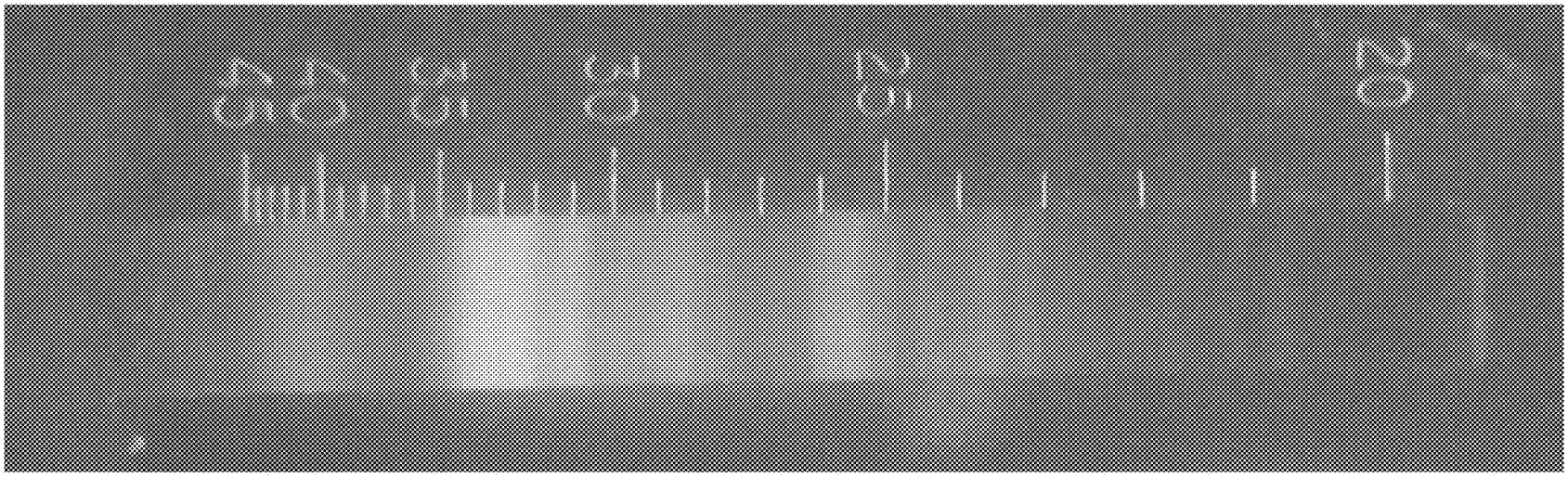

FIG. 137 shows the spectral lines produced from titanium to carbon.

Figure 138:
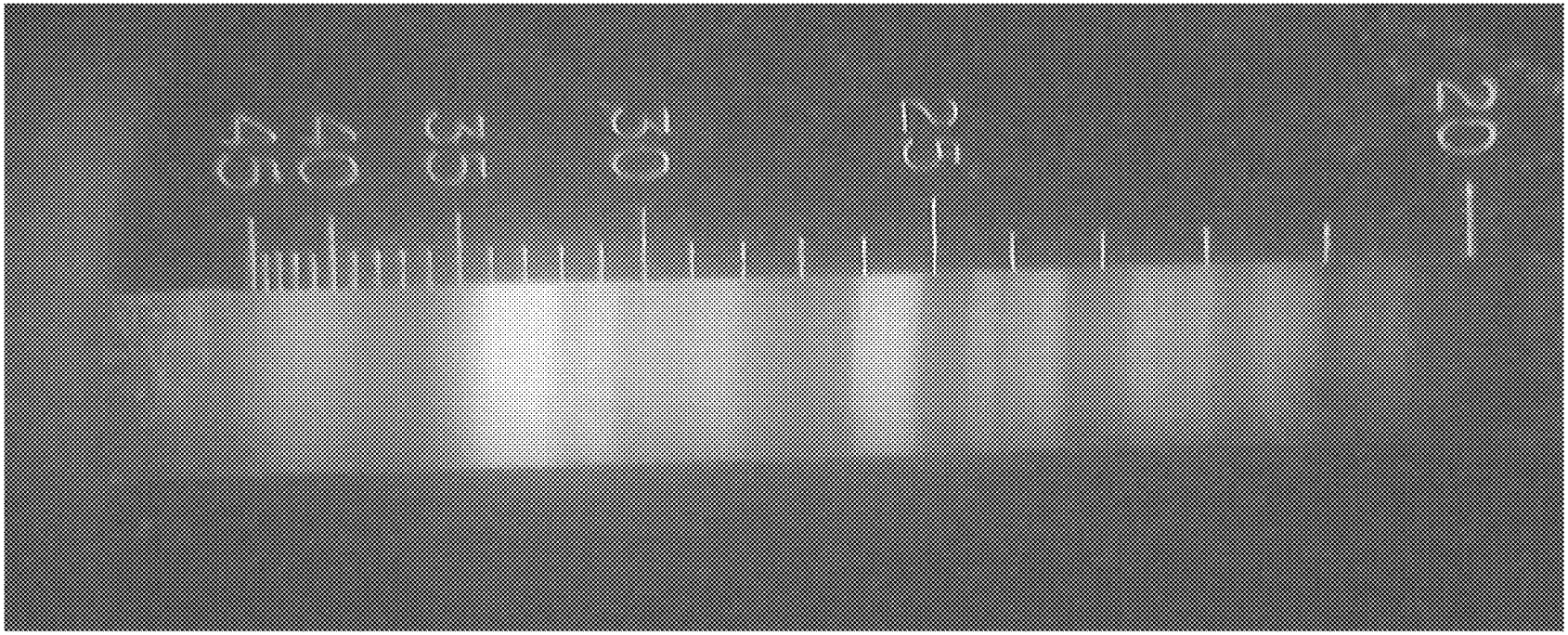

FIG. 138 shows the spectral lines produced from titanium to copper.

Figure 139:
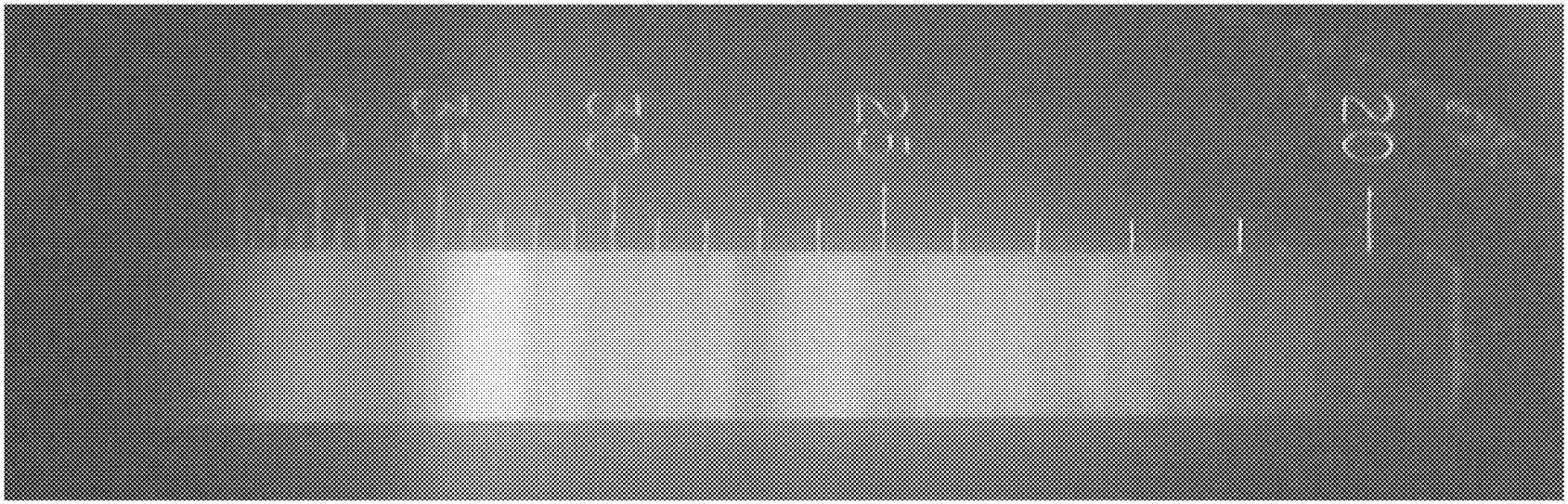

FIG. 139 shows the spectral lines produced from titanium to dysprosium.

Figure 140:
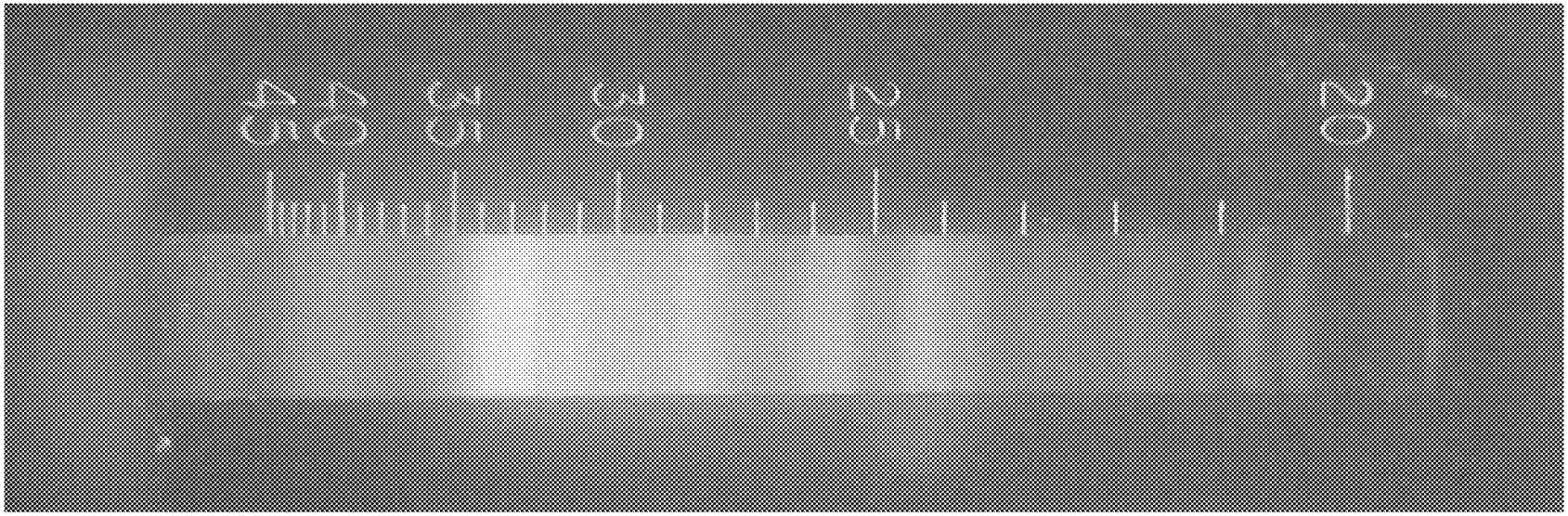

FIG. 140 shows the spectral lines produced from titanium to erbium.

Figure 141:
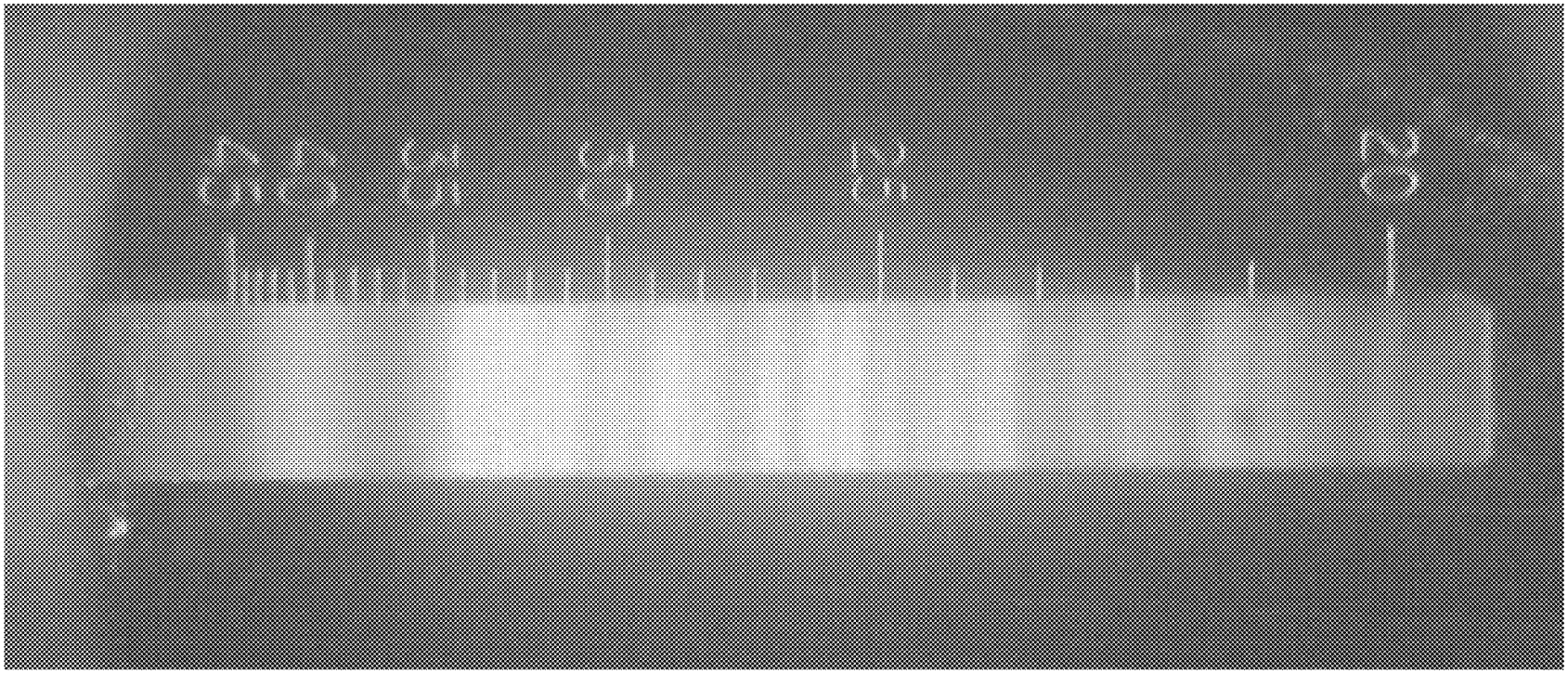

FIG. 141 shows the spectral lines produced from titanium to hafnium.

Figure 142:
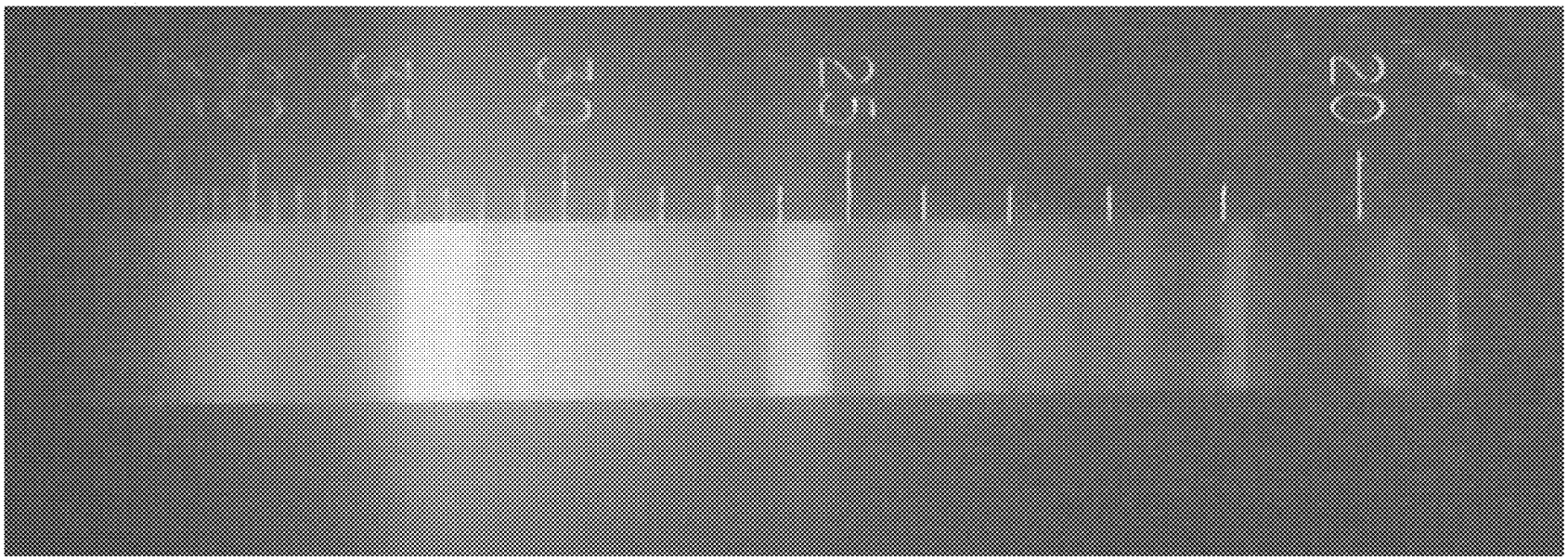

FIG. 142 shows the spectral lines produced from titanium to indium.

Figure 143:
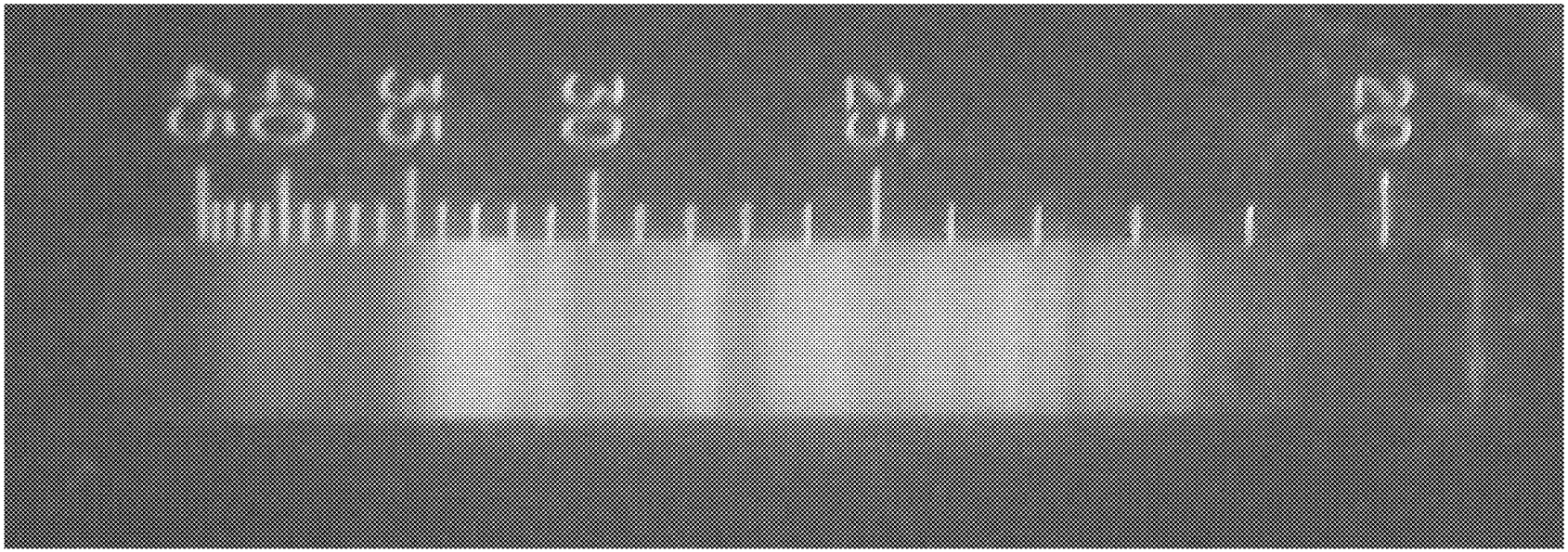

FIG. 143 shows the spectral lines produced from titanium to iron.

Figure 144:
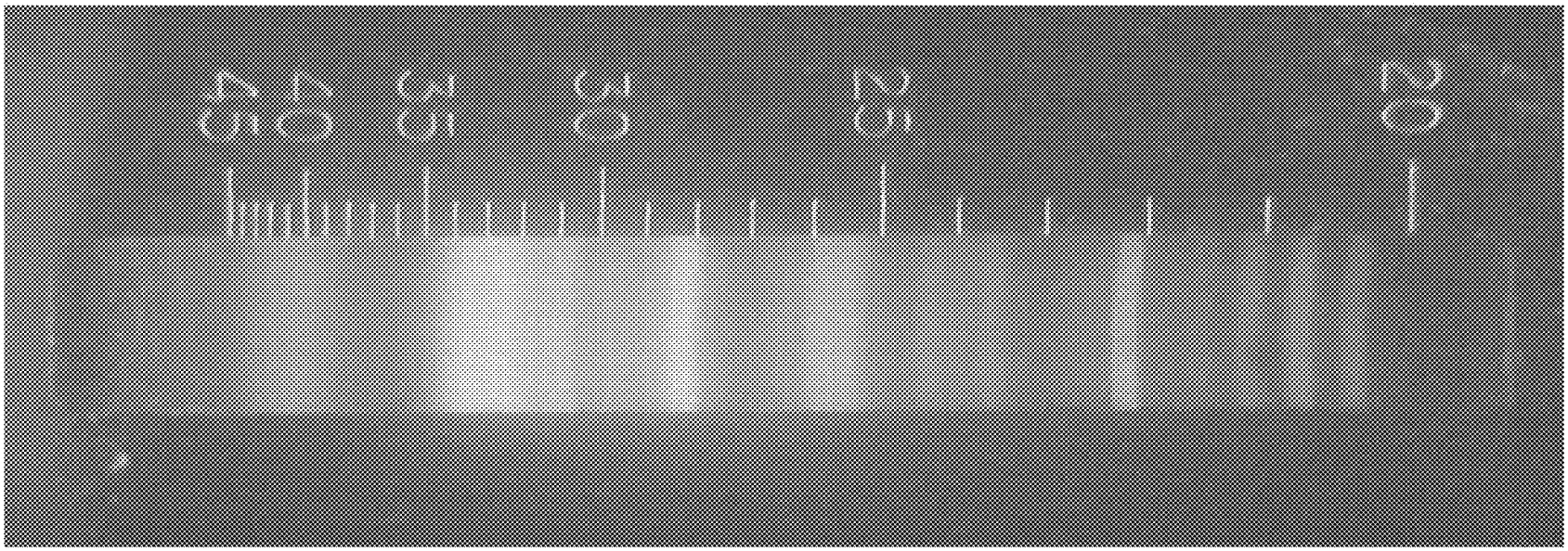

FIG. 144 shows the spectral lines produced from titanium to lead.

Figure 145:
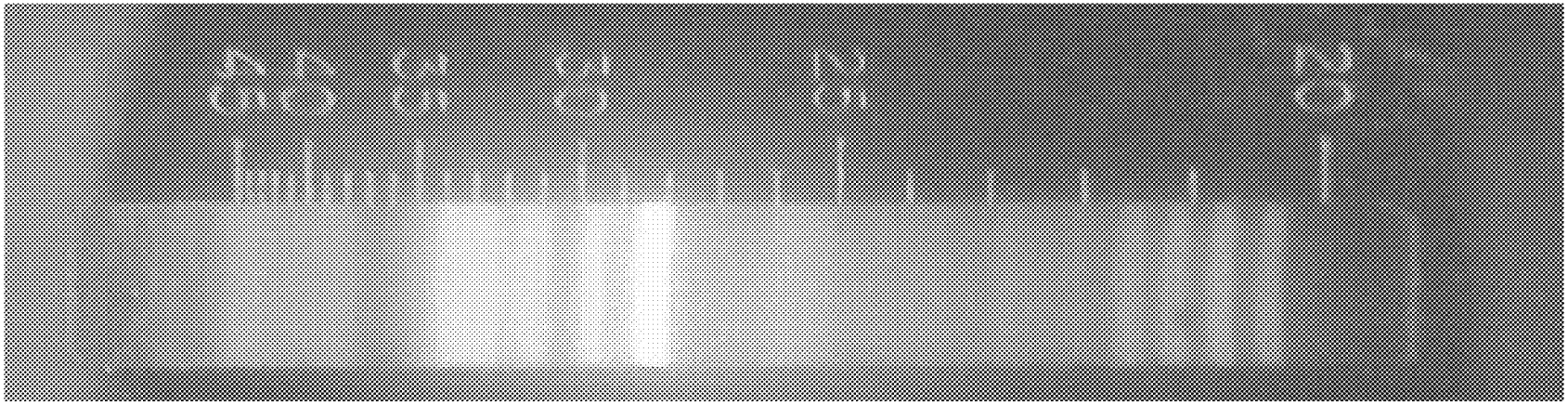

FIG. 145 shows the spectral lines produced from titanium to magnesium.

Figure 146:
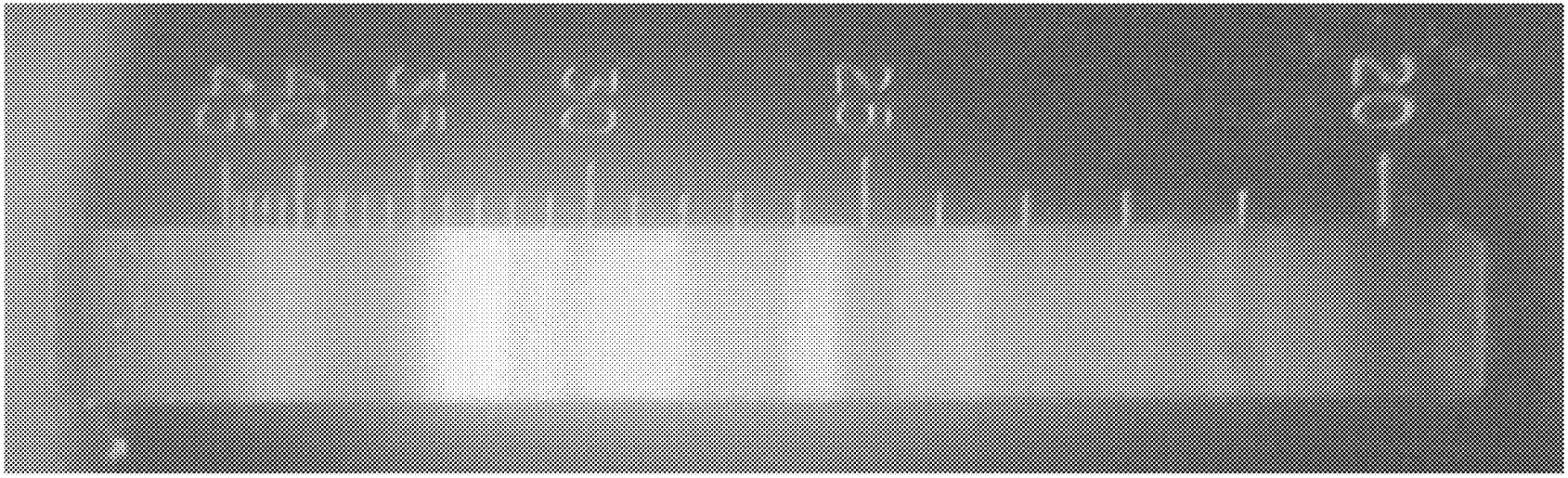

FIG. 146 shows the spectral lines produced from titanium to molybdenum.

Figure 147:
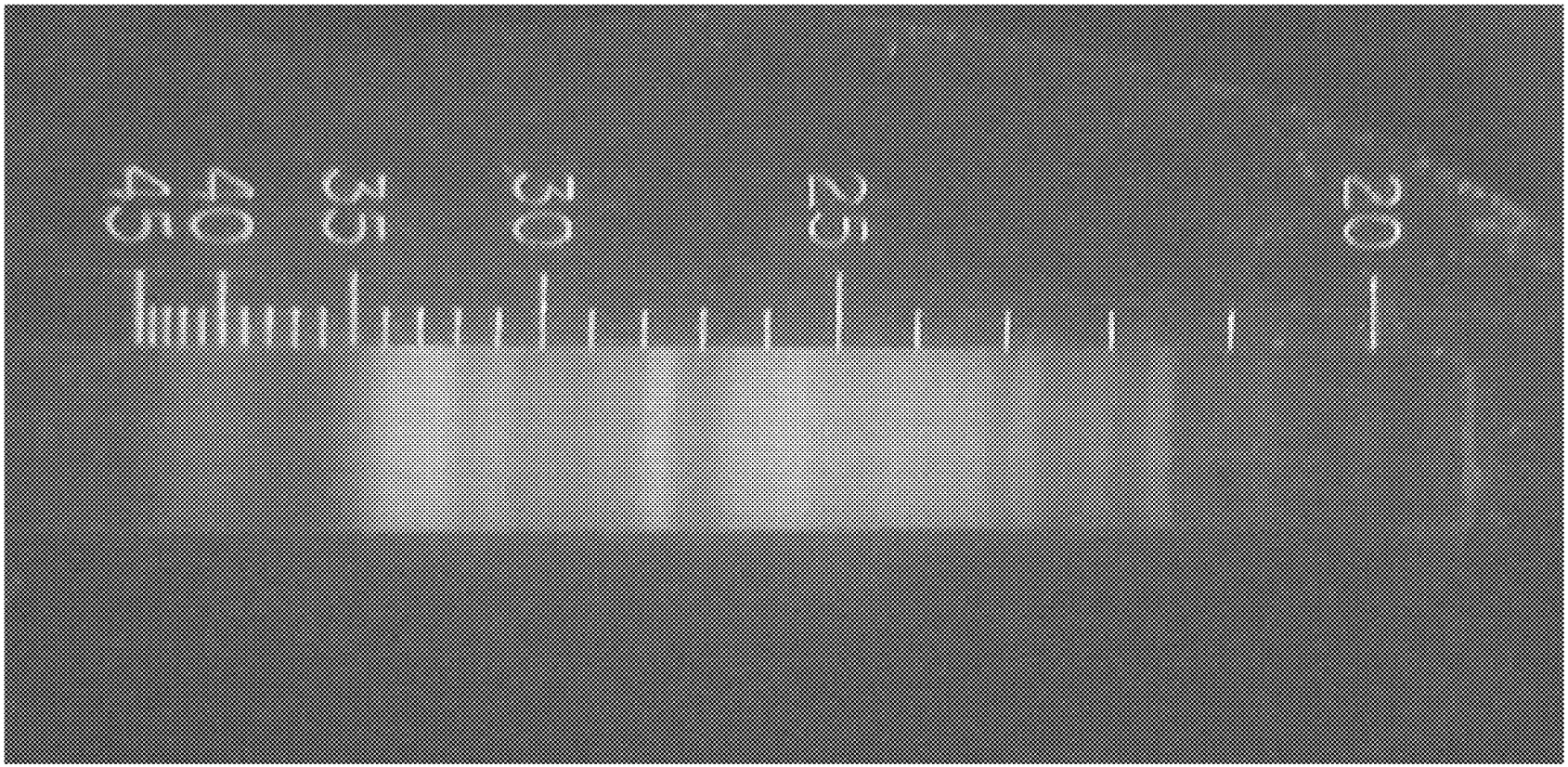

FIG. 147 shows the spectral lines produced from titanium to nickel.

Figure 148:
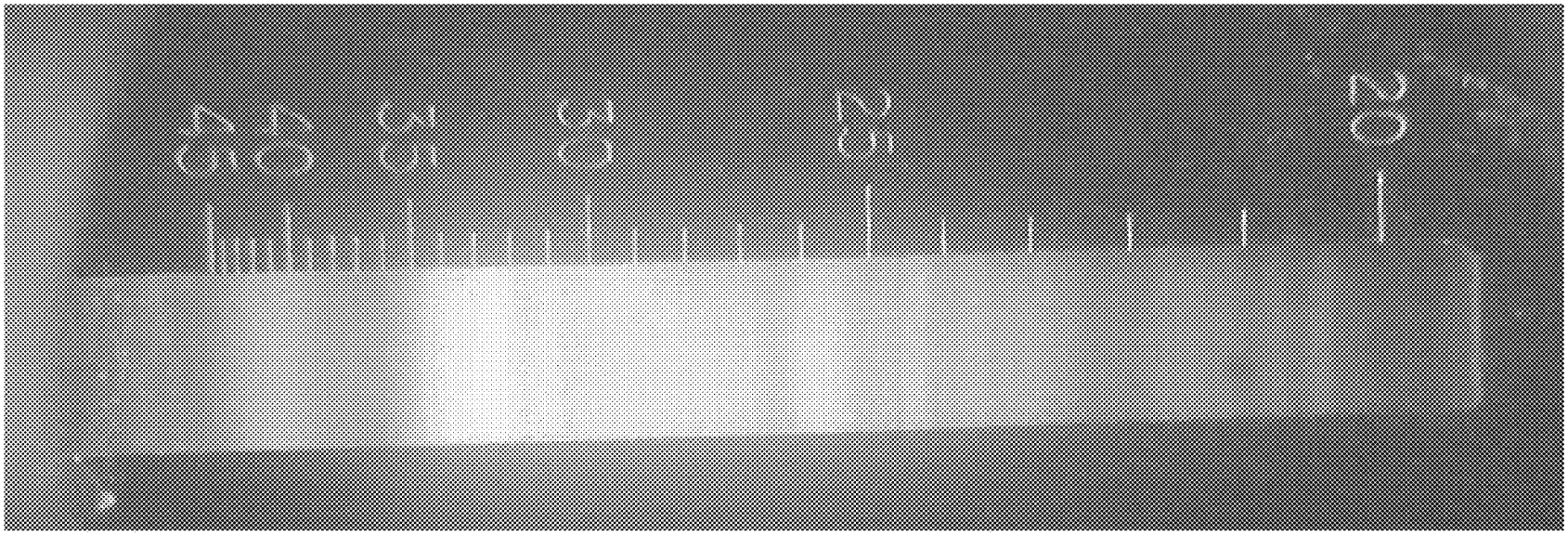

FIG. 148 shows the spectral lines produced from titanium to niobium.

Figure 149:
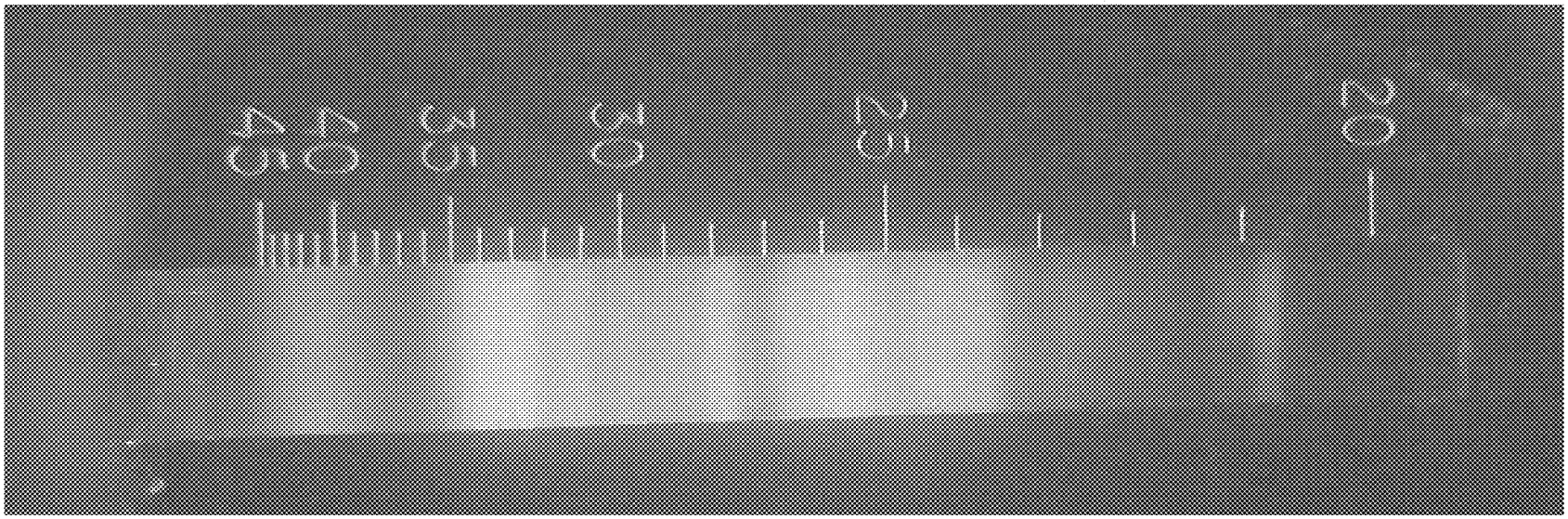

FIG. 149 shows the spectral lines produced from titanium to niobium chromium.

Figure 150:
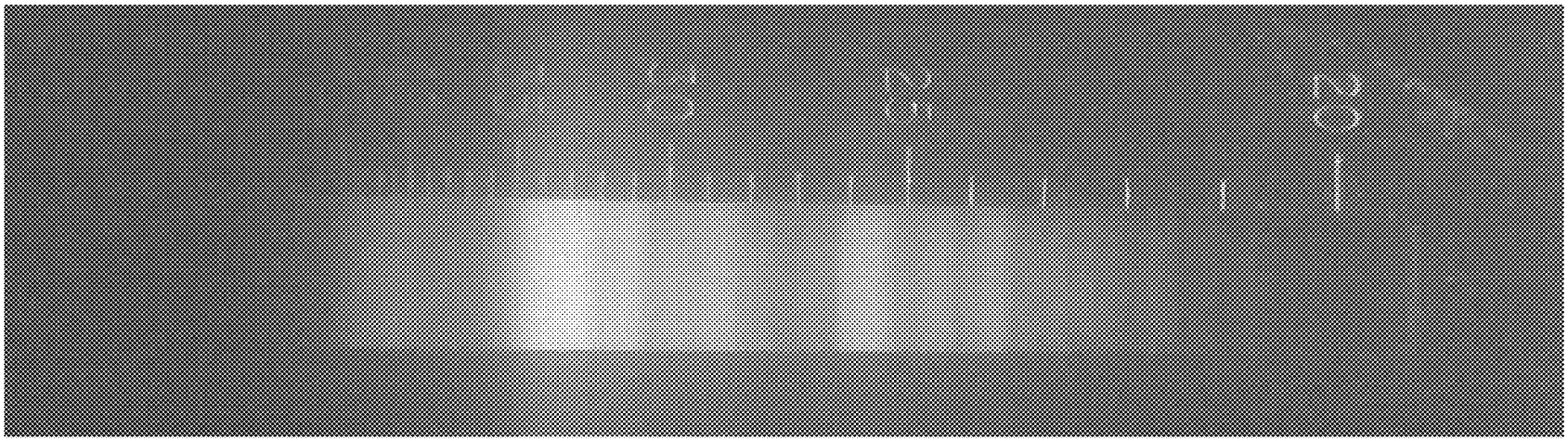

FIG. 150 shows the spectral lines produced from titanium to palladium.

Figure 151:
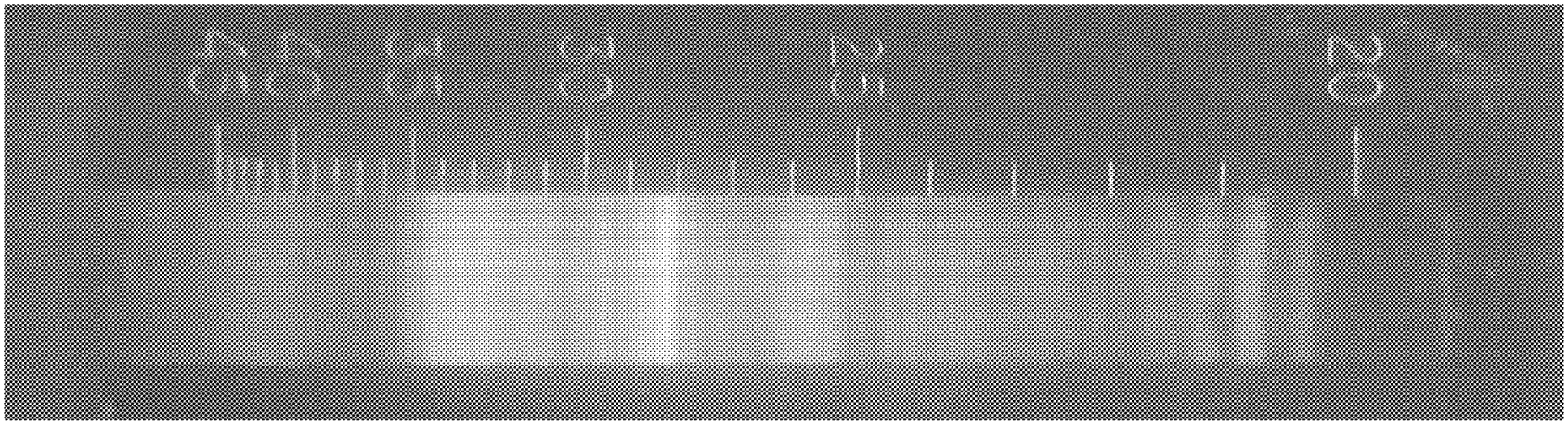

FIG. 151 shows the spectral lines produced from titanium to Rexalloy.

Figure 152:
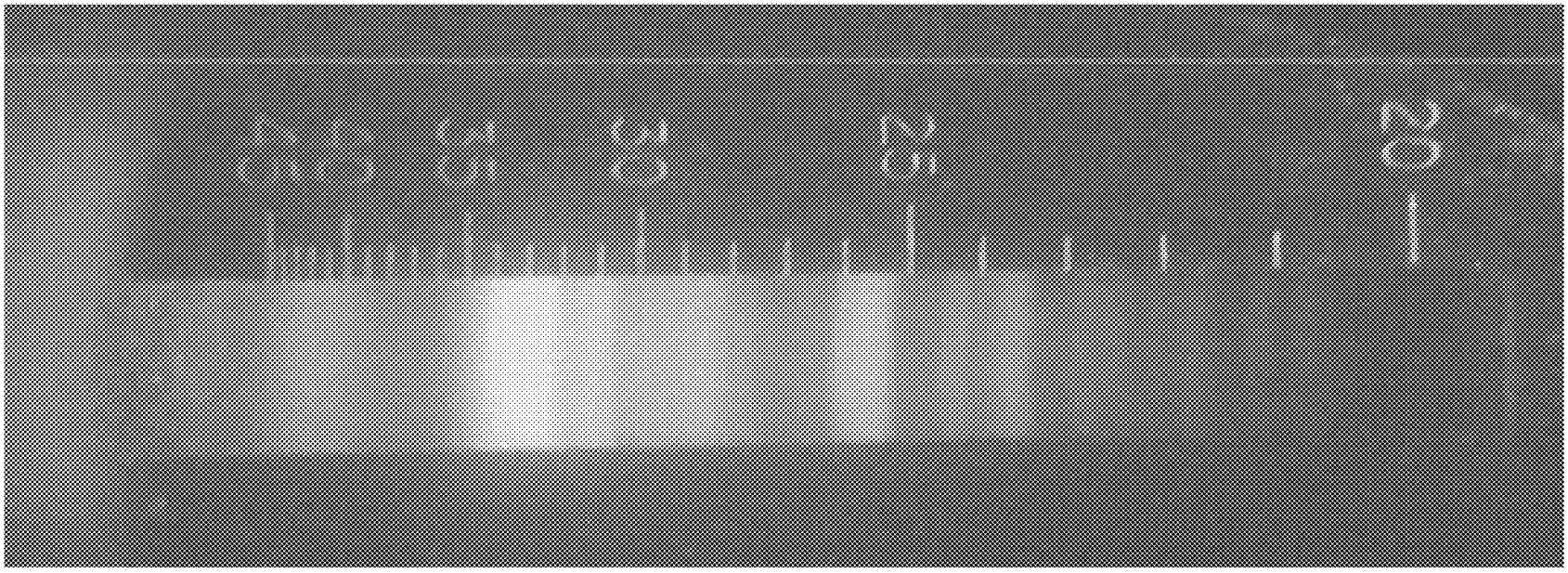

FIG. 152 shows the spectral lines produced from titanium to rhenium.

Figure 153:
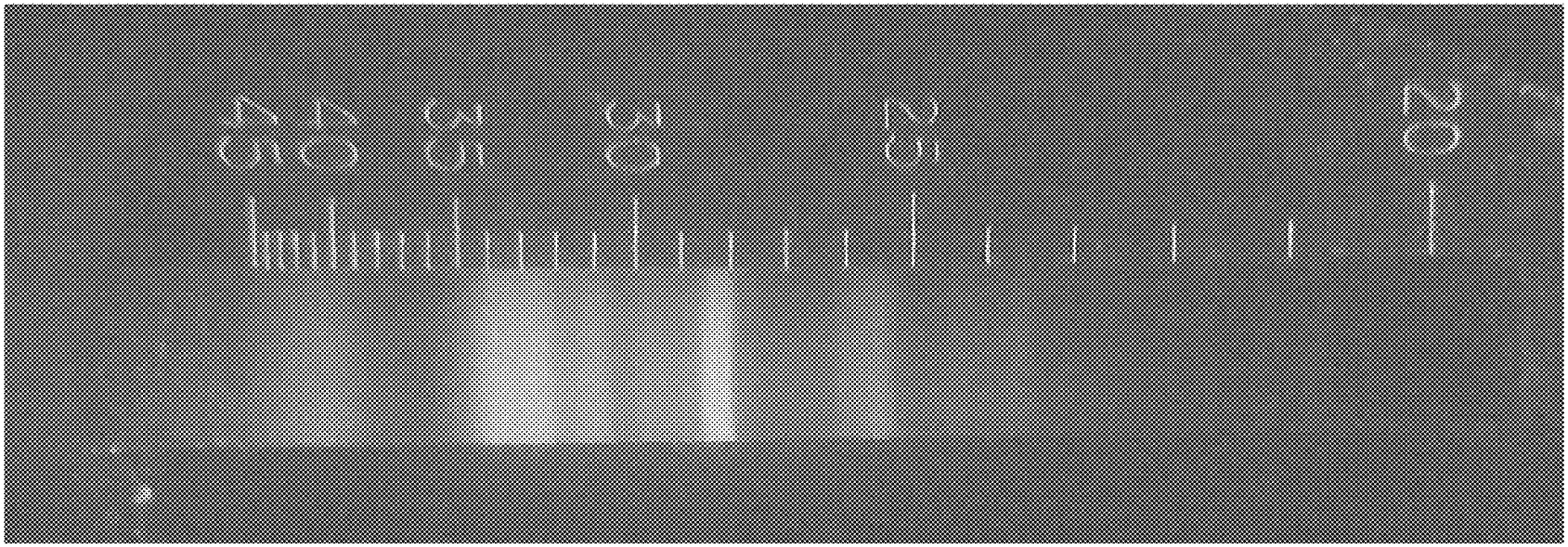

FIG. 153 shows the spectral lines produced from titanium to silicon.

Figure 154:
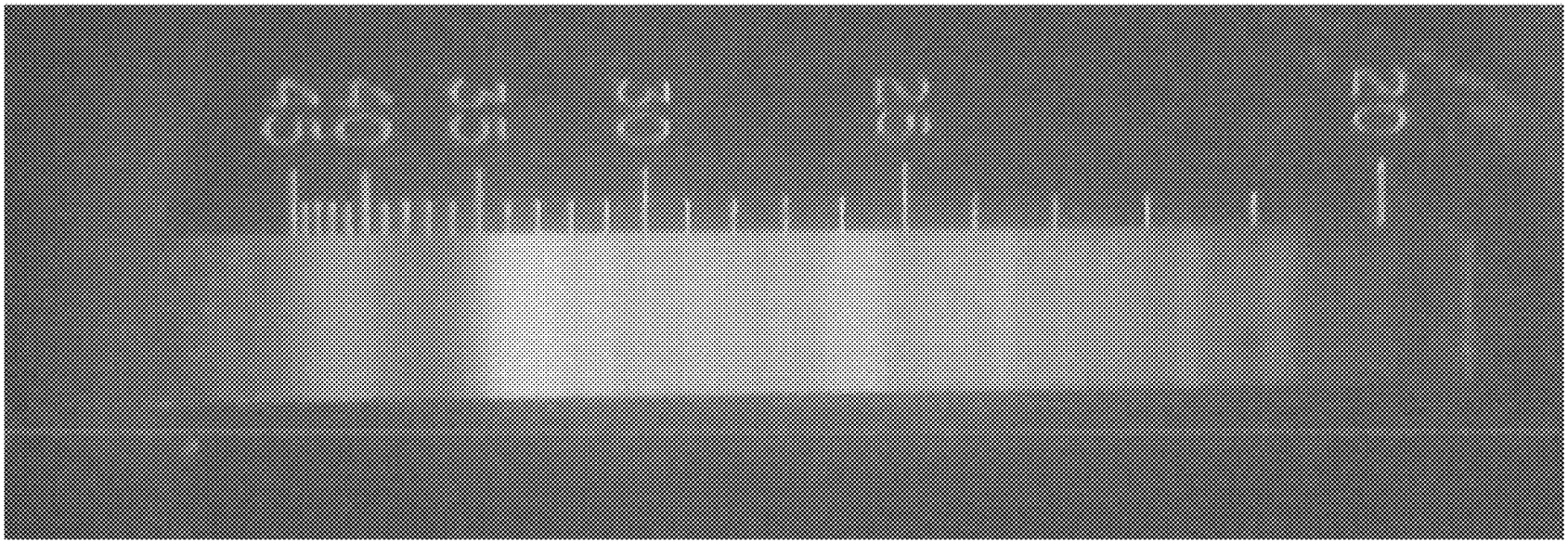

FIG. 154 shows the spectral lines produced from titanium to tantalum.

Figure 155:
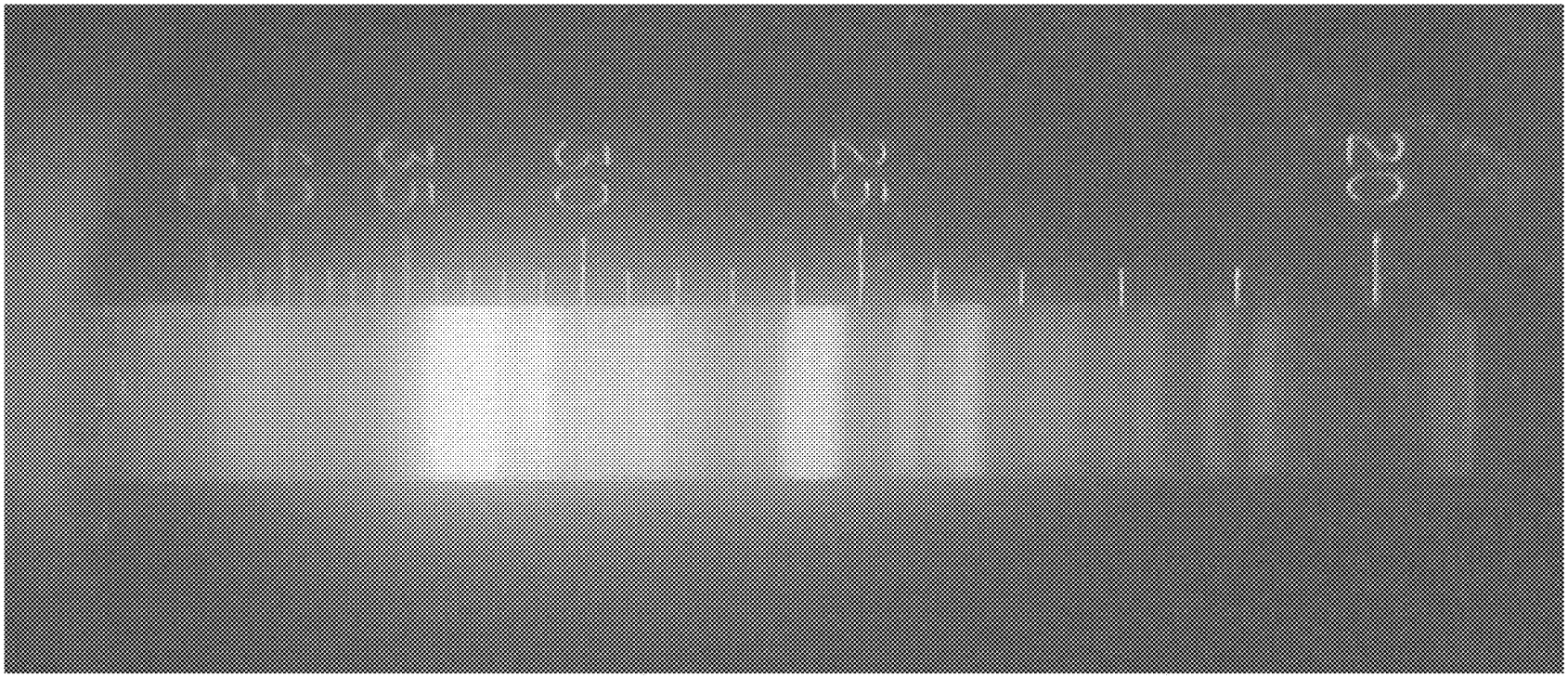

FIG. 155 shows the spectral lines produced from titanium to titanium.

Figure 156:
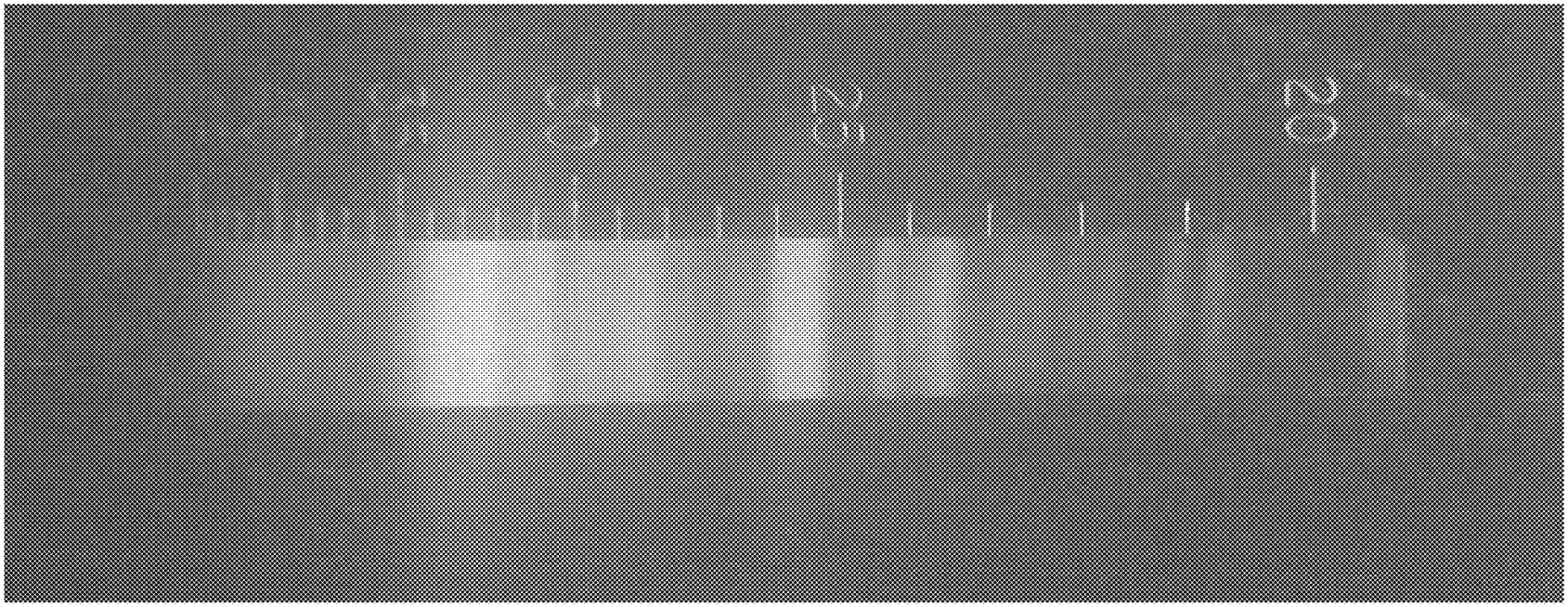

FIG. 156 shows the spectral lines produced from titanium to tungsten.

Figure 157:
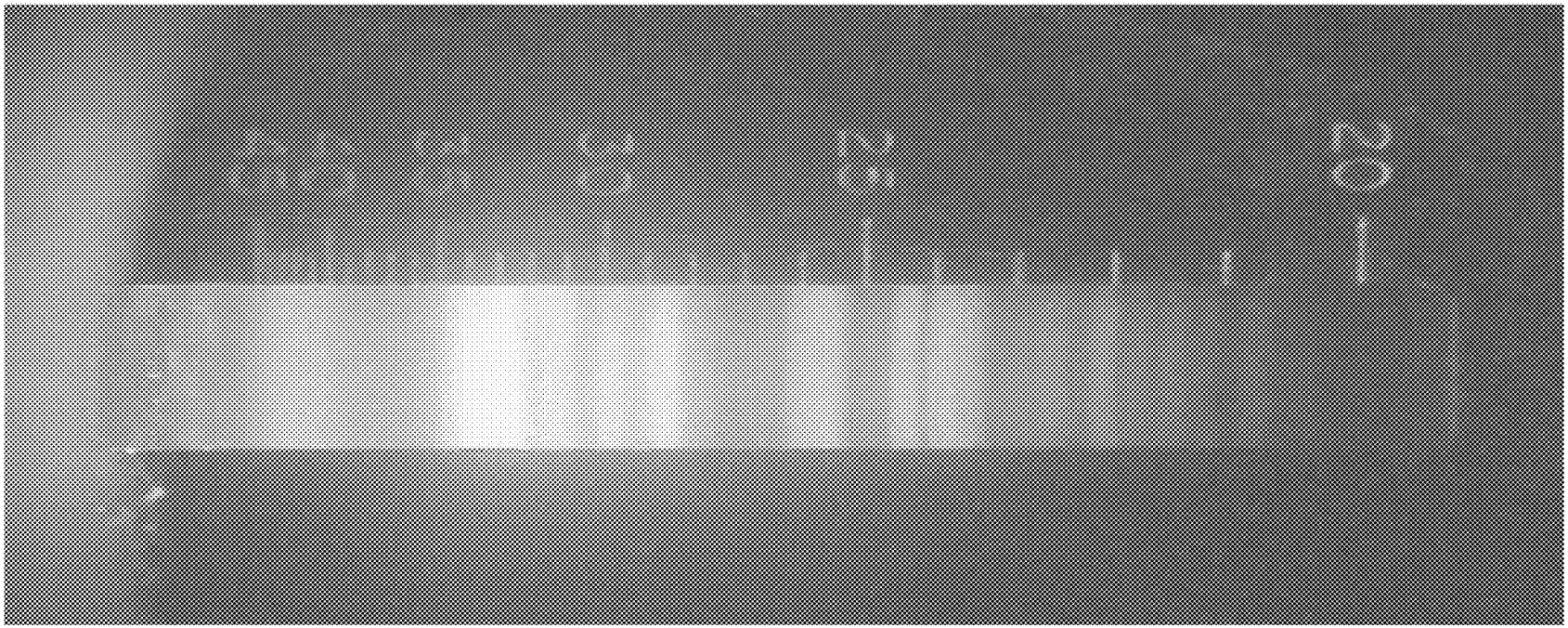

FIG. 157 shows the spectral lines produced from titanium to yttrium.

Figure 158:
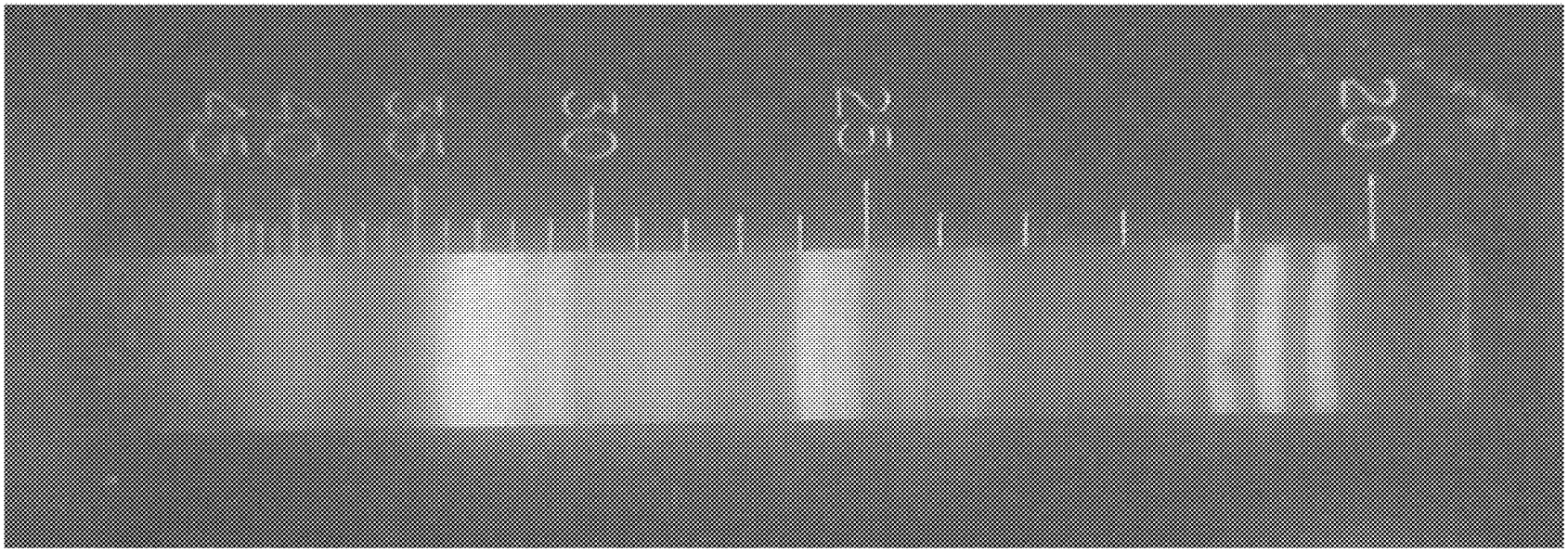

FIG. 158 shows the spectral lines produced from titanium to zinc.

Figure 159:
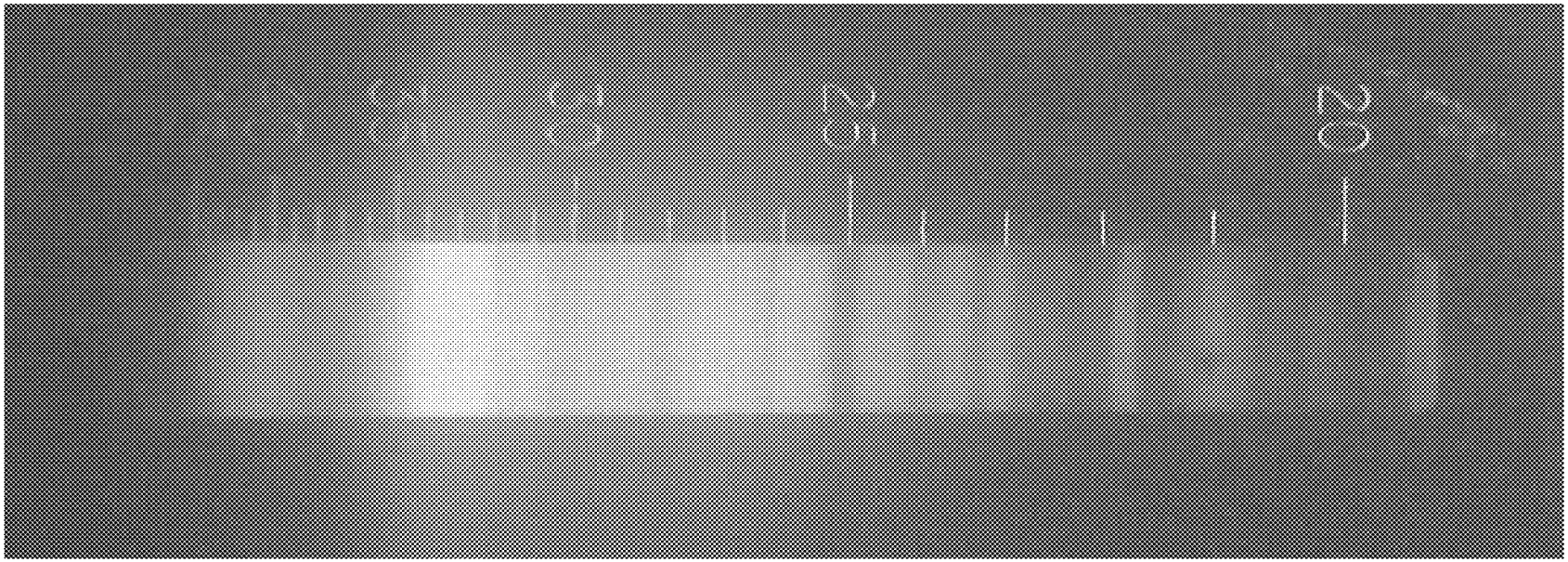

FIG. 159 shows the spectral lines produced from titanium to zirconium.

Figure 160:
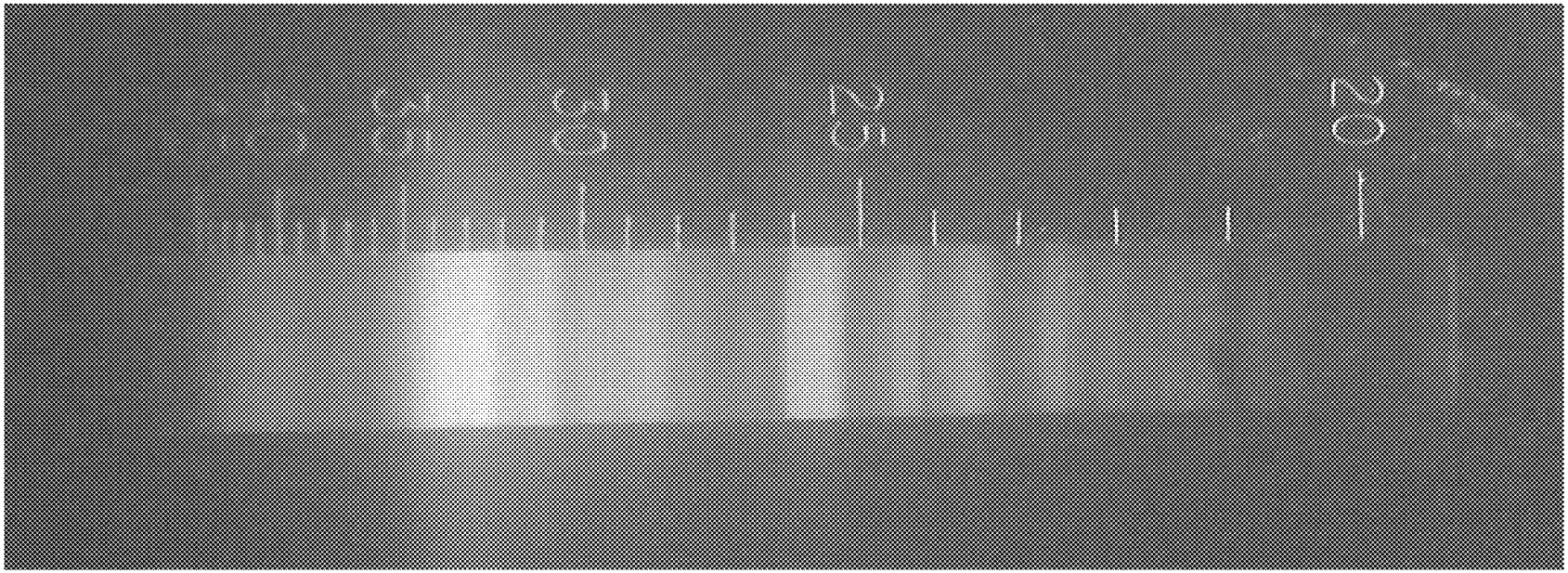

FIG. 160 shows the spectral lines produced from titanium to 25% silver 75% copper.

Figure 161:
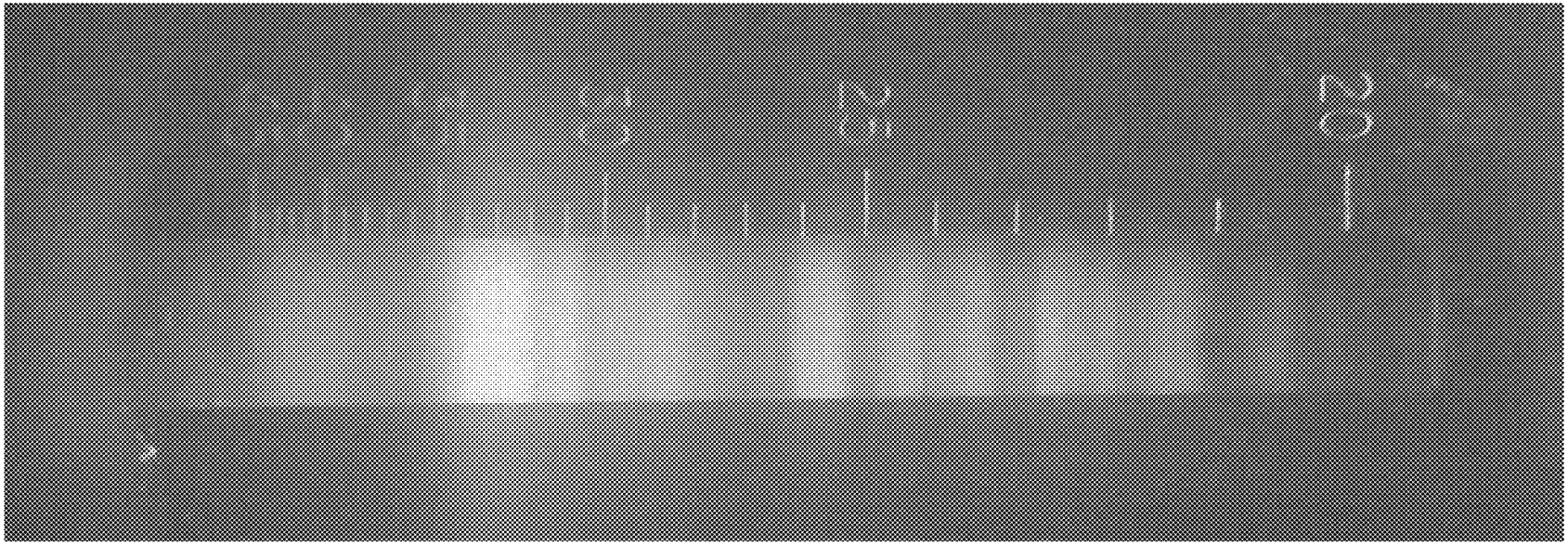

FIG. 161 shows the spectral lines produced from titanium to 50% copper 50% silver.

Figure 162:
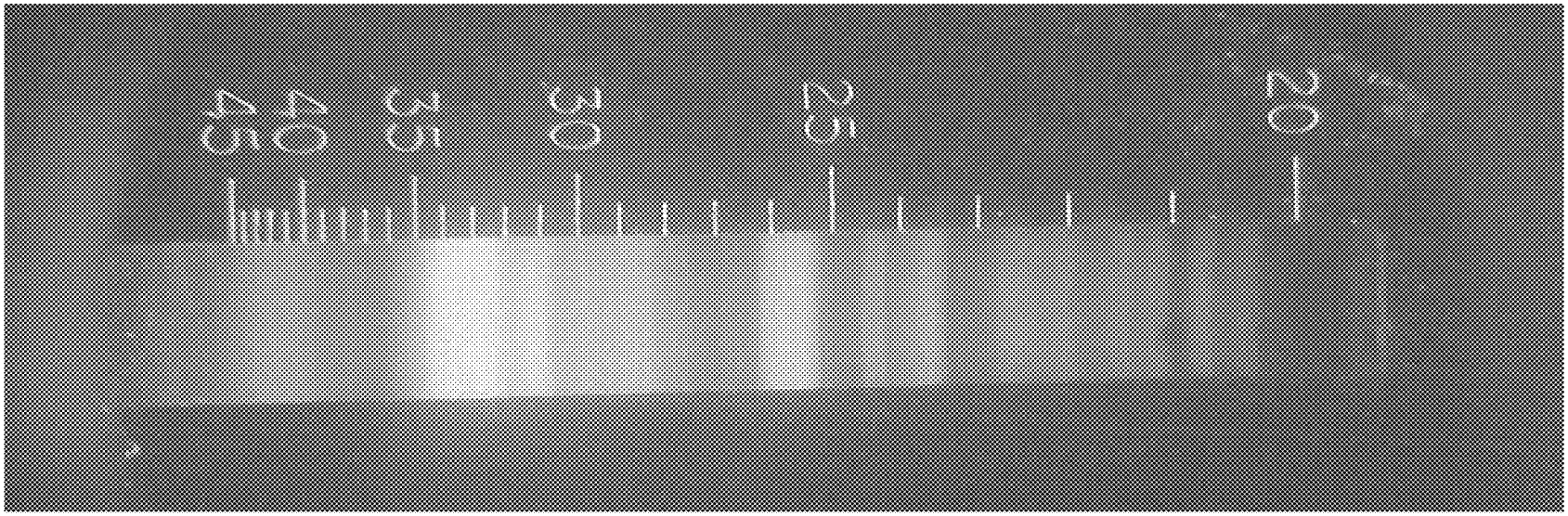

FIG. 162 shows the spectral lines produced from titanium to 60% copper 40% zinc.

FIG. 163 shows the spectral lines produced from titanium to 6061 aluminum.

For reference, some of the materials used for these spectrographs are as follows:

6061 aluminum, standard grade, bar stock
304 stainless steel, standard grade, bar stock
360 brass, standard grade, bar stock
tungsten: 99.96% purity rod
copper: 99% purity powder
nickel: 99% purity powder
tin: 99% purity, cast ingot
magnesium: metal foil, 99%
indium: cast ingot, 99% purity
soft iron: 99% powder It is evident by studying the various alloys and mixtures that each combination of materials produces a unique ultraviolet spectrum; further even the same materials when used in different proportions produces unique ultraviolet spectra. The addition of different gases other than plain air, either at atmospheric pressure or slightly under vacuum or pressurized also influences the spectral output of the diverse materials. This alone, or when combined with gas discharges and/or corona discharges, presents unique spectra, for example, for ultraviolet research previously not explored.

Figure 164:
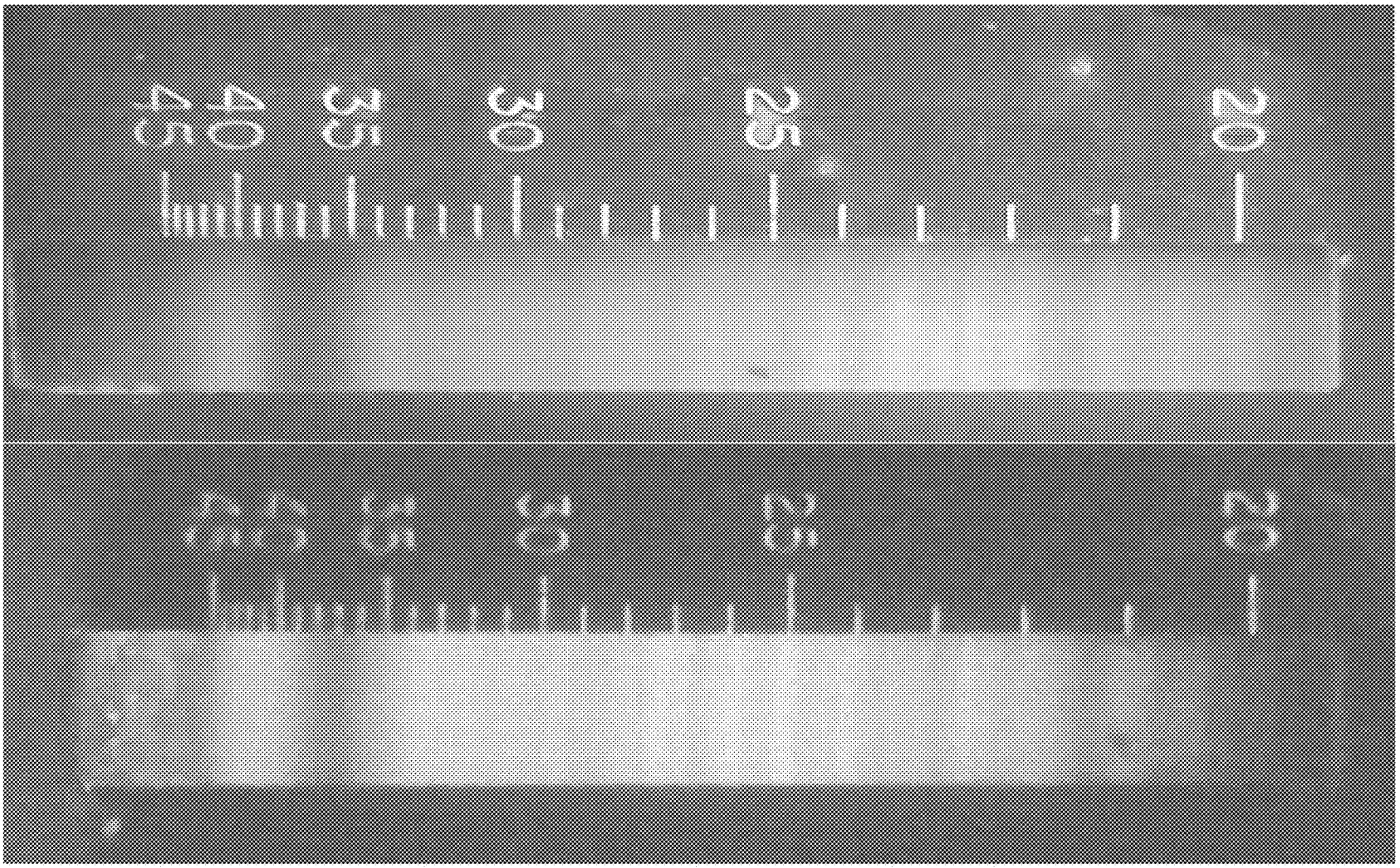
FIG. 164 shows the difference between pure elemental tungsten when operated under open air/normal atmosphere as compared to a pressurized environment of pure argon gas.

FIG. 164 shows a discharge between tungsten electrodes using the lamp in FIG. 12. To the left is the spectrograph showing plain air at normal atmospheric pressure. To the right is the spectrograph showing argon gas at 5 pounds pressure. The window material used is magnesium fluorite, and the spectrometer was placed 1" in front of the window under normal atmospheric pressure in common air. For reference, the transformer was set to produce 4600V at 24 mA with the capacitor adjusted to 0.015 microfarads. The spark gap was between pure tungsten electrodes 0.1875" in diameter set 0.09" apart. This equates to around 185 breaks per second with an energy of 0.27 joules.

Figure 165:
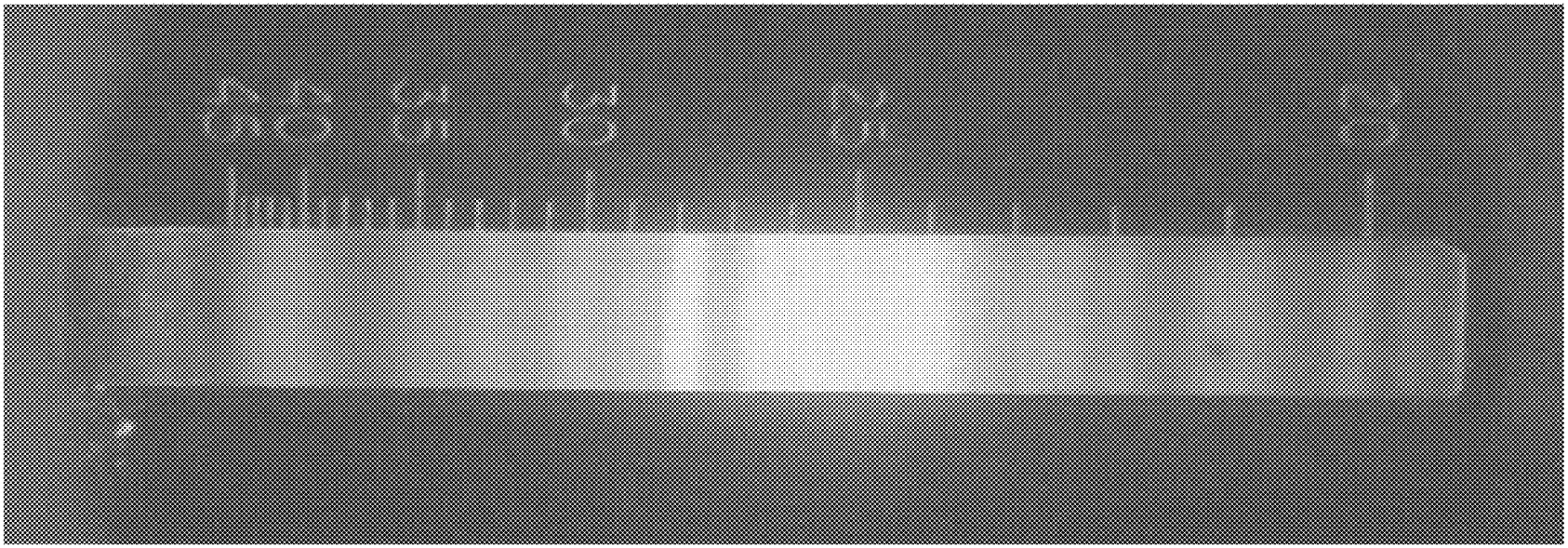
FIG. 165 shows the original ultraviolet spectrum of the meteorite Muonionalusta.

FIG. 165 shows the original ultraviolet spectrum of the meteorite Muonionalusta.

Figure 166:
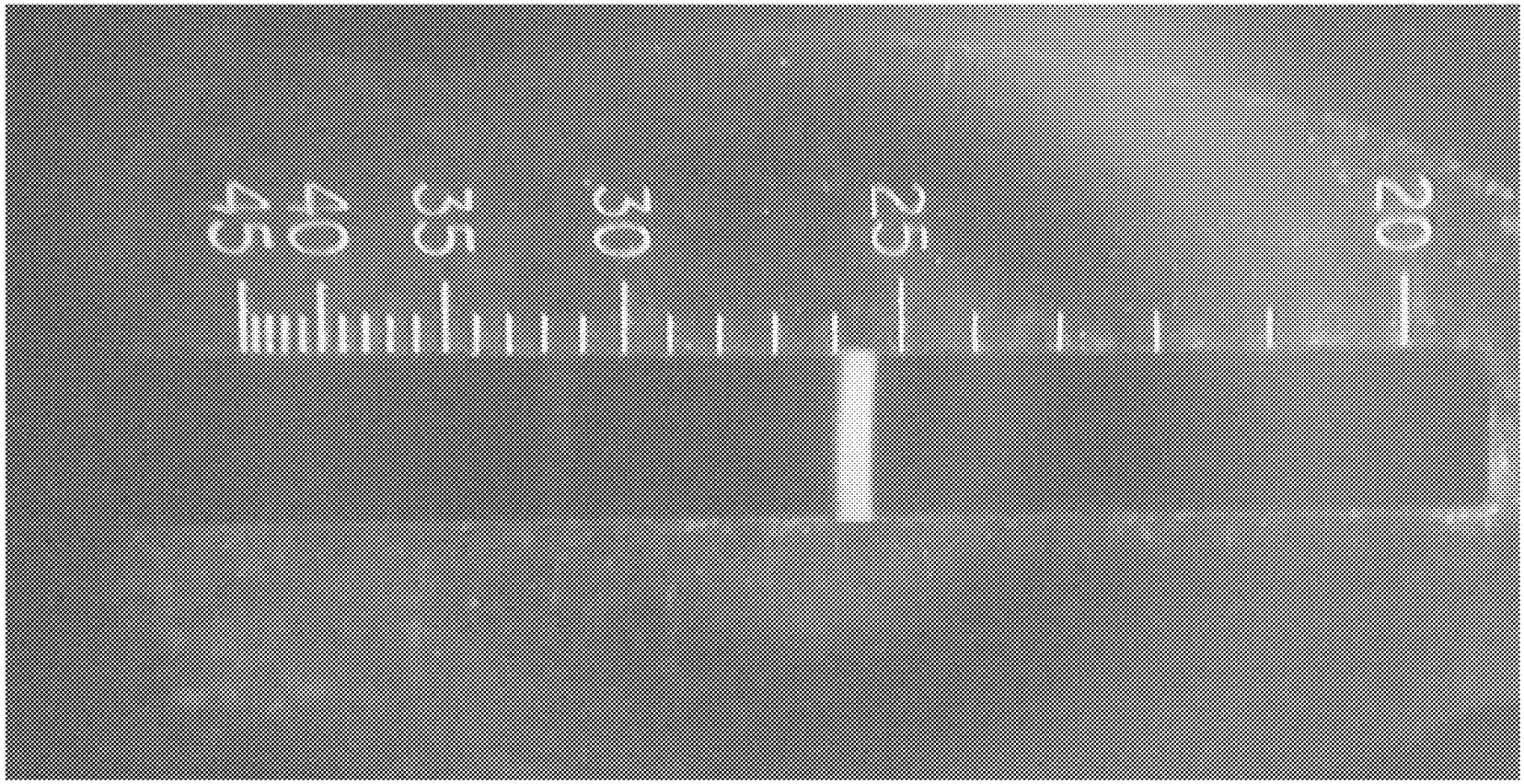
FIG. 166 shows the wavelengths of ultraviolet radiation produced by a low pressure mercury vapor lamp.

FIG. 166 shows the wavelengths of ultraviolet radiation produced by a low pressure mercury vapor lamp.

Figure 167:
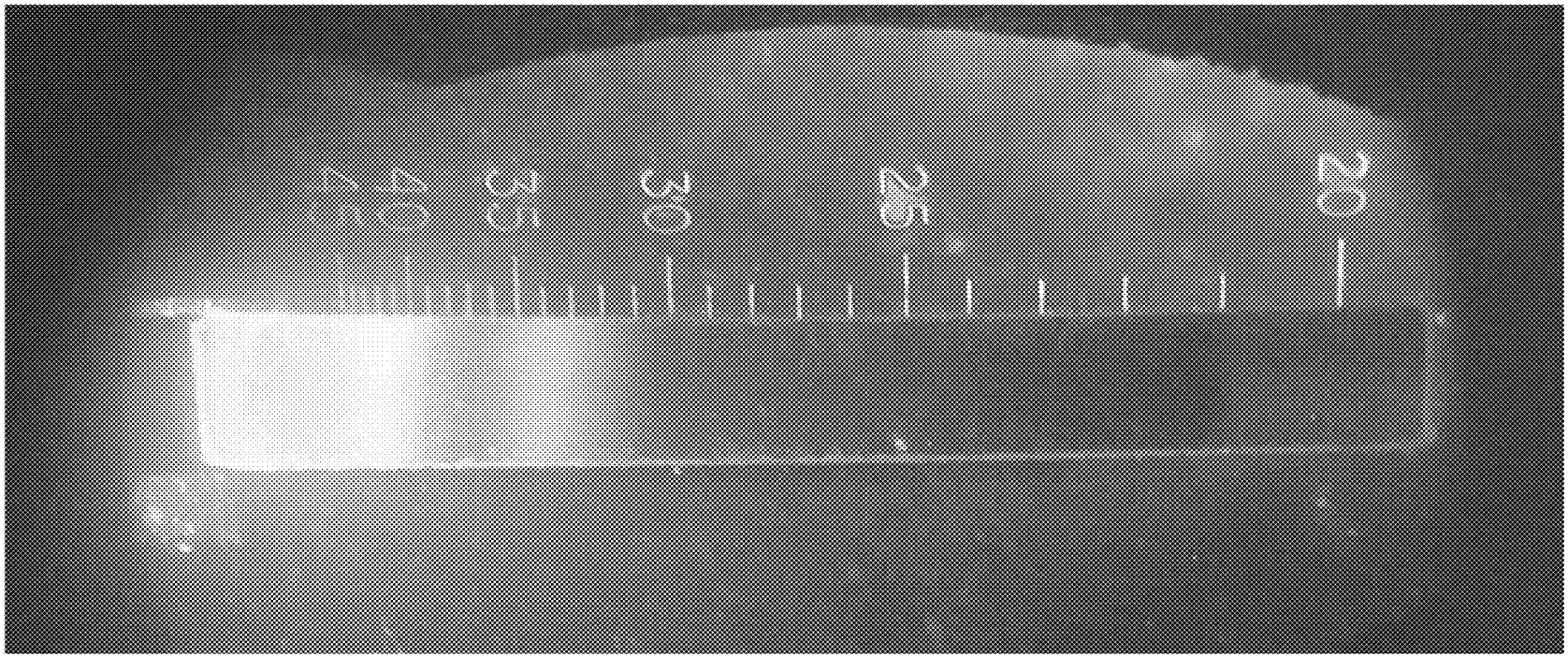
FIG. 167 shows the wavelengths of ultraviolet radiation produced by the sun on a South Florida afternoon.

FIG. 167 shows the wavelengths of ultraviolet radiation produced by the sun on a South Florida afternoon.

While the subject matter of this disclosure has been described and shown in considerable detail with reference to certain illustrative embodiments, including various combinations and sub-combinations of features, those skilled in the art will readily appreciate other embodiments and variations and modifications thereof as encompassed within the scope of the present disclosure. Moreover, the descriptions of such embodiments, combinations, and sub-combinations is not intended to convey that the recited subject matter requires features or combinations of features other than those expressly recited in the numbered embodiments. Accordingly, the scope of this disclosure is intended to include all modifications and variations encompassed within the spirit and scope of the following appended embodiments. Any positional terms used in these numbered embodiments are intended in a relative—not absolute—sense, such that the claimed devices, components, and systems may be rotated or their orientation changed without effect vis-à-vis the scope of the following numbered embodiments.

According to some embodiments, the disclosed lamp can be used as a UV light source in the systems, devices, and methods described in the issued US patents and published patent applications identified in the attached Appendix A.

According to some embodiments, the lamp can be used as a UV light source in the air purification systems and HVAC maintenance products, wastewater treatment and wash water recycling systems, and food safety and sanitation systems available from RGF Environmental Group Inc. and described in the product literature included in the attached Appendix B.

The invention claimed is:

1. A device for generating broad spectrum ultraviolet radiation, the device comprising:

an adjustable spark gap of metallic solids, the spark gap comprising:

a first electrode coupled to a first heatsink, and a second electrode coupled to a second heatsink, the second electrode spaced apart and opposite from the first electrode;

a variable capacitor configured to discharge a voltage through the spark gap to generate broad spectrum ultraviolet radiation;

a voltage source; and a controller configured to control the variable capacitor, wherein the first electrode is formed from a first metallic solid and the second electrode is formed from a second metallic solid, and the ultraviolet radiation generated is in the 140 nm to 400 nm range.

2. The device of claim 1, wherein the first and second metallic solids each comprise one or more of aluminum, stainless steel, brass, tungsten, copper, nickel, tin, magnesium, indium, soft iron, tantalum, and carbon.

3. The device of claim 1, wherein the first and second metallic solids each comprise an alloy from a meteorite, and the ultraviolet radiation generated is in the 190 nm to 350 nm range.

4. The device of claim 1, further comprising:

an air-core choke coil configured to create an oscillatory RF circuit.

5. The device of claim 4, further comprising:

a secondary coil placed within the air-choke coil, the secondary coil configured to act as a high frequency transformer for the production of corona discharges.

6. The device of claim 5, further comprising:

a terminal, the terminal configured to direct discharges from the secondary coil.

7. The device of claim 5, wherein a magnetic field is placed perpendicular to the adjustable spark gap.

8. A lamp comprising the device of claim 1.

9. The lamp of claim 8, further comprising:

a housing, the housing comprising an enclosed cylinder;

a first binding post, the first binding post operable to secure the first electrode inside the housing; and a second binding post, the second binding post operable to secure the second electrode inside the housing.

10. The lamp of claim 9, further comprising:

an opaque covering comprising a window, wherein the opaque covering is affixed to the housing such that a portion of the generated ultraviolet spectrum passes through the window.

11. The lamp of claim 10, wherein the opaque covering is affixed to the housing such that it covers at least a portion of the housing.

12. The lamp of claim 10, wherein the window is made of at least one of quartz, fused silica, fluorite, calcite, Icelandic spar, or rock salt.

13. The lamp of claim 11, wherein the one or more components comprises one or more of: an inert gas, a hydrocarbon, compressed air, a vacuum, or a liquid.

14. The lamp of claim 9, wherein the housing comprises one or more inlets for the admission of one or more components into the housing.

15. A product comprising the lamp of claim 8, wherein the product is configured to apply the generated ultraviolet radiation to:

inactivate viruses, disrupt the DNA of cells or bacteria, cause fluorescence of minerals, phosphors, or diverse materials, produce chemical reactions, excite catalysts, or treat skin conditions through phototherapy or actinotherapy.

* * * * *